US012723840B2

(12) United States Patent
Smith et al.

(10) Patent No.: US 12,723,840 B2
(45) Date of Patent: Sep. 1, 2026

(54) THUMB-ACTUATED LOCKING HOLSTER SYSTEM

(71) Applicant: Vista Outdoor Operations LLC, Anoka, MN (US)

(72) Inventors: Paul N. Smith, Bozeman, MT (US); Troy E. Lance, Livingston, MT (US); Oscar C. Woods, Manhattan, MT (US); Daniel D. Sereday, Belgrade, MT (US); Christopher J. Michael, Belgrade, MT (US); Robert J. Meinert, Andover, MN (US)

(73) Assignee: Revelyst Operations LLC, Irvine, CA (US)

( * ) Notice: Subject to any disclaimer, the term of this patent is extended or adjusted under 35 U.S.C. 154(b) by 41 days.

(21) Appl. No.: 18/242,089

(22) Filed: Sep. 5, 2023

(65) Prior Publication Data

US 2023/0417509 A1 Dec. 28, 2023

Related U.S. Application Data

(63) Continuation of application No. 16/900,443, filed on Jun. 12, 2020, now Pat. No. 11,781,831.

(51) Int. Cl.
*F41C 33/02* (2006.01)
*F41C 33/04* (2006.01)

(52) U.S. Cl.
CPC ..... *F41C 33/0263* (2013.01); *F41C 33/0236* (2013.01); *F41C 33/041* (2013.01)

(58) Field of Classification Search
CPC .. F41C 33/046; F41C 33/0227; F41C 33/045; F41C 33/041; F41C 33/001; A45F 5/021; A45F 2005/008; A45F 2005/025
(Continued)

(56) References Cited

U.S. PATENT DOCUMENTS 1,046,912 A 12/1912 Wanee
1,113,530 A 10/1914 Audley
(Continued)

FOREIGN PATENT DOCUMENTS

DE 8233562 6/1983
DE 9406333 7/1994
(Continued)

OTHER PUBLICATIONS

European Patent Office Search Opinion of Application No. 10828676.6 dated Feb. 16, 2015 3 pages.
(Continued)

*Primary Examiner* — Corey N Skurdal
(74) *Attorney, Agent, or Firm* — Reed Smith LLP; Matthew P. Frederick; Cheryl L. Gastineau

(57) ABSTRACT

A holster for receiving and withdrawing a handgun has a first handgun retention mechanism. The mechanism having a first lever with a tab portion for actuation and release of a trigger guard, the lever having a snap fit into a lever region without a separate pin. A belt engaging member covers the lever region capturing the first lever therein. If a second retention mechanism is used, another lever with a tab portion is positioned so the tabs are stacked, depressing one also depresses the tab behind it, such that both mechanisms are released. Accessories for the holster or belt engaging members are also provided which include a leg strap adapter that is rotatable and height-adjustable with a leg strap, a red dot sight dust cover that can be incorporated with the holster and a quick detach system that can allow for quick attachment and detachment of a holster.

14 Claims, 99 Drawing Sheets

(58) Field of Classification Search
USPC ..... 224/222, 661, 677
See application file for complete search history.

(56) References Cited

U.S. PATENT DOCUMENTS 1,148,935 A 8/1915 Snavely
1,421,578 A 7/1922 Schussler
1,635,984 A 7/1927 Corriston
1,641,439 A 9/1927 Jovino
1,750,139 A 3/1930 Swift
1,851,352 A 3/1932 Denkert
1,951,865 A 3/1934 Franz
2,051,844 A 8/1936 Green
2,084,412 A * 6/1937 Schaefer ..... A41F 15/00 24/186
2,088,811 A 8/1937 Ray
2,109,734 A 3/1938 Preneta
2,349,376 A 5/1944 Ray
2,443,397 A 6/1948 Myres
2,551,913 A 5/1951 Toby
2,577,869 A 12/1951 Adams
2,893,615 A 7/1959 Couper
3,289,903 A 12/1966 Taormina
3,419,728 A 12/1968 Wilson
3,420,420 A 1/1969 Clark
3,550,821 A 12/1970 Daigle
3,550,822 A 12/1970 Lloyd
3,669,325 A 6/1972 Furman
3,718,240 A 2/1973 Rose
3,777,952 A 12/1973 Theodore
3,804,306 A 4/1974 Azurin
3,828,990 A 8/1974 Baldocchi
3,866,811 A 2/1975 Hamby
3,904,091 A 9/1975 Jones
3,910,469 A 10/1975 Baldocchi
RE30,139 E 11/1979 Jones
4,277,007 A 7/1981 Bianchi et al.
4,846,384 A 7/1989 Perry
4,953,767 A 9/1990 Bennett
5,018,654 A 5/1991 Rogers et al.
5,048,735 A 9/1991 McCormick
5,082,318 A 1/1992 Held et al.
5,094,376 A 3/1992 Baruch
5,100,036 A 3/1992 Rogers et al.
5,127,566 A 7/1992 Beletsky
5,129,562 A 7/1992 Bianchi
5,199,620 A 4/1993 Beletsky
5,215,238 A 6/1993 Baruch
5,274,885 A 1/1994 Hellweg
5,275,317 A 1/1994 Rogers et al.
5,282,559 A 2/1994 Aerle et al.
5,284,281 A 2/1994 Nichols
5,322,200 A 6/1994 Blanchard
5,358,160 A 10/1994 Bianchi
5,372,288 A 12/1994 Rogers et al.
5,395,021 A 3/1995 Brown
5,419,474 A 5/1995 Marx et al.
5,421,497 A 6/1995 Gilmore
5,449,103 A 9/1995 Tilley
5,458,266 A 10/1995 Pichot
5,467,909 A 11/1995 Resca et al.
5,501,380 A 3/1996 Wu
5,501,381 A 3/1996 Rogers et al.
5,509,591 A 4/1996 Carver
5,513,785 A 5/1996 Campagna, Jr.
5,518,155 A 5/1996 Gallagher
5,551,611 A 9/1996 Gilmore
5,570,830 A 11/1996 Nichols
5,573,157 A 11/1996 Mauriello et al.
5,598,958 A 2/1997 Ryan, III et al.
5,611,164 A 3/1997 Rassias
5,622,295 A 4/1997 Hellweg et al.
5,749,507 A 5/1998 Wood
5,758,448 A 6/1998 Thummel
5,768,816 A 6/1998 Rassias
5,779,114 A 7/1998 Owens
5,806,739 A 9/1998 Wood
5,810,221 A 9/1998 Beletsky et al.
5,810,222 A 9/1998 Shoemaker
5,855,305 A 1/1999 Nichols
5,916,087 A 6/1999 Owens
5,918,784 A 7/1999 Serpa
5,927,578 A 7/1999 Kay
5,931,358 A 8/1999 Rogers
5,944,239 A 8/1999 Rogers et al.
5,961,013 A 10/1999 Collins
6,010,045 A 1/2000 Rogers
6,085,951 A 7/2000 Beletsky et al.
6,112,962 A 9/2000 Matthews
6,149,042 A 11/2000 Rassias
6,189,751 B1 2/2001 Tserng
6,230,946 B1 5/2001 Vor Keller et al.
6,267,279 B1 7/2001 Matthews
6,276,581 B1 8/2001 Glock
6,320,975 B1 11/2001 Vieweg
D453,068 S 1/2002 Rogers et al.
6,349,496 B1 2/2002 Neely
6,389,726 B1 5/2002 Bentley
6,398,089 B1 6/2002 Har-Shen
6,415,541 B1 7/2002 Rassias
6,467,660 B2 10/2002 Rogers et al.
6,523,374 B1 2/2003 Owens
6,533,149 B2 3/2003 Vor Keller et al.
6,547,111 B2 4/2003 French
6,547,118 B2 4/2003 Beletsky et al.
6,585,209 B1 7/2003 Mattingly
6,588,635 B2 7/2003 Vor Keller et al.
6,588,640 B1 7/2003 Rogers et al.
6,604,657 B2 8/2003 Yirmiyahu et al.
6,616,020 B1 9/2003 Spielberger
6,634,527 B2 10/2003 Lui
6,641,009 B2 11/2003 French et al.
6,732,891 B2 5/2004 Locklear, III
6,752,300 B2 6/2004 Har-Shen
6,755,331 B2 6/2004 Rassias
6,769,581 B2 8/2004 Rogers et al.
6,769,582 B1 8/2004 Beletsky et al.
6,799,392 B2 10/2004 Milec et al.
D501,991 S 2/2005 Cook et al.
6,854,626 B2 2/2005 Liao
6,886,725 B2 5/2005 Lowe et al.
6,918,519 B2 7/2005 Vor Keller et al.
6,948,644 B1 9/2005 Beletsky
D512,561 S 12/2005 Cook et al.
7,140,523 B2 11/2006 Lowe et al.
7,200,965 B2 4/2007 Vor Keller et al.
7,258,259 B1 8/2007 Owens
7,434,712 B2 10/2008 Cook et al.
7,461,765 B2 12/2008 French et al.
7,530,456 B1 5/2009 Tsai
7,543,404 B2 6/2009 Kovalchuk et al.
7,556,181 B2 7/2009 Spielberger
7,562,797 B2 7/2009 Senn et al.
7,584,875 B2 9/2009 Lowe et al.
7,591,402 B2 9/2009 Rassias
7,644,845 B2 1/2010 Lowe
7,694,860 B2 4/2010 Clifton, Jr.
7,735,255 B1 6/2010 Kincaid et al.
7,762,018 B1 7/2010 Fitzpatrick et al.
7,819,294 B2 10/2010 Lowe et al.
7,841,497 B1 11/2010 Gregory et al.
7,850,053 B2 12/2010 Rassias
7,922,050 B2 4/2011 Benes
7,927,076 B1 4/2011 Bucher et al.
7,934,333 B1 5/2011 Tuz
7,937,880 B1 5/2011 Fidlow
7,950,553 B2 5/2011 Rassias
7,950,554 B2 5/2011 Hoffner et al.
7,954,971 B1 6/2011 Kincaid et al.
8,052,018 B2 11/2011 Gallagher
8,096,453 B2 1/2012 Lowe et al.
8,132,355 B1 3/2012 Kincaid et al.
8,141,210 B2 3/2012 Colorado
8,141,758 B2 3/2012 Spielberger

(56) References Cited

U.S. PATENT DOCUMENTS

| | | | | |
|---|---|---|---|---|
| 8,177,108 | B1 | 5/2012 | Kincaid et al. | |
| 8,196,792 | B2 | 6/2012 | Clifton | |
| 8,215,525 | B2 | 7/2012 | Rassias | |
| 8,235,263 | B1 | 8/2012 | Yeats et al. | |
| 8,251,266 | B2 | 8/2012 | Gregory et al. | |
| 8,281,512 | B2 | 10/2012 | Lara | |
| 8,302,827 | B1 | 11/2012 | Cole | |
| 8,371,487 | B1 | 2/2013 | Plappert | |
| 8,474,670 | B1 | 7/2013 | Gregory et al. | |
| RE44,428 | E | 8/2013 | Spielberger | |
| 8,517,234 | B2 | 8/2013 | Kincaid et al. | |
| 8,517,235 | B1 | 8/2013 | Kincaid et al. | |
| D690,504 | S * | 10/2013 | Tyybakinoja | D3/222 |
| 8,544,706 | B2 | 10/2013 | Crye | |
| 8,602,275 | B1 | 12/2013 | Kiger et al. | |
| 8,602,276 | B2 | 12/2013 | Tyybakinoja | |
| 8,631,981 | B2 | 1/2014 | Zusman | |
| 8,646,665 | B2 | 2/2014 | Abushaev | |
| 8,684,242 | B2 | 4/2014 | Pomeroy et al. | |
| 8,690,032 | B2 | 4/2014 | Baumman et al. | |
| 8,720,753 | B2 | 5/2014 | Benes | |
| 8,720,754 | B2 | 5/2014 | Kirsch | |
| 8,720,755 | B2 | 5/2014 | Gregory et al. | |
| 8,783,532 | B2 | 7/2014 | Gregory et al. | |
| 8,807,404 | B1 | 8/2014 | Howell et al. | |
| 8,851,344 | B2 | 10/2014 | Baumann et al. | |
| 8,870,042 | B2 | 10/2014 | Clifton | |
| 8,910,839 | B2 | 12/2014 | Clifton | |
| 8,925,773 | B2 | 1/2015 | Clifton | |
| D723,796 | S | 3/2015 | Resca | |
| 8,985,412 | B2 | 3/2015 | Rorick et al. | |
| 9,016,533 | B2 | 4/2015 | Visalli et al. | |
| 9,022,262 | B2 | 5/2015 | Pellegrini | |
| 9,057,579 | B2 | 6/2015 | Rorick et al. | |
| 9,057,580 | B2 | 6/2015 | Rorick et al. | |
| 9,086,254 | B1 | 7/2015 | Plappert | |
| 9,101,198 | B2 | 8/2015 | Tseng | |
| 9,109,855 | B1 | 8/2015 | Kincel | |
| 9,134,093 | B2 | 9/2015 | Yeates | |
| 9,175,925 | B2 | 11/2015 | Pellegrini | |
| 9,222,751 | B2 * | 12/2015 | Glock | F41C 33/045 |
| 9,228,802 | B2 | 1/2016 | Ribas | |
| 9,347,741 | B2 | 5/2016 | Wegner et al. | |
| 9,541,348 | B2 | 1/2017 | Rogers | |
| 9,664,480 | B2 | 5/2017 | Faifer | |
| 9,765,806 | B2 | 9/2017 | Busch | |
| 9,816,778 | B2 | 11/2017 | Bardy et al. | |
| D807,028 | S | 1/2018 | Resca | |
| D807,029 | S | 1/2018 | Resca | |
| D828,019 | S | 9/2018 | Dara | |
| D839,590 | S | 2/2019 | Vedder | |
| D860,642 | S * | 9/2019 | Dara | D3/222 |
| 10,436,551 | B1 | 10/2019 | Bradford | |
| 2001/0019071 | A1 | 9/2001 | Vor Keller et al. | |
| 2003/0205594 | A1 | 11/2003 | Rassias | |
| 2004/0050887 | A1 | 3/2004 | Spielberger | |
| 2004/0195282 | A1 | 10/2004 | Beletsky et al. | |
| 2004/0251284 | A1 | 12/2004 | Pelligrini | |
| 2005/0035163 | A1 | 2/2005 | French et al. | |
| 2005/0205621 | A1 | 9/2005 | Shults | |
| 2005/0205624 | A1 | 9/2005 | French et al. | |
| 2005/0279789 | A1 | 12/2005 | Lowe | |
| 2006/0156525 | A1 | 7/2006 | Jenkins et al. | |
| 2006/0157520 | A1 | 7/2006 | Clifton | |
| 2006/0175366 | A1 | 8/2006 | Dekaise | |
| 2006/0226185 | A1 | 10/2006 | Har-Shen | |
| 2007/0181619 | A1 | 8/2007 | Seyfert et al. | |
| 2008/0110947 | A1 | 5/2008 | Pikielny | |
| 2008/0121670 | A1 | 5/2008 | Buress | |
| 2008/0179359 | A1 | 7/2008 | Aberle et al. | |
| 2008/0179360 | A1 | 7/2008 | Lowe et al. | |
| 2009/0321480 | A1 | 12/2009 | Kincaid et al. | |
| 2010/0203931 | A1 | 8/2010 | Tynecek et al. | |
| 2010/0276464 | A1 | 11/2010 | Hirt et al. | |
| 2011/0011904 | A1 | 1/2011 | Schultz et al. | |
| 2011/0101063 | A1 | 5/2011 | Zusman | |
| 2011/0163138 | A1 | 7/2011 | Tybakinoja | |
| 2011/0174849 | A1 | 7/2011 | Clifton, Jr. | |
| 2011/0174850 | A1 | 7/2011 | Clifton, Jr. | |
| 2013/0075435 | A1 | 3/2013 | Hellweg | |
| 2013/0240582 | A1 | 9/2013 | Tyybakinoja et al. | |
| 2014/0048572 | A1 | 2/2014 | Yeates | |
| 2014/0109345 | A1 | 4/2014 | Melville | |
| 2014/0124557 | A1 * | 5/2014 | Velarde | A61F 5/0123 224/576 |
| 2015/0108191 | A1 * | 4/2015 | Velarde | F41C 33/048 224/576 |
| 2015/0247701 | A1 | 9/2015 | Faifer | |
| 2015/0285587 | A1 | 10/2015 | Abushaev | |
| 2015/0345898 | A1 | 12/2015 | Bardy | |
| 2016/0231081 | A1 | 8/2016 | Evans | |
| 2017/0276453 | A1 | 9/2017 | Lance et al. | |
| 2018/0321014 | A1 | 11/2018 | Rassias | |
| 2018/0325248 | A1 | 11/2018 | Tedder et al. | |
| 2019/0120592 | A1 | 4/2019 | Yeates | |
| 2019/0219359 | A1 | 7/2019 | Rogers et al. | |
| 2019/0346233 | A1 | 11/2019 | Rorick et al. | |
| 2023/0342155 | A1 * | 10/2023 | Kilbey | G06F 9/544 |
| 2024/0118055 | A1 * | 4/2024 | Shearer | F41C 33/045 |

FOREIGN PATENT DOCUMENTS

| | | |
|---|---|---|
| EP | 1008313 | 6/2000 |
| EP | 1975542 | 10/2008 |
| EP | 2757271 | 7/2014 |
| EP | 007258660-0001 | 11/2019 |
| FR | 2893404 | 5/2007 |
| TW | M393664 | 12/2010 |
| WO | WO2006076753 | 7/2006 |
| WO | WO2010064268 | 6/2010 |
| WO | WO2013071402 | 5/2013 |
| WO | WO2014028876 | 2/2014 |
| WO | WO20140108893 | 7/2014 |
| WO | WO2015036922 | 3/2015 |
| ZA | 986778 | 2/1999 |

OTHER PUBLICATIONS

European Patent Office Supplementary Search Report of Application No. 10828676.6 dated Feb. 16, 2015 2 pages.

Written Opinion of the International Searching Authority for International Application No. PCTUS2010002935 dated Jan. 7, 2011.

PCT International Preliminary Report on Patentability for International Application No. PCTUS2010002935 dated May 15, 2012 5 pages.

PCT International Search Report for International Application No. PCTUS2010002935 dated Jan. 7, 2011 2 pages.

International Search Report and Written Opinion dated Jun. 11, 2019 for PCT/US19/23945.

International Preliminary Report on Patentability dated Sep. 29, 2020 for PCT/US19/23945.

"OSH Rti Starter Kit", G-Code. (Accessed Mar. 2, 2020).

"GOCDE RTI Holster Setup Review" YouTube.com. Jan. 14, 2019. (Accessed Mar. 2, 2020).

"Model 6004-27 Single Strap Leg Shroud with Drop Flex Adapter." (Accessed Mar. 2, 2020).

"Safariland 6070 Mid-Ride Universal Ride Belt Loop with QLS 22 Receiver." (Accessed Mar. 2, 2020).

"Safariland Drop Flex Adapter with Leg Shroud Assembly Polymer." (Accessed Mar. 2, 2020).

"Gabriel© Red Dot Sight IWB Strong Side Carry Holster." (Accessed Mar. 2, 2020).

"Rockin' Reflexes: 13 Holsters for Handguns Topped with Red Dot Sights." (Accessed Mar. 2, 2020).

"Usw-A1 Level 2 Concealment Holster." (Accessed Mar. 2, 2020).

"The B&T Universal Service Weapon (USW) in 9mm." YouTube.com. Nov. 2017. (Accessed Mar. 2, 2020).

(56) References Cited

OTHER PUBLICATIONS

European Supplemental Search Report dated Oct. 29, 2021 for EP19770969.

* cited by examiner

FIG. 35C
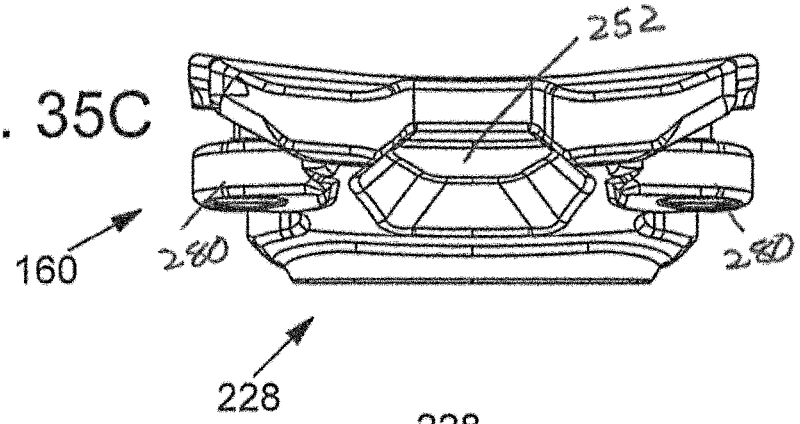
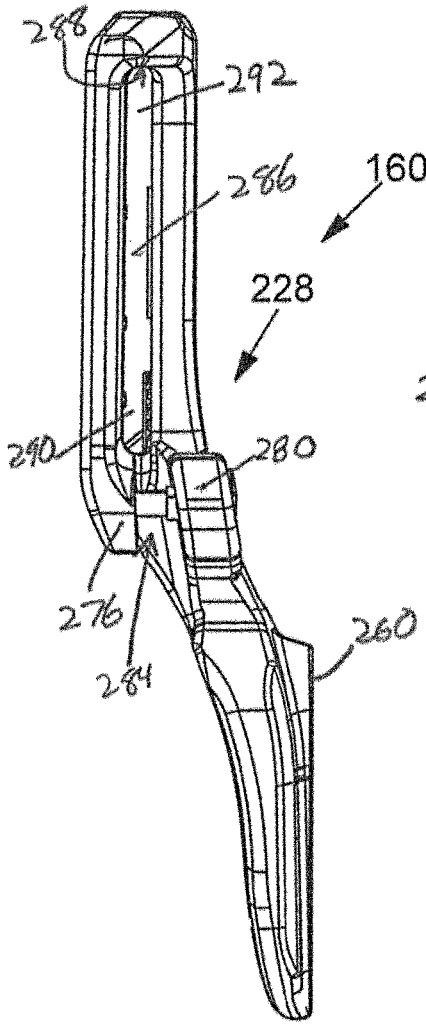
FIG. 35A
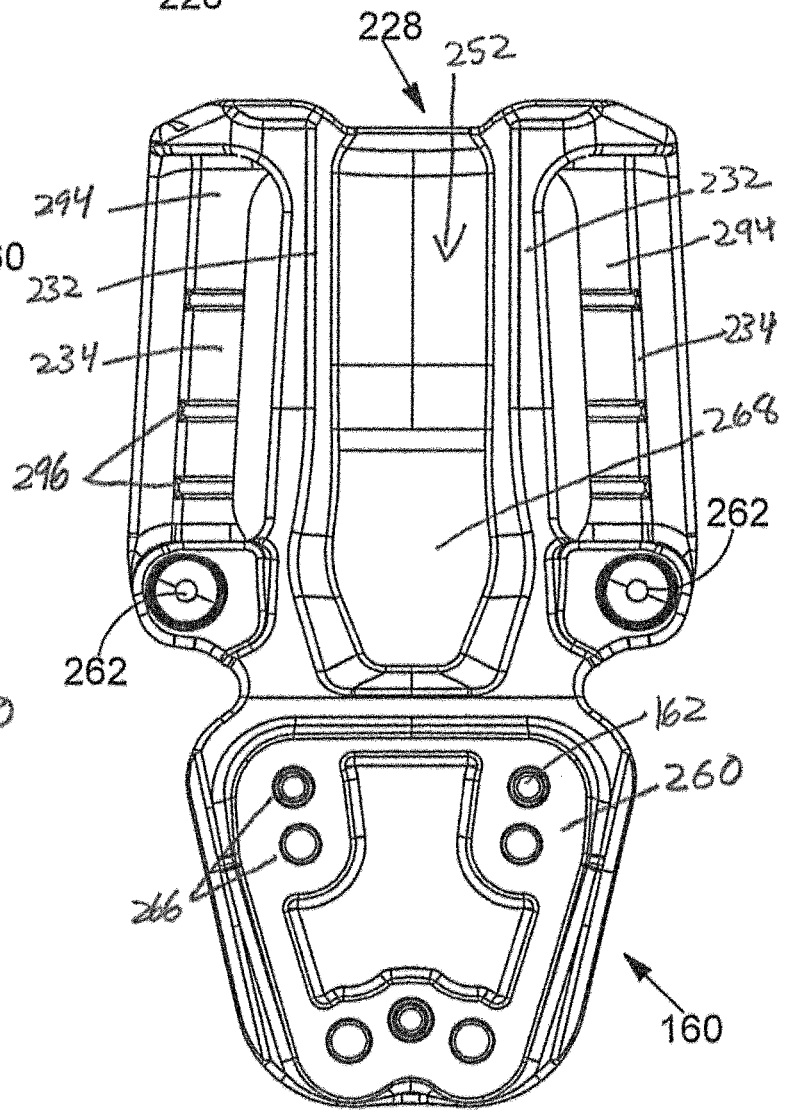
FIG. 35B

FIG. 39C
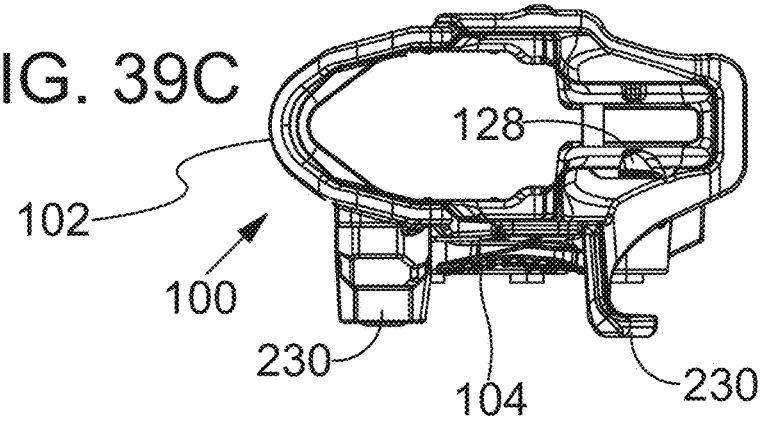
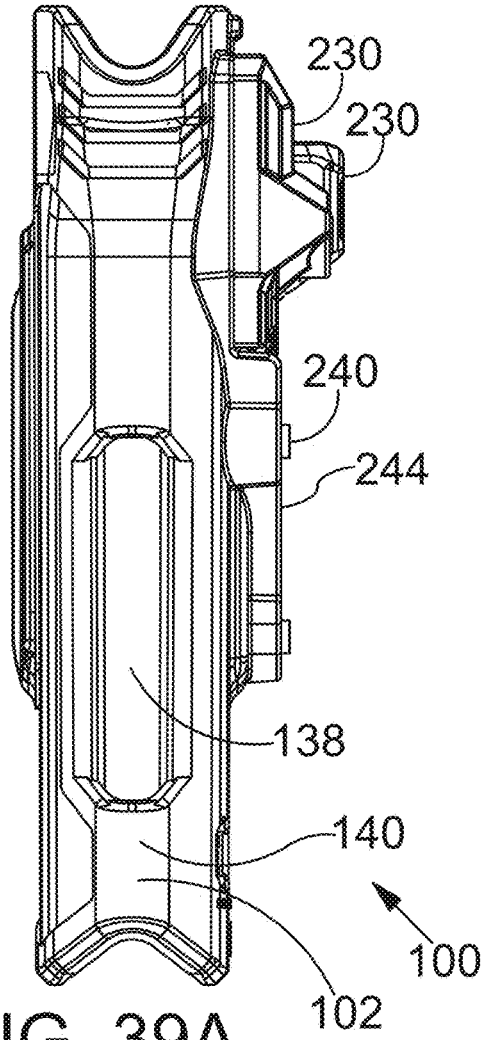
FIG. 39A
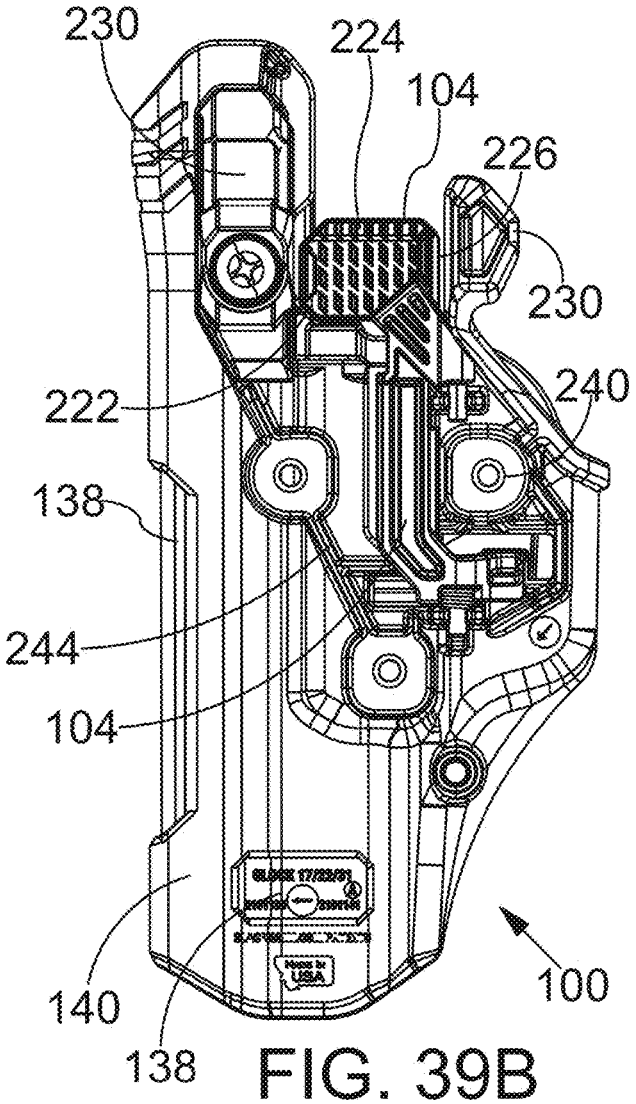
FIG. 39B

THUMB-ACTUATED LOCKING HOLSTER SYSTEM

CROSS-REFERENCE TO RELATED APPLICATION

This application is a continuation of U.S. patent application Ser. No. 16/900,443 filed Jun. 12, 2020, the entire contents of which are incorporated by reference herein.

BACKGROUND OF THE DISCLOSURE

In many countries (e.g., Germany, Poland and the United States) law enforcement officers often carry a handgun in an openly visible manner while on duty. The handgun is typically carried in a holster designed to protect the handgun and hold it securely. The holster may include a belt loop that allows it to be hung from a wide belt, for example, a police officer's service belt. The holster may also include a locking mechanism to prevent an assailant from drawing the holster user's weapon and prevent the handgun from inadvertently falling out of the holster, for example, when the holster user is running, climbing over a fence, etc. It is important that the retention mechanisms are secure in such challenging situation.

In addition to having the handgun be secure in the holster in challenging situations, ease of withdrawal when urgently needed by the user is an important feature. That is, easy actuation of release mechanisms in stressful situations.

A holster that securely retains a handgun and that provides improvement in ease of use when the handgun is urgently needed would be welcomed by the industry. Accessories for such a holster would also be welcomed by the industry.

To have holsters be commercially viable, they need to be priced to meet expectations of the consuming populace. So any improvement of assembly and cost efficiencies by minimizing the number of parts and minimizing the number of assembly steps would also be welcomed by the industry.

SUMMARY

A holster for receiving and holding a handgun having a trigger guard comprises a polymer holster body and an elongate polymer pivoting lever that together define a handgun retention mechanism that is thumb actuated and moves a trigger guard block portion of the lever between retention and release positions. A thumb button depressible toward the handgun is optimally positioned on the user side of the holster, is framed by the holster body and is shielded by thumb guides which may be projecting portions of the body or by components both above and below (with respect to the handgun orientation) the thumb button. In the same motion of grasping the handgun the thumb button is depressed releasing the handgun. A feature and advantage of this arrangement is that unintended access to the handgun release, specifically the thumb button, particularly by others, is limited, while allowing intuitive and easy user access to the thumb button by user's thumb when grasping the handgun.

Although thumb buttons that release trigger guard block portions are known, such buttons are not well protected from inadvertent actuation, or actuation by others and could use improvement in intuitively accessing such buttons by the user.

In embodiments, the holster may be a level-2 configuration, with one active restraint, for example the trigger guard, or a level-3 configuration, with two active restraints, for example the trigger guard and the hood or shroud. Both the level 2 configuration and the level 3 configuration utilize the optimally positioned thumb button and may include the elongate polymer pivoting lever that selectively engages the trigger guard of the handgun. The level-3 holster configuration also includes a hood or shroud, such as a U-shaped shroud, that is pivotally supported by the holster body so that the U-shaped shroud selectively pivots between a handgun retaining position in which the U-shaped shroud extends across a rearward opening of the cavity and a release position in which the U-shaped shroud is displaced from the rearward opening so that a withdrawal path of the handgun is unobstructed.

In embodiments, a thumb button of the retaining mechanism is positioned to allow for an intuitive and ergonomic release of the handgun from the holster by positioning the thumb button on the user's side of the holster exactly forward (with respect to the handgun) of the upper handgrip or backstrap recess; the handgrip or backstrap recess is located below the handgun slide of holstered handgun. The thumb button is sized and positioned to receive the inside surface of the thumb at the distal knuckle. The thumb button is actuated by depressing it toward the handgun and is spaced about one half inch or less from the handgun body. When a user lowers his hand onto the handle of the holstered handgun, with the webbing between the user's thumb and forefinger engaging the backstrap recess, as the user grasps the handgun grip, he will wrap his middle, ring and pinky fingers around the grip of the handgun, will move the thumb naturally to an actuation position with respect to the thumb button, and will allow the forefinger to be received by an elongate finger recess extending forwardly (with respect to the handgun) on the holster. Squeezing the grip for a full grasping of the handgun can readily depress the thumb button and release the handgun. This arrangement advantageously allows the user to actuate the thumb button and release the handgun with much less or no concerted effort of depressing a release button. While the forearm is extending in a downward direction, grasping of the holstered handgun is with less tension in the muscles and tendons of the thumb and forearm. The thumb button position as described provides for natural and comfortable movement of the thumb, the same movement as grasping the handgun. It is noted that the mechanics of the muscles and tendons of the thumb and forearm when downward readily accomplish this grip and handgun release, the mechanics change when the forearm is extending in a horizontal direction away from the torso of the handgun user. The master grip is facilitated in embodiments, both level two and level three, where the thumb button has no holster body portions or other holster components directly rearward of the rearward margin of the thumb button, and no holster body portions below the thumb button. Such embodiments provide the feature and advantage that as the handgun is withdrawn, the user's thumb slides off of the thumb button into immediate contact with the handgun. That is, there is no engagement with the exterior surface of the holster body by the user's thumb either during actuation of the release of the retention mechanism or as the handgun is withdrawn. In that the thumb button is positioned in close proximity to the surface of the handgun, the thumb movement inward as the thumb transitions from engagement with the button to engagement with the body of the handgun is minimal.

In embodiments, a holster for receiving a handgun having a trigger guard comprises a holster body having a plurality of holster wall portions defining a rearward opening cavity with a handgun receiving and withdrawal axis. The holster has a first handgun retention mechanism, a second handgun retention mechanism, and a thumb receiving tab that actuates both the first handgun retention mechanism and the second handgun retention mechanism. In embodiments, each handgun retention mechanism selectively prevents the handgun from being withdrawn from the cavity defined by the wall portions of the holster body.

In embodiments, the first handgun retention mechanism may comprise a lever pivotally supported by the holster body. In embodiments, the lever has an elongate central portion, a depressible portion, and a blocking portion. The depressible portion of the lever comprises a first arm extending away from the elongate central portion in a first direction so that the elongate central portion and the first arm cooperate to form a first L-shape. The blocking portion of the lever comprises a second arm extending away from the elongate central portion in a second direction opposite the first direction so that the elongate central portion and the second arm cooperate to form a second L-shape. The entire lever having a stretched Z shape. In embodiments, the lever is pivotally supported by the holster body so that the lever pivots about a lever axis that extends in upward and downward directions with respect to the worn holster, and forward and rearward with the handgun orientation. In embodiments, the lever pivots between a handgun trigger guard capture position and a handgun trigger guard release position. The blocking portion of the lever extends into a trigger guard portion of the holster body while the lever is disposed in the handgun trigger guard capture position.

In embodiments, the second handgun retention mechanism may comprise a hood or shroud, for example a U-shaped hood or shroud that is pivotally supported by the holster body so that the U-shaped shroud selectively pivots between a handgun retaining position in which the U-shaped shroud extends across a rearward opening of the cavity and a release position in which the U-shaped shroud extends forward of the rearward opening so that a withdrawal path of the handgun is unobstructed.

In embodiments, the holster includes a U-shaped shroud that is part of a hood assembly including a bracket that captures the U-shaped shroud and defines a slot. In embodiments, the holster includes a leaf spring that is received in the bracket slot when the U-shaped shroud is in the handgun retaining position. A spring biases the U-shaped shroud to pivot toward a handgun withdrawal position. In embodiments, depression of the thumb button causes the lever to rotate through a first range of rotary motion and causes deflection of the leaf spring so that a distal portion of the leaf spring is outside of the slot. In embodiments, further depression of the thumb button causing rotation of the lever through a second range of rotary motion causes the thumb button to engage the depressible portion of the lever causing at least part of the blocking portion of the lever to be withdrawn from the trigger guard receiving portion of the holster body releasing the trigger guard and allowing removal of the handgun.

In embodiments, two handgun retention mechanisms utilize pivoting components rather than sliding components, this is believed to generally reduce the size, complexity, and reliability of the mechanisms and components. Additionally the two actuatable handgun retention mechanisms, and particularly the pivoting components, are mounted on the exterior of the holster body, thereby simplifying assembly, operation, maintenance, and cleaning, if needed.

In embodiments, the holster body is formed from two polymers, one overmolded onto the other, providing an interior layer and an exterior layer. In embodiments, the interior layer being softer than the exterior layer minimizing any wear, damage or markings on the exterior surface of the handgun. In embodiments, the interior layer and the exterior layer are combined using an injection molding "overmolding" process where one layer in injection molded onto the previously molded layer. In embodiments, the interior layer comprises a thermoplastic elastomer (TPE) and the exterior layer a thermoplastic material. In embodiments, the interior layer comprises a polymer such as Hytrel and the exterior layer comprises a polyamide material (e.g., nylon).

In embodiments, the holster body is formed to provide a handgun fitting function that can be adjusted by rotating a tensioning screw. The shape of the forward portion of the handgun can be conceptualized as a rectangle and the shape of the cavity defined by the holster body can be configured to make point contact with the four corners of the rectangular handgun portion. In embodiments, the shape of the cavity defined by the holster body can be conceptualized as two opposing V-shapes, and upper V-shape and a lower V-shape. The two legs of the upper V-shape and the two legs of the lower V-shape may each contact one corner of the rectangle. In embodiments, the lower V-shape defines a split near the lower end of the V-shape. A tensioning screw is positioned to selectively decrease the angle between the two legs of the lower V-shape. As the angle between the two legs of the lower V-shape decreases, the two legs of the lower V-shape apply upwardly directed component forces to the corresponding corners of the rectangular handgun portion. The forces applied to the lower corners of the rectangular handgun portion urge the upper corners of the rectangle against the two legs of the upper V-shape. In embodiments, the softer inner layer provides a higher level of friction to the insertion and withdrawal of the handgun and thus the adjustment of the tensioning screw is more sensitive and effective in controlling the friction associated with a handgun withdrawal compared to the same configuration with a harder plastic interior surface.

A feature and advantage of embodiments is a retention mechanism has two distinct separated pivoting connections forming a hinge portion of the handgun retention mechanism. The hinge portion of the retention mechanism has a hinge length extending between the outer end portions of the two pivot portions. A ratio of the hinge length to the overall length of the elongate lever is greater than 0.8. This arrangement provides stability of attachment, robustness and ease of assembly. This arrangement also places less stress on the holster body. In embodiments, the pivot portions of the lever and pivot of the body are coupled using a simple assembly process with no separate hinge pin.

A rearward pivoting connection and a forward pivoting connection of the retention mechanism may each be formed from a pair of cooperating connector pivot portions. In embodiments, a forward pivot portion is a pin portion and the other forward pivot portion is a C-shaped pin receiving portion. One of the rearward pivot portions may be a pin portion and the other of the rearward pivot portions may be a C-shaped pin receiving portion. One of the rearward pivot portions may be integrally formed with the holster body and the other of the rearward pivot portions may be integrally formed with the lever. One of the forward pivot portions may be integrally formed with the holster body and the other of the forward pivot portions may be integrally formed with the lever.

A feature and advantage of embodiments is a pivoting arrangement having a pin portion that snaps into a corresponding C-shaped portion. This arrangement provides manufacturing advantages including fewer parts, easier assembly, the possibility of performing a repair by replacing the lever, and the possibility of replacing the lever with one or more levers having alternate configurations to suit the preferences of different users.

A feature and advantage of embodiments is a pivoting handgun release arrangement in a holster made almost entirely of polymeric material, except for springs and fasteners. This arrangement provides ease of assembly and cost efficiencies by minimizing the number of parts and minimizing the number of assembly steps. In embodiments, the pivoting arrangement includes a polymer pin portion that is received in a corresponding C-shaped portion.

A feature and advantage of embodiments is a retention mechanism in a holster that is thumb actuated to selectively release the handgun when the user wishes to draw his or her weapon. The release actuation mechanism includes a pivoting lever. The blocking portion of the lever pivots from the blocking position to the release position when the user's thumb applies a pivoting force to the thumb receiving portion of the lever.

A feature and advantage of embodiments is that thumb actuating release actuation mechanism is biased, such as by a spring, to a preactuation position and is automatically reset after withdrawal of the handgun. The handgun can be reholstered without manual reset of the retention mechanism or the release actuation mechanism.

A feature and advantage of embodiments of a holster and attached belt loop is that the release button of the holster is positioned between the handgun and a belt loop and the holster user and nested within a three-sided frame of the holster body. The thumb release button in this position is not readily accessible or visible to potential attackers.

A feature and advantage of embodiments is a thumb actuated holster with a depressible thumb button, the holster mounted to a jacket slot belt loop, the jacket slot having vertical ribs that inhibit lateral access to the depressible thumb button.

A feature and advantage of embodiments is a thumb-actuated lever that is captured between the holster and a mounting plate defining one or more slots for receiving belts, straps, releasable holster attachment systems, and the like. In embodiments, the holster body and the mounting plate define a funneling portion that may be guide the user's thumb toward the thumb-actuated lever.

A feature and advantage of embodiments is a holster having two handgun retention mechanisms that are both actuated by a single thumb-actuated button. In embodiments, one of the handgun retaining mechanisms comprises a U-shaped shroud that is selectively positionable to extend across an upper opening of the holster body. In embodiments, the other of the handgun retaining mechanisms comprises a lever having a trigger guard block portion. In embodiments, the U-shaped shroud and the lever are actuated sequentially by a single thumb-actuated button. In embodiments, the U-shaped shroud is released before the lever is rotated. In embodiments, releasing the U-shaped shroud before the lever is rotated assures that the U-shaped shroud is out of the way before the user attempts to withdraw the handgun from the holster.

A feature and advantage of embodiments is a holster having a U-shaped shroud that may remain open when the handgun is reholstered, allowing the holster to be used in a mode having a lesser level of retention than with the U-shaped shroud in a handgun obstructing position. In embodiments, the U-shaped shroud may be reset by rotating the U-shaped shroud to a position in which the U-shaped shroud obstruct the withdrawal path of the handgun.

A feature and advantage of embodiments is a holster comprising one or more finger guides that facilitate consistent and intuitive gripping of the handgun before, during and after drawing the handgun from the holster. In embodiments, the finger guides guide the user's hand to consistently hold the handgun in the master grip upon drawing the handgun from the holster. In embodiments, the hand assumes the master grip position while the handgun is still holstered in the holster. Thumb guides direct the user's thumb to a thumb button and a datum element is located so that the index finger of the hand is received in the groove while the grip portion of the handgun is being gripped in the palm of the hand and the index finger is extending downwardly away from the palm of the hand. In embodiments, the handgun is held in the master grip after the handgun is unholstered. The index finger may transition from holster engagement to handgun engagement as the handgun is withdrawn from the holster cavity. The thumb easily transitions from the thumb button to gripping the handgun body. In embodiments, the holster comprises a novel combination of elements that facilitate reliable and intuitive unholstering of the handgun.

A feature and advantage of embodiments is that the groove defined by a datum element on the outside panel of the body provides a tactile indication of where the index finger should be placed. In embodiments, datum element defines the groove at a location overlaying the handgun frame while the handgun is holstered. The finger datum element may provide a high degree of certainty that the user will properly grip the handgun after withdrawal of the handgun from the cavity. In embodiments, the user may use one motion to reach downward to grasp the handgun. In embodiments of the invention, the groove for receiving the user's straightened index finger may be defined by a datum element formed of thermoplastic elastomer material. In embodiments, a finger guiding member is positioned and adapted so that a phalanx of the index finger is in contact with the datum element prior to and as the handgun is being removed from the holster.

A feature and advantage of embodiments is a holster having a finger guide that engages the user's finger and a thumb actuated button that engages the user's thumb. In embodiments, the release actuation mechanism is actuated by the user's thumb rather than the user's index finger.

A feature and advantage of embodiments is a holster having a thumb-actuated button that is not readily accessible or visible to potential attackers. In embodiments, the thumb-actuated button is positioned between two or more protruding portions of the holster body. In embodiments, the thumb-actuated button is positioned between the holster body and a holster mounting plate. In embodiments, the holster mounting plate defined a plurality of slots, the slots being dimensioned and positioned to receive a belt, such as, for example, a police officer's service belt.

A feature and advantage of embodiments is a holster body with an inner polymer layer or liner disposed on an inside surface of an outer polymer shell layer. This arrangement may reduce or eliminate wear and tear on handgun surface finishes. In embodiments, the inner layer or liner is of a softer polymer than the shell portion, the shell portion may be nylon. Portions of the inner layer may be exposed through windows in the shell layer. A feature and advantage of such embodiments is that there is a reduction in noise associated with insertion and withdrawal of the handgun and the finish of the handgun is better protected from scuffing or scratching. In embodiments, the inner softer layer is injection molded first and the nylon layer is molded onto the inner layer. In embodiments, the order may be reversed. In embodiments the dual layer holster body has a tensioning mechanism comprising the holster body with a slit forward from a portion of the holster body that engages the trigger guard of the handgun, the slit extending to a front opening in the forward end of the holster body, the upper portion of the holster body having a peak with two inclined holster body wall portions joined at the peak. A threaded fastener extending through aligned holes forward of the trigger guard receiving region of the holster body may be tightened to pull the opposing sides of the holster body together effecting a clamping on the four corners of the forward holster body and slide.

A feature and advantage of embodiments is a holster that is user convertible between a level two retention level and a level three retention level. In embodiments, a thumb actuated lever that releases a shroud over a rearward opening to the holster cavity also engages and depresses a tab portion on a trigger block lever that rotates the lever to move a trigger guard blocking member out of a blocking position. The thumb actuated lever and shroud may be removed and the trigger block lever with the tab portion is replaced with a lever with a push button thereon. In embodiments, the trigger block lever may be readily removed and replaced with a thumb actuated lever having a thumb pushbutton, the alternate levers may be snapped or seated into a lever receiving region on a proximal side of the holster body, the levers rotatable along a lever axis when seated in the lever receiving region. Each of the alternate levers may be captured and secured in the lever receiving region by a holster mounting portion such as a belt loop or a jacket slot belt loop. This provides the advantage that the user can select and modify her holster for either level two or level three retention rather than buying one level three holster and one level two holster.

A feature and advantage of embodiments is an advantageous method of manufacturing holster utilizes a single mold for the holster body for both a level two holster and a level three holster. The mold having features for a proximal side belt loop mounting region, for example a flat surface with three holes. Above the mounting region structure (positionally the "upper" holster receives the slide of the handgun), the mold having structure for molding features for a first lever receiving seat and other features associated with a first active handgun retention mechanism, including for example, openings in the proximal holster wall portion forward of the lever receiving seat and rearward of the lever receiving seat such that the molded holster body can receive portions of a first lever of the first active handgun receiving region. The mold also has a second lever receiving region and features for receiving a second active handgun retention mechanism with a shroud pivotally attached at a rear opening of the holster body. In embodiments, mold inserts may be utilized to preclude the molded holster body from having the features for receiving the second retention mechanism. For example, a mold insert will be placed in the mold when openings for attaching the second retention mechanism are desired, those mold inserts removed when the molded holster body is intended for a level two retention. Use of the same mold makes the production more economical resulting in lower prices to the consumer and/or better margins in manufacturing.

A feature and advantage of embodiments is a thumb actuated button of a retaining mechanism is positioned to allow for intuitive and ergonomic release of the handgun from the holster. This allows the user to press his or her thumb against the thumb button with less tension in the muscles and tendons of the thumb and forearm. The thumb button position provides for natural and comfortable movement of the thumb while the forearm is extending in a downward direction.

A feature and advantage of embodiments is a thumb actuated button that can be pivoted with little tension in the muscles and tendons of the forearm and thumb while the forearm is extending in a downward direction and the thumb is contacting the thumb actuated button. In embodiments, the thumb actuated button pivots about an axis that is parallel to a handgun insertion and withdrawal axis of the holster. In embodiments, the retaining mechanism comprises a lever having a thumb button portion, and the lever pivots about an axis that is parallel to a handgun insertion and withdrawal axis of the holster. In embodiments, the retaining mechanism comprises a thumb-actuated button that pivots about a first axis and a lever that pivots about a second axis that is parallel to the first axis.

The retention mechanism for the holster may include a lever pivotally supported by the holster body. The lever may comprise an elongate central portion integrally formed with a first forward pivot portion, and the holster body may comprise a second forward pivot portion integrally formed with a wall portion of the holster body. The first forward pivot portion may be mated with the second forward pivot portion so that the lever is pivotally supported by the holster body. In embodiments, one of the forward pivot portions is a pin portion and the other of the forward pivot portions is a C-shaped pin receiving portion. In embodiments, the C-shaped pin receiving portion has a circumferential span less than or equal to 180 degrees. In embodiments, the C-shaped pin receiving portion has a circumferential span greater than 180 degrees. In embodiments, the pin receiving portion may extend 360 degrees. In embodiments, one of the forward pivot portions is a pin portion and the other of the forward pivot portions is a U-shaped pin receiving portion. The lever may also include a first rearward pivot portion integrally formed with the elongate central portion and the holster body may comprise a second rearward pivot portion integrally formed with a wall portion of the holster body. The first rearward pivot portion may be mated with the second rearward pivot portion so that the lever is pivotally supported by the holster body. In embodiments, one of the rearward pivot portions is a pin portion and the other of the rearward pivot portions is a C-shaped pin receiving portion. In embodiments, the C-shaped pin receiving portion has a circumferential span less than or equal to 180 degrees. In embodiments, the C-shaped pin receiving portion has a circumferential span greater than 180 degrees. In embodiments the circumferential span is greater than 185 degrees. In embodiments, the circumferential span is greater than 190 degrees. In embodiments, the circumferential span is 360 degrees. In embodiments, one of the rearward pivot portions is a pin portion and the other of the rearward pivot portions is a U-shaped pin receiving portion. In embodiments the lever may have only one pivot portion and the body only one cooperating pivot portion. In embodiments, the pivot portion of the lever extends substantially or mostly the length of the lever.

In embodiments, the pin portion is configured as a pintle and the pin receiving portion is configures as a gudgeon. In embodiments, the pintle is unitary with the lever of the retention mechanism and the gudgeon is unitary with the holster body.

A holster in accordance with this detailed description may comprise a user attachment means such as a belt engaging member, a holster body and a lever disposed between the holster body and the user attachment means. The lever may be pivotally supported by the holster body and may be moveable between a handgun trigger guard capture position and a handgun trigger guard release position. In embodiments, the belt engaging member is fixed to the holster body by a plurality of screws. The lever, may be, for example, captured between the user attachment means and the holster body. In embodiments, the lever can be freely separated from the holster body after the user attachment means is removed from the holster body. In embodiments, the user attachments means is a belt engaging member comprising a first belt loop portion defining a first belt passageway. In embodiments, the belt engaging member comprises a second belt loop portion defining a second belt passageway.

In embodiments, the user attachment means is a jacket slot belt loop that has a lower plate portion having a holster attachment region, a mid level portion, and an upper portion with a pair of belt loops. The lower plate portion having apertures for receiving threaded fasteners for attachment of the holster at the holster attachment region. The mid level portion may have a distal side that cooperates with the holster body to capture components of a retention mechanism between the holster body and the mid level portion and thereabove a pair of upright ribs protruding outwardly from the distal side defining a recess therebetween that extends upwardly to the upper portion and is open upwardly. The upper portion having a central column with an upper margin. A pair of belt loop members are displaced distally inward of the central column and displaced laterally from the central column. The belt loop members connect to the central column at upper connecting portions, the central column, the upper connection portions and the belt loop members all unitary with each other. Each belt loop member having a lower end not unitarily joined to the central column but having a closable spacing therefrom. The central column may have protruding portions configured as bosses to cooperate with the lower ends of the belt loop members. Threaded fasteners may be utilized to adjust the spacing between each belt loop member and the central column effecting a clamping action onto a belt, such as a duty belt, whereby the jacket slot belt loop is secured to a user's belt. Optional elastomeric bushings may be utilized between the lower ends of the belt loop members and bosses of the central column. A feature and advantage of such embodiments is that the level of clamping of the jacket slot belt loop and holster are readily adjustable. Moreover, the lateral offset of the belt loop members from the central column provides stability for the mounting system and holster as the length of the engagement of the jacket slot belt loop with the holster is extended.

The ribs may provide structural strengthening of the plate portion as well as providing access inhibiting structure to prevent access by others from front of the holster or the back side of the holster, as the holster is worn. The recess opening upwardly providing access to the holster wearer as well as guide structure to easily and non-visually guide the users thumb to the proper location both to actuate a thumb release button and for the master grip.

A holster for receiving a handgun having a trigger guard, comprises a holster body supporting a retention mechanism. In embodiments, the holster body has a plurality of holster wall portions defining a handgun holding cavity extending along a handgun receiving and withdrawal axis. In embodiments, the retention mechanism comprises a lever pivotally supported by the holster body. In embodiments, the lever with a pivoting connection length of the lever extending more than half of the length of the lever, providing stability of the lever and holster body interface. In embodiments, the lever comprising an elongate central portion integrally formed with a first forward pivot portion and the holster body comprising a second forward pivot portion integrally formed with one of the holster wall portions, the first forward pivot portion mating with the second forward pivot portion. In embodiments, the lever further comprises a first rearward pivot portion integrally formed with the elongate central portion and the holster body comprising a second rearward pivot portion integrally formed with one of the holster wall portions, the first rearward pivot portion mating with the second rearward pivot portion. In embodiments, one of the forward pivot portions is a pin portion and the other of the forward pivot portions is a C-shaped pin receiving portion. In embodiments, one of the rearward pivot portions is a pin portion and the other of the rearward pivot portions is a C-shaped pin receiving portion. In embodiments, the lever is pivotally attached to the holster body and is moveable between a handgun trigger guard capture position and a handgun trigger guard release position.

In embodiments, a holster body has exterior bosses for receiving either a handgun button guard for a holster with a single active retention mechanism, or for receiving components of a second retention mechanism. A feature and advantage is the same holster body can be utilized for two different holsters, one with a single active retention mechanism and one with two active retention mechanisms.

In embodiments, a holster body has an inner liner supported by an outer layer, the inner liner of a polymer softer than the polymer of the outer layer, the holster body defining a pair of opposing V-shaped portions for supporting the forward portion of the handgun, the V-shaped portions having an upper inverted V portion and a lower V portion, the V-shaped portions for engaging with the slide and body corners of the forward portion of the handgun, the lower V-shaped portion having an tensioning screw for adjusting the spacing of opposing legs of the lower V-shaped portion.

In embodiments, a forward holster body has a rhombus or diamond shape, with an adjustable gap at the bottom of where four corners of the forward portion of a handgun engages intermediate portions of each side of the diamond shape. An adjustment screw at the bottom of diamond causes contraction or expansion of the diamond shape allowing adjustment of the engagement and gripping of the holster on the handgun. A softer inner layer of the holster body enhances the gripping function.

In embodiments, a jacket slot belt loop attaches to a proximal wall portion of a holster, the holster having an active retention mechanism on the proximal wall portion of the holster, the jacket slot belt loop capturing components of the active retention mechanism between the proximal wall portion of the holster body and the jacket slot belt loop.

In embodiments, the U-shaped shroud of the holster is part of a hood assembly. In embodiments, a bracket of the hood assembly includes a lug portion and the thumb receiving tab includes a protrusion portion that engages the lug portion of the hood assembly while the U-shaped shroud is in the handgun retaining position. In embodiments, the holster further includes a hood spring that biases the U-shaped shroud to pivot toward the release position. In embodiments, the hood spring biases the lug portion of the hood assembly against the protrusion portion of the thumb receiving tab while the U-shaped shroud is in the handgun retaining position. In embodiments, rotation of the thumb receiving tab through a first range of rotary motion causes the protrusion portion of the thumb receiving tab to disengage from the lug portion of the hood assembly. In embodiments, rotation of the thumb receiving tab through a second range of rotary motion causes the thumb receiving tab to engage the tab receiving portion of the lever causing at least a portion of the trigger guard retaining portion of the lever to be withdrawn from the trigger guard receiving portion of the holster body.

In embodiments, the holster includes the hood spring, a lever spring and a tab spring. In embodiments, each spring comprises a length of wire, the wire of the spring forming a first leg, a second leg and a coil disposed between the first leg and the second leg. In embodiments, the first leg of the hood spring is fixed relative to the holster body and the second leg of the hood spring is seated against the hood assembly so that the U-shaped shroud is biased to pivot toward the release position. In embodiments, the lever spring is positioned and adapted to bias the lever to rotate toward the handgun trigger guard capture position. In embodiments, the first leg of the lever spring is seated against to the holster body and the second leg of the lever spring is seated against the lever. In embodiments, the tab spring is positioned and adapted to bias the thumb receiving tab to rotate in a direction that moves a distal end of the thumb receiving tab away from the holster body. In embodiments, the first leg of the tab spring is seated against to the holster body and the second leg of the tab spring is seated against the thumb receiving tab.

In embodiments, a leg strap adapter for attachment to a belt engaging member is provided that includes a leg strap adapter plate having a central, vertical axis and a horizontal axis; two or more holes disposed along the central, vertical axis of the leg strap adapter plate; and two slots disposed along the horizontal axis of the leg strap adapter plate and configured to receive a strap or belt, wherein the leg strap adapter is configured to be rotatably attached to a belt engaging member.

In embodiments, a holster is provided that includes a holster body configured to receive a handgun equipped with a red dot sight (RDS), said holster body comprising an upward wall portion having a projection to accommodate at least a portion of the RDS and a two-position detent positioned on an interior surface of the upward wall portion, having a first side and a second side each comprising a first, open position detent and a second, closed position detent; and a dust cover hingeably connected to the holster body and positioned and configured to cover at least a portion of the RDS not covered by the holster body when the dust cover is in a second, closed position and to not cover the RDS when in a first, open position, said dust cover comprising two followers at an end of the dust cover proximal to the upper wall portion, said followers disposed on either side of a vertical axis of the dust cover and extending toward and configured to engage the two-position detent on the first side and the second side of the two-position detent, respectively.

In embodiments, a quick detach system is provided that includes an attachment plate comprising three keyhole apertures disposed in a triangular configuration whereby two of the keyhole apertures are disposed proximal to a top edge of the attachment plate and the third keyhole aperture is disposed proximal to a bottom edge of the attachment plate, each keyhole aperture having an upper portion and a lower portion, the upper portion having a diameter or width wider than a diameter of width of the lower portion, the attachment plate further comprising a snap lock mechanism disposed about the third keyhole aperture, the snap lock mechanism comprising two pivotable arms connected by a spring between said pivotable arms, said pivotable arms extending outward and beyond from a plane of the attachment plate, said pivotable arms being pivotable about an axis orthogonal to a plane of the attachment plate and configured to obstruct at least a portion of a lower portion to prevent movement of an attachment member from the lower portion of the third keyhole aperture to the upper portion of the third keyhole aperture when the pivotable arms are in a first position, said spring biasing the pivoting arms in the first position, wherein in a second position the pivotable arms are deflected to permit movement of the attachment member from the upper portion of the third keyhole aperture to the lower portion or vice versa, wherein movement from the first position to the second position is effected by moving the attachment member from the upper portion of the third keyhole aperture to the lower portion of the third keyhole aperture or by moving the pivotable arms to deflect them from obstructing the lower portion of the third keyhole aperture.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

In FIG. 32C, the U-shaped shroud, the bracket and the finger receiving tab are shown from a different viewpoint.

FIG. 35A is a front view of the belt engaging member shown in FIGS. 34A and 34B.

FIG. 35B is a right side view of the belt engaging member shown in FIGS. 34A and 34B.

FIG. 35C is a top view of the belt engaging member shown in FIGS. 34A and 34B.

FIG. 39A is a front view of the holster shown in FIGS. 38A and 38B.

FIG. 39B is a right side view of the holster shown in FIGS. 38A and 38B.

FIG. 39C is a top view of the holster shown in FIGS. 38A and 38B.

Figure 1:
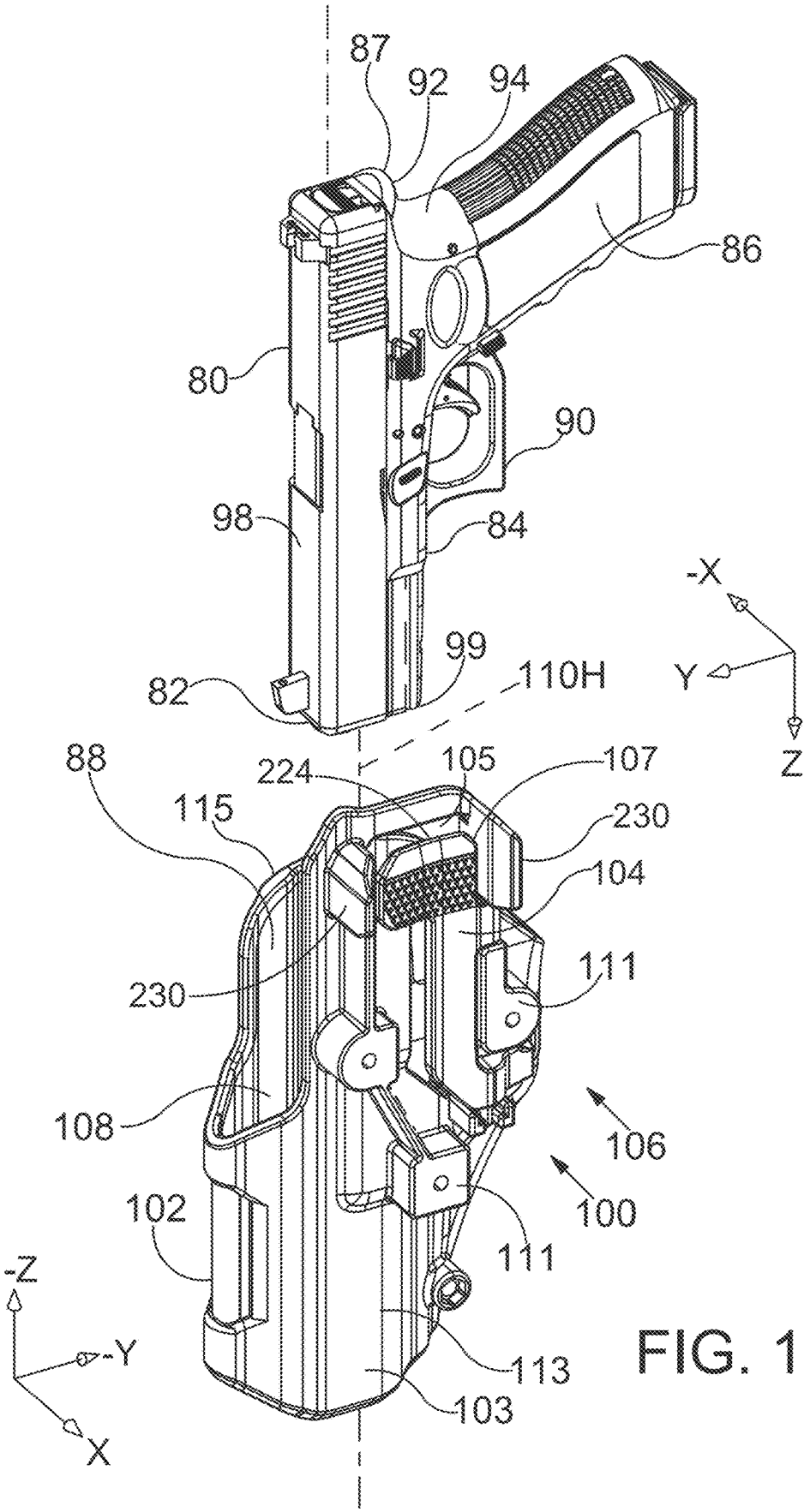
FIG. 1 is a perspective view showing a handgun and a holster in accordance with the detailed description.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2:
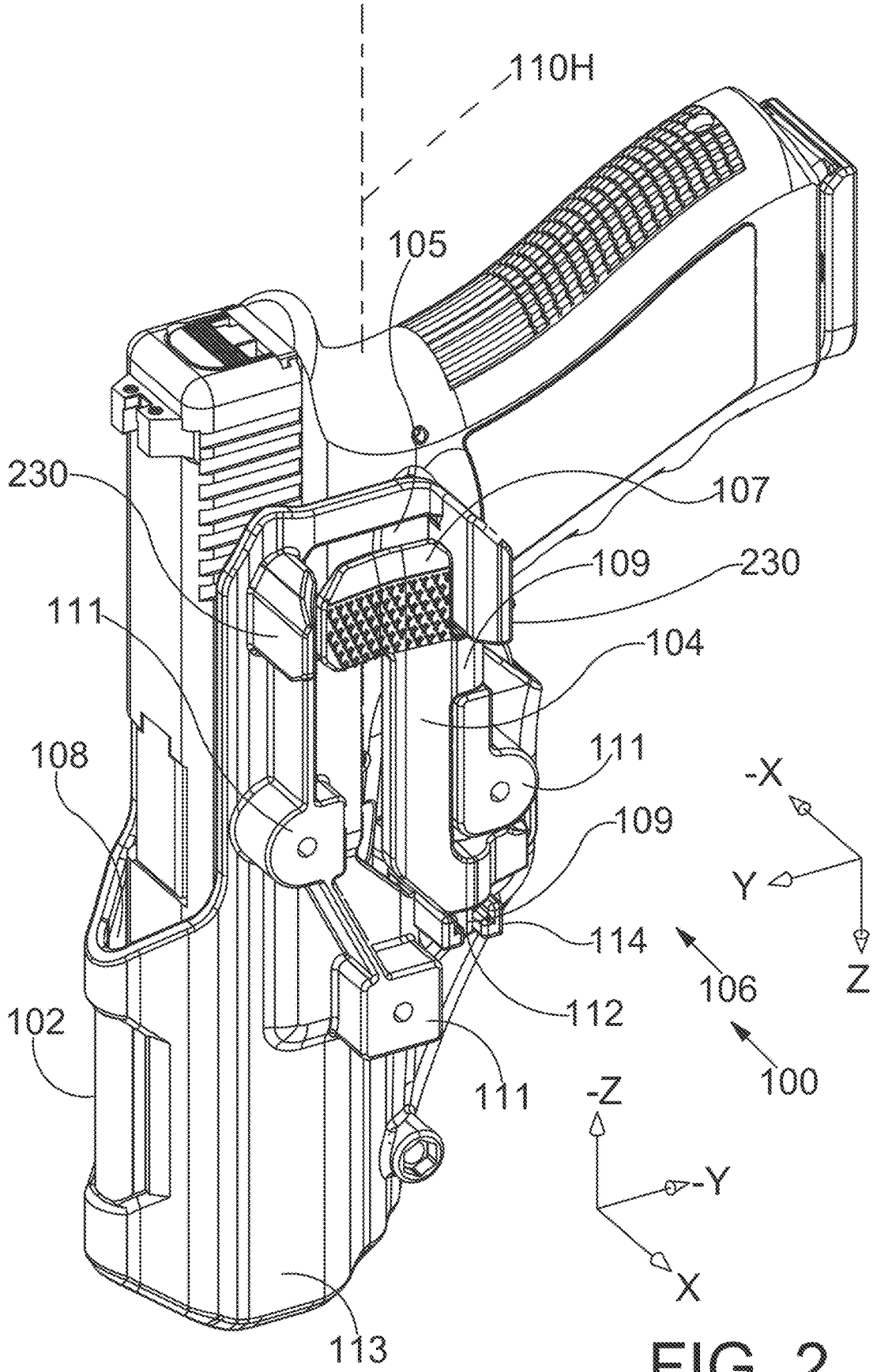
FIG. 2 is a perspective view showing a handgun and a holster in accordance with the detailed description.

Referring to FIGS. 1-4, perspective views of a handgun 80 and a holster 100 are shown. FIG. 1 shows the handgun 80 withdrawn from the holster 100 and FIG. 2 shows the handgun inserted into the holster 100. The handgun being conventional and having a forward end 82, a handgun body 84, a grip 86 at a rearward end 87 of the handgun 80, a trigger guard 90, a back strap 92 with a backstrap recess 94, a slide 98 positioned above the handgun body, and a rail 99 positioned below the slide. In embodiments, the holster 100 for receiving and withdrawing the handgun having a trigger guard 90 comprises a polymer holster body 102, an elongate polymer pivoting lever 104 that is part of a first handgun retention mechanism 106 that is thumb actuated. The pivoting lever has an actuation tab 107 configured as by a thumb receiving button that is disposed in an opening 105 in the holster body, actuation of the thumb receiving button moves a trigger guard block portion 128 of the lever between retention and release positions. The retention mechanism 106 has two distinct separated pivoting connections 109 each formed from a pair of cooperating connector pivot portions 110, one of each pair unitary with the holster body and the other of each pair unitary with the lever. In embodiments, the pivot portions 110 of the lever 104 and pivot portions 110 of the holster body 102 are coupled using a simple assembly process with no separate hinge pin.

Figure 12:
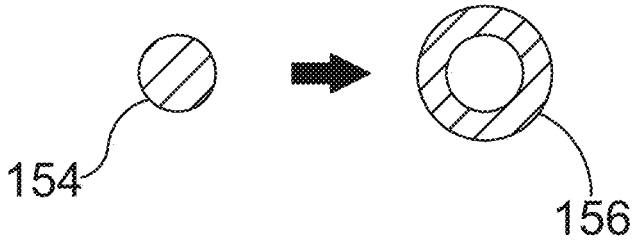
FIG. 12 is a stylized cross-sectional view showing a pin and a pin receiving portion.
Figure 13:
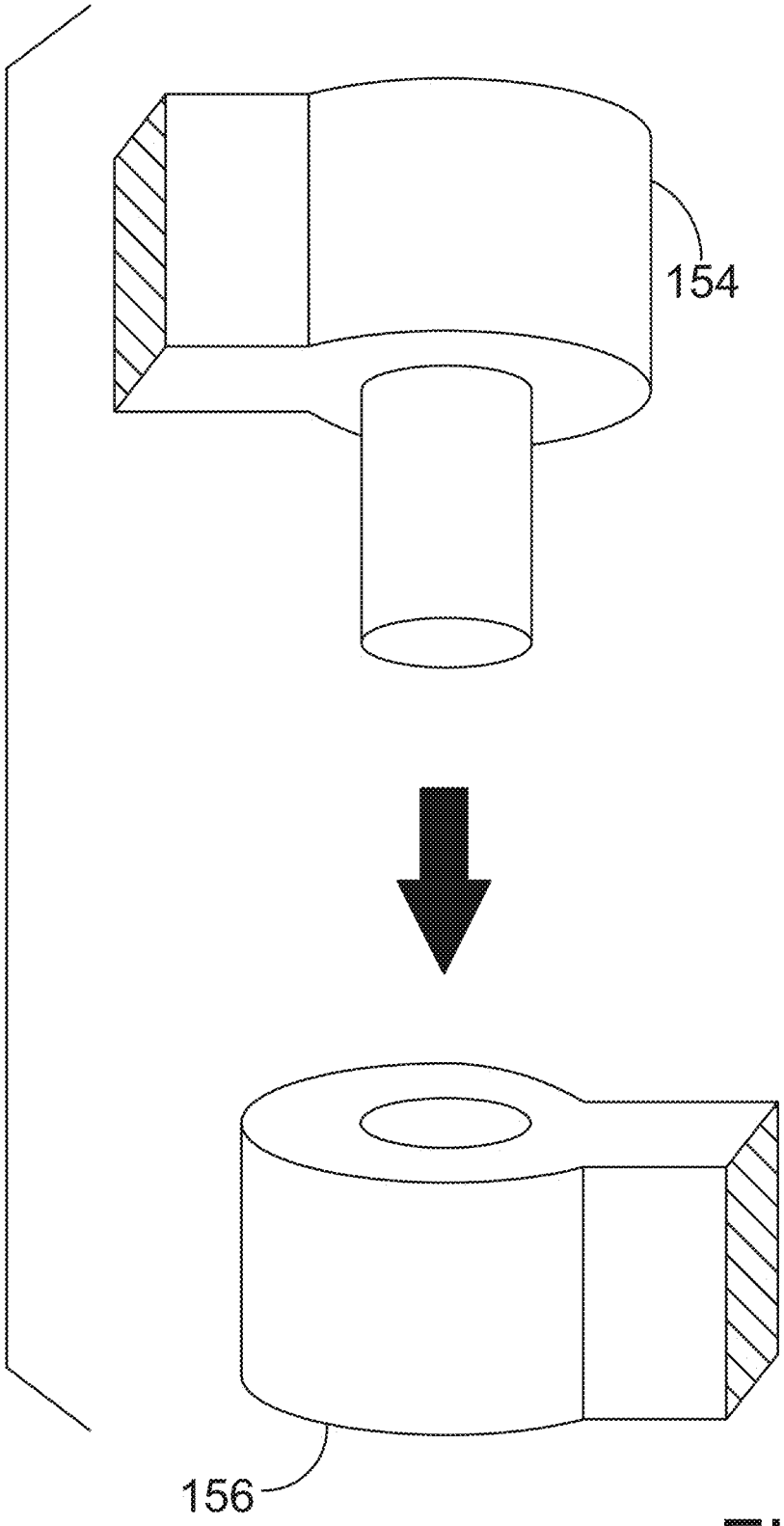
FIG. 13 is a perspective view showing a pin and a pin receiving portion.

The holster body has three unitary bosses 111 on a proximal wall portion 113 for attachment to a plate portion of a user attachment means, such as a belt engaging member. See FIGS. 12 and 13. The holster having a proximal side and the holster body having a proximal side.

Continuing to referring to FIGS. 1-4, in embodiments, the holster body 102 has a plurality of holster wall portions defining a cavity 108 extending along a handgun receiving and withdrawal axis 110H. In embodiments, the retention mechanism 106 comprises a lever 104 pivotally supported by the holster body 102 and retained by holster attachment plate portion 165 or by other means. The lever 104 may comprise an elongate central portion 124 integrally formed with a first forward pivot portion 112 and the holster body 102 may comprises a second forward pivot portion 114 integrally formed with one of the holster wall portions. The first forward pivot portion 112 may mate with the second forward pivot portion 114 to form a forward pivoting connection 109. In embodiments, the lever 104 further comprises a first rearward pivot portion 116 integrally formed with the elongate central portion 124 of the lever 104 and the holster body 102 comprises a second rearward pivot portion 118 integrally formed with one of the holster wall portions. The first rearward pivot portion 116 may mate with the second rearward pivot portion 118 to form a rearward pivoting connection 109. In embodiments all pivot portions of the retention mechanism are axially aligned and co-axial when assembled.

Continuing to referring to FIGS. 1-4, in embodiments, is a retention mechanism having a lever that can be pivoted with little tension in the muscles and tendons of the forearm and thumb while the forearm is extending in a downward direction and the thumb is contacting the a thumb button portion of the lever. In embodiments, the retaining mechanism comprises a lever having a thumb button portion, and the lever pivots about an axis that is parallel to a handgun insertion and withdrawal axis of the holster. In embodiments, the retaining mechanism comprises a thumb-actuated button that pivots about a first axis and a lever that pivots about a second axis that is parallel to the first axis.

Referring to FIGS. 5-8B, in embodiments, the lever 104 of the retention mechanism 106 has an elongate central portion 124, a thumb receiving portion 107, configured as a thumb button, and a blocking portion 128. The thumb receiving portion of the lever comprising a first arm 130 extending away from the elongate central portion 124 in a first direction, the elongate central portion 124 and the first arm 130 cooperating to form a first L-shaped portion 132. The blocking portion 128 of the lever 104 comprises a second arm 134 extending away from the elongate central portion 124 in a second direction opposite the first direction, the elongate central portion 124 and the second arm 134 cooperating to form a second L-shaped portion 136.

Figure 6:
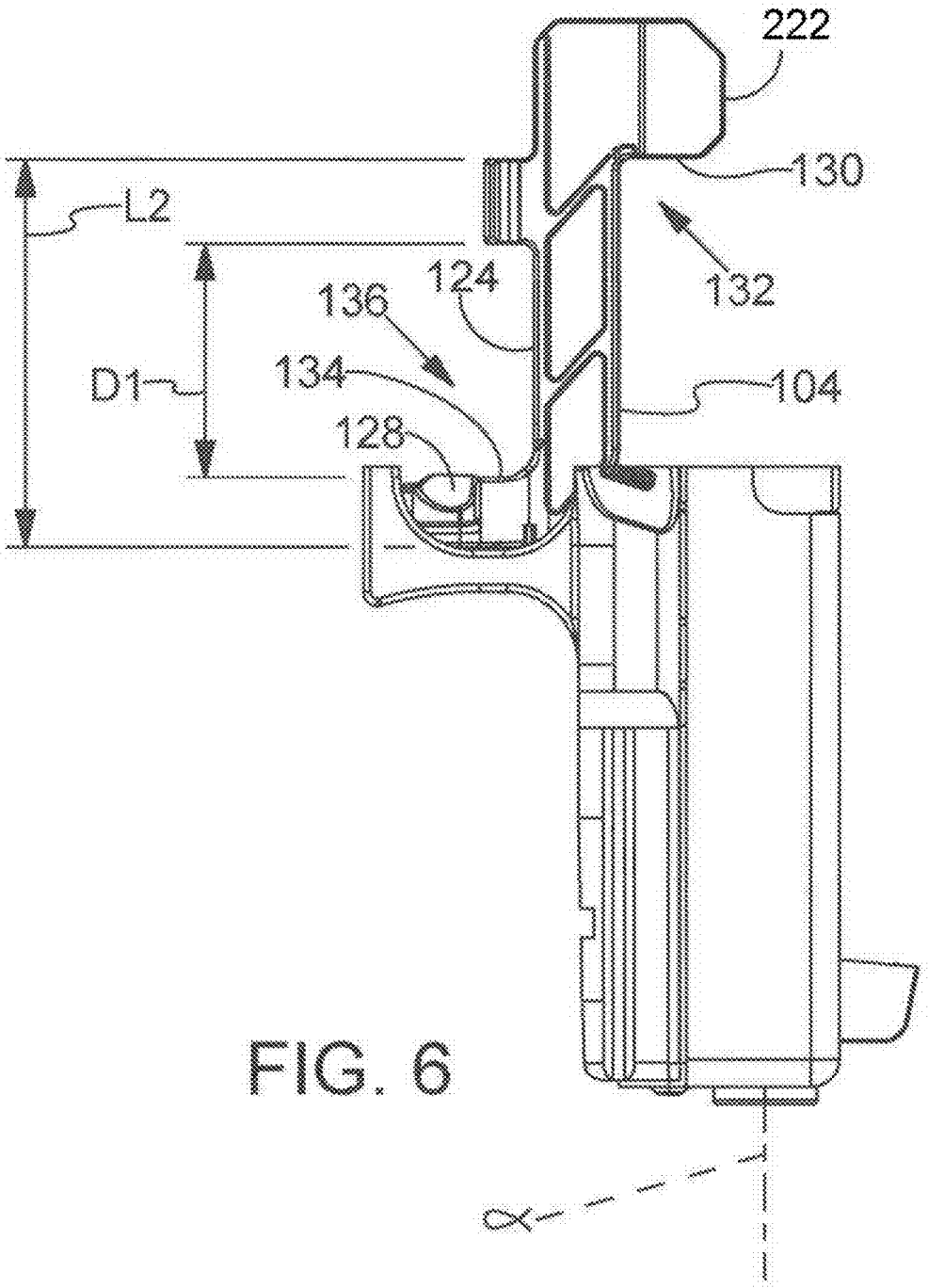
FIG. 6 is a perspective view of an assembly including a lever and a handgun having a trigger guard. The handgun is cross-sectioned for purposes of illustration in FIG. 6.
Figure 7:
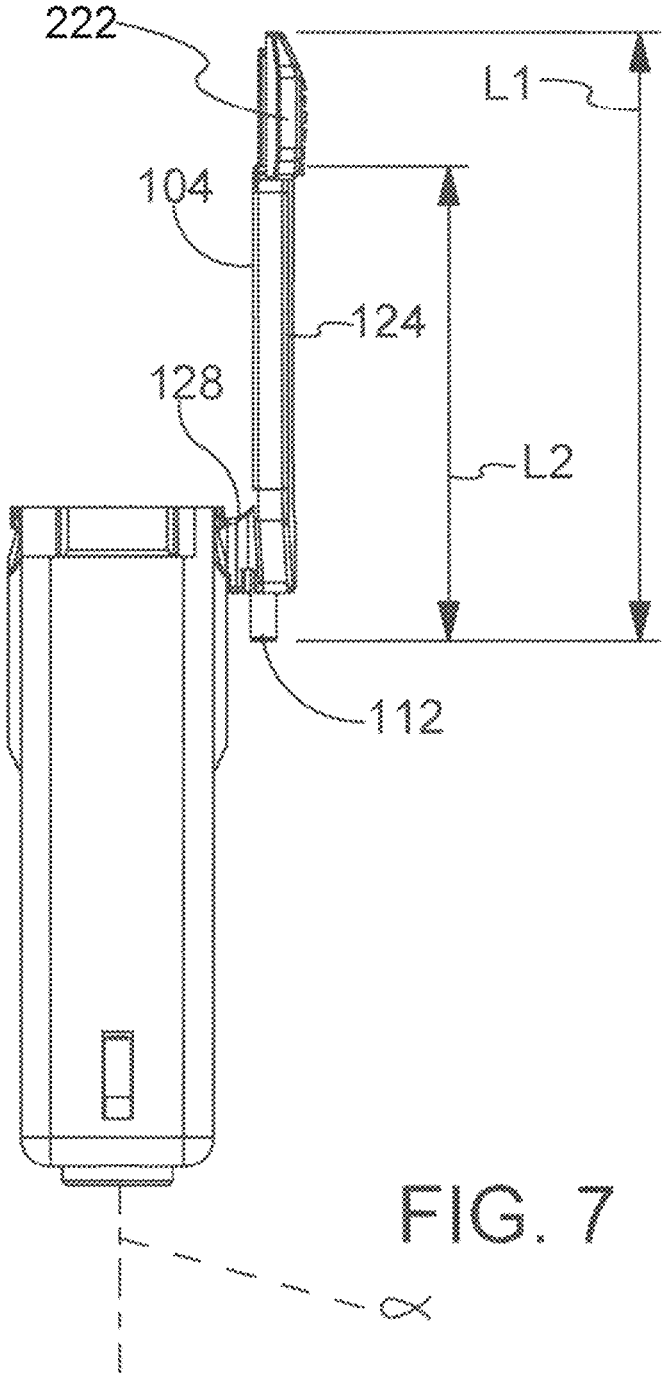
FIG. 7 is a perspective view of an assembly including a lever and a handgun having a trigger guard. The handgun is cross-sectioned for purposes of illustration in FIG. 7.
Figure 8A:
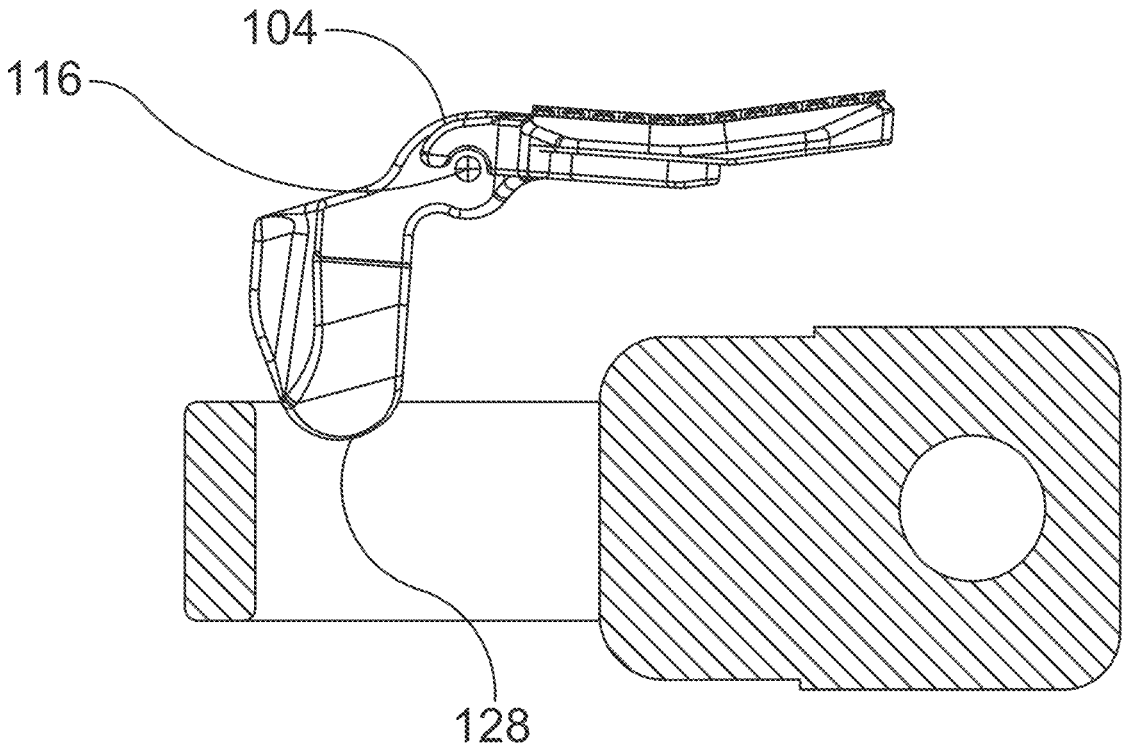
FIGS. 8A and 8B are plan views of an assembly including a lever and a handgun having a trigger guard. The handgun is cross-sectioned for purposes of illustration in FIGS. 8A and 8B.
Figure 8B:
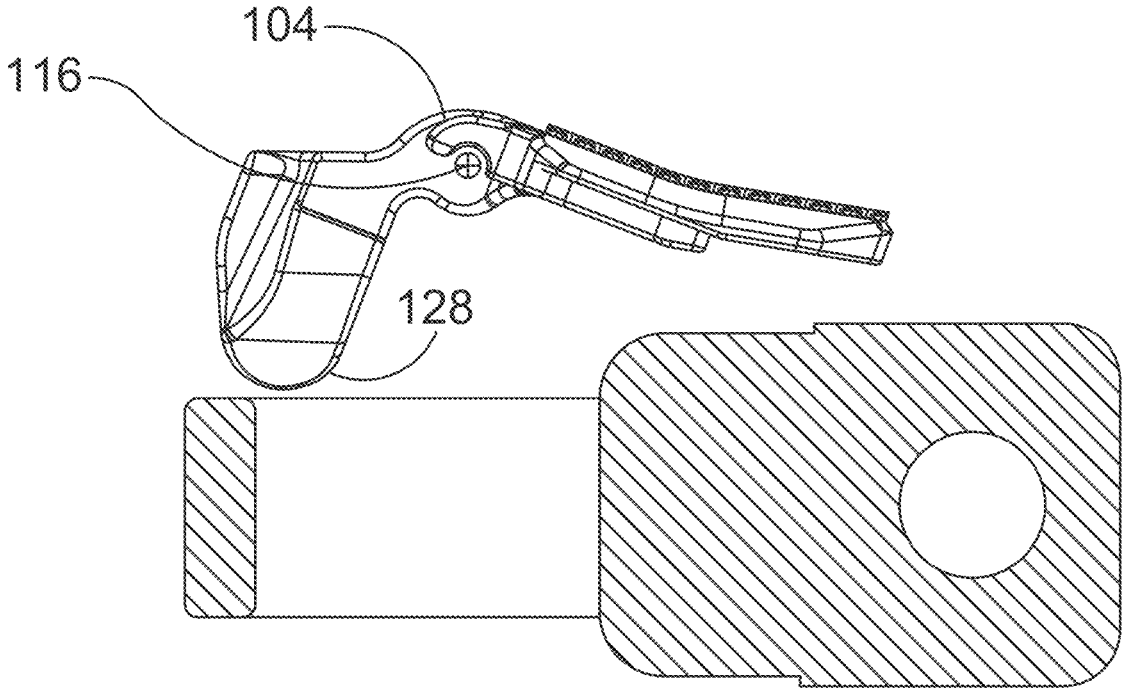

Referring to FIGS. 6 and 7, the lever 104 is elongate in the direction of the axis X and has a lever length L1. The pivot portions 112, 116 have a separation distance D1 and have a pivoting connection length L2. The pivoting connection length L2 to the overall lever length L1 is in embodiments greater than 0.70 or 70%; in embodiments, greater than 0.60 or 60%; in embodiments greater than 0.80 or 80%.

Referring to FIGS. 1 and 2, a forward or handgun insertion direction Z and a rearward or handgun withdrawal direction −Z are illustrated using arrows labeled "Z" and "−Z," respectively. An upward direction Y and a downward direction −Y are illustrated using arrows labeled "Y" and "−Y," respectively. A direction X extending away from the user's body and the user attachment side of the holster is illustrated using an arrow labeled "X." A direction −X extending toward the user's body and the user attachment side of the holster is illustrated using an arrow labeled "−X." The directions illustrated using these arrows may be conceptualized, by way of example and not limitation, from the point of view of a user who is wearing a holster hung from a service belt and inserting a handgun into the holster. The directions illustrated using these arrows may also be conceptualized, by way of example and not limitation, from the point of view of a user holding a handgun in a normal firing position and viewing the gunsights of the handgun. The directions illustrated using these arrows may be applied to the apparatus shown and discussed throughout this application. In embodiments, the Z direction and the −Z direction are both generally orthogonal to the XY plane defined by the X direction and the Y direction. In embodiments, the X direction and the −X direction are both generally orthogonal to the ZY plane defined by the Z direction and the −Z direction. In embodiments, the Y direction and the −Y direction are both generally orthogonal to the ZX plane defined by the Z direction and the X direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "rearwardly," etc. should not be interpreted to limit the scope of the invention recited in the attached claims.

Figure 9:
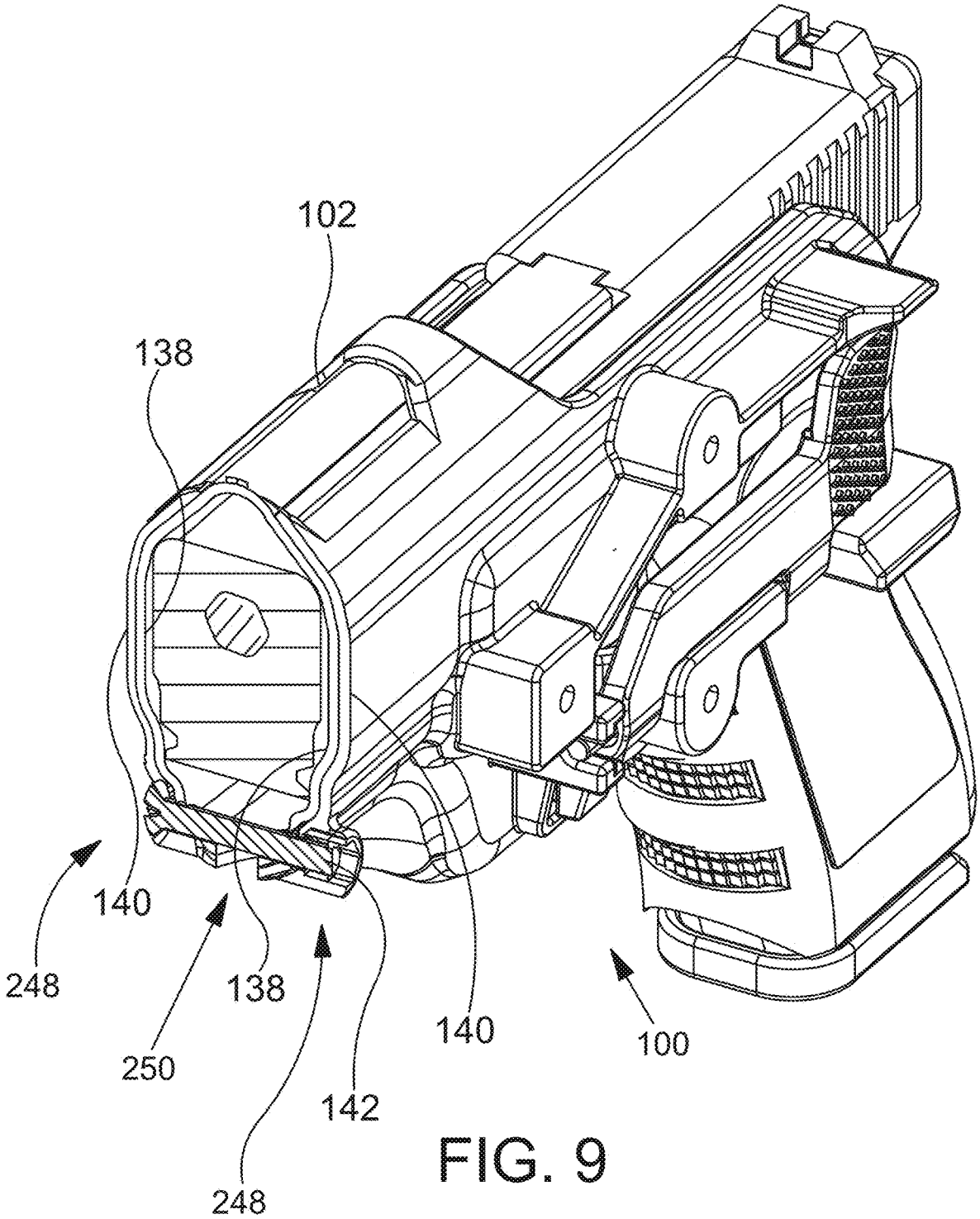
FIG. 9 is a cross-sectioned perspective view of an assembly including a holster and a handgun having a trigger guard. The holster and the handgun are cross-sectioned for purposes of illustration in FIG. 9.

Referring to FIG. 9, a cross-sectioned perspective view of a holster body 102 is shown. In the example embodiment of FIG. 9, the holster body 102 is formed from two polymers, one overmolded onto the other, providing an interior layer 138 and an exterior layer 140. In embodiments, the interior layer 138 is softer than the exterior layer 140 minimizing any wear, damage or markings on the exterior surface of the handgun that is received in the cavity 108 defined by the holster. In embodiments, the interior layer 138 and the exterior layer 140 are combined using an assembly process. In embodiments, the interior layer 138 comprises a thermoplastic elastomer (TPE) and the exterior layer 140 a thermoplastic material. In embodiments, the interior layer 138 comprises Hytrel® polymer, available from DuPont, and the exterior layer 140 comprises nylon. The exterior layer being harder and stiffer than the interior layer.

Figure 10:
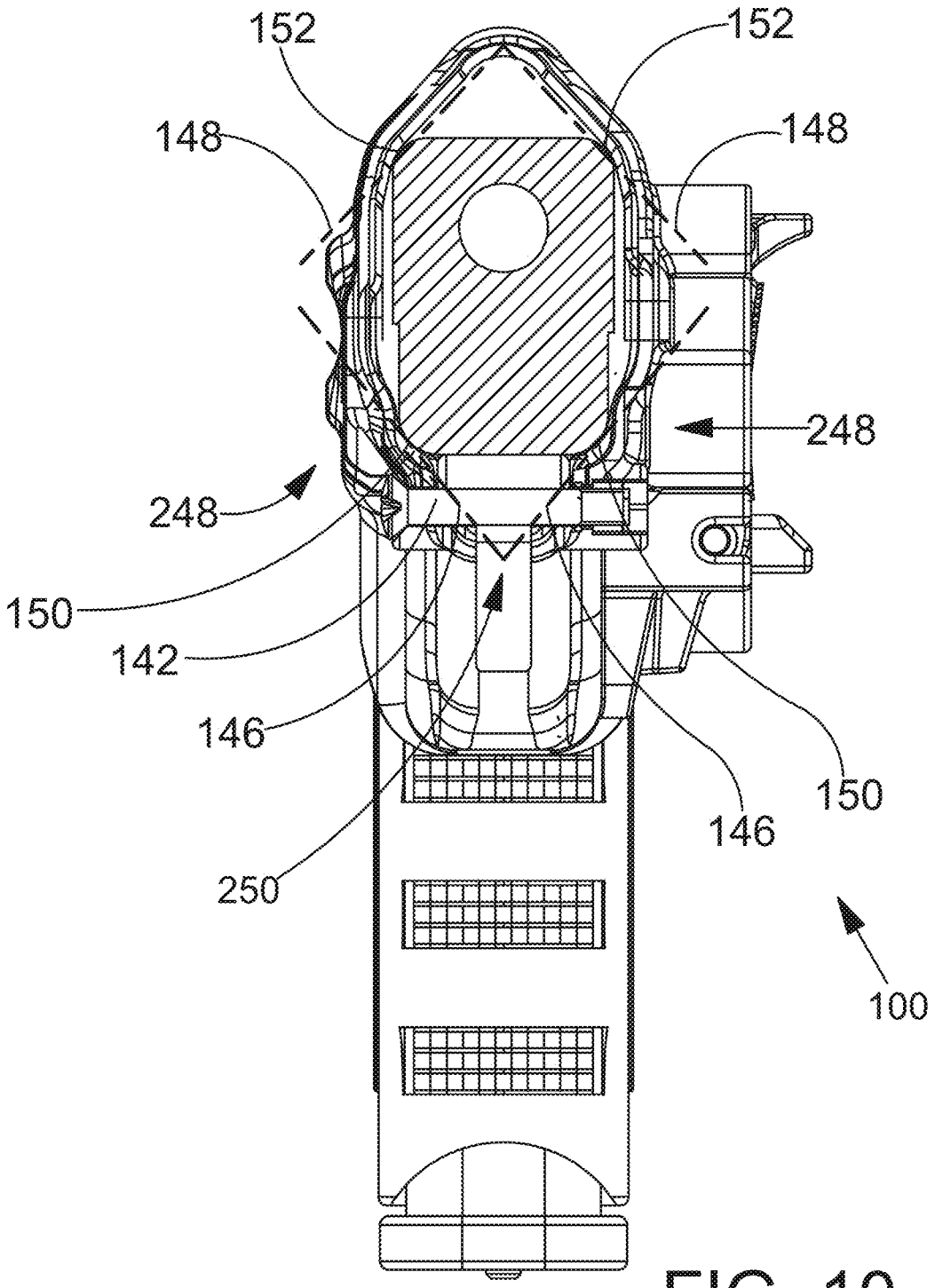
FIG. 10 is a plan view of an assembly including a holster and a handgun having a trigger guard. The holster and the handgun are cross-sectioned for purposes of illustration in FIG. 10.
Figure 11A:
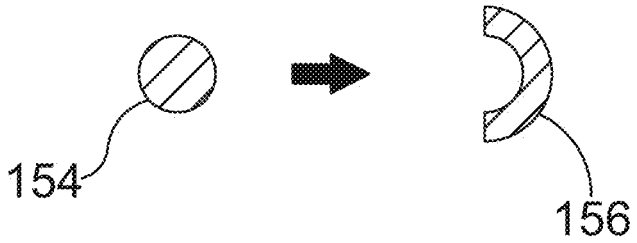
FIGS. 11A-11C are stylized cross-sectional views each showing a pin and a pin receiving portion.
Figure 11B:
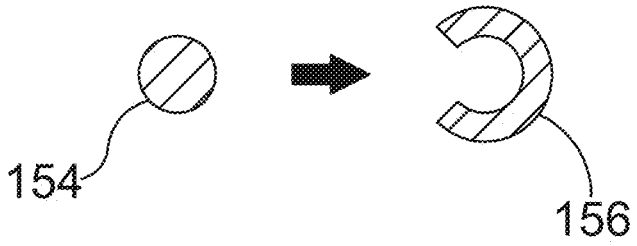
Figure 11C:
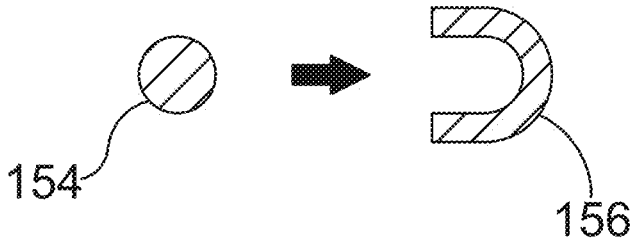

Referring to FIG. 10, a cross-sectional view of a holster body 102 is shown. In embodiments, the holster body 102 is formed to provide a handgun fitting function that can be adjusted by rotating a tensioning screw 142. The shape of the forward portion of the handgun can be conceptualized as a four cornered geometric figure, roughly a rectangle, and the shape of the cavity 108 defined by the holster body 102 can be configured to make point contact with the four corners of the figure or rectangle. In embodiments, the shape of the cavity 108 defined by the holster body 102 can be conceptualized as two opposing V-shapes, an upper V-shape 148 and a lower V-shape 146. The upper V-shape 148 and the lower V-shape 146 are shown using dashed lines in FIG. 10. The two legs of the upper V-shape 148 and the two legs of the lower V-shape 146 may each contact one corner of the figure or rectangle. In embodiments, the lower V-shape 146 defines a slot 144 near the lower end of the lower V-shape 146. A tensioning screw 142 is positioned to selectively decrease the angle between the two legs of the lower V-shape 146. As the angle between the two legs of the lower V-shape 146 decreases, the two legs of the lower V-shape 146 apply upwardly directed component forces to two lower corners 150 of the rectangle. The forces applied to the lower corners 150 of the rectangle urge the two upper corners 152 of the rectangle against the two legs of the upper V-shape 148.

The components herein may be formed of thermoplastic polymers using an injection molding process.

Referring to FIGS. 3, 4 and 11A-11C, a retention mechanism 106 for a holster 100 may include a lever pivotally supported by the holster body 102. The lever 104 may comprise an elongate central portion 124 integrally formed with a first forward pivot portion 112, and the holster body 102 may comprise a second forward pivot portion 114 integrally formed with a wall portion of the holster body 102. The first forward pivot portion 112 may be mated with the second forward pivot portion so that the lever 104 is pivotally supported by the holster body 102. In embodiments, one of the forward pivot portions 112, 114 is a pin portion 154 and the other of the forward pivot portions 112, 114 is a C-shaped pin receiving portion 156. In embodiments, the C-shaped pin receiving portion 156 has a circumferential span less than or equal to 180 degrees. In embodiments, the C-shaped pin receiving portion 156 has a circumferential span greater than 180 degrees; in embodiments greater than 185°; and in embodiments greater than 190°. In embodiments, one of the forward pivot portions 112, 114 is a pin portion 154 and the other of the forward pivot portions 112, 114 is a U-shaped pin receiving portion 156.

With continuing reference to FIGS. 3, 4 and 11A-11C, the lever 104 may further comprise a first rearward pivot portion 116 integrally formed with the elongate central portion 124 and the holster body 102 may comprise a second rearward pivot portion 118 integrally formed with a wall portion of the holster body 102. The first rearward pivot portion 116 may be mated with the second rearward pivot portion so that the lever 104 is pivotally supported by the holster body 102. In embodiments, one of the rearward pivot portions 116, 118 is a pin portion 154 and the other of the rearward pivot portions 116, 118 is a C-shaped pin receiving portion 156. In embodiments, the C-shaped pin receiving portion 156 has a circumferential span less than or equal to 180 degrees. In embodiments, the C-shaped pin receiving portion 156 has a circumferential span greater than 180 degrees; in embodiments greater than 185°; and in embodiments greater than 190°. In embodiments, one of the rearward pivot portions 116, 118 is a pin portion 154 and the other of the rearward pivot portions 116, 118 is a U-shaped pin receiving portion 156.

Figure 3A:
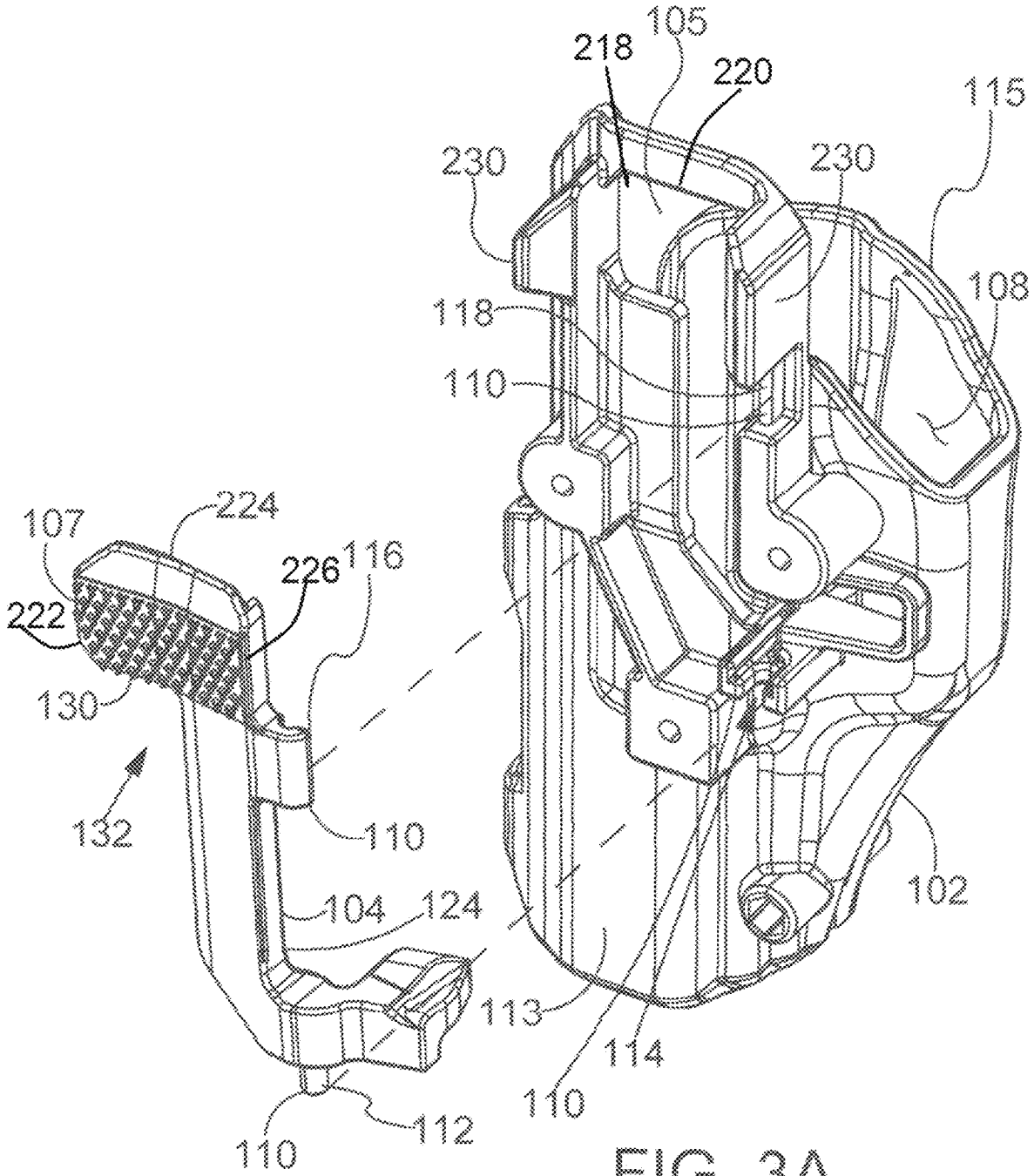
FIG. 3A is an exploded perspective view showing a holster body and a lever.
Figure 3B:
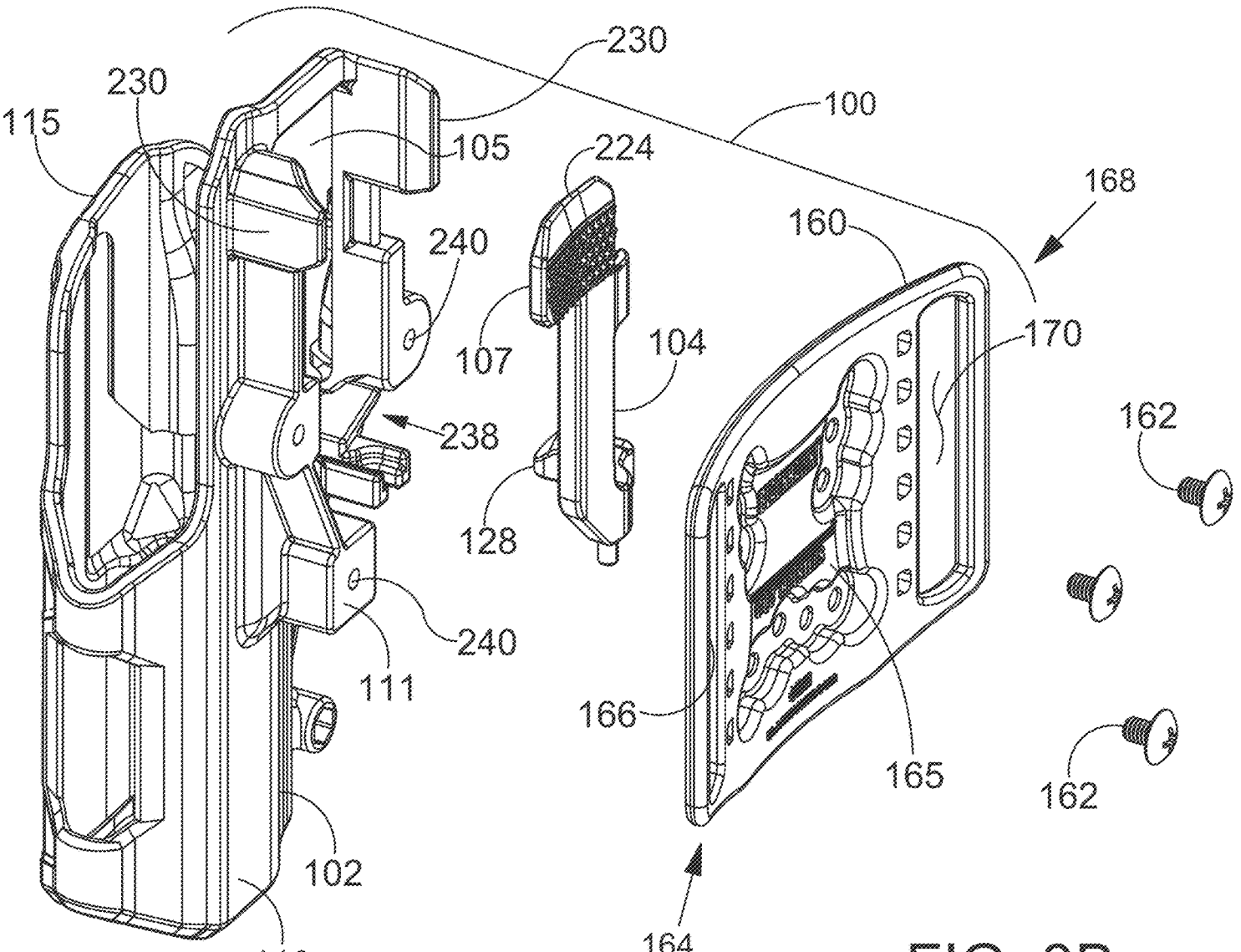
FIG. 3B is an exploded perspective view showing a belt receiving member, a holster body and a lever.
Figure 3C:
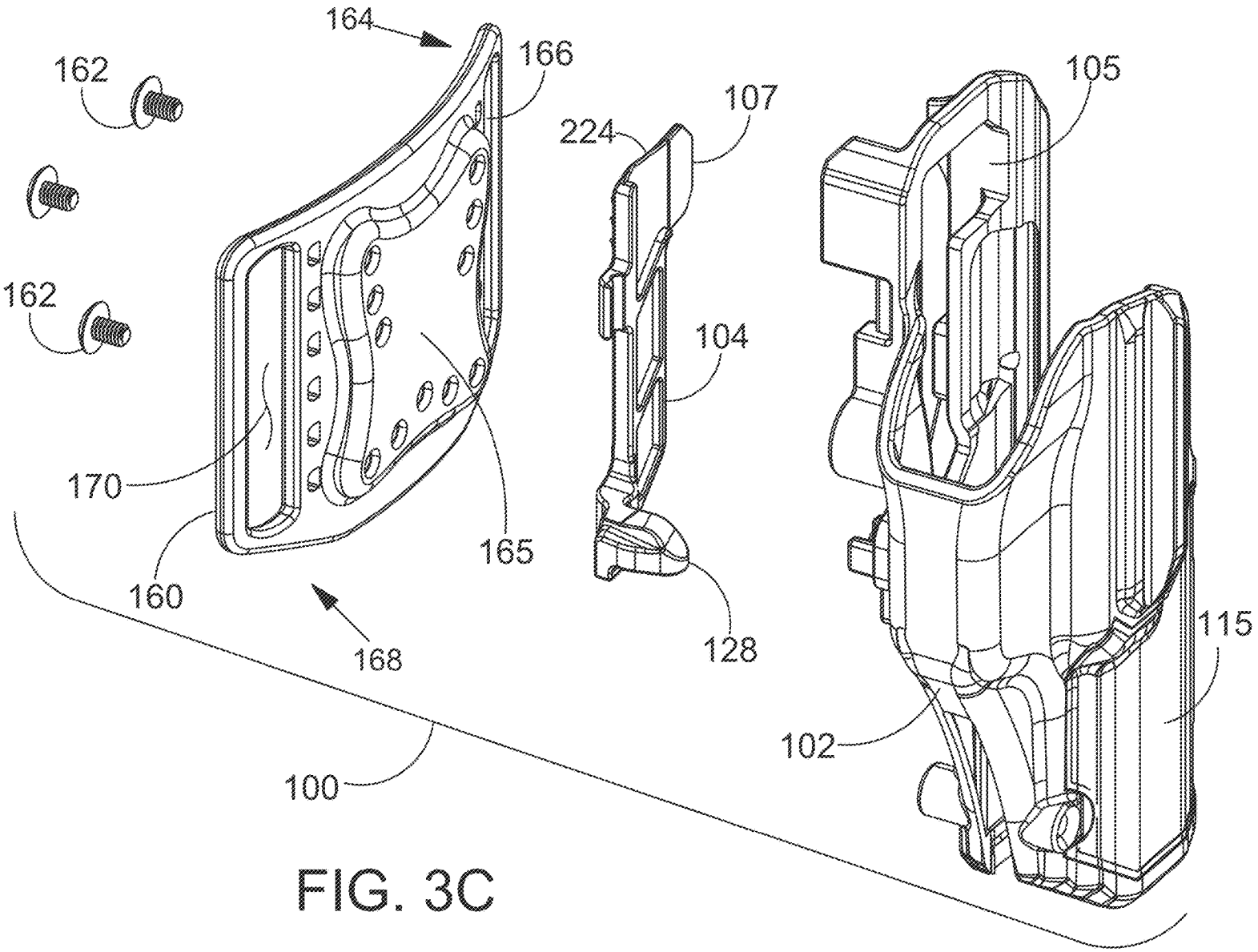
FIG. 3C is an exploded perspective view showing a belt receiving member, a holster body and a lever.
Figure 4:
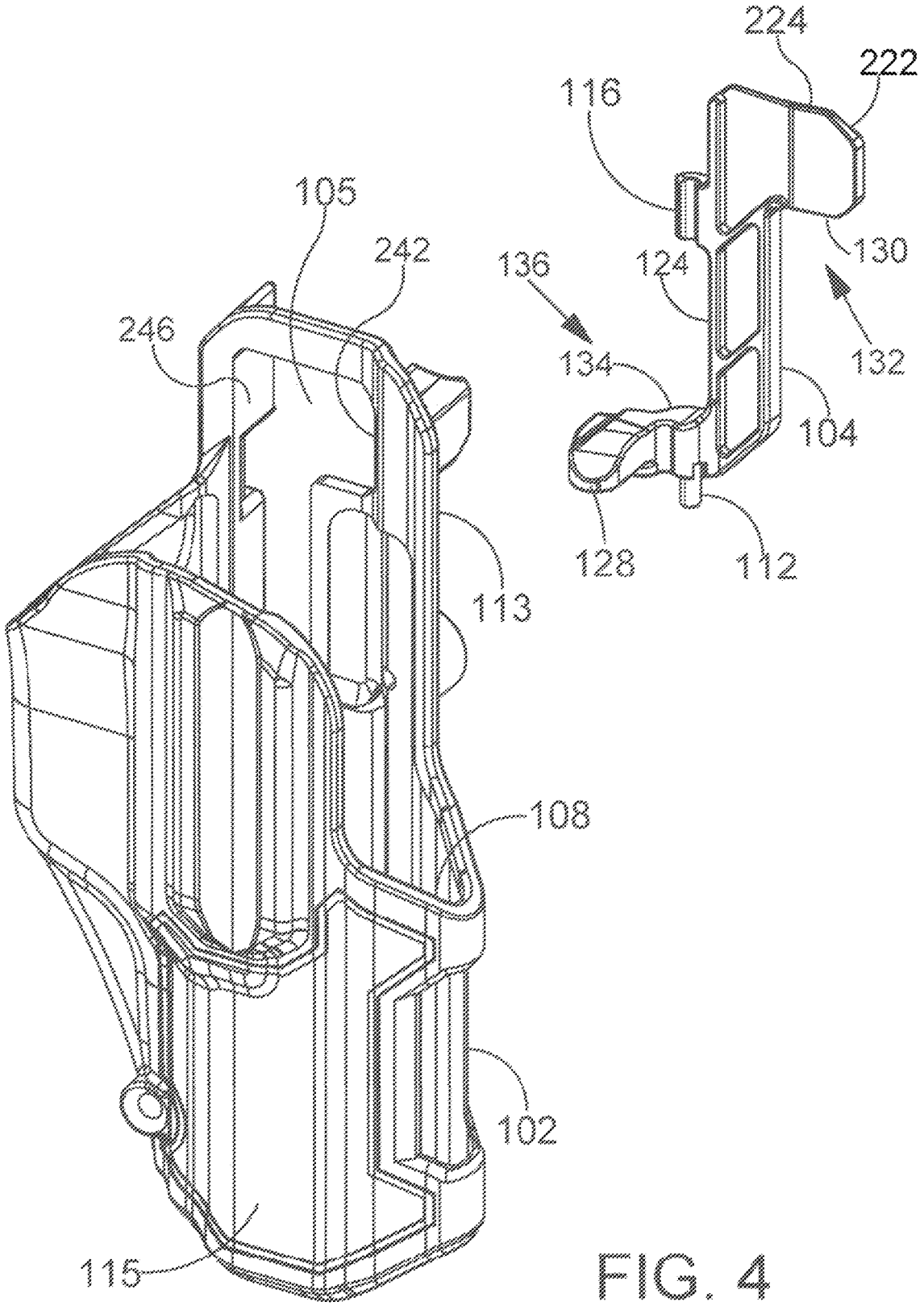
FIG. 4 is an exploded perspective view showing a holster body and a lever.
Figure 5:
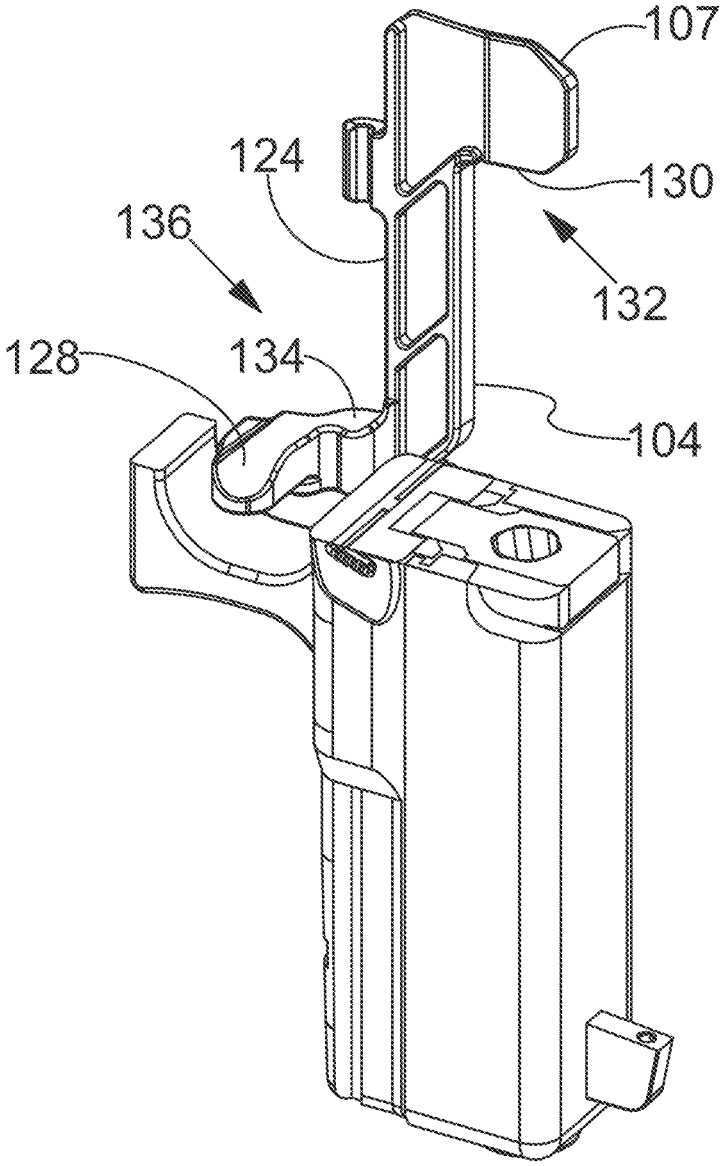
FIG. 5 is a perspective view of an assembly including a lever and a handgun having a trigger guard. The handgun is cross-sectioned for purposes of illustration in FIG. 5.

Referring to FIGS. 3B and 3C, a holster 100 in accordance with this detailed description may comprise a holster attachment plate portion 165 that is part of or all of a user attachment means for the holster which may be a belt engaging member. The plate portion 165 may retain the lever 104 in a pivoting connection arrangement with the holster body 102. The lever 104 may be pivotally supported by the holster body 102 and may be moveable between a handgun trigger guard capture position and a handgun trigger guard release position. In embodiments, the plate portion 165 is fixed to the holster body 102 by a plurality of screws 162. The lever 104, may be, for example, captured between the belt engaging member 160, or other user attachment means, and the holster body 102. In embodiments, the lever 104 can be freely separated from the holster body 102 after the belt engaging member 160 is removed from the holster body 102. In embodiments, the belt engaging member 160 comprises a first belt loop portion 164 defining a first passageway 166 to receive a belt and a second belt loop portion 168 defining a second passageway 170 for receiving the belt.

The user attachment means 160 may comprise various holster supporting devices without deviating from the spirit and scope of this detailed description. Examples of holster supporting devices that may be suitable in some applications are disclosed in the following United States Patents all of which are hereby incorporated by reference herein: U.S. D653,848, U.S. D567,707, U.S. D508,318, U.S. Pat. Nos. 9,134,093, 8,783,532, 8,517,234, 8,469,245, 8,297,562, 8,251,266, 8,235,263, 7,866,515, 7,320,420, 9,423,210, 9,664,480, 9,841,255, 9,222,751, 8,544,706, 8,215,525, 8,100,304, 7,971,762, 7,922,050, 7,690,541, 6,478,202, 6,189,751, and 5,467,909.

Referring to FIGS. 14-17, in embodiments, a holster 100 has a first handgun retention mechanism 106' that engages the trigger guard as previously described with respect to FIGS. 1-13, and a second handgun retention mechanism 106' with a pivoting lever 104'. A dual actuation member 179 with a thumb button 180 actuates both the first handgun retention mechanism 106' and the second handgun retention mechanism 174. In embodiments, each handgun retention mechanism selectively prevents the handgun 80 from being withdrawn from the cavity 108 defined by the wall portions 109 of the holster body 102.

The second handgun retention mechanism 106' comprises a slide retention member configured as a U-shaped shroud 176 that is pivotally supported by the holster body 102 so that the U-shaped shroud 176 selectively pivots between a handgun retaining position in which the U-shaped shroud 176 extends across a portion of a rearward opening 178 of the cavity 108 and a release position in which the U-shaped shroud 176 extends forward of the rearward opening 178 so that a withdrawal path of the handgun 80 is unobstructed. In embodiments, the U-shaped shroud 176 pivots about a shroud pivot axis AC that extends laterally and is perpendicular to the handgun insertion and withdrawal axis AA.

Referring to FIGS. 15-20, in embodiments, the first handgun retention mechanism 106' comprises a lever 104' pivotally supported by the holster body 102. The lever 104' may be similarly configured to the lever 106 of FIGS. 1-13. In embodiments, the lever 104' has an elongate central portion 124, a depressible actuation portion 186, and a trigger guard blocking portion 128. The depressible actuation portion 186 of the lever 104 comprises a first arm 130 extending away from the elongate central portion 124 in a first direction so that the elongate central portion 124 and the first arm 130 cooperate to form a first L-shape 182. The trigger guard blocking portion 128 of the lever 104' comprises a second arm 134 extending away from the elongate central portion 124 in a second direction opposite the first direction so that the elongate central portion 124 and the second arm 134 cooperate to form a second L-shape 184. In embodiments, the lever 104' is pivotally supported by the holster body so that the lever 104' pivots about a lever axis 110 that extends in upward and downward directions as the holster is worn or forward and rearward with respect to the handgun. In embodiments, the lever pivots between a handgun trigger guard blocking or capture position and a handgun trigger guard non-blocking or release position. The trigger guard blocking portion 128 of the lever 104 extends into a trigger guard portion of the holster body 102 when the lever 104' is disposed in the handgun trigger guard capture position.

Continuing to referring to FIGS. 15-20, a feature and benefit of embodiments is a retention mechanism having a lever that can be pivoted with little tension in the muscles and tendons of the forearm and thumb while the forearm is extending in a downward direction and the thumb is used to rotate the lever. In embodiments, the retaining mechanism comprises a thumb-actuated button that pivots about a first axis and a lever that pivots about a second axis that is parallel to the first axis. In embodiments, the lever pivots about an axis that is parallel to a handgun insertion and withdrawal axis of the holster. In embodiments, the thumb-actuated button pivots about an axis that is parallel to a handgun insertion and withdrawal axis of the holster.

Referring to FIGS. 16-20, the second handgun retention mechanism is illustrated. The slide blocking member configured as a shroud 176 is part of a hood assembly 188. Fasteners 197, 198 pivotally secure the U-shaped shroud, second handgun retention mechanism housing 201, bracket 190 with slot 144, to the holster body. Fastener 199 secures the opposite side of the shroud to the holster body. The second handgun retention mechanism 174 utilizes the retention mechanism housing 201 to secure components of the retention mechanism in place. The housing has two cooperating components, and inward member 202 and an outward member 204, that may be arranged in a clamshell-like fashion that captures the leaf spring 194 and a pivoting shaft 206 of the dual actuation member 179 within the housing 201. In embodiments, the holster includes a spring 196 that biases the U-shaped shroud 176 to pivot toward the release position. In embodiments, the holster 100 includes the leaf spring 194 that is received in the slot 144 of the bracket 190 when the U-shaped shroud 176 is in the handgun retaining position. The base 195 of the leaf spring 194 is fixed with respect to the holster body and the tip 196 of the leaf spring 194 can flex inwardly and outwardly. The bracket 190 is attached to the U-shaped shroud 176 such that as the leaf spring 194 keeps the bracket from rotating forwardly it also keeps the shroud from rotating forwardly. In embodiments, rotation of the thumb receiving tab or button 180 through a first range of rotary motion causes deflection of the leaf spring 194 so that a distal portion of the leaf spring 194 moves outside of the slot 144 allowing the bracket 190 and also the shroud 176 to rotate forwardly. In embodiments, rotation of the thumb button 180 through a second range of rotary motion causes the thumb button 180 to engage the depressible actuation portion 186 of the lever 104 causing at least part of the trigger guard blocking portion 128 of the lever to be withdrawn from the trigger guard receiving portion of the holster body 102. In this embodiment, the thumb receiving portion of the lever 104 of the embodiment of FIGS. 1-4 has been replaced with an actuation portion or depressible portion that is depressed by the inner side of the thumb receiving tab 180.

The first and second active handgun retention mechanisms may be arranged such that the second and first mechanisms can actuate sequentially or simultaneously, in embodiments.

Figure 14:
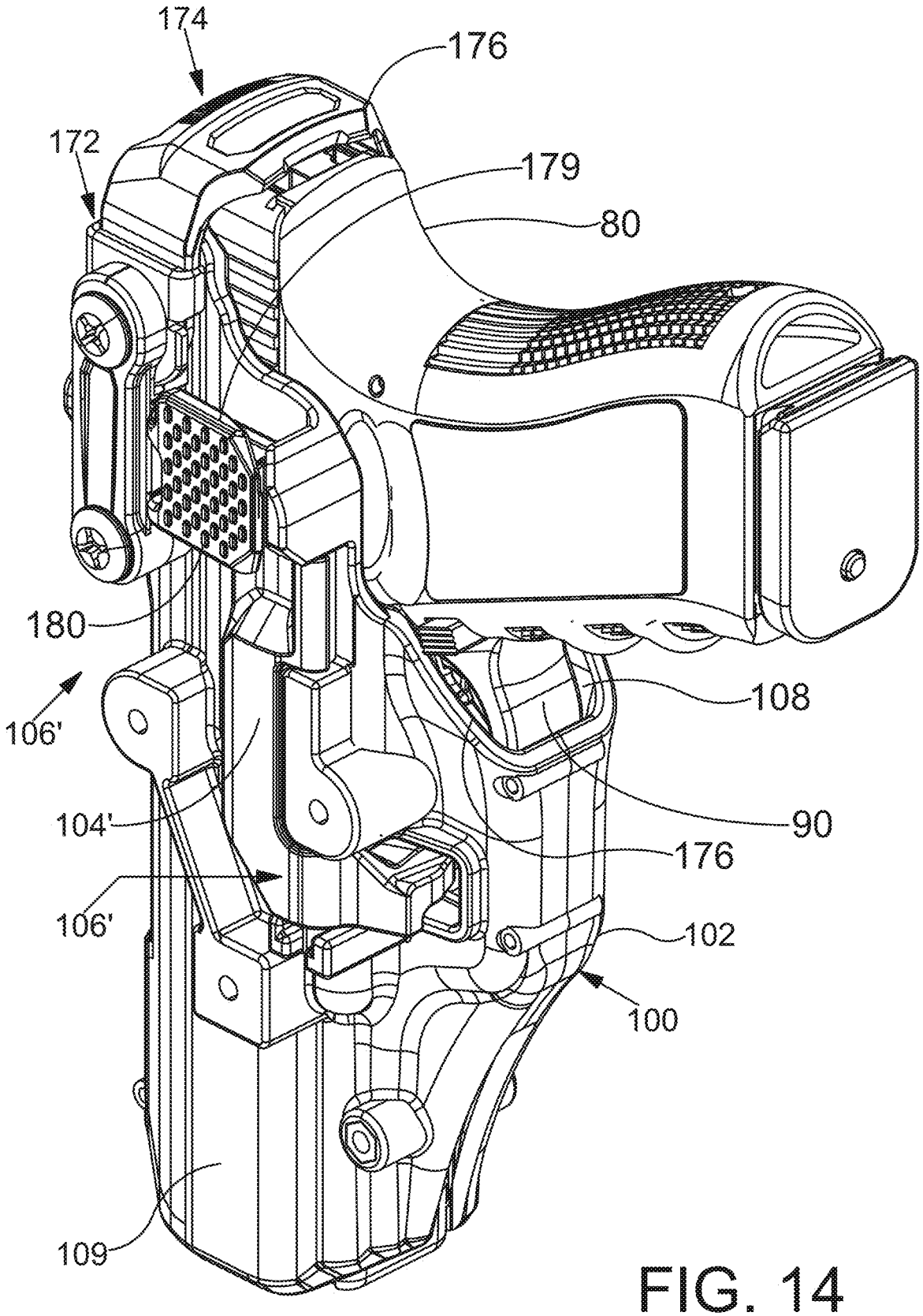
FIG. 14 is a perspective view showing a handgun and a holster in accordance with the detailed description.
Figure 15:
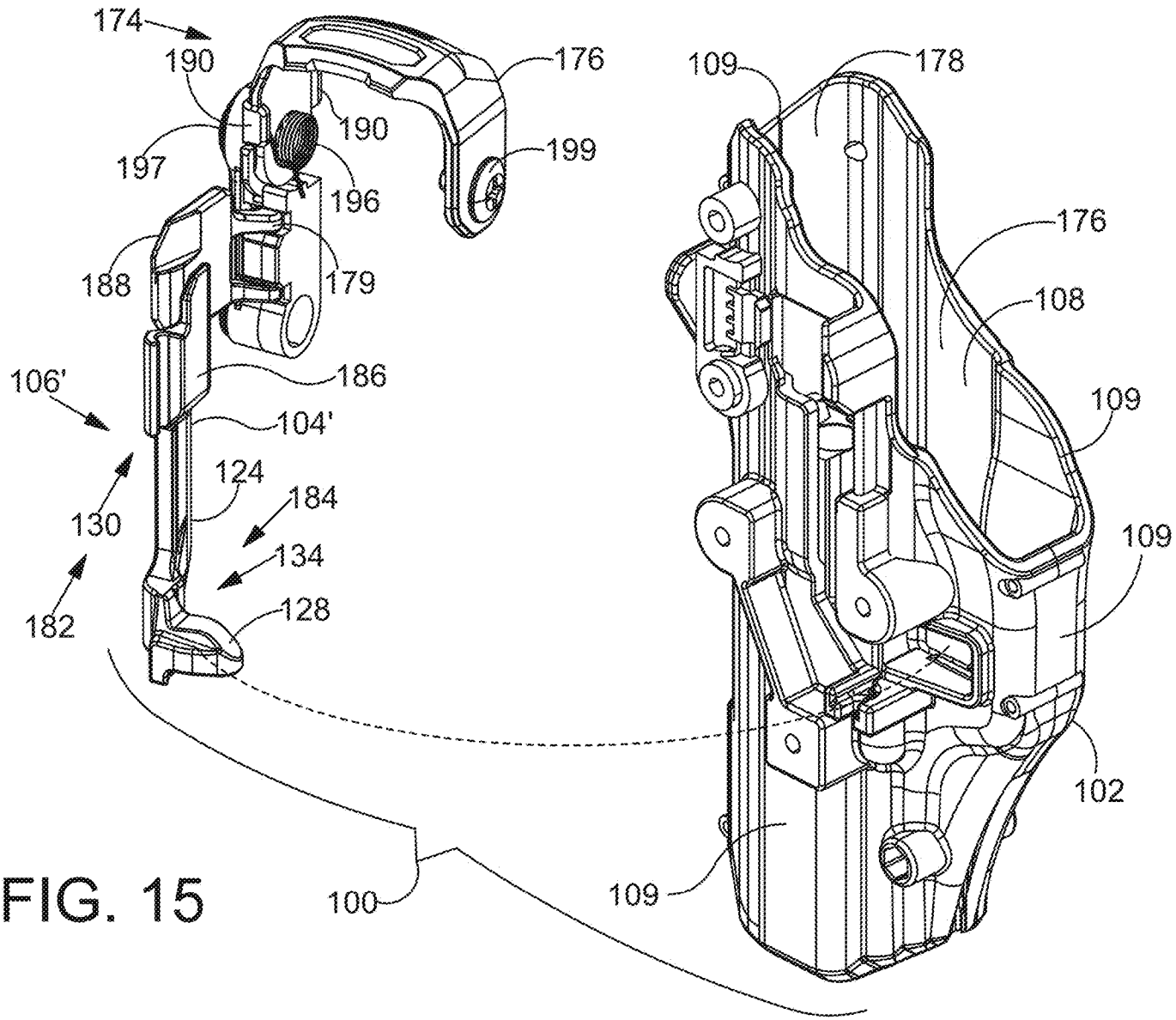
FIG. 15 is an exploded perspective view showing a holster body and two active handgun retention mechanisms operated by a single thumb button.
Figure 16:
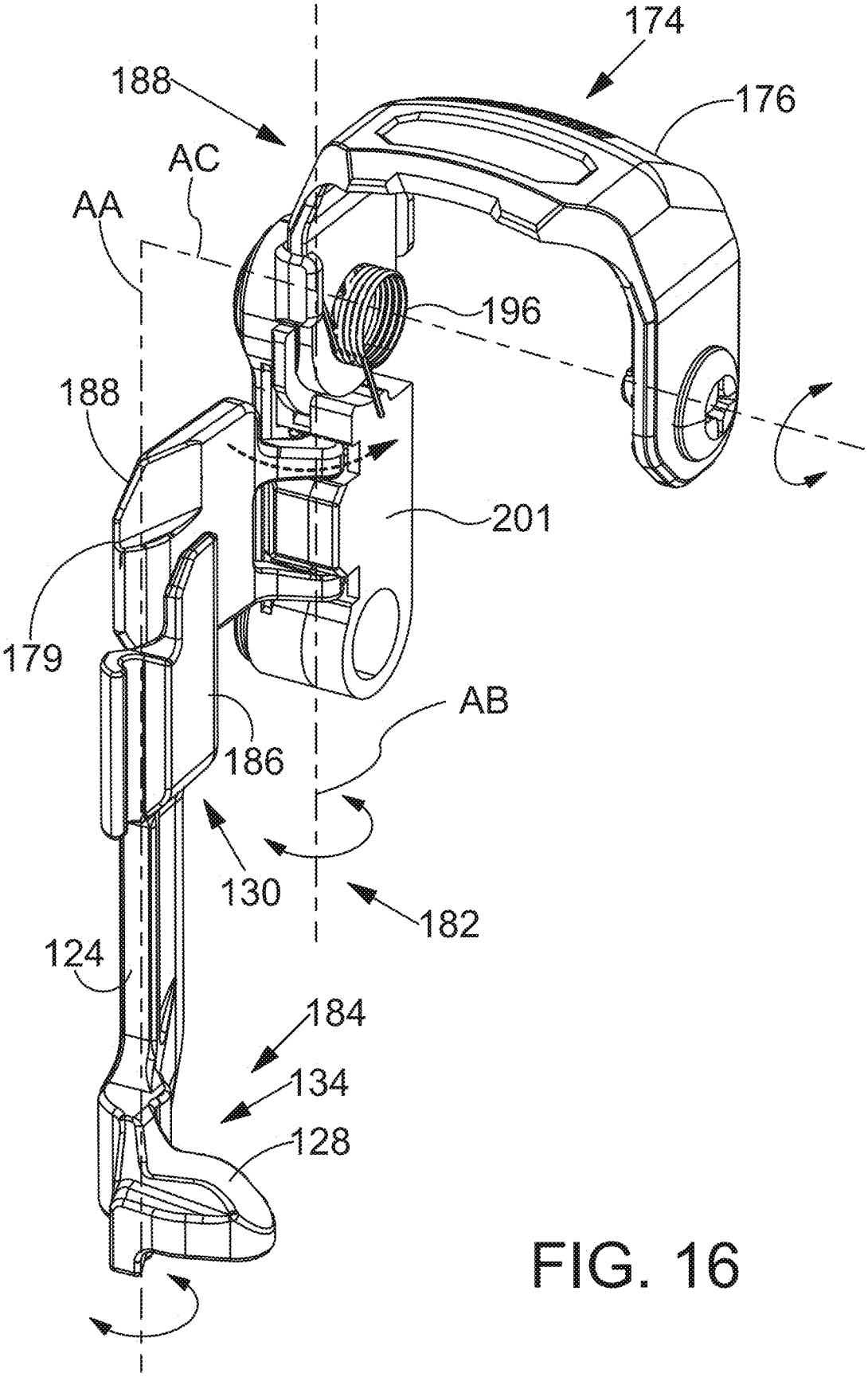
FIG. 16 is a perspective view showing retention mechanisms seen in the exploded perspective view of FIG. 15.
Figure 17:
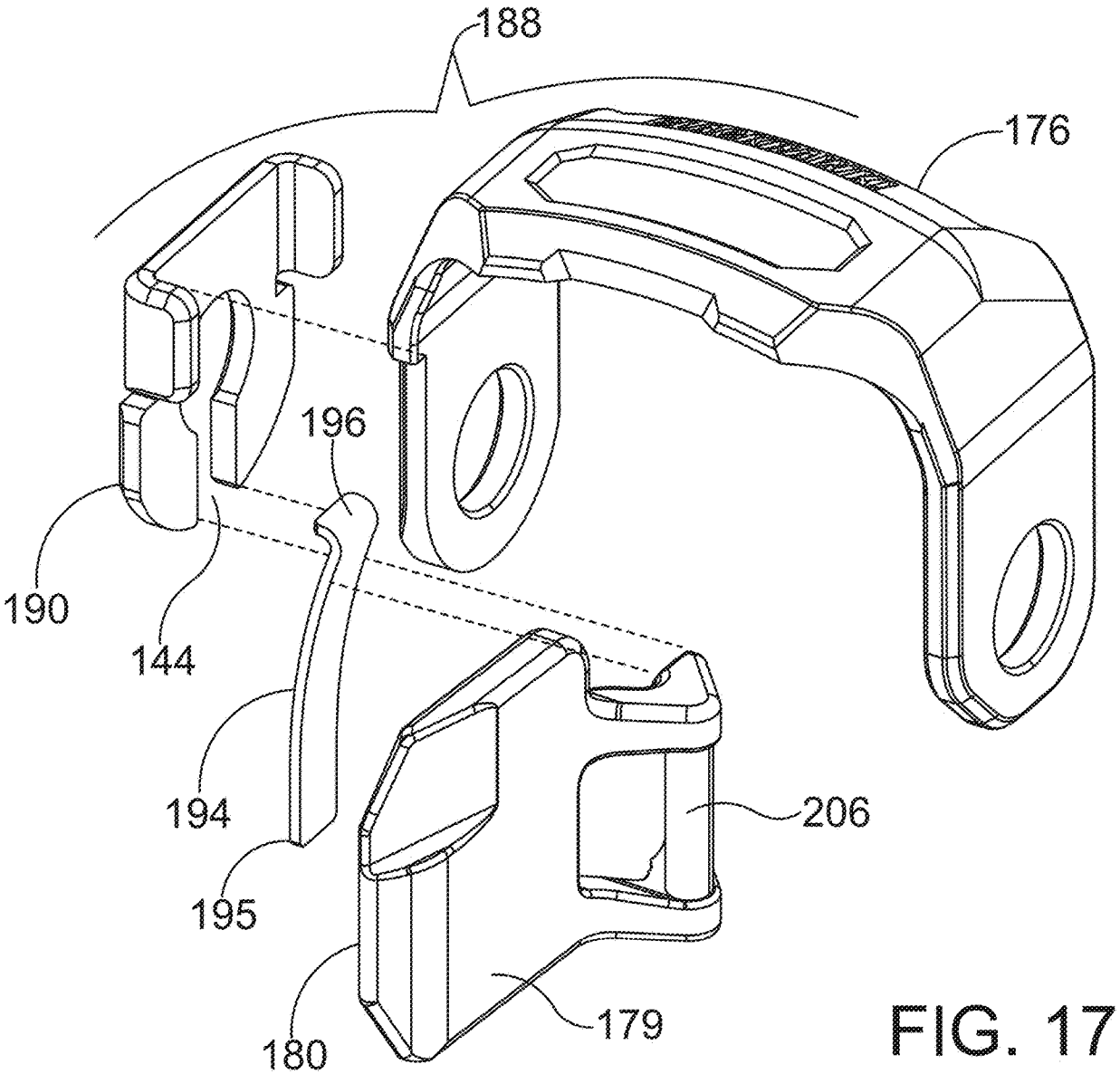
FIG. 17 is an exploded perspective view further illustrating some of the elements seen in the sub-assembly of FIG. 16.
Figure 18B:
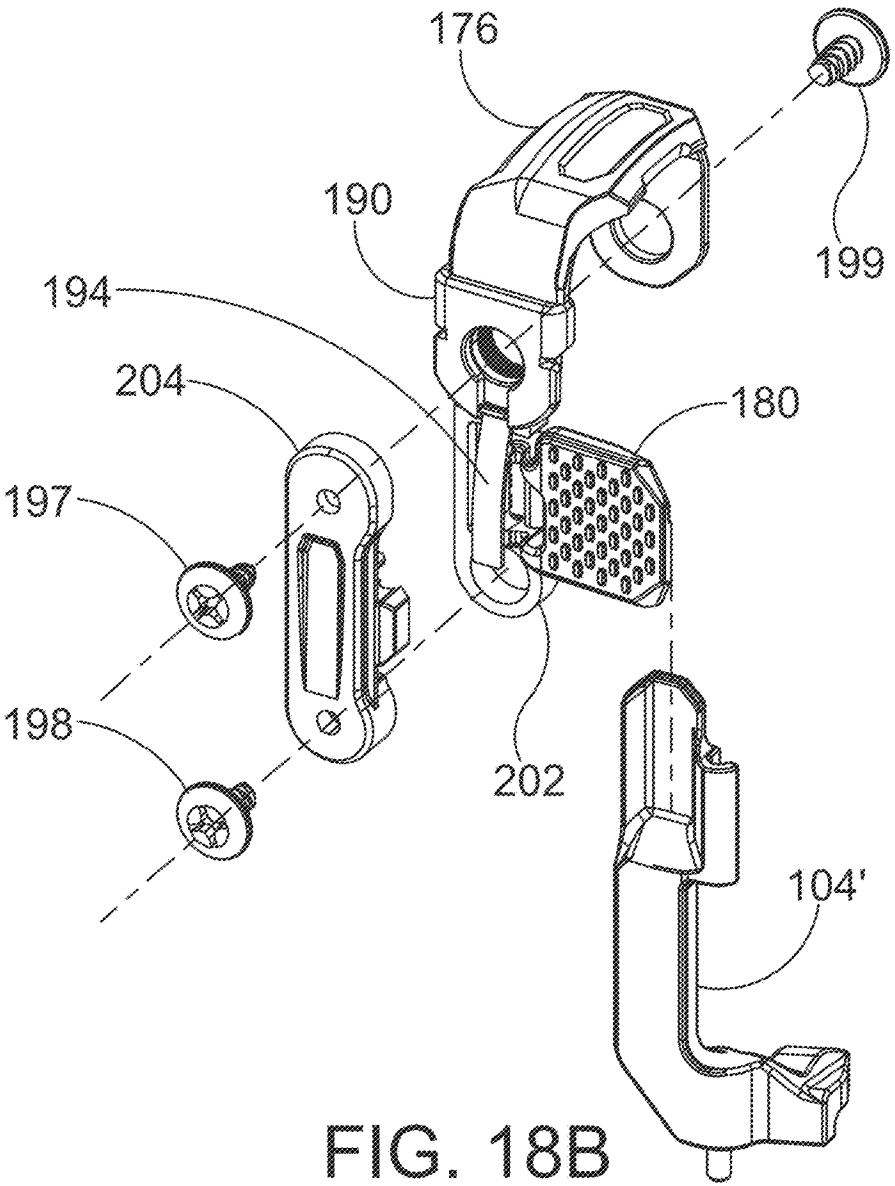
FIG. 18B is an exploded view of the components of FIG. 18A.
Figure 18A:
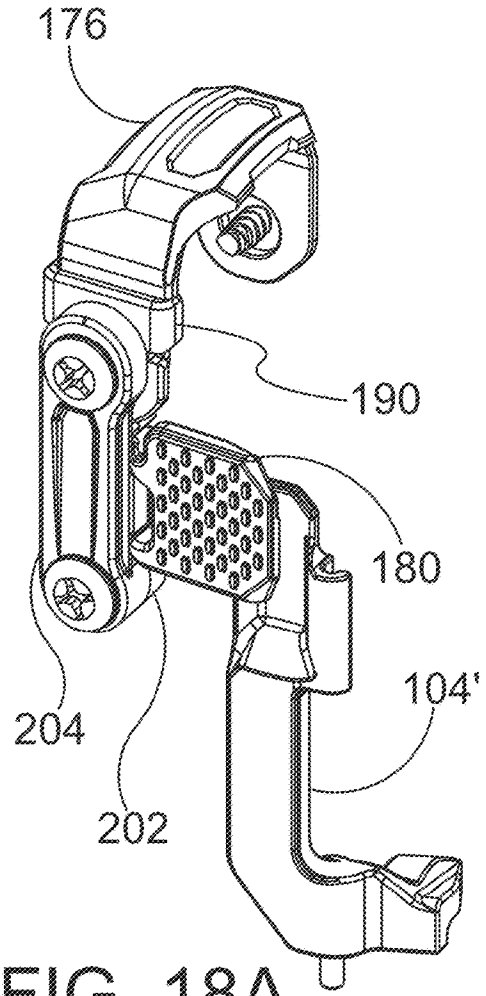
FIG. 18A is a perspective view of components of handgun retention mechanisms.
Figure 19:
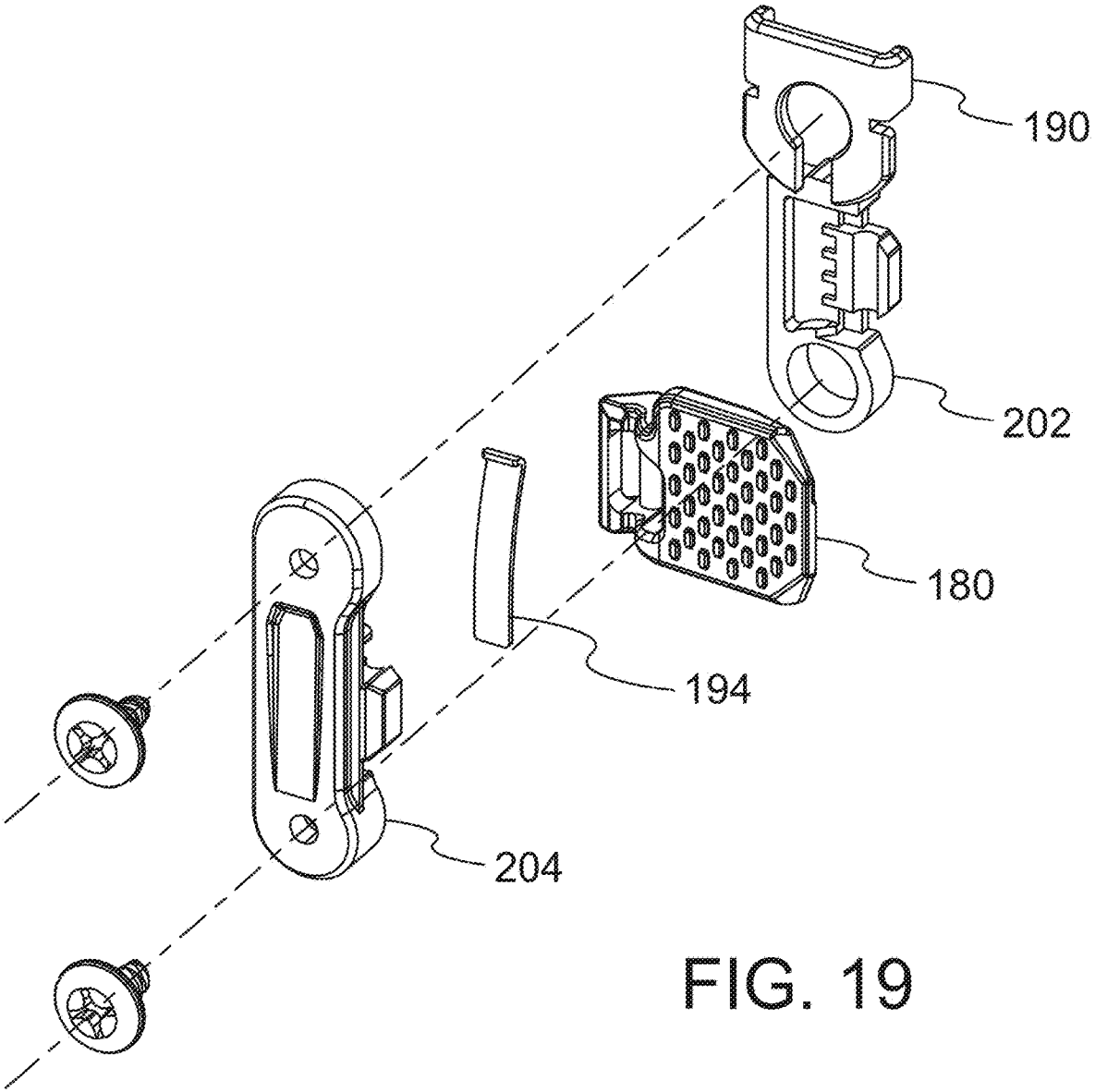
FIG. 19 is a further exploded view of components of the handgun retention mechanisms including a housing for securing the pivoting thumb button.
Figure 20:
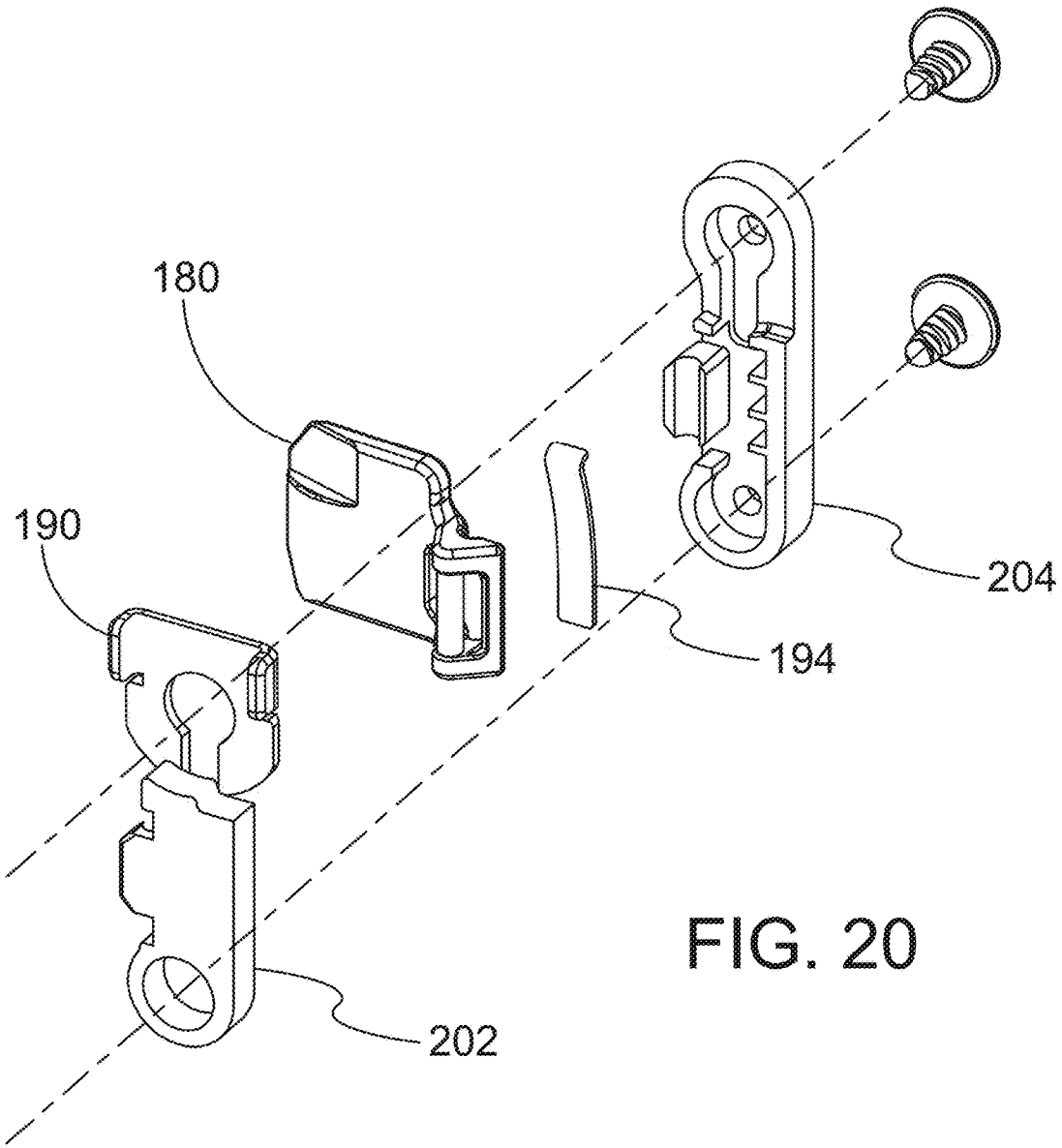
FIG. 20 is a further exploded view of components of the handgun retention mechanisms taken from the side opposite that of FIG. 19.
Figure 21:
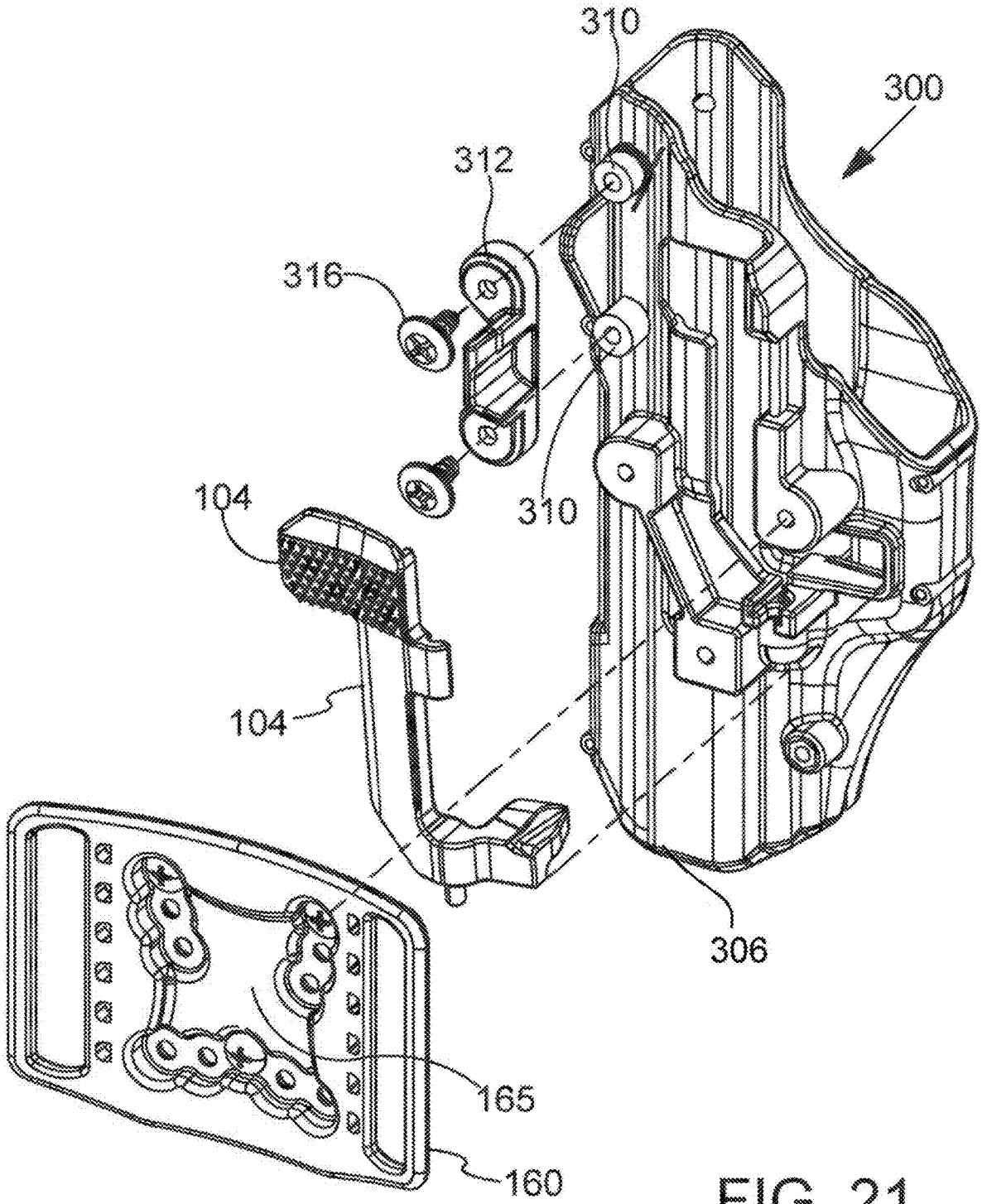
FIG. 21 is an exploded view of an embodiment of a holster with a with thumb button operating a single retention mechanism and a thumb button guard.

Referring to FIG. 21, another embodiment of a holster 300 comprising a holster body 306 similar to that of FIGS. 14 and 15 with a top or forward wall portion that mostly covers the slide of a handgun holstered therein, a pair of bosses 310 that can receive components of a second active handgun retention mechanism or, as illustrated in FIG. 21, a removable thumb button guard 312 secured to the bosses with fasteners 316. The lever 104 may be configured as discussed previously with respect to FIGS. 1-9 and has a thumb button 180. The plate portion 165 of a belt engaging member may capture the pivoting lever onto the holster body.

Figure 22:
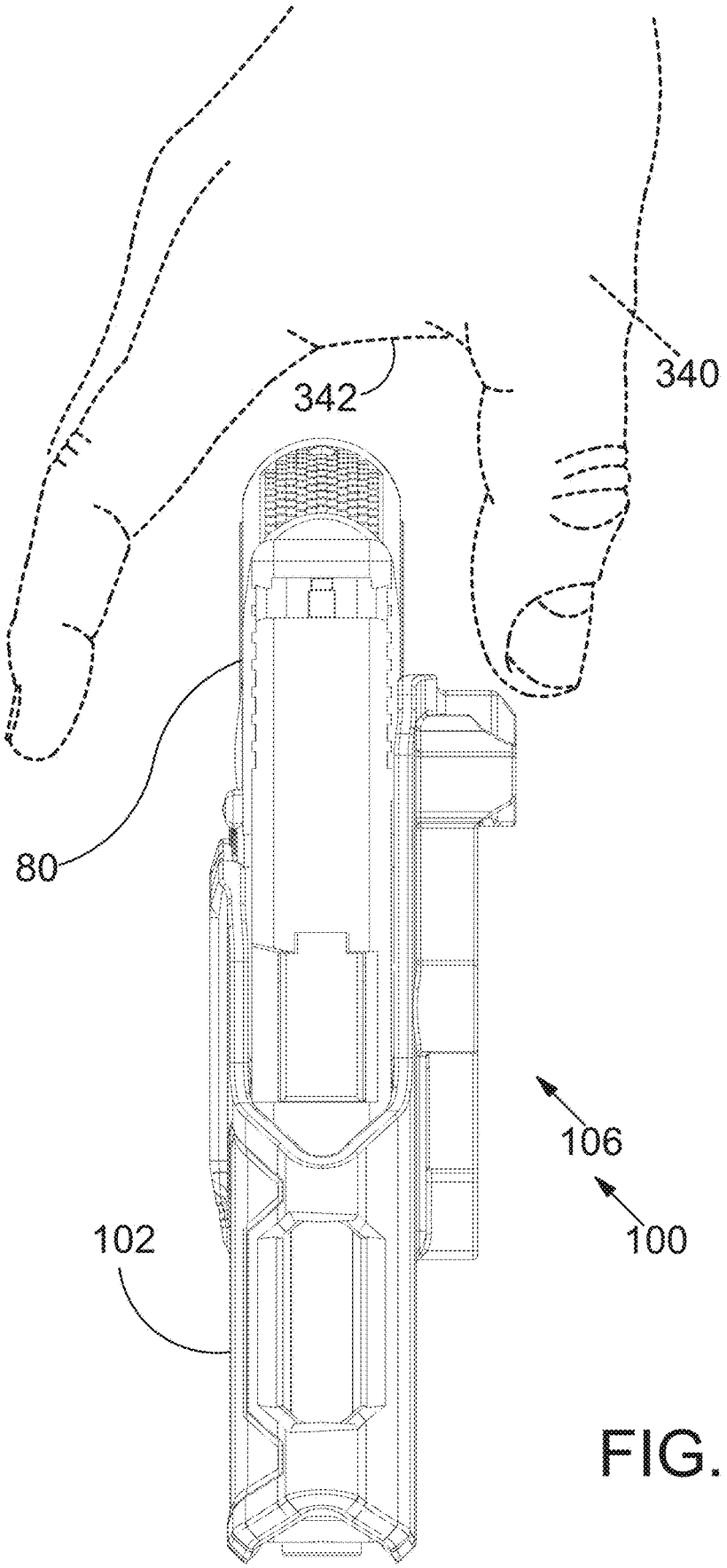
FIG. 22 is a plan view of a holster with a holstered handgun and a user's hand about the grasp the handgun.
Figure 23:
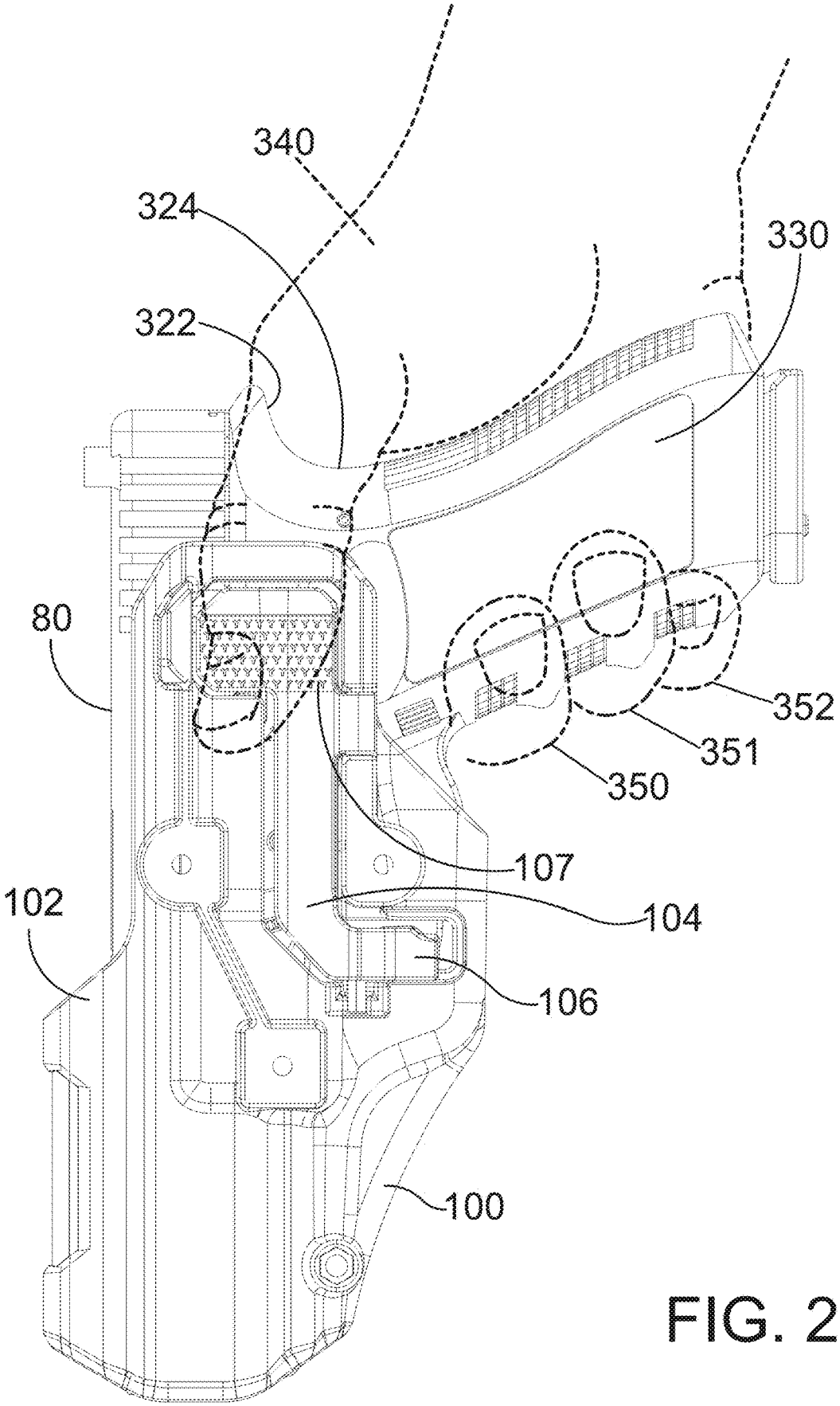
FIG. 23 is a plan view of a holster with a holstered handgun and a user's hand engaging the handgun.
Figure 24:
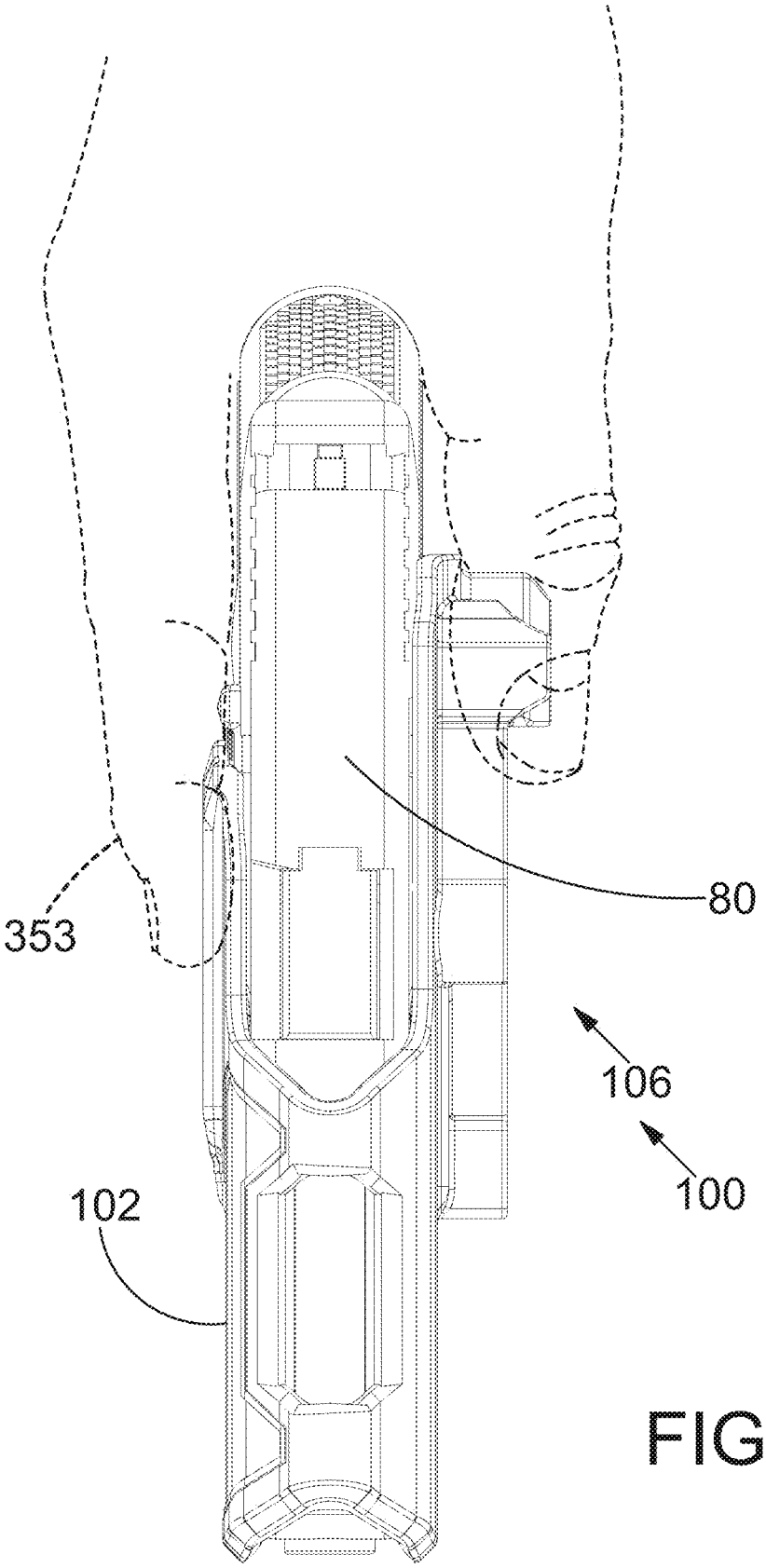
FIG. 24 is a plan view of a holster with a holstered handgun and a user's hand engaging the handgun.
Figure 25:
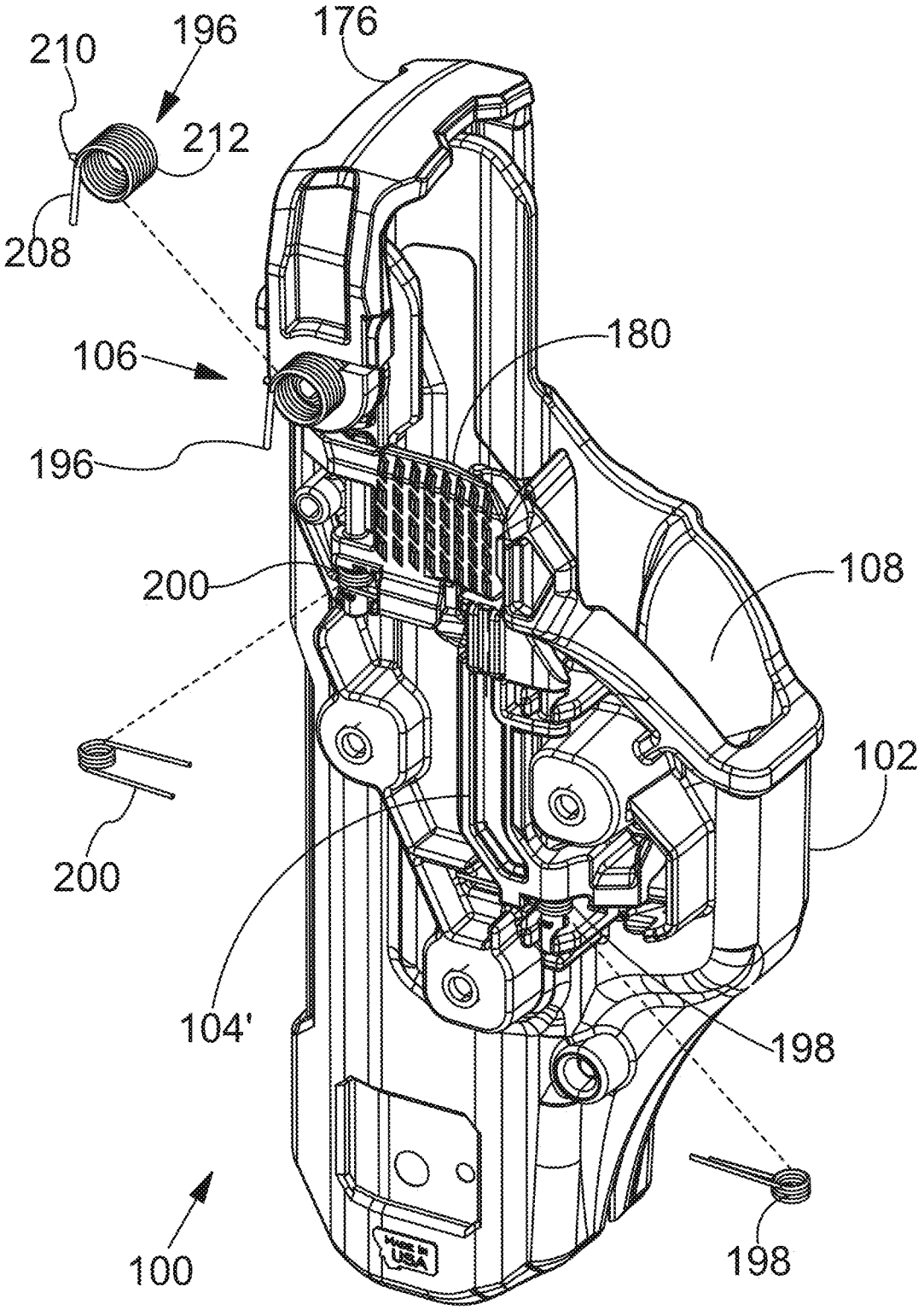
FIG. 25 is a perspective view showing a holster including a hood spring, a lever spring, and a tab spring. For purposes of illustration and explanation, the hood spring, the lever spring, and the tab spring are each illustrated a second time at a location spaced away from the holster.
Figure 26:
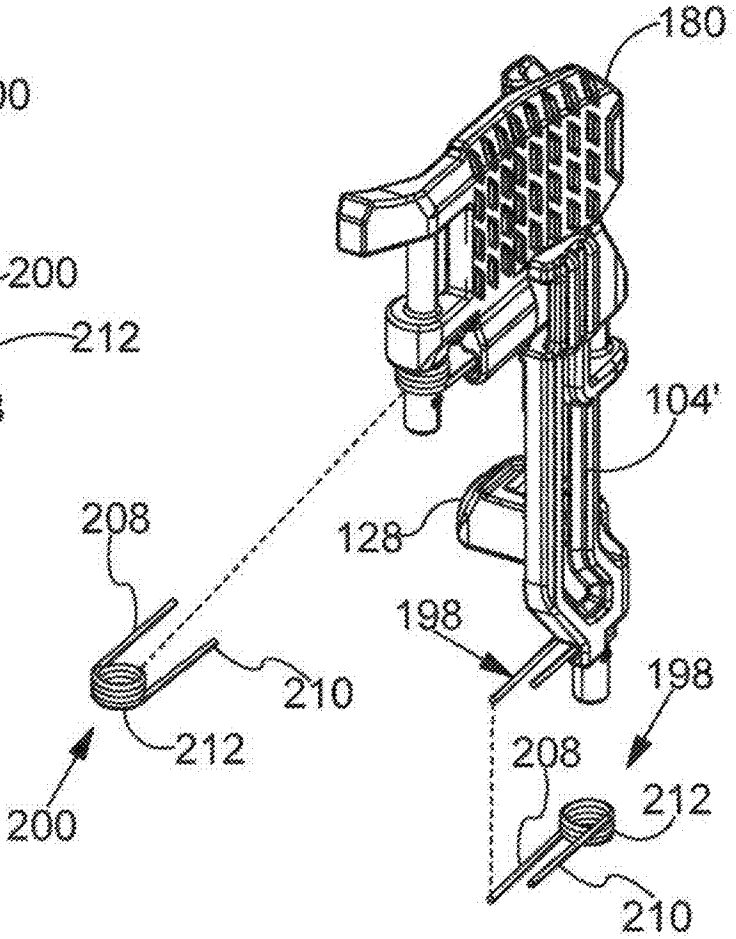
FIG. 26 is a perspective view showing an assembly including a lever, a lever spring, a tab, and a tab spring. For purposes of illustration and explanation, the lever spring and the tab spring are each illustrated a second time at a location spaced away from the assembly.
Figure 27:
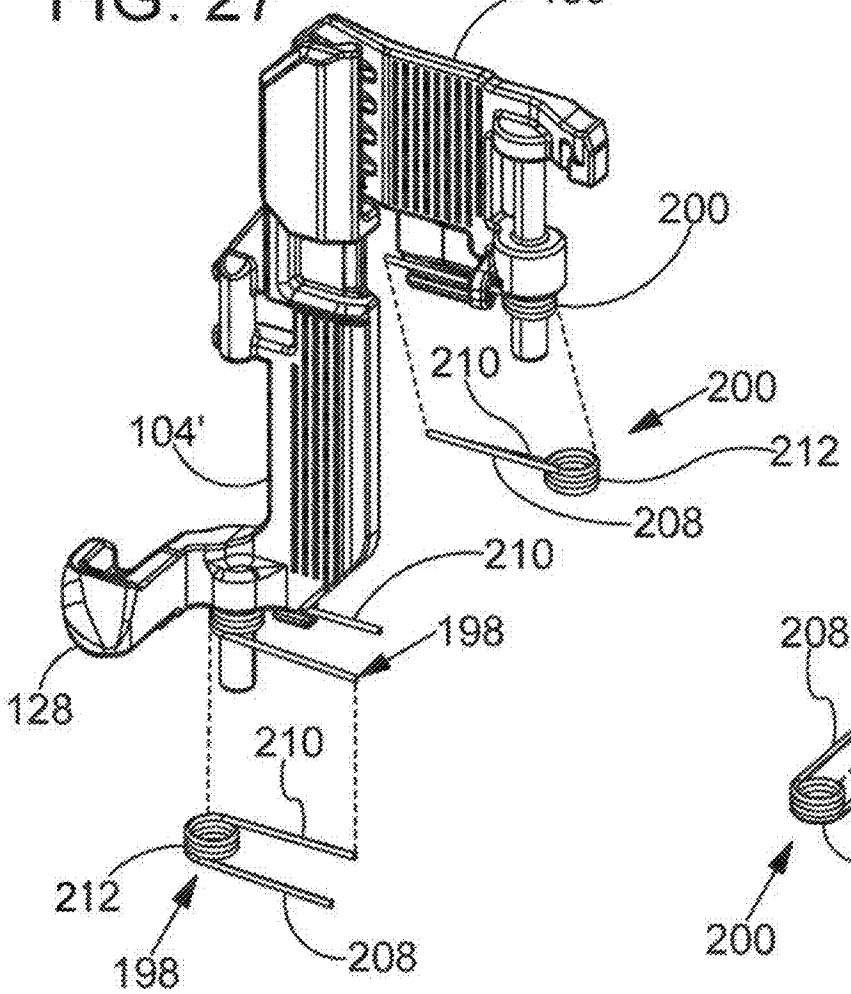
FIG. 27 is a perspective view of an assembly including a lever, a lever spring, a tab, and a tab spring. For purposes of illustration and explanation, the lever spring and the tab spring are each illustrated a second time at a location spaced away from the assembly.
Figure 29A:
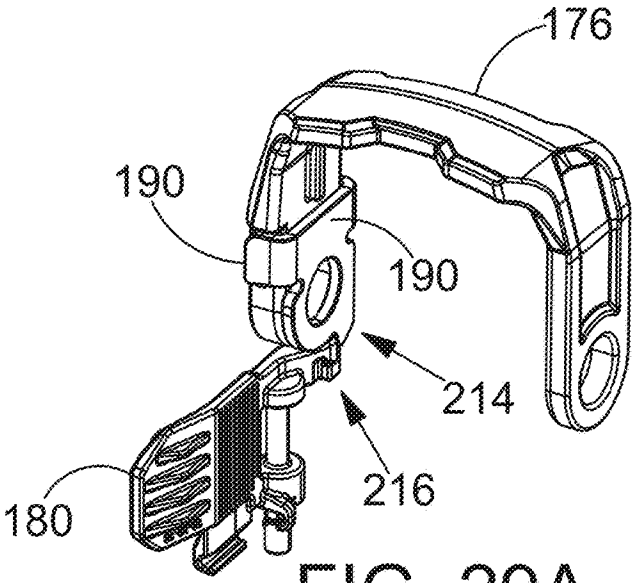
FIGS. 29A and 29B are perspective views showing an assembly including a hood assembly and a thumb receiving tab.
Figure 29B:
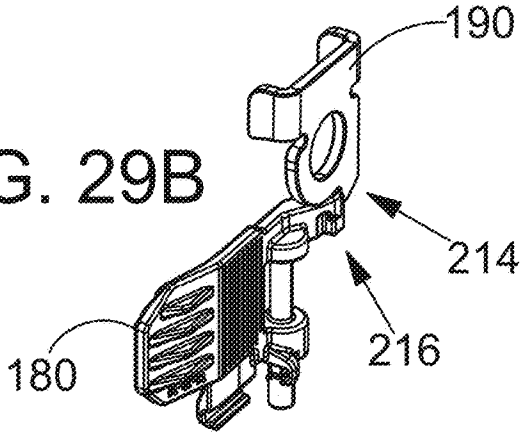
Figure 28A:
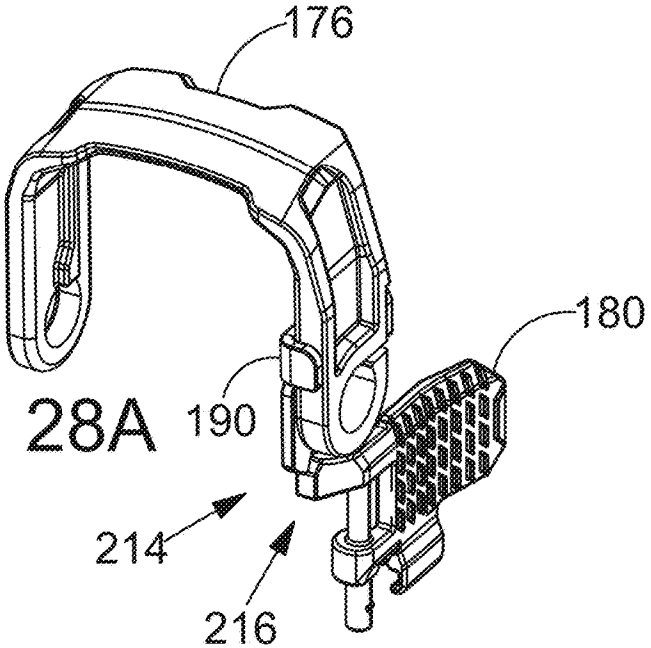
FIGS. 28A and 28B are perspective views showing an assembly including a hood assembly and a thumb receiving tab.
Figure 28B:
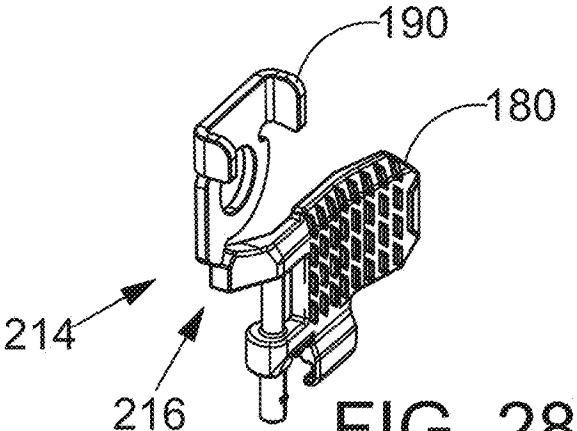
Figure 31A:
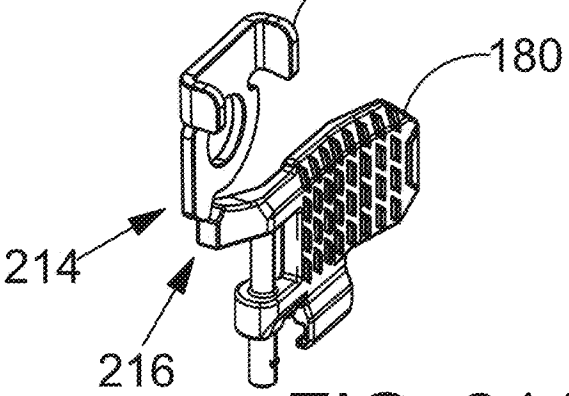
FIG. 31A is a perspective view of the assembly shown in FIG. 30A. In the embodiments of FIGS. 30A and 31A, the hood assembly part is in a handgun retaining position.
Figure 31B:
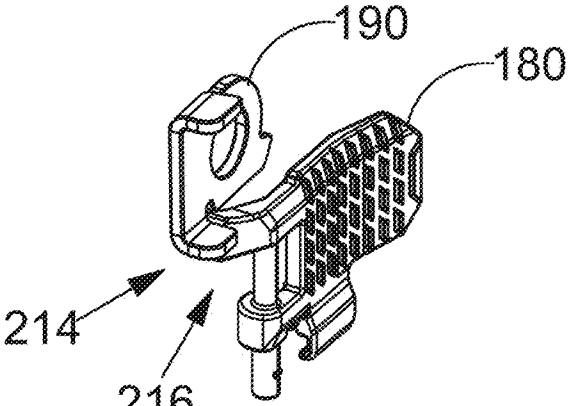
FIG. 31B is a perspective view of the assembly shown in FIG. 30B. In the embodiments of FIGS. 30B and 31B, the hood assembly part is in a handgun releasing position.
Figure 30A:
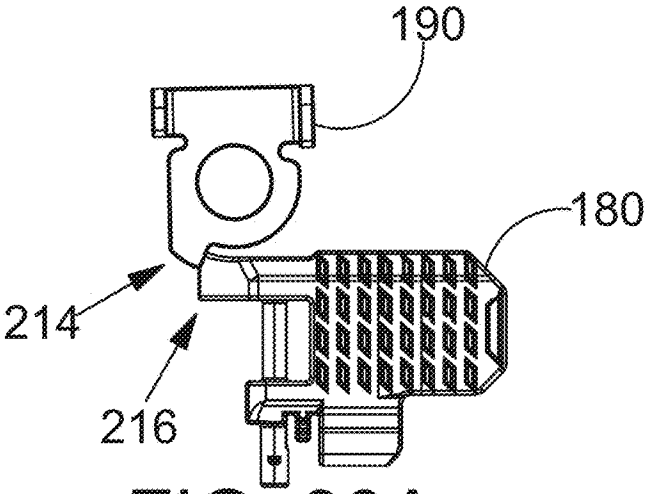
FIG. 30A is a plan view showing a hood assembly part having a lug portion and a thumb receiving tab having a protrusion portion that selectively engages the lug portion of the hood assembly part.
Figure 30B:
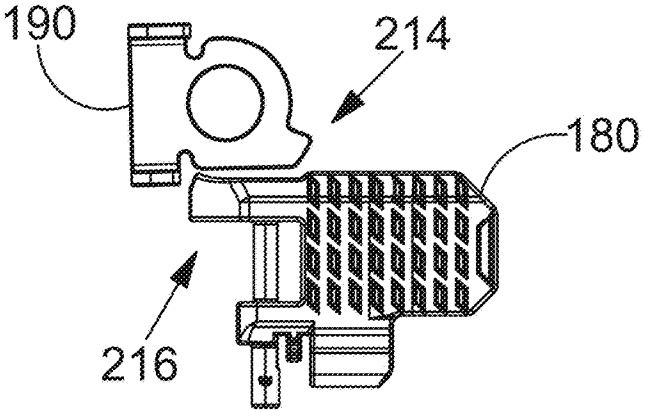
FIG. 30B is a plan view showing a hood assembly part having a lug portion and a thumb receiving tab having a protrusion portion that selectively engages the lug portion of the hood assembly part.
Figure 32A:
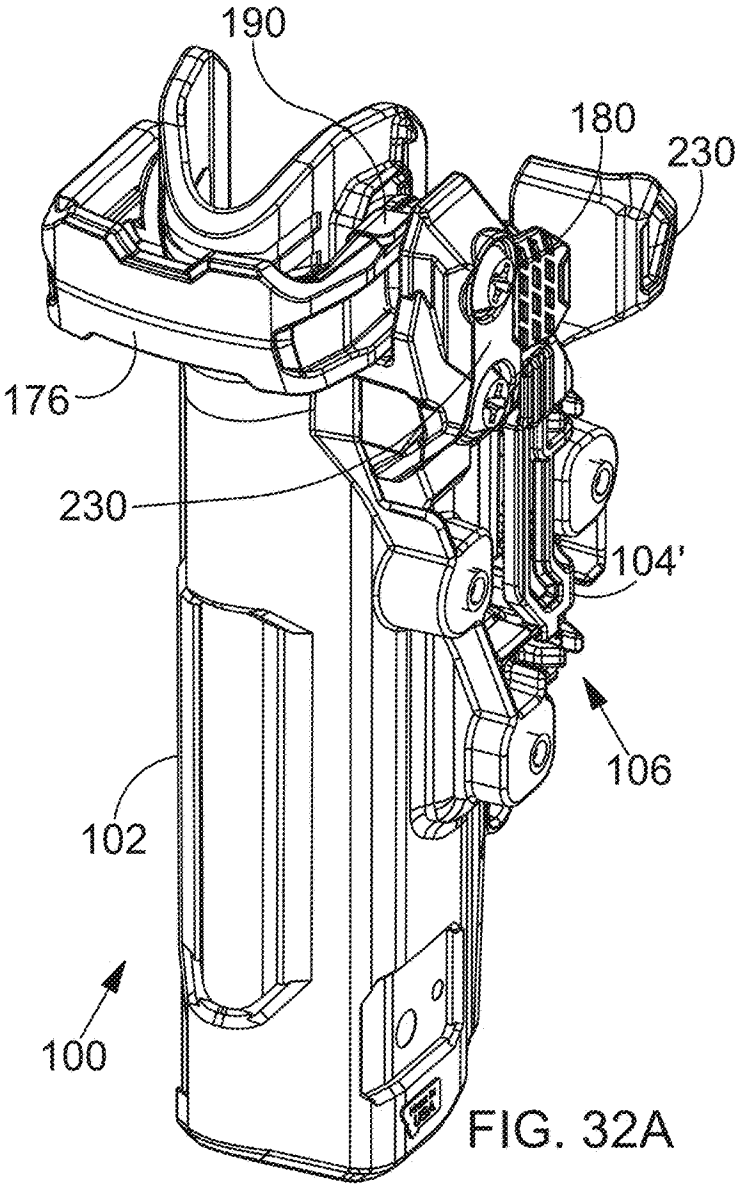
FIG. 32A is a perspective view showing a holster in accordance with the detailed description.
Figure 32B:
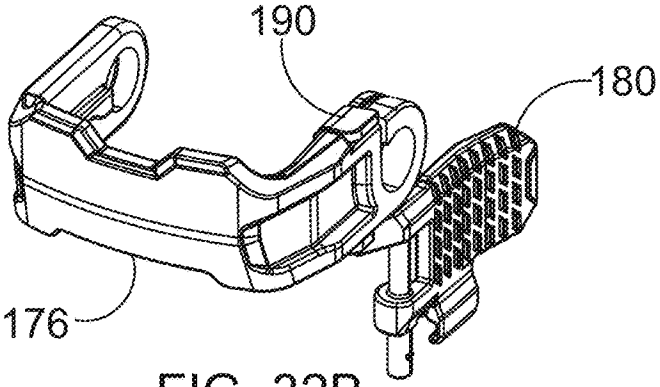
FIG. 32B is a perspective view showing selected parts from the holster shown in FIG. 32A. The parts shown in FIG. 32B include a U-shaped shroud, a bracket and a finger receiving tab.
Figure 32C:
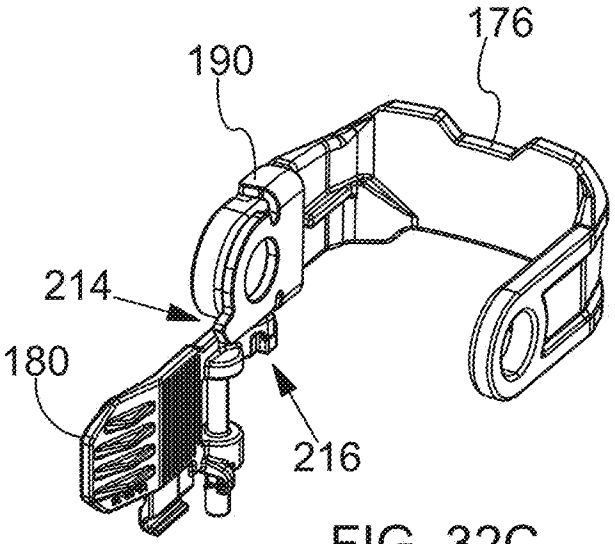
FIG. 32C is a perspective view further illustrating the parts shown in FIG. 32B.

Referring to FIGS. 22-24, the sequence of gripping and drawing a handgun 80 from a holster 100 having a optimally positioned thumb button 107 is illustrated. The handgrip 330 of the handgun 80 has a backstrap 322 region with a backstrap recess 324 that receives the user's hand 340 initially by the webbing 342 of the hand contacting the recess 324. The user will then wrap his middle, ring, and pinky fingers 350, 351, 352 around the grip as shown in FIG. 23 and will have his forefinger 353 in a longitudinal recess for said finger on the side of the holster opposite the thumb button. The thumb 354 will naturally be positioned at the thumb button 107 such that a normal grasping action of the grip, consistent with the "master grip" will depress the thumb button 107 and actuate the retention mechanism 104. Referring to FIGS. 22-25, 36A, 36B, 38A, 38B and 40-43, the master grip and ergonomics are further facilitated in embodiments where the thumb button 180 is positioned with no holster body directly rearward of the rearward margin of the thumb button 180, as well as no holster body portions below the thumb button 180. In use, as the handgun 80 is gripped prior to actuation of the thumb button 180, the user's thumb is in the natural gripping position at the surface of the thumb button 180, the thumb button 180 is depressed, coincident with grasping the handgun 80, and as the handgun 80 is withdrawn, the user's thumb slides off of the thumb button 180 into immediate contact with the handgun 80. That is, there is no engagement with the exterior surface of the holster body 102 by the user's thumb either during actuation of the release of the retention mechanism or as the handgun 80 is withdrawn. In that the thumb button 180 is positioned in close proximity to the surface of the handgun 80, the thumb movement inward as the thumb transitions from engagement with the thumb button 180 to engagement with the body of the handgun 80 is minimal.

Referring to FIGS. 25-27C, in embodiments, the holster includes the hood spring 196, a lever spring 198 and a tab spring 200. In embodiments, each spring comprises a length of wire, the wire of the spring forming a first leg 208, a second leg 210 and a coil 212 disposed between the first leg 208 and the second leg 210. In embodiments, the first leg 208 of the hood spring 196 is fixed relative to the holster body 102 and the second leg 210 of the hood spring 196 is seated against the hood assembly 188 so that the U-shaped shroud 176 is biased to pivot toward the release position. In embodiments, the lever spring 198 is positioned and adapted to bias the lever 104 to rotate toward the handgun trigger guard capture position. In embodiments, the first leg 208 of the lever spring 198 is seated against to the holster body 102 and the second leg 210 of the lever spring 198 is seated against the lever 104. In embodiments, the tab spring 200 is positioned and adapted to bias the thumb receiving tab 180 to rotate in a direction that moves a distal end of the thumb receiving tab 180 away from the holster body 102. In embodiments, the first leg 208 of the tab spring 200 is seated against to the holster body 102 and the second leg 210 of the tab spring 200 is seated against the thumb receiving tab 180.

Referring to FIGS. 28A-31B, in embodiments, the U-shaped shroud 176 is part of a hood assembly 188. In embodiments, a bracket 190 of the hood assembly 188 includes a lug portion 214 and the thumb receiving tab 180 includes a protrusion portion 216 that engages the lug portion 214 of the hood assembly 188 while the U-shaped shroud 176 is in the handgun retaining position. In embodiments, the holster 100 further includes a hood spring 196 that biases the U-shaped shroud 176 to pivot toward the release position. In embodiments, the hood spring 196 biases the lug portion 214 of the hood assembly 188 against the protrusion portion 216 of the thumb receiving tab 180 while the U-shaped shroud 176 is in the handgun retaining position. In embodiments, rotation of the thumb receiving tab 180 through a first range of rotary motion causes the protrusion portion 216 of the thumb receiving tab 180 to disengage from the lug portion 214 of the hood assembly 188. In embodiments, rotation of the thumb receiving tab 180 through a second range of rotary motion causes the thumb receiving tab 180 to engage the tab receiving portion of the lever 104 causing at least a portion of the trigger guard retaining portion of the lever 104 to be withdrawn from the trigger guard receiving portion of the holster body 102.

Figure 33B:
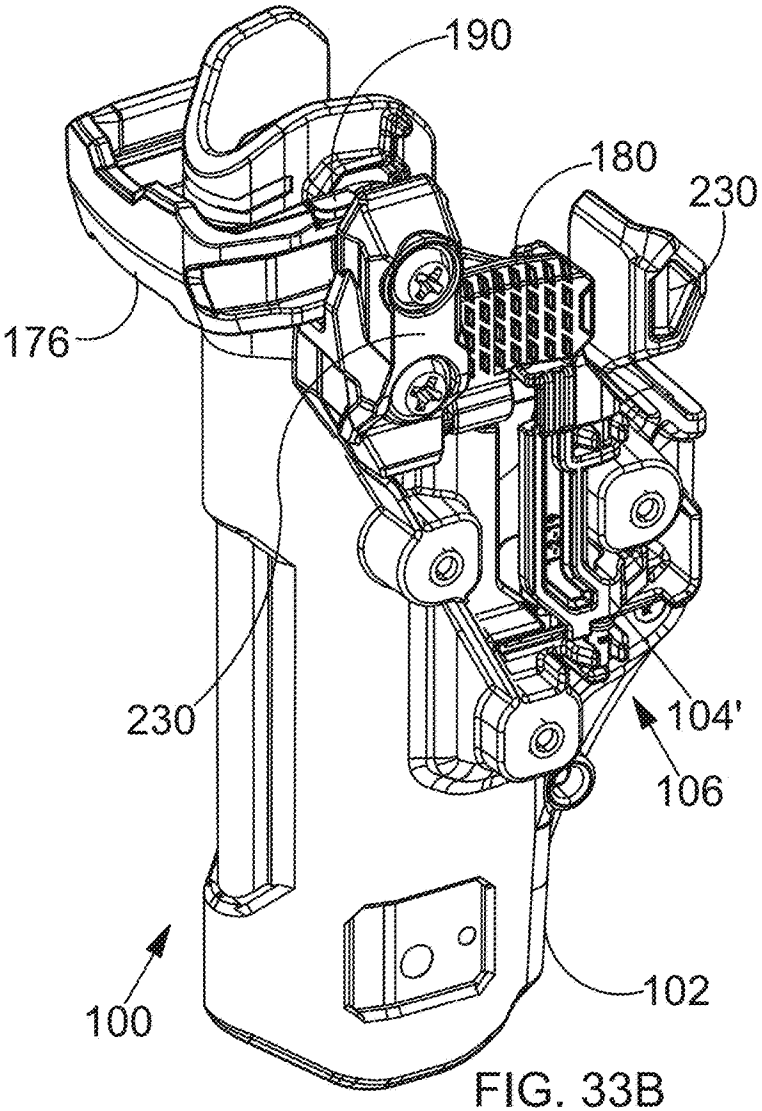
FIGS. 33A and 33B are two perspective views showing a holster including a U-shaped shroud. In the embodiment of FIG. 33A, the U-shaped shroud is in a handgun retaining position. In the embodiment of FIG. 33B, the U-shaped shroud is in a release position.
Figure 33A:
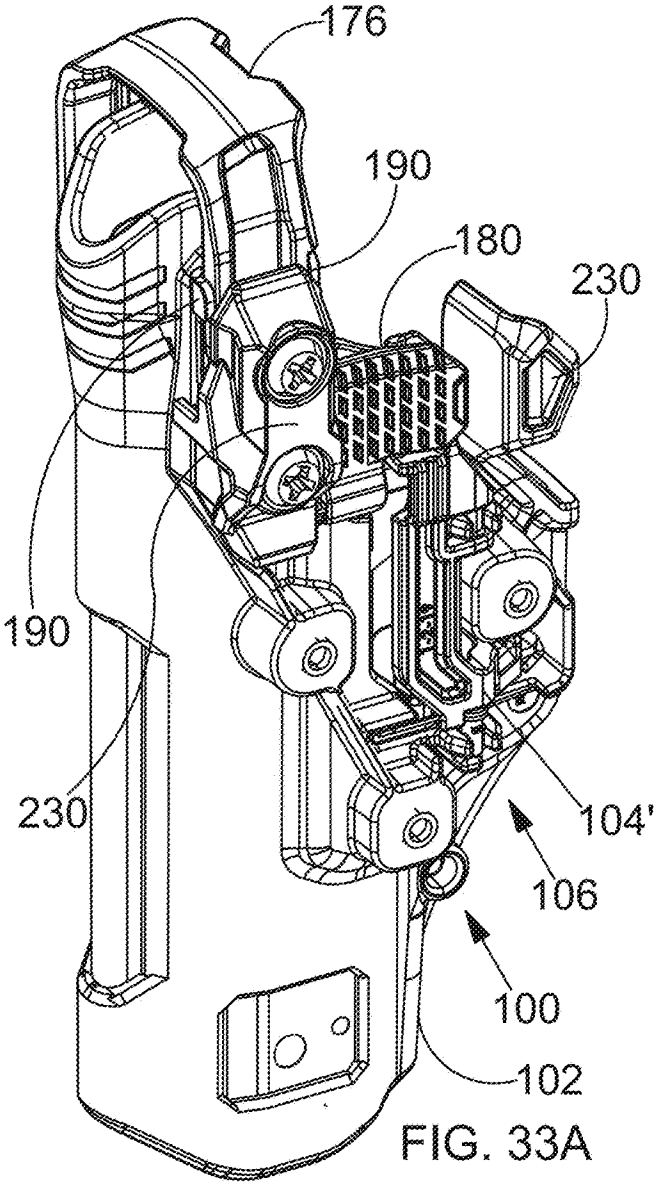
Figure 34B:
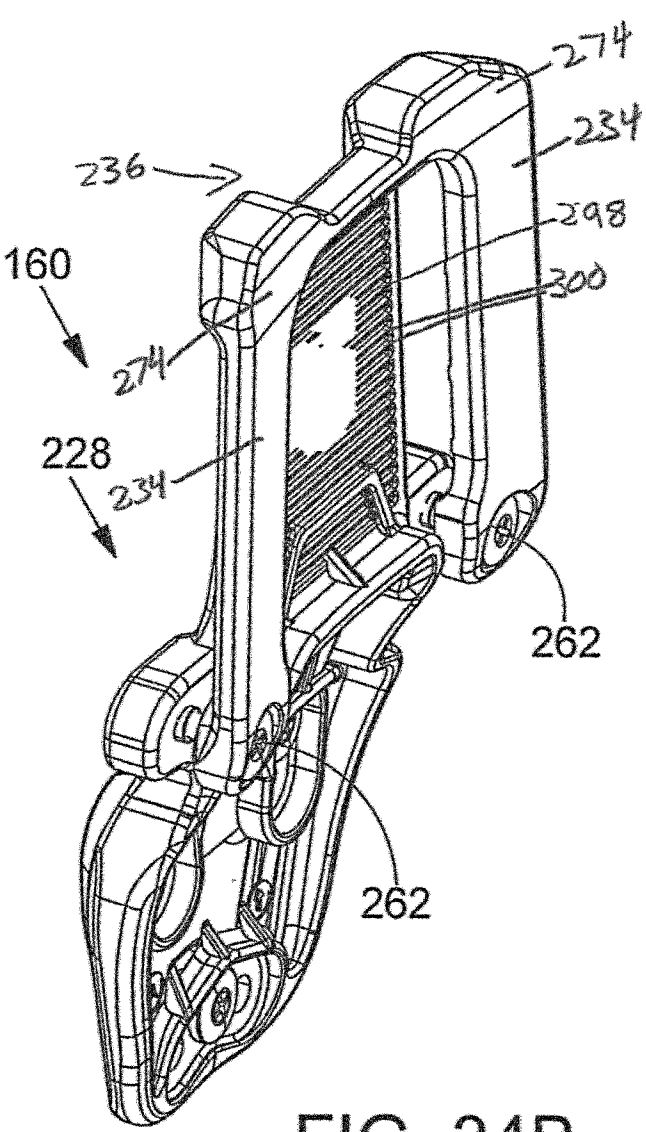
FIGS. 34A and 34B are perspective views of a belt engaging member.
Figure 34A:
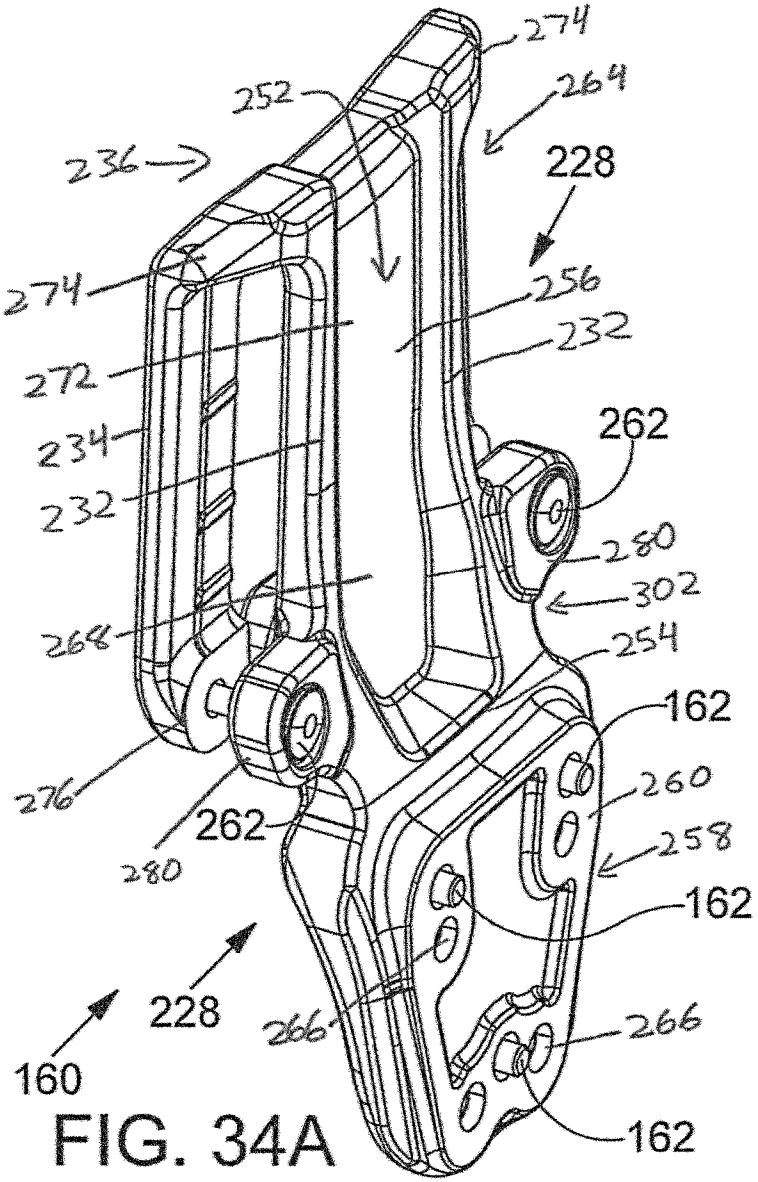
Figure 35D:
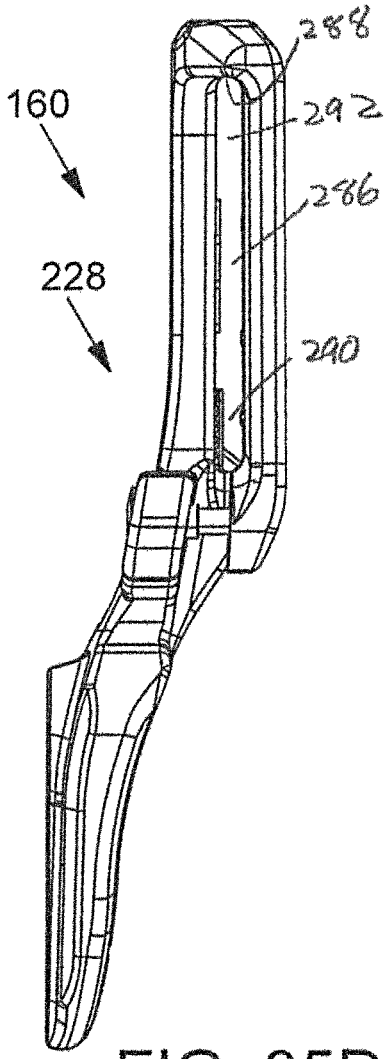
FIG. 35D is a rear view of the belt engaging member shown in FIGS. 34A and 34B.
Figure 35E:
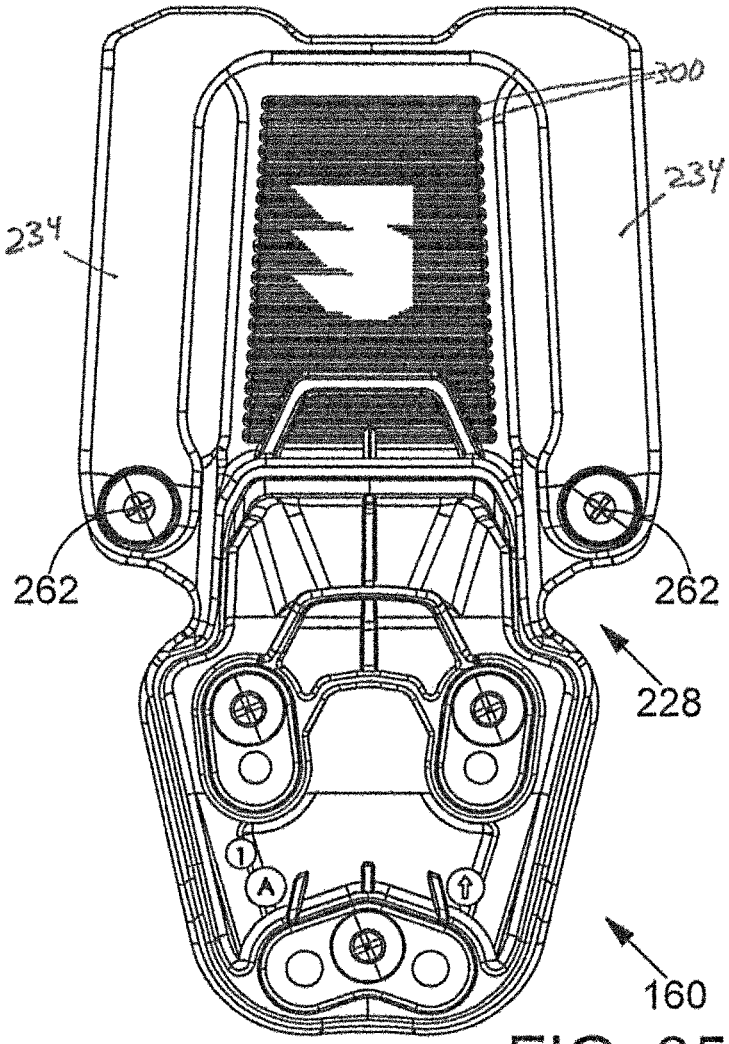
FIG. 35E is a left side view of the belt engaging member shown in FIGS. 34A and 34B.
Figure 35F:
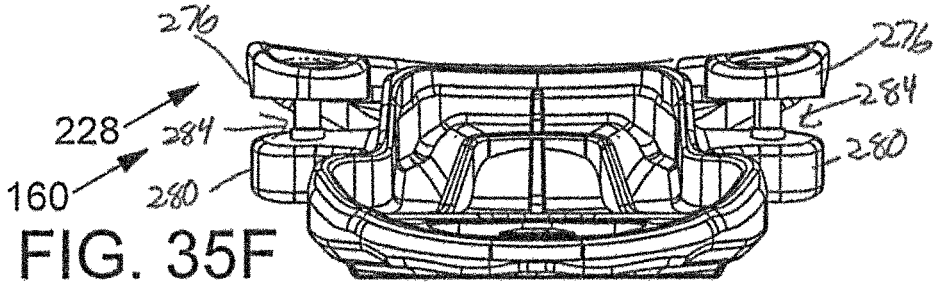
FIG. 35F is a bottom view of the belt engaging member shown in FIGS. 34A and 34B.
Figure 36B:
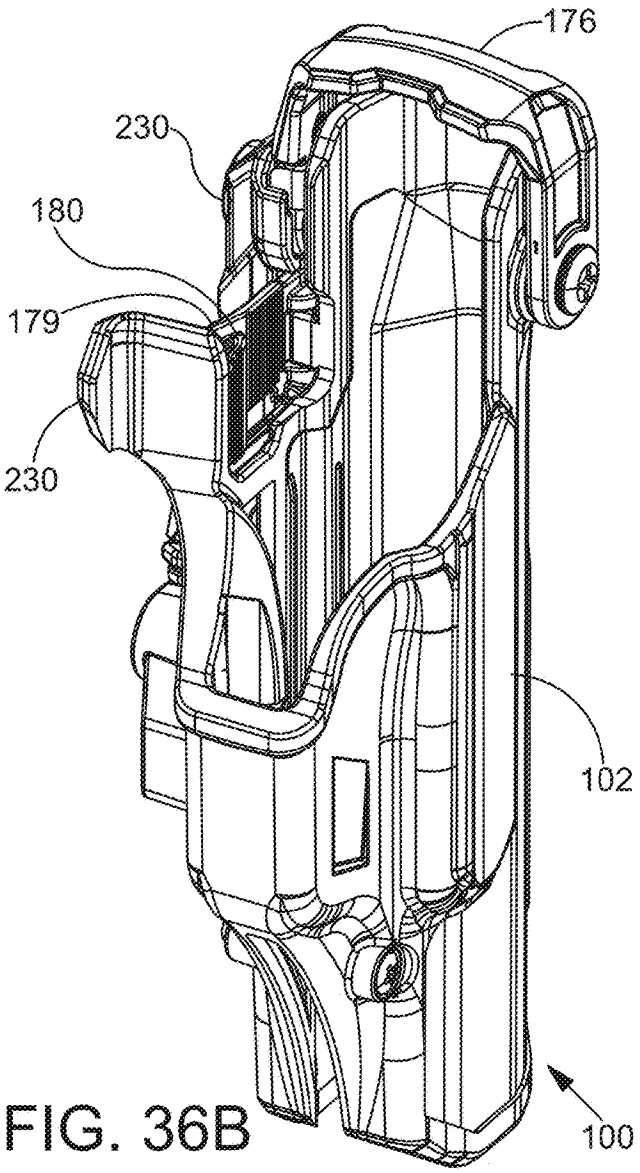
FIGS. 36A and 36B are two perspective views showing a holster having a first handgun retention mechanism including a pivotable lever and a second handgun retention mechanism including a U-shaped shroud. In the embodiment of FIGS. 36A and 36B, the U-shaped shroud is in a handgun retaining position.
Figure 36A:
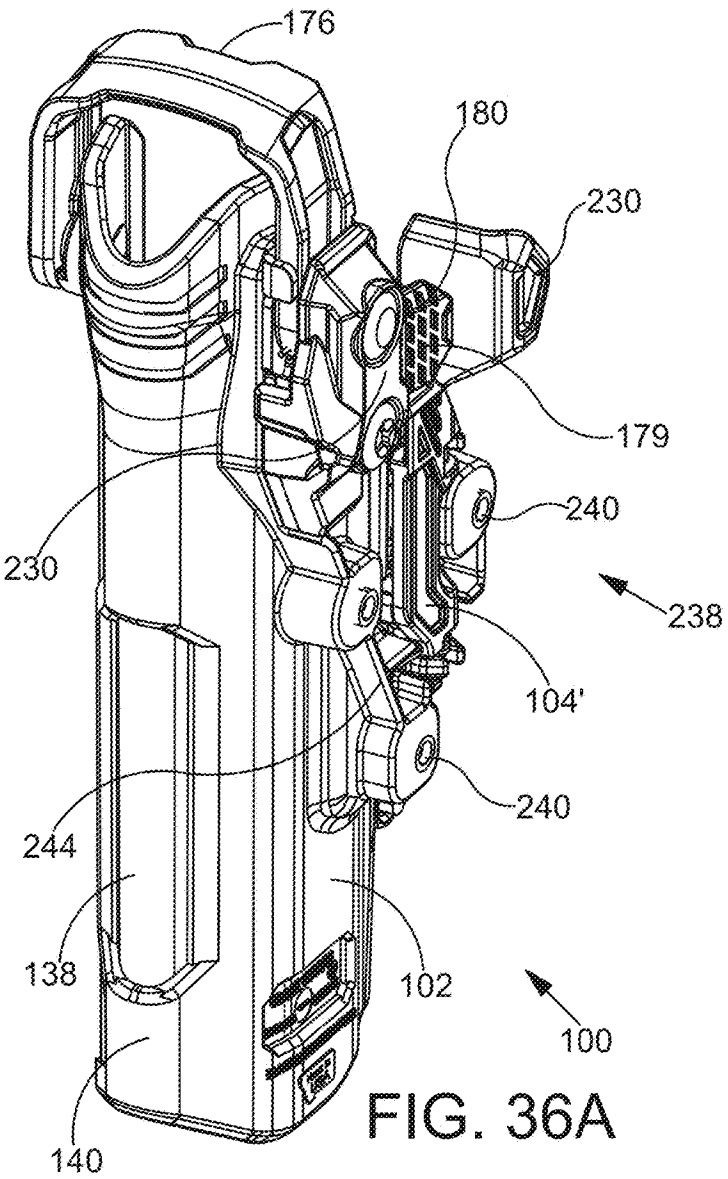
Figure 37C:
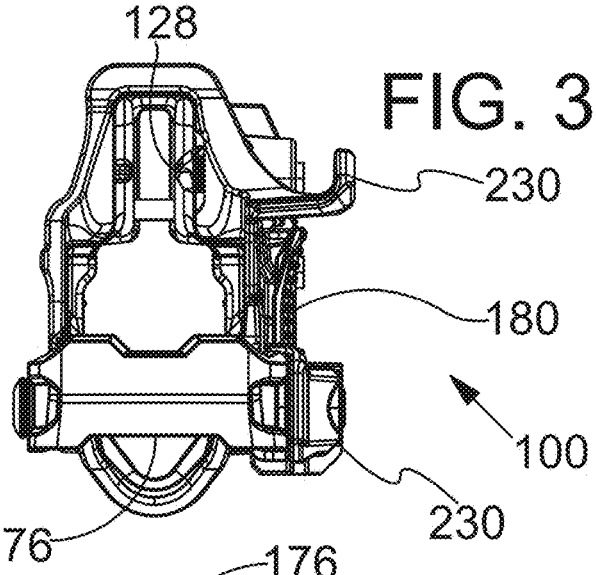
FIG. 37C is a top view of the holster shown in FIGS. 36A and 36B.
Figure 37A:
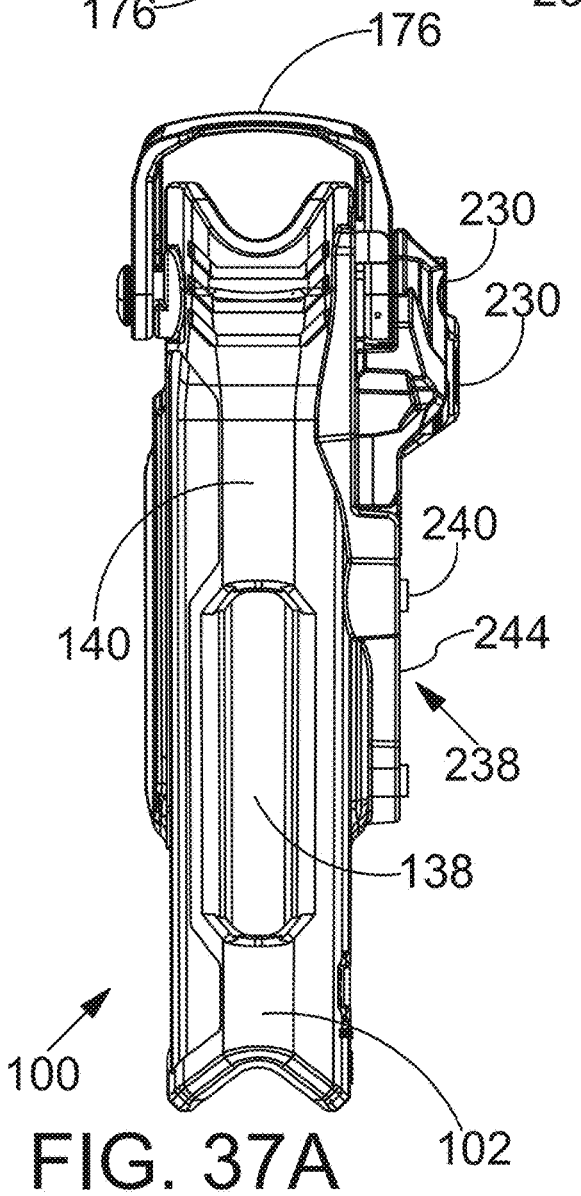
FIG. 37A is a front view of the holster shown in FIGS. 36A and 36B.
Figure 37B:
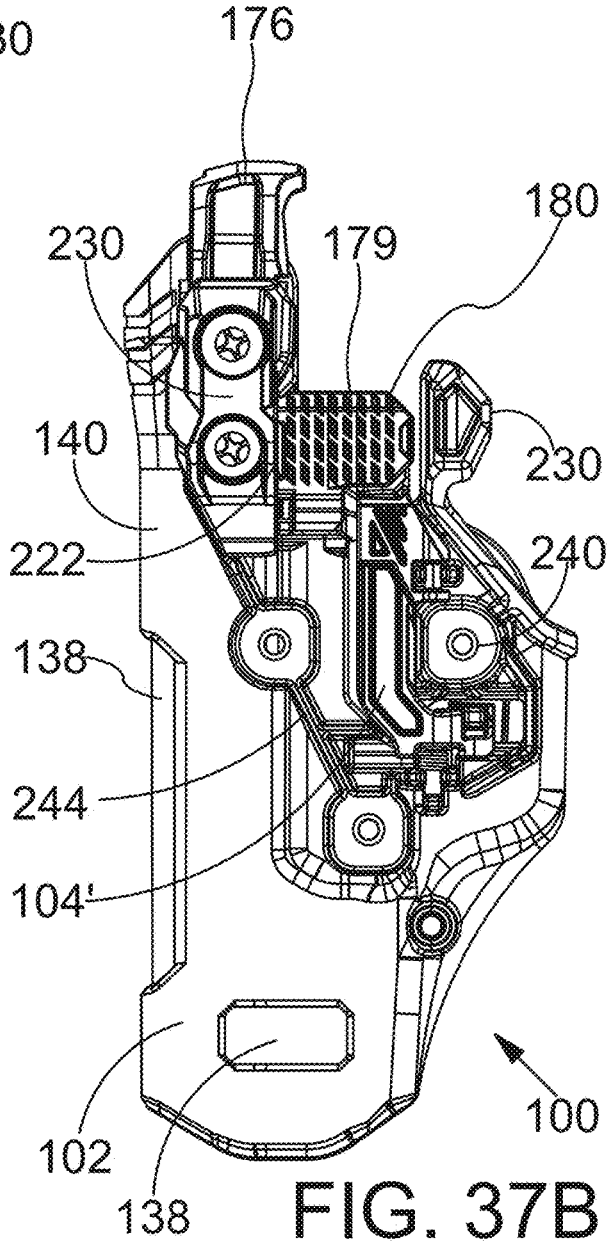
FIG. 37B is a right side view of the holster shown in FIGS. 36A and 36B.
Figure 37D:
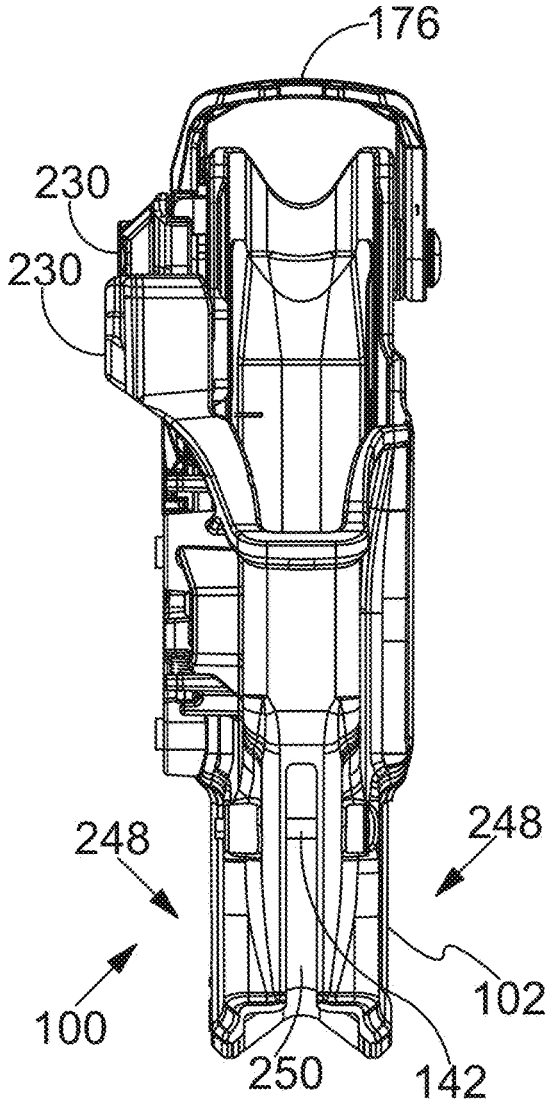
FIG. 37D is a rear view of the holster shown in FIGS. 36A and 36B.
Figure 37E:
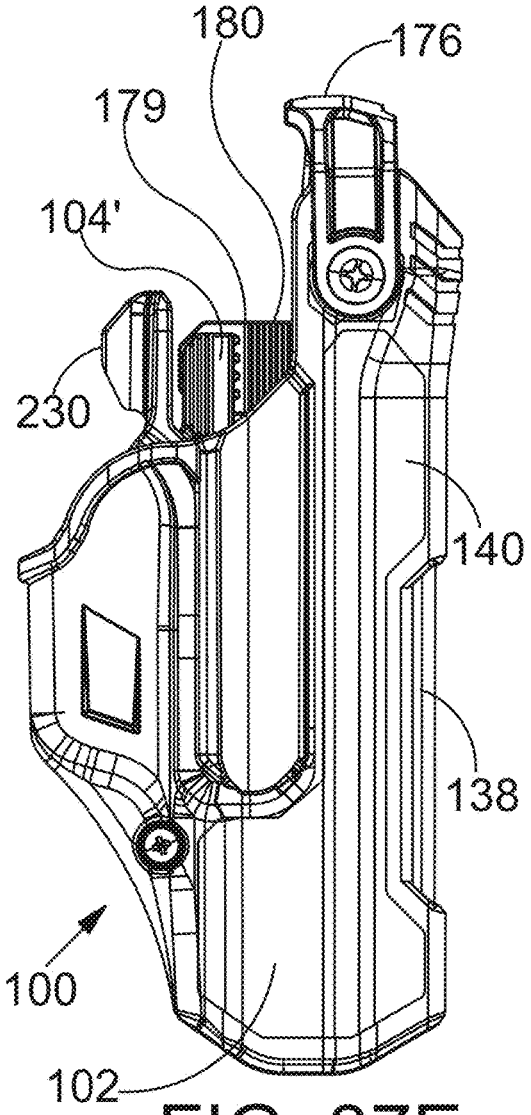
FIG. 37E is a left side view of the holster shown in FIGS. 36A and 36B.
Figure 37F:
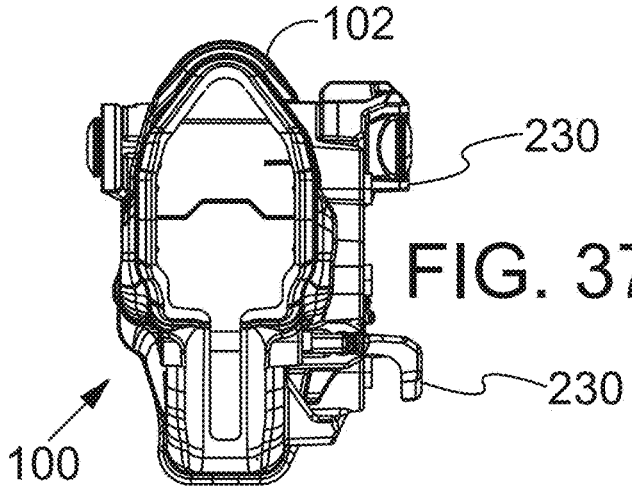
FIG. 37F is a bottom view of the holster shown in FIGS. 36A and 36B.
Figure 38B:
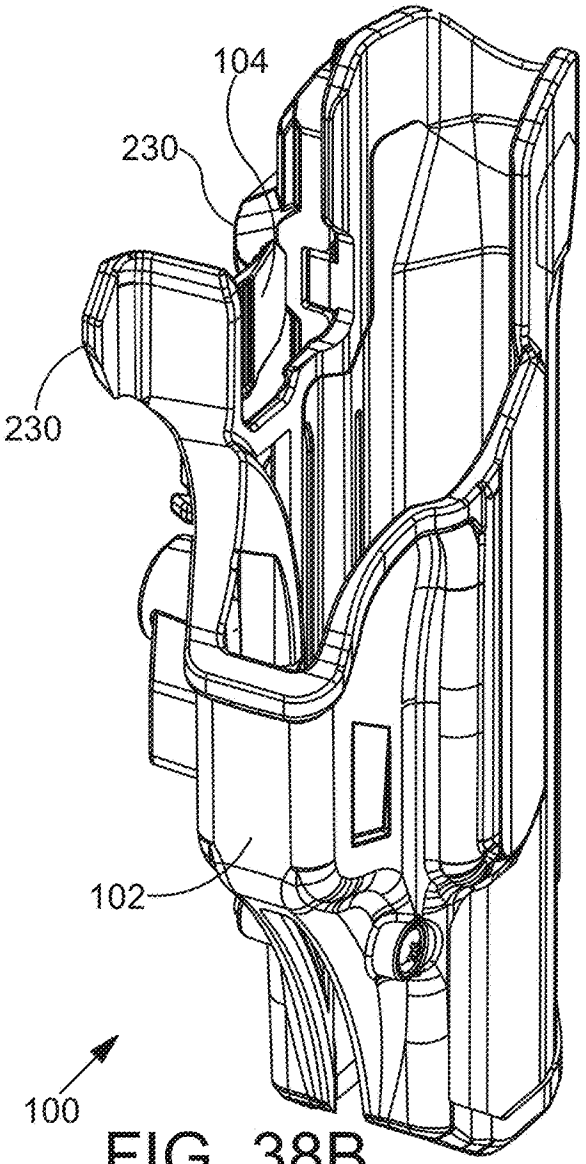
FIGS. 38A and 38B are two perspective views showing a holster having a handgun retention mechanism including a pivotable lever.
Figure 38A:
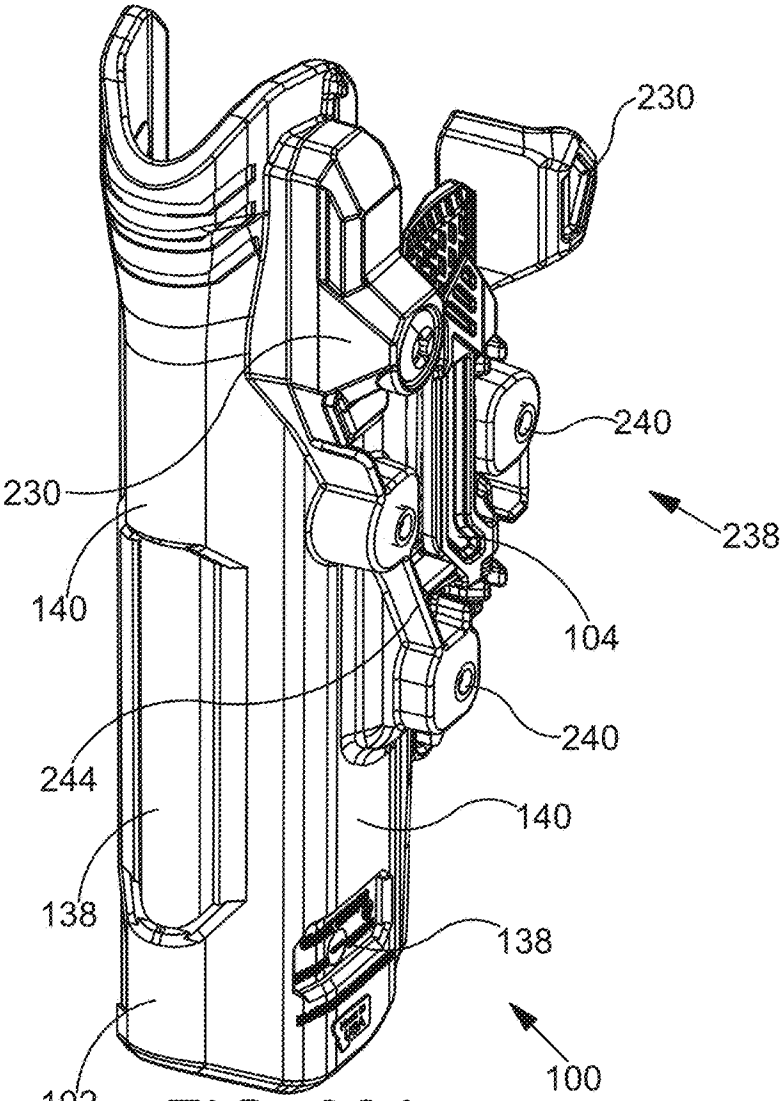
Figure 39D:
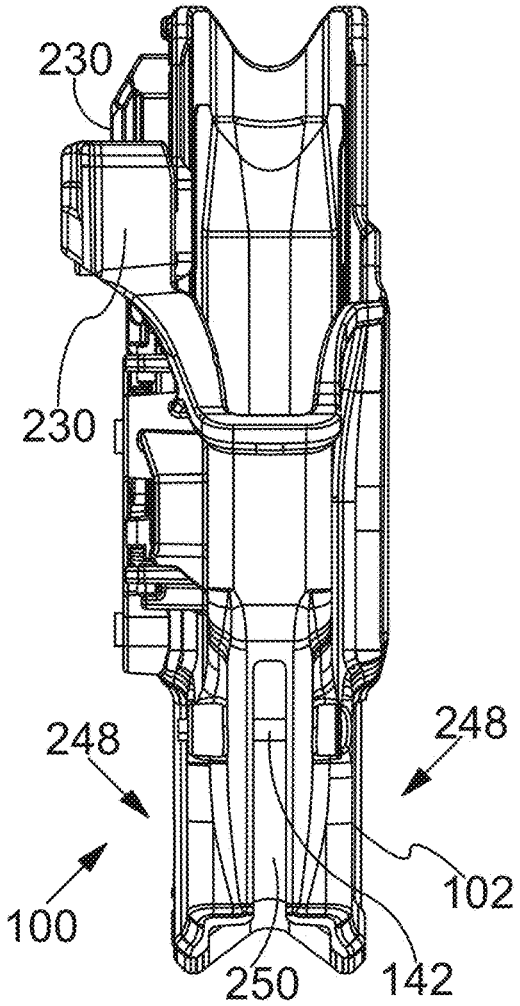
FIG. 39D is a rear view of the holster shown in FIGS. 38A and 38B.
Figure 39E:
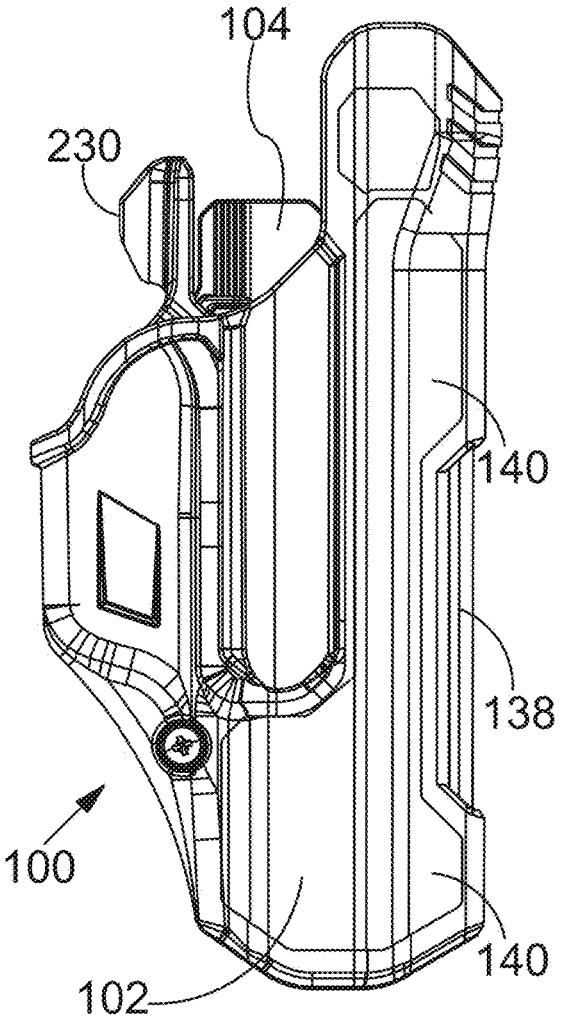
FIG. 39E is a left side view of the holster shown in FIGS. 38A and 38B.
Figure 39F:
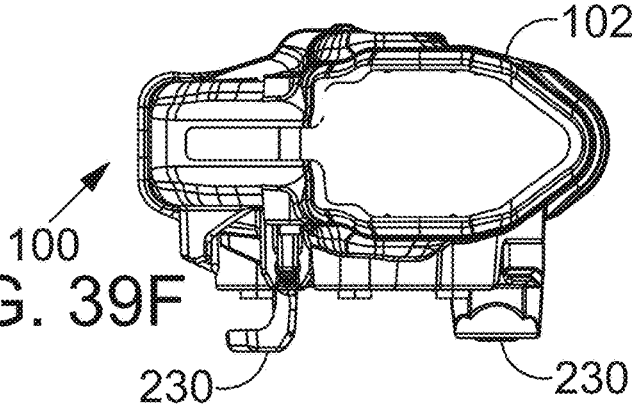
FIG. 39F is a bottom view of the holster shown in FIGS. 38A and 38B.
Figure 40:
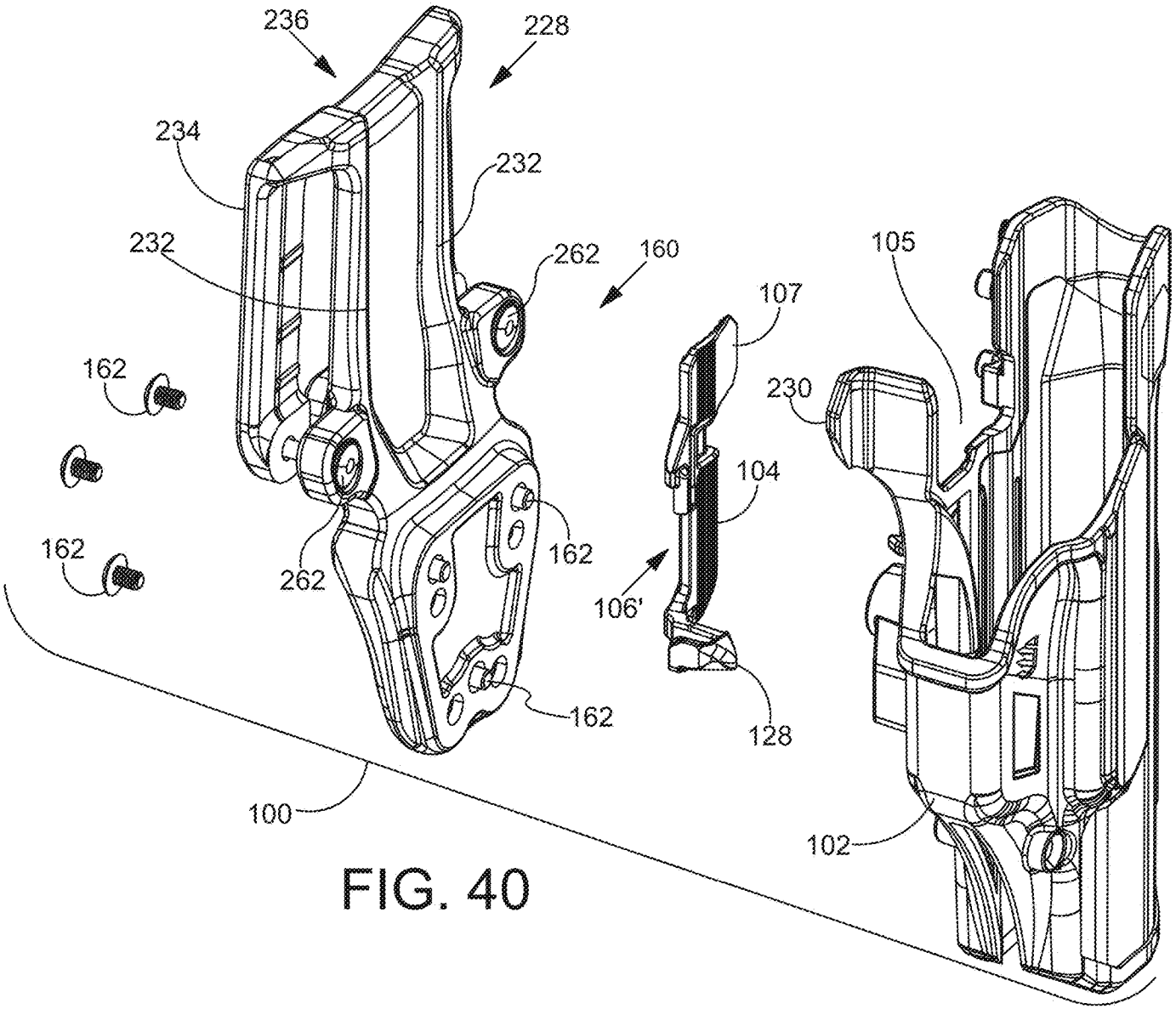
FIG. 40 is an exploded perspective view showing a belt receiving member, a holster body and a lever.
Figure 41:
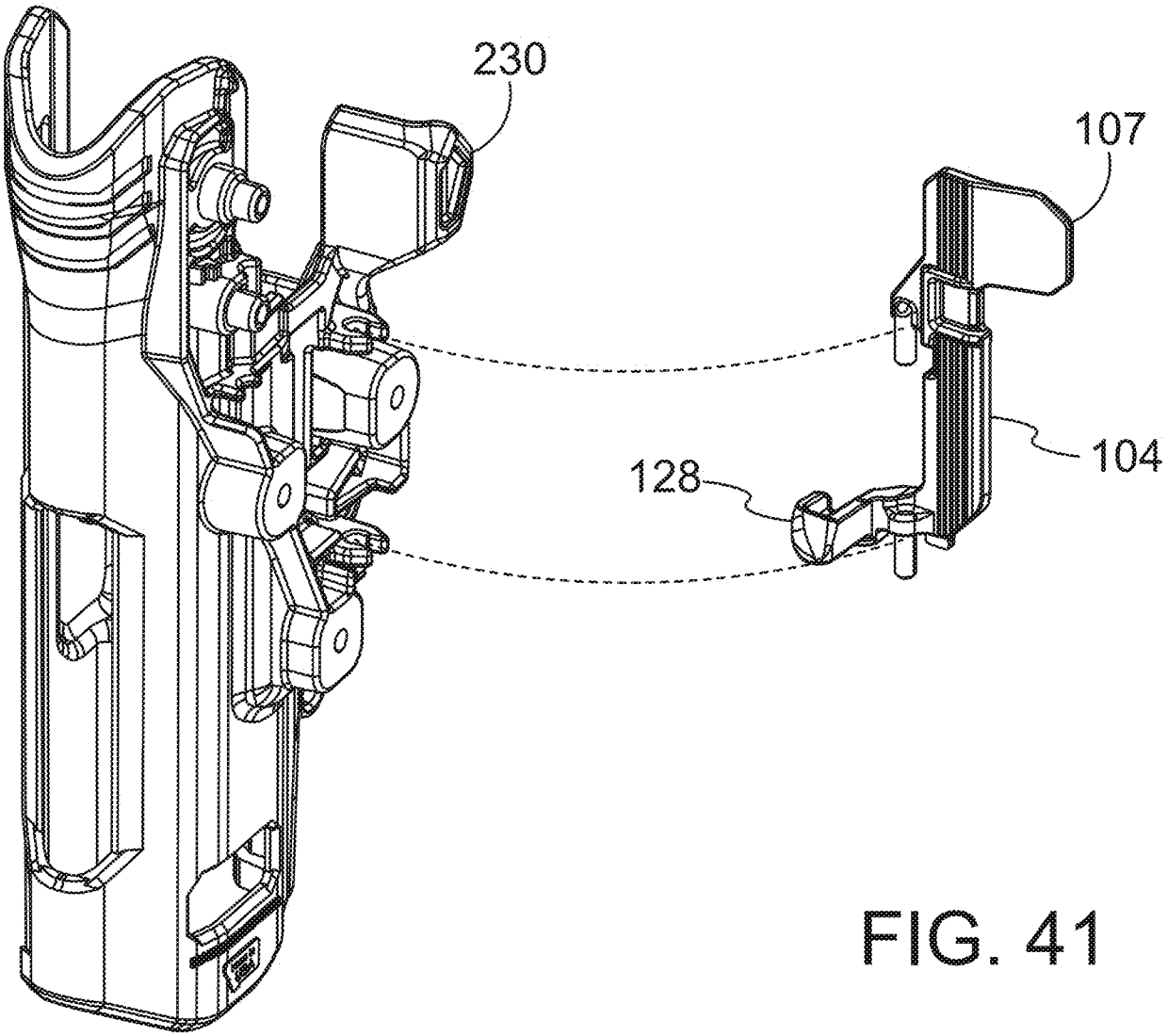
FIG. 41 is an exploded perspective view showing a holster body and a lever.
Figure 42:
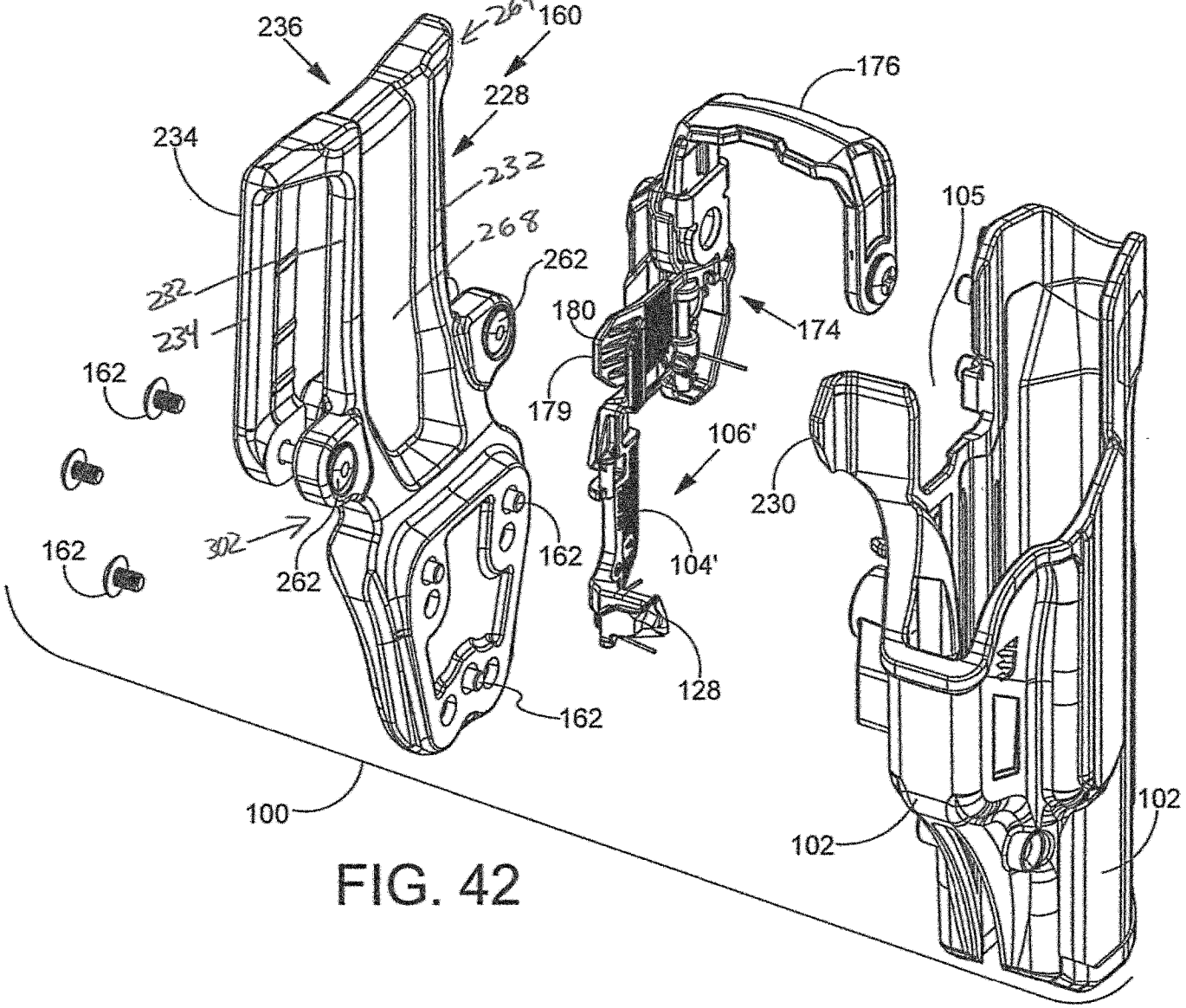
FIG. 42 is an exploded perspective view showing a belt receiving member, a holster body and two locking mechanisms.
Figure 43:
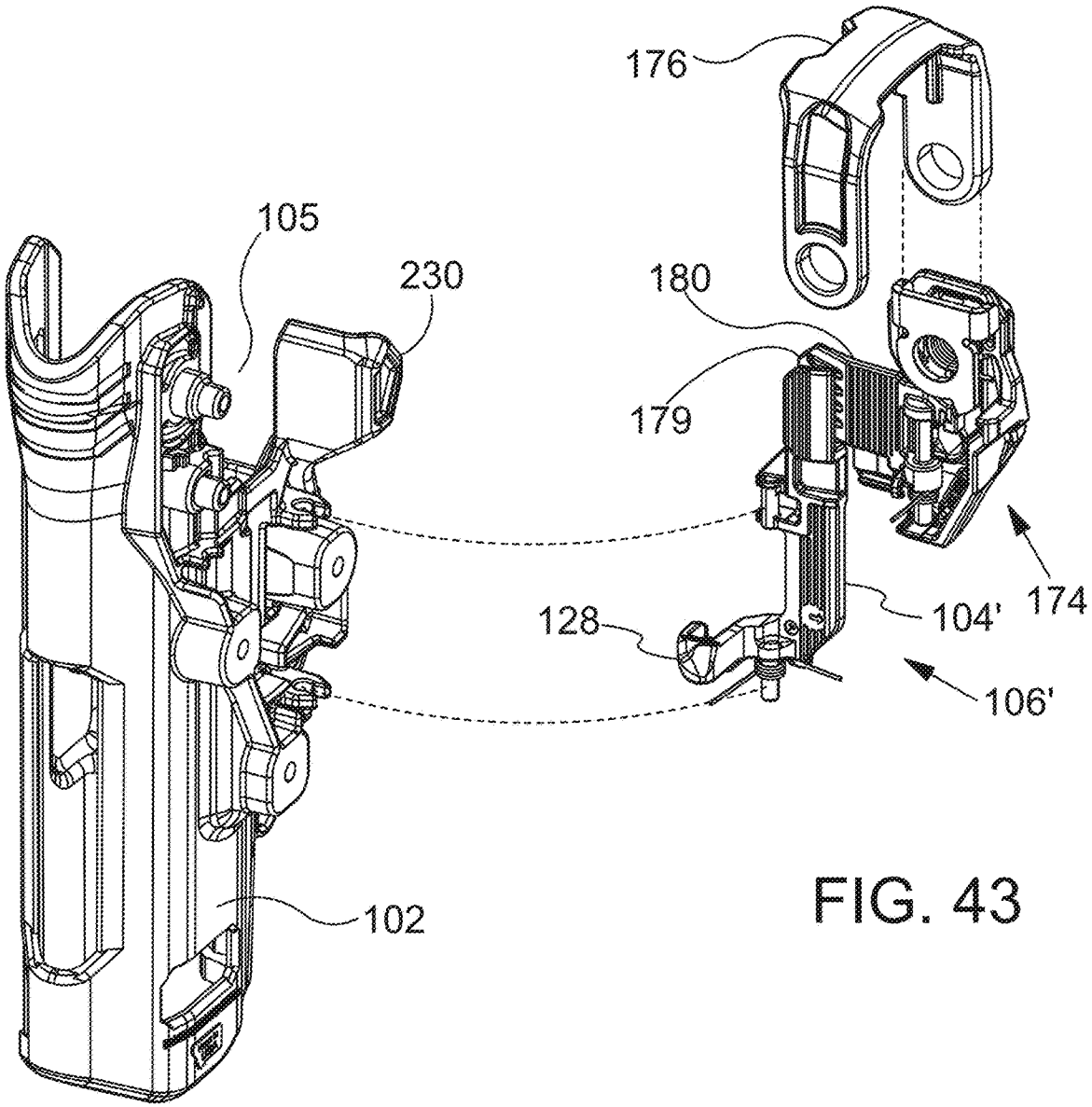
FIG. 43 is an exploded perspective view showing a holster body and two locking mechanisms.
Figure 45:
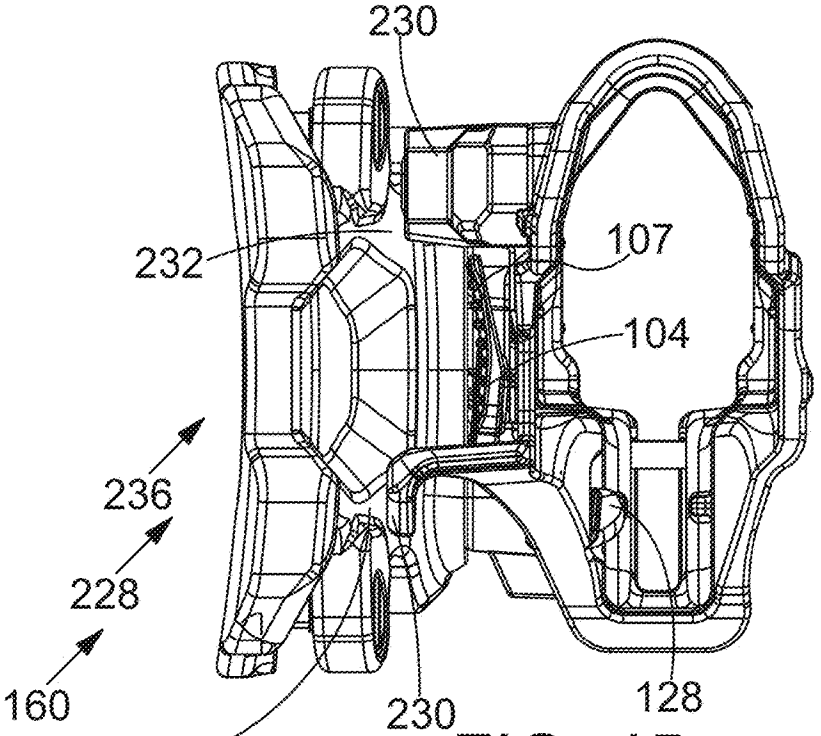
FIG. 45 is a top view showing the belt receiving member, the holster body and the lever shown in FIG. 40.
Figure 44:
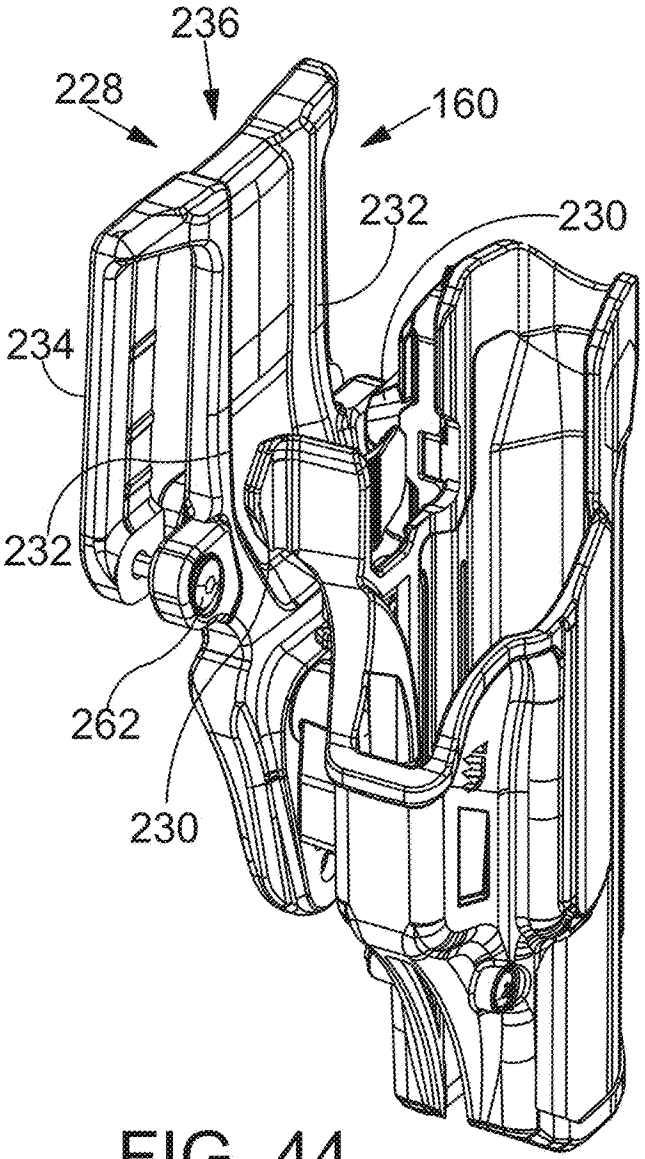
FIG. 44 is a perspective view showing the belt receiving member, the holster body and the lever shown in FIG. 40.
Figure 47:
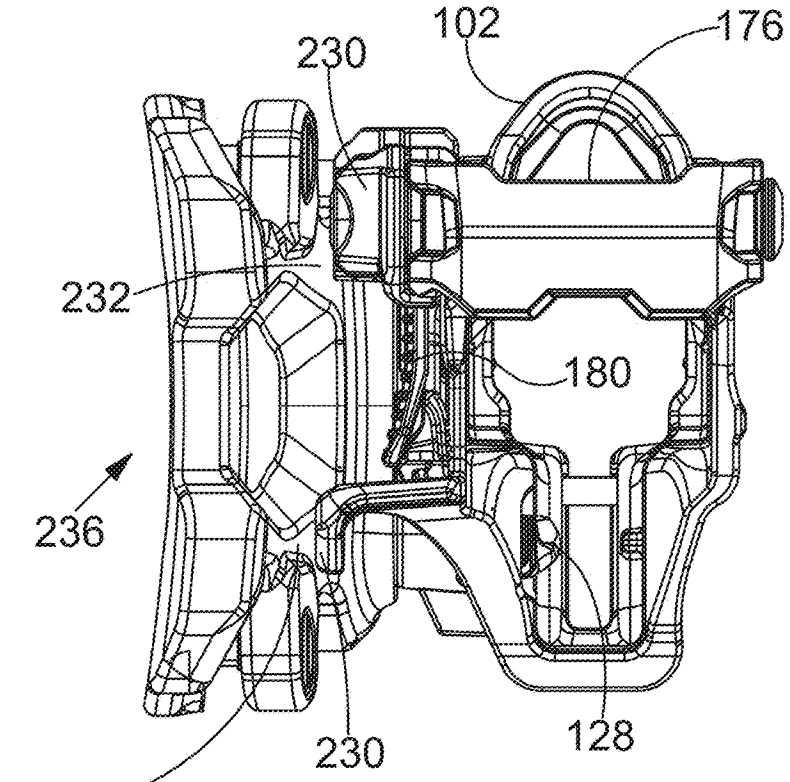
FIG. 47 is a top view showing the belt receiving member, the holster body and the locking mechanisms shown in FIG. 42.
Figure 46:
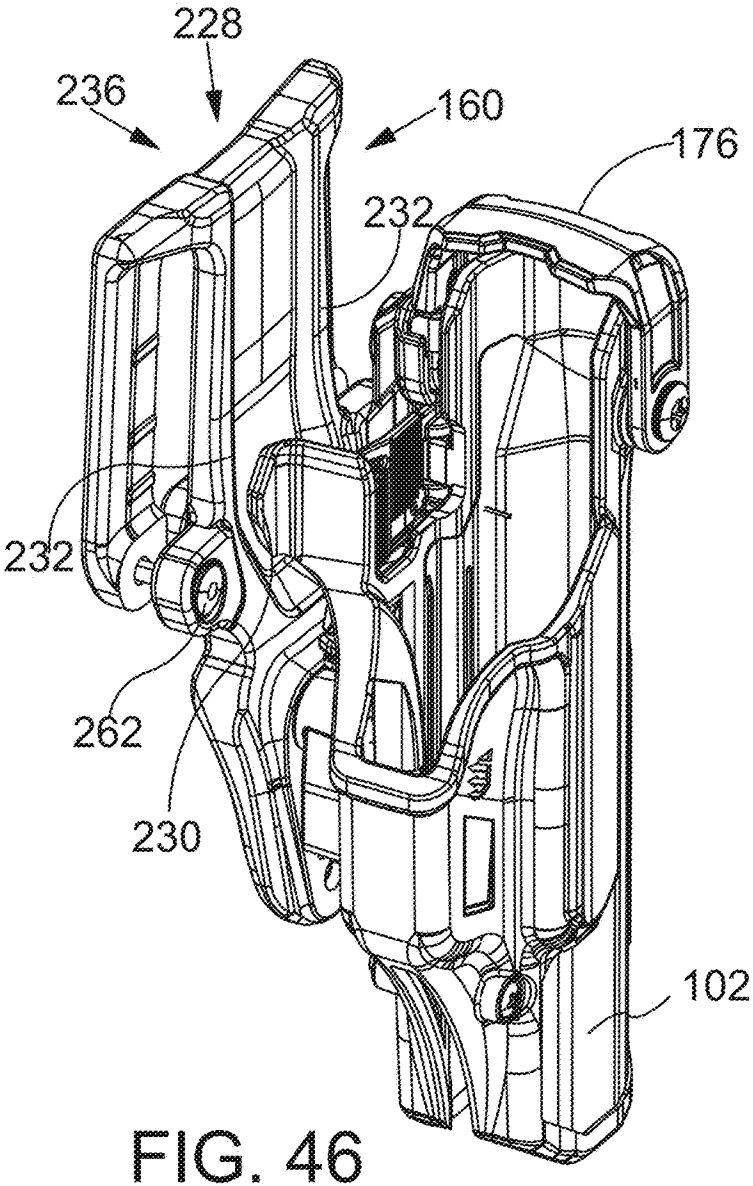
FIG. 46 is a perspective view showing the belt receiving member, the holster body and the locking mechanisms shown in FIG. 42.
Figure 48A:
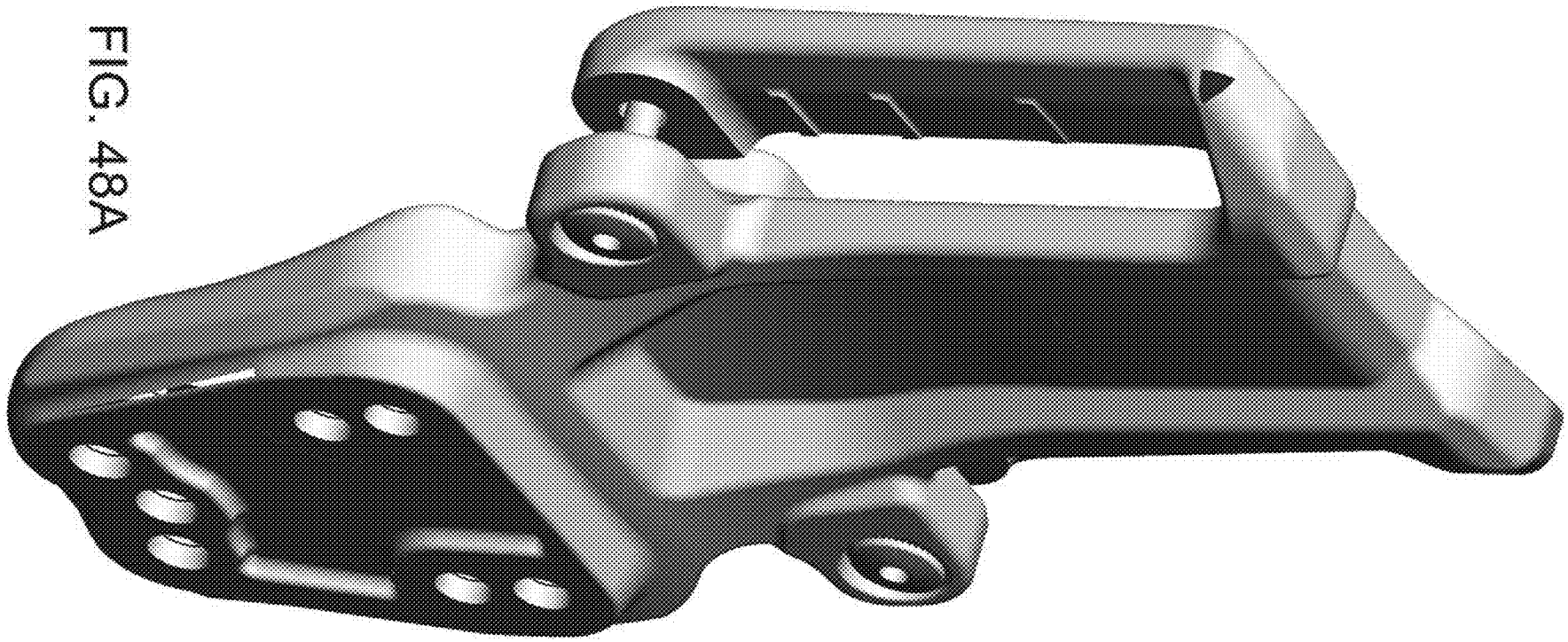
FIGS. 48A and 48B are perspective views of a belt engaging member.
Figure 48B:
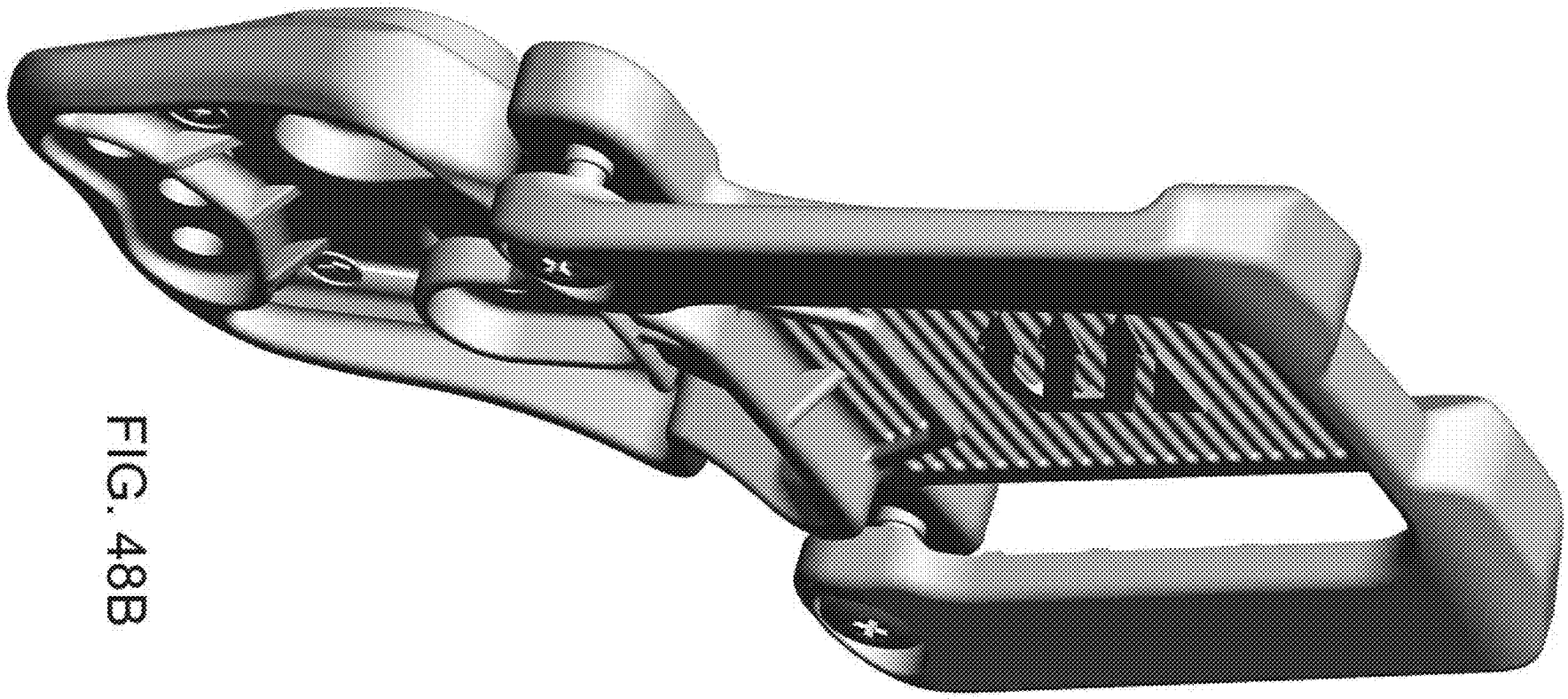
Figure 49A:
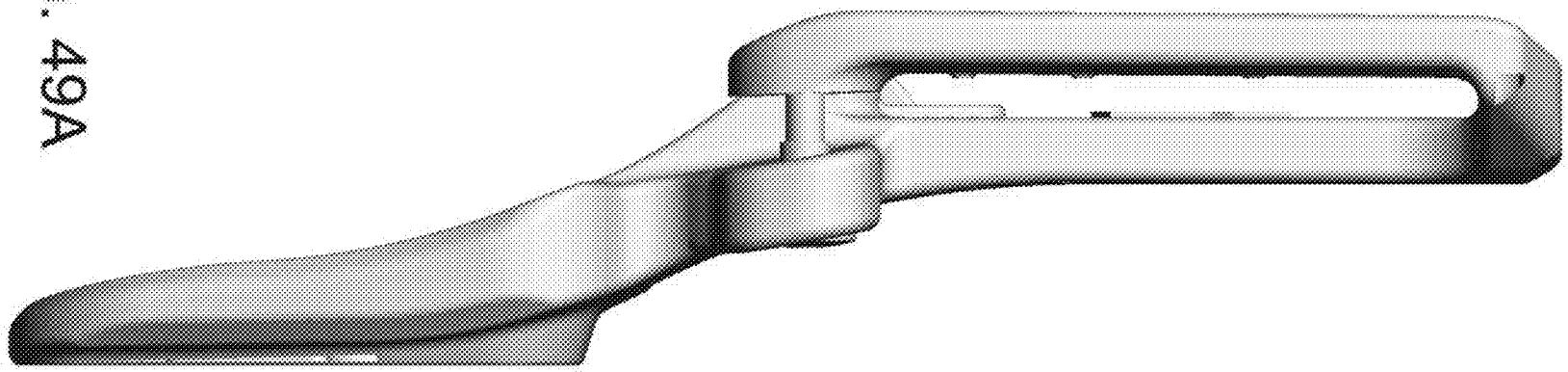
FIG. 49A is a front view of the belt engaging member shown in FIGS. 48A and 48B.
Figure 49B:
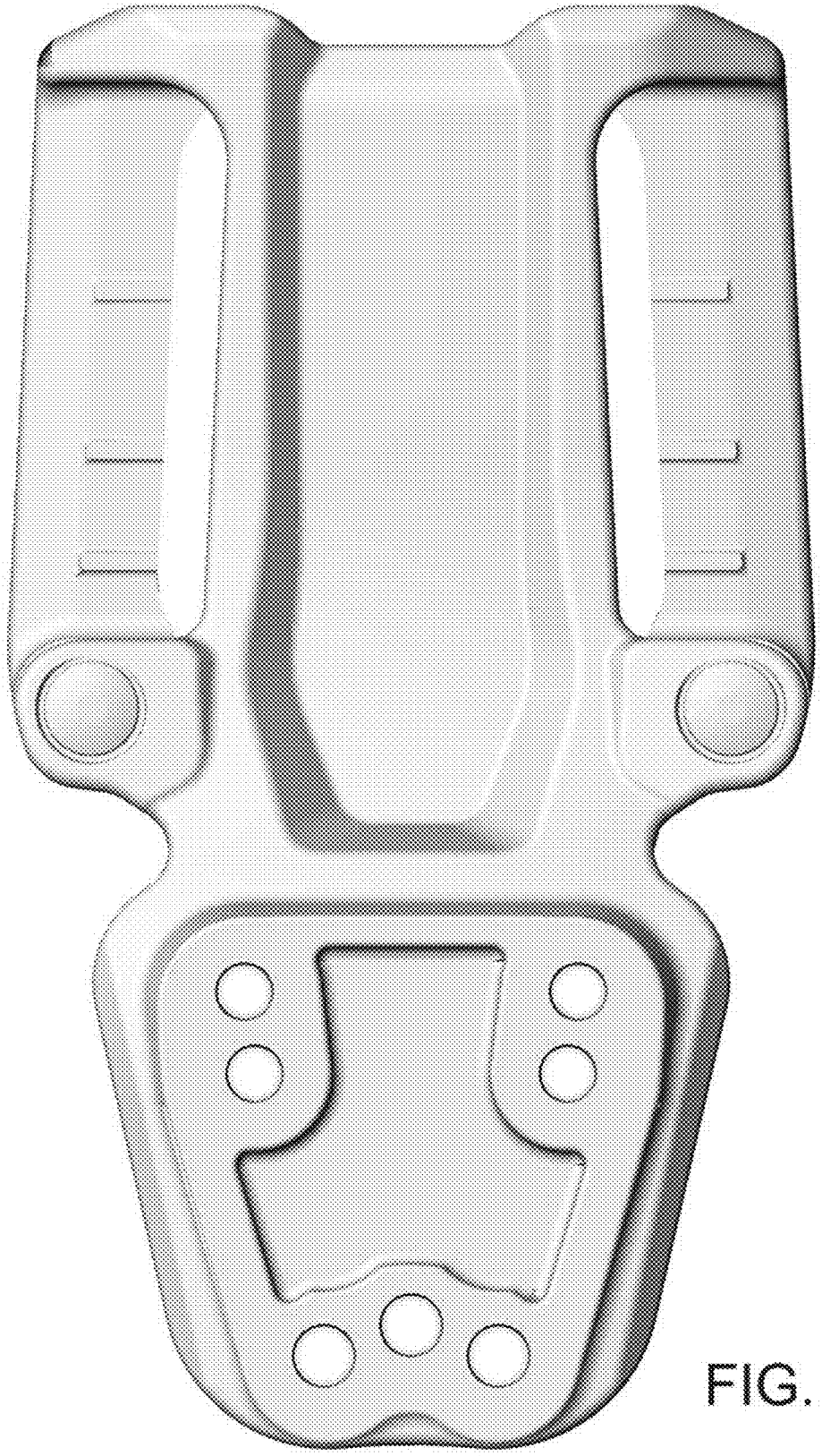
FIG. 49B is a right side view of the belt engaging member shown in FIGS. 48A and 48B.
Figure 49C:
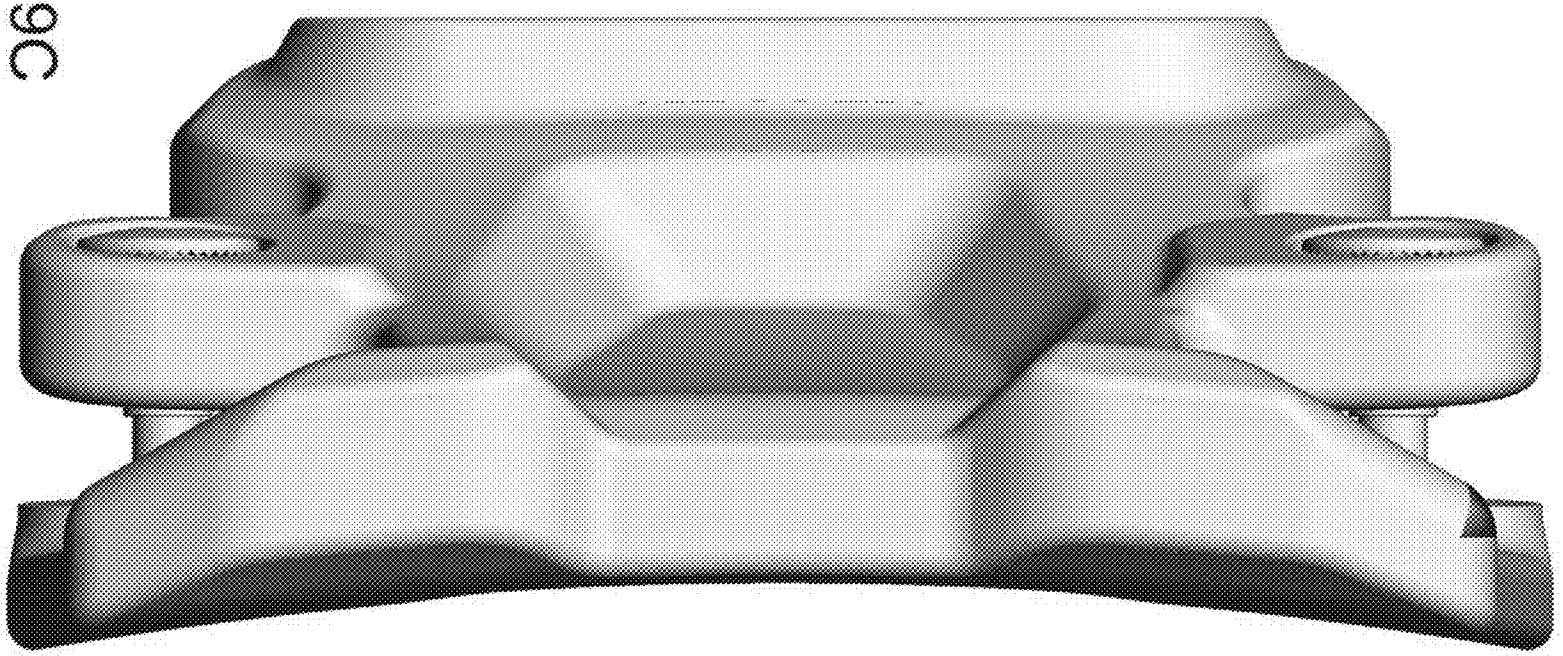
FIG. 49C is a top view of the belt engaging member shown in FIGS. 48A and 48B.
Figure 49D:
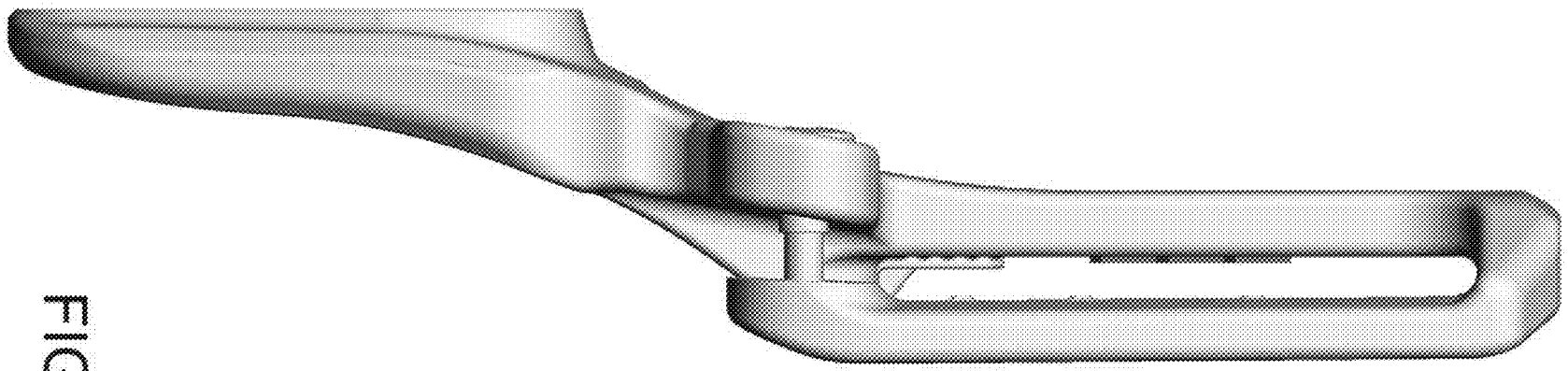
FIG. 49D is a rear view of the belt engaging member shown in FIGS. 48A and 48B.
Figure 49E:
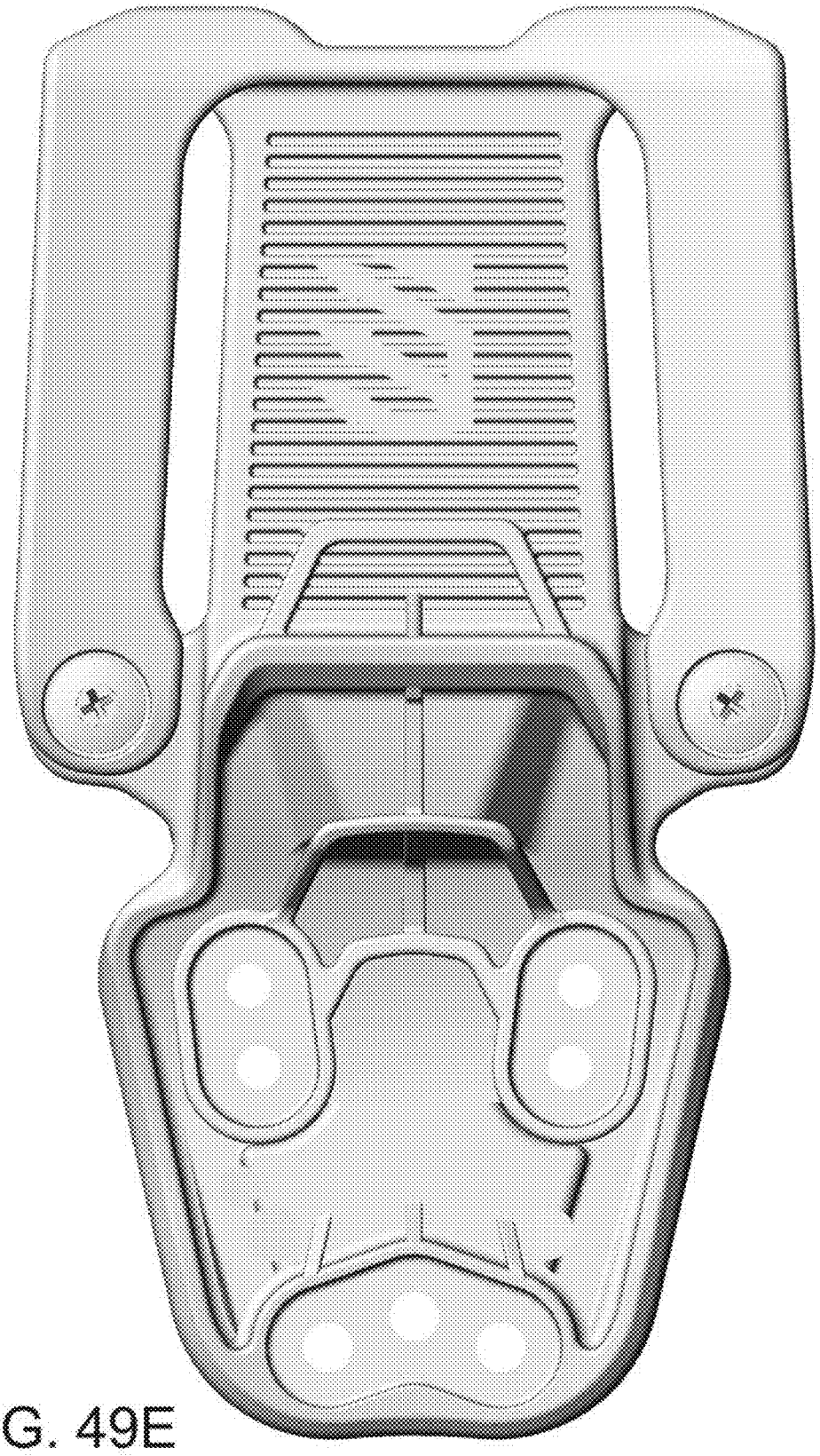
FIG. 49E is a left side view of the belt engaging member shown in FIGS. 48A and 48B.
Figure 49F:
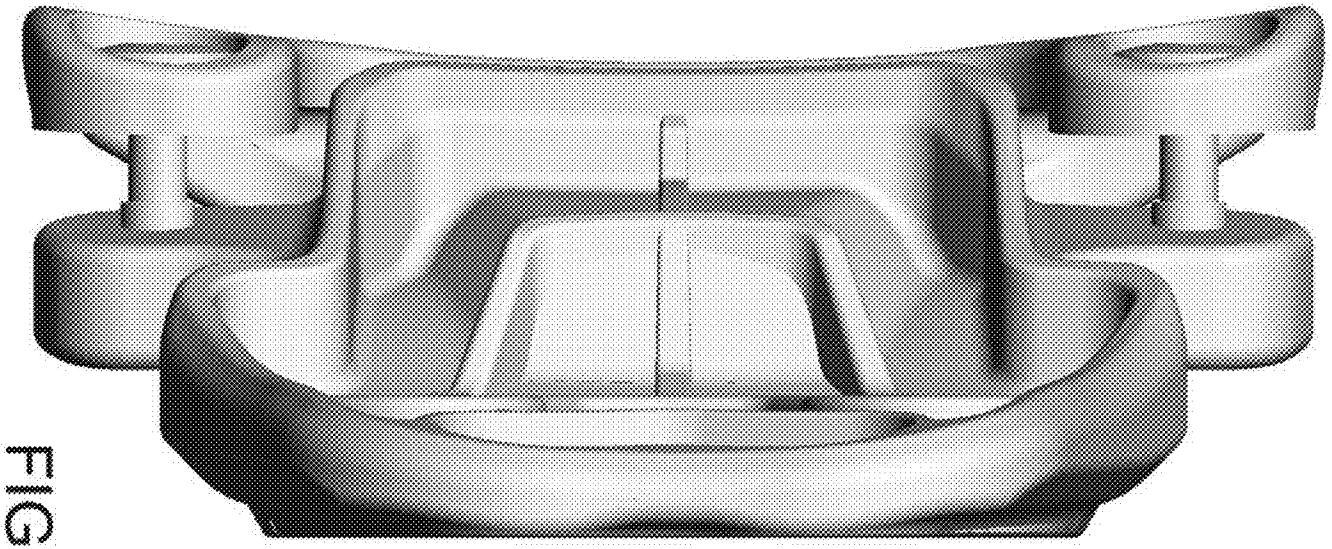
FIG. 49F is a bottom view of the belt engaging member shown in FIGS. 48A and 48B.
Figure 50A:
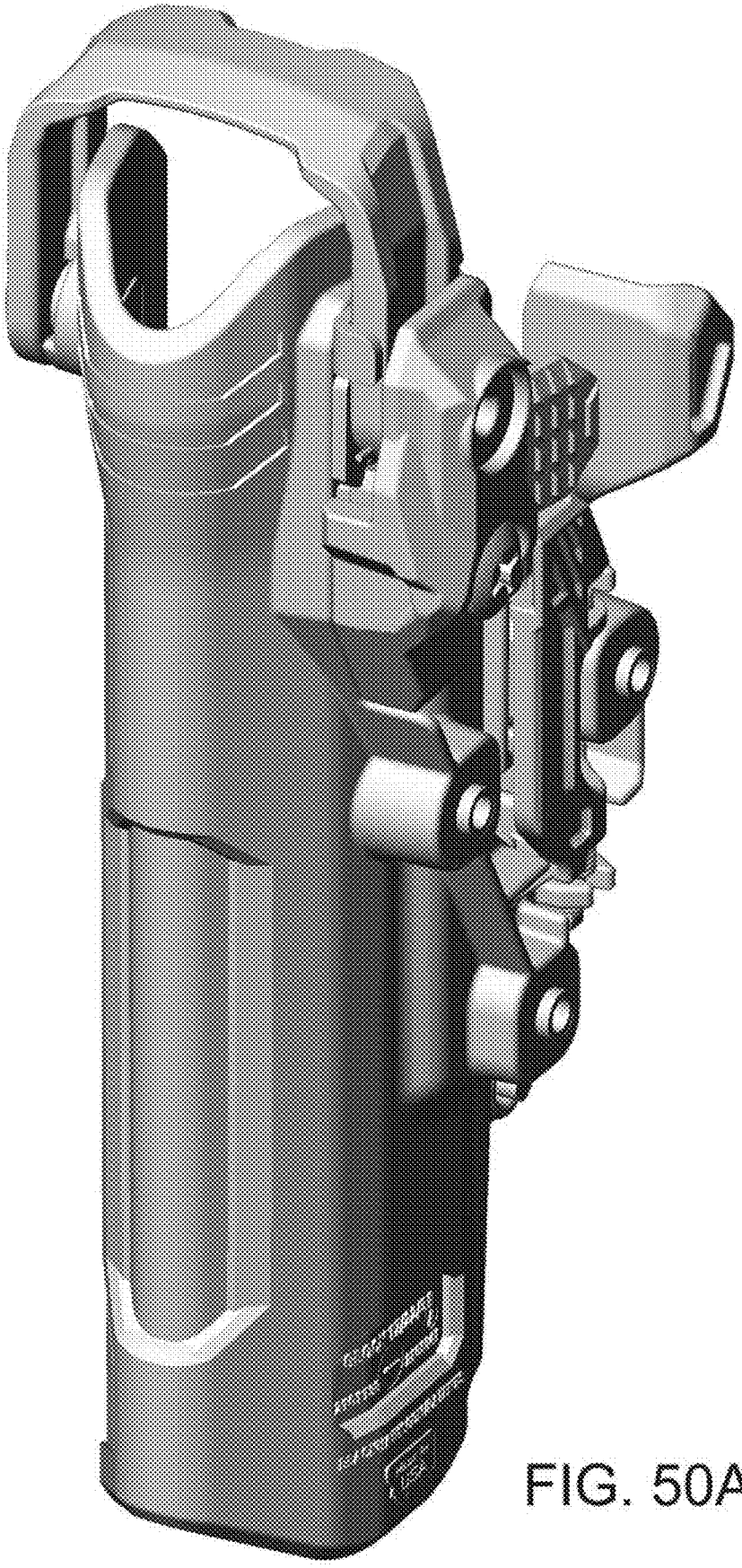
FIGS. 50A and 50B are two perspective views showing a holster having a first handgun retention mechanism including a pivotable lever and a second handgun retention mechanism including a U-shaped shroud. In the embodiment of FIGS. 50A and 50B, the U-shaped shroud is in a handgun retaining position.
Figure 50B:
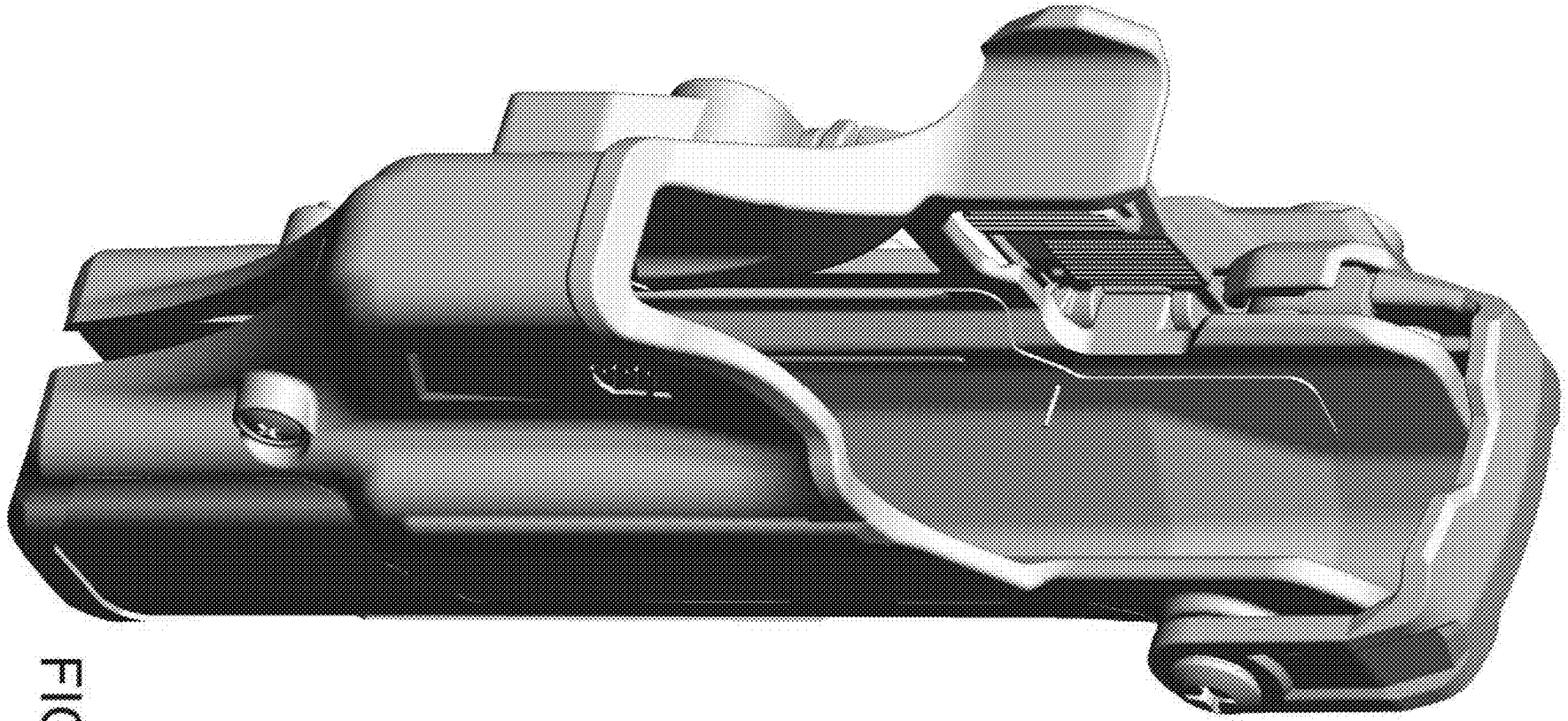
Figure 51A:
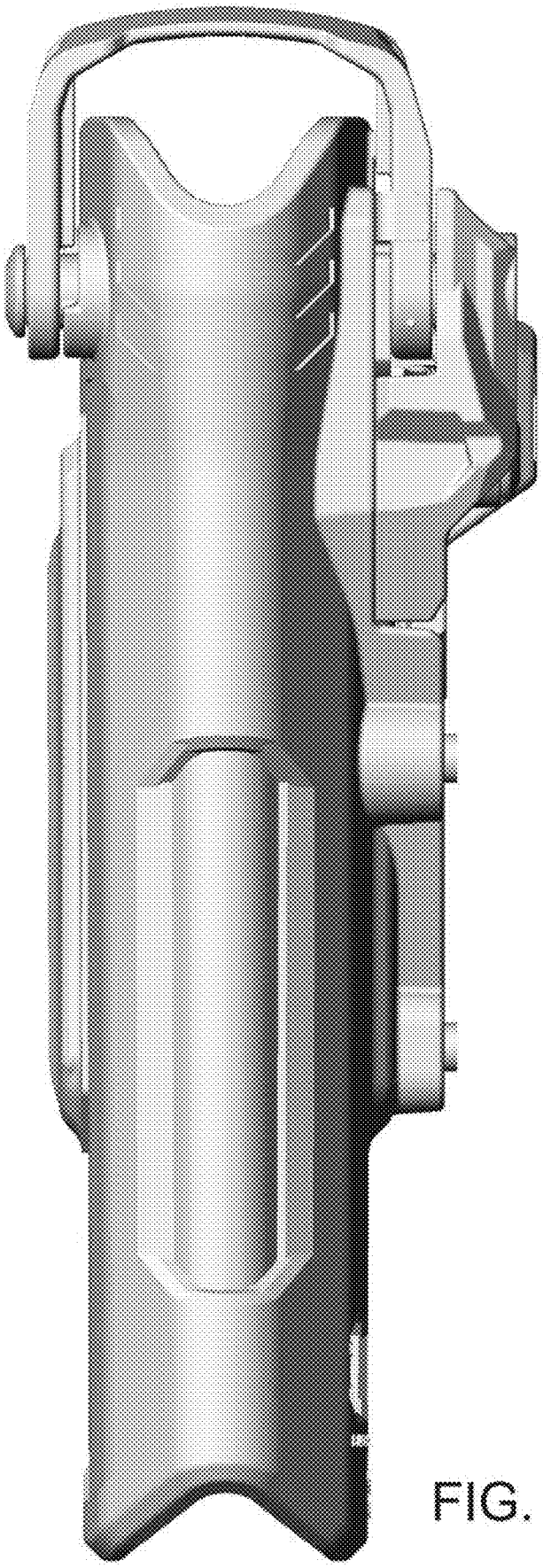
FIG. 51A is a front view of the holster shown in FIGS. 50A and 50B.
Figure 51B:
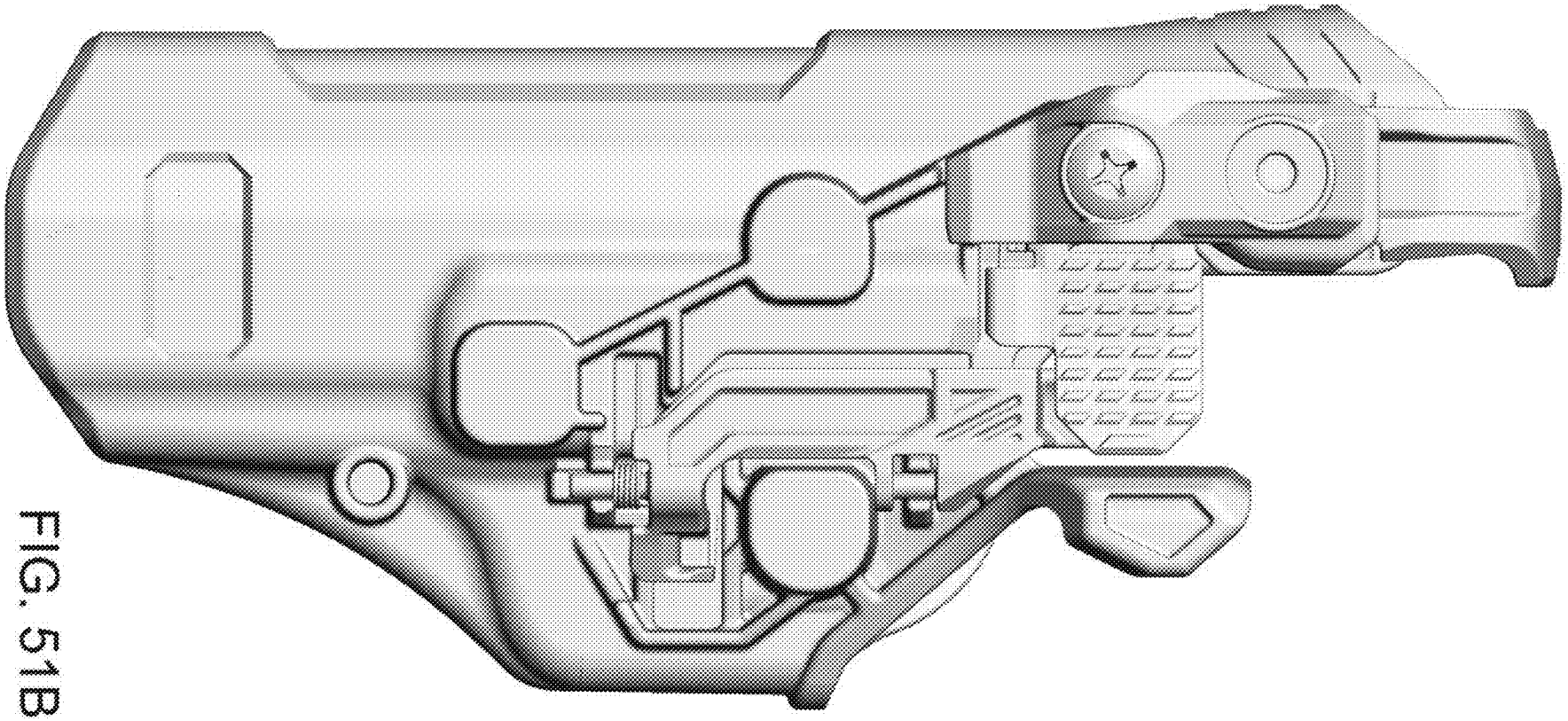
FIG. 51B is a right side view of the holster shown in FIGS. 50A and 50B.
Figure 51C:
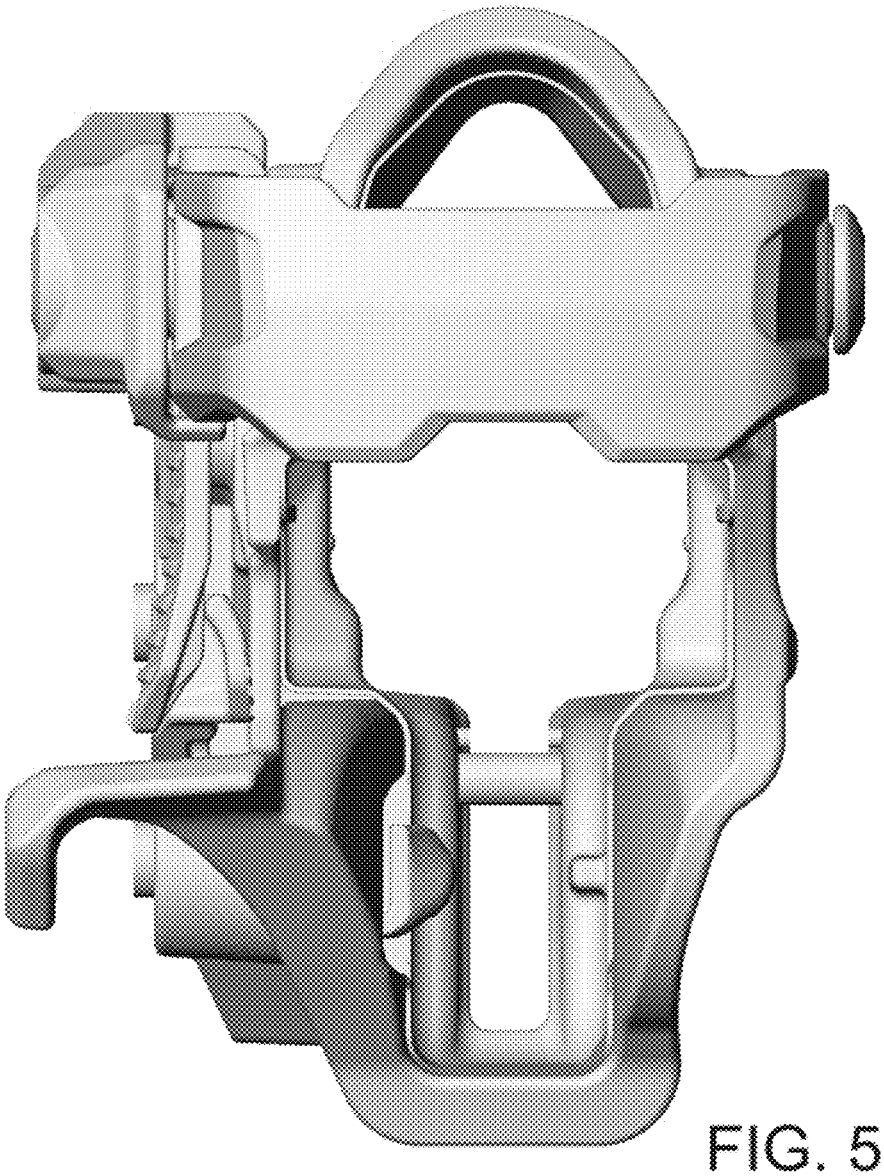
FIG. 51C is a top view of the holster shown in FIGS. 50A and 50B.
Figure 51D:
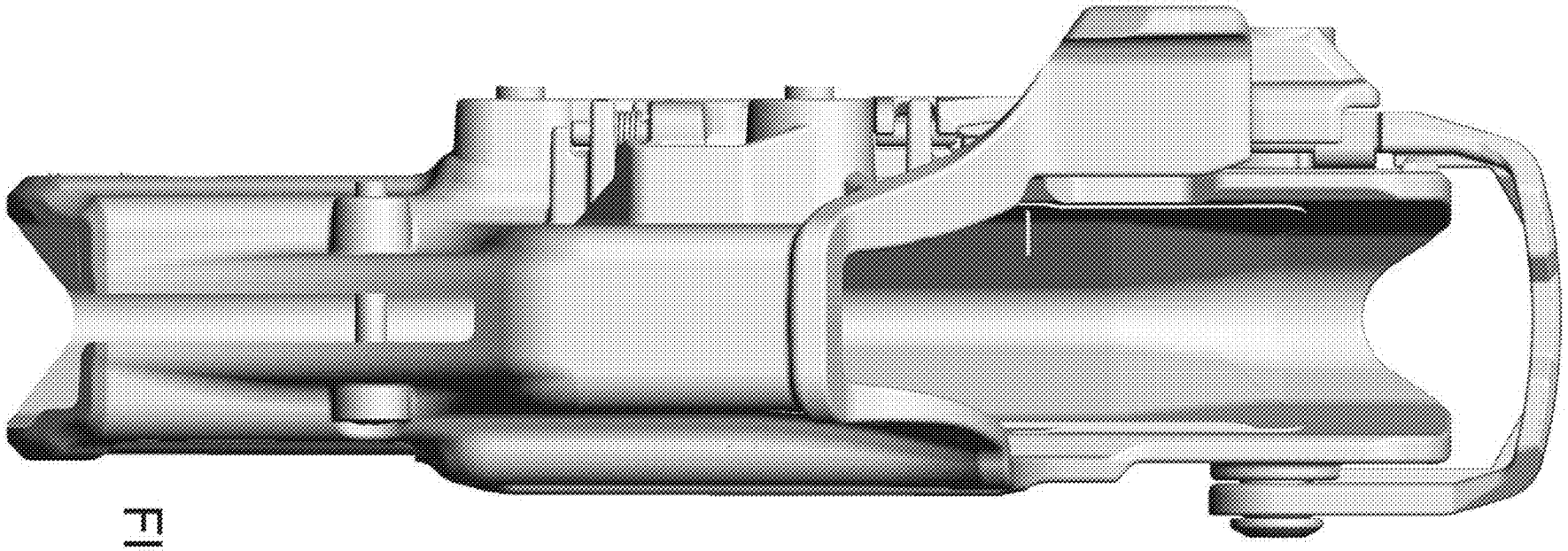
FIG. 51D is a rear view of the holster shown in FIGS. 50A and 50B.
Figure 51E:
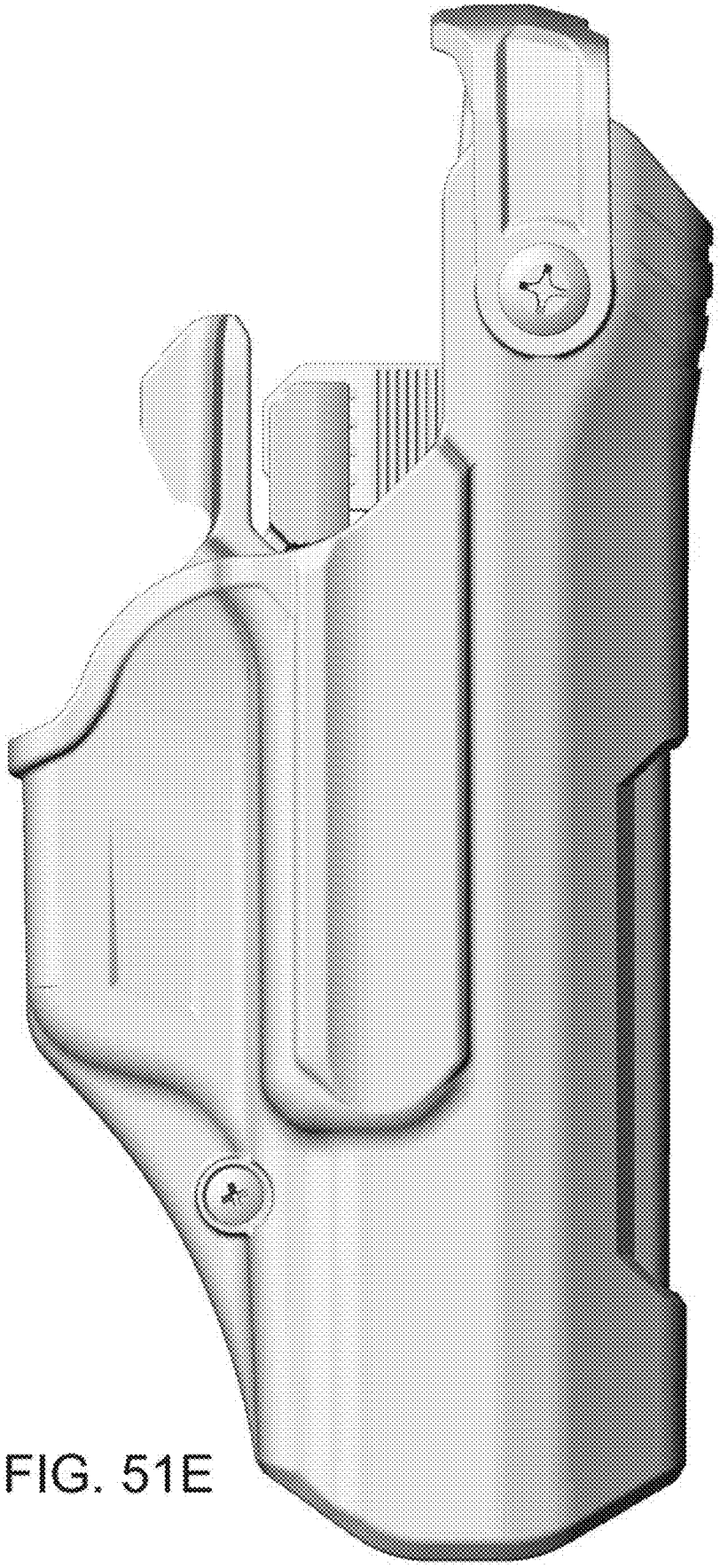
FIG. 51E is a left side view of the holster shown in FIGS. 50A and 50B.
Figure 51F:
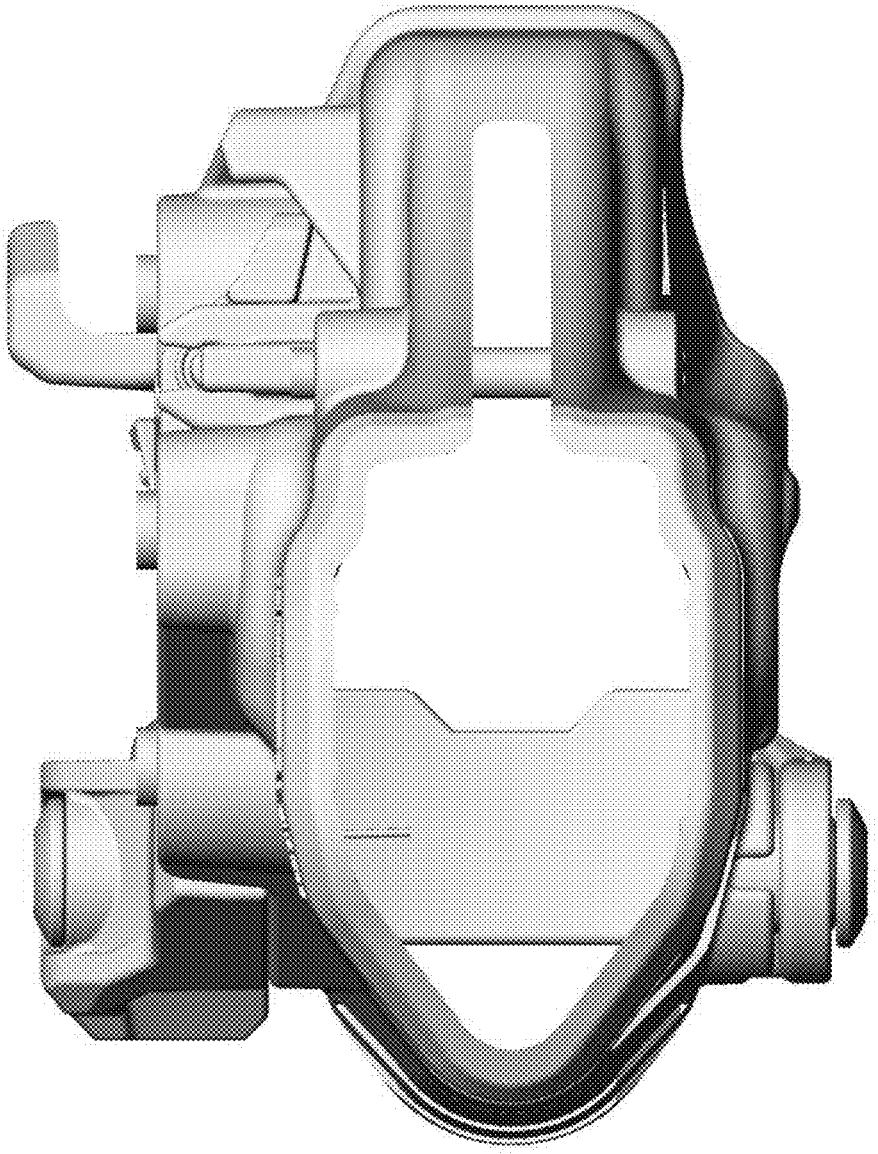
FIG. 51F is a bottom view of the holster shown in FIGS. 50A and 50B.
Figure 52A:
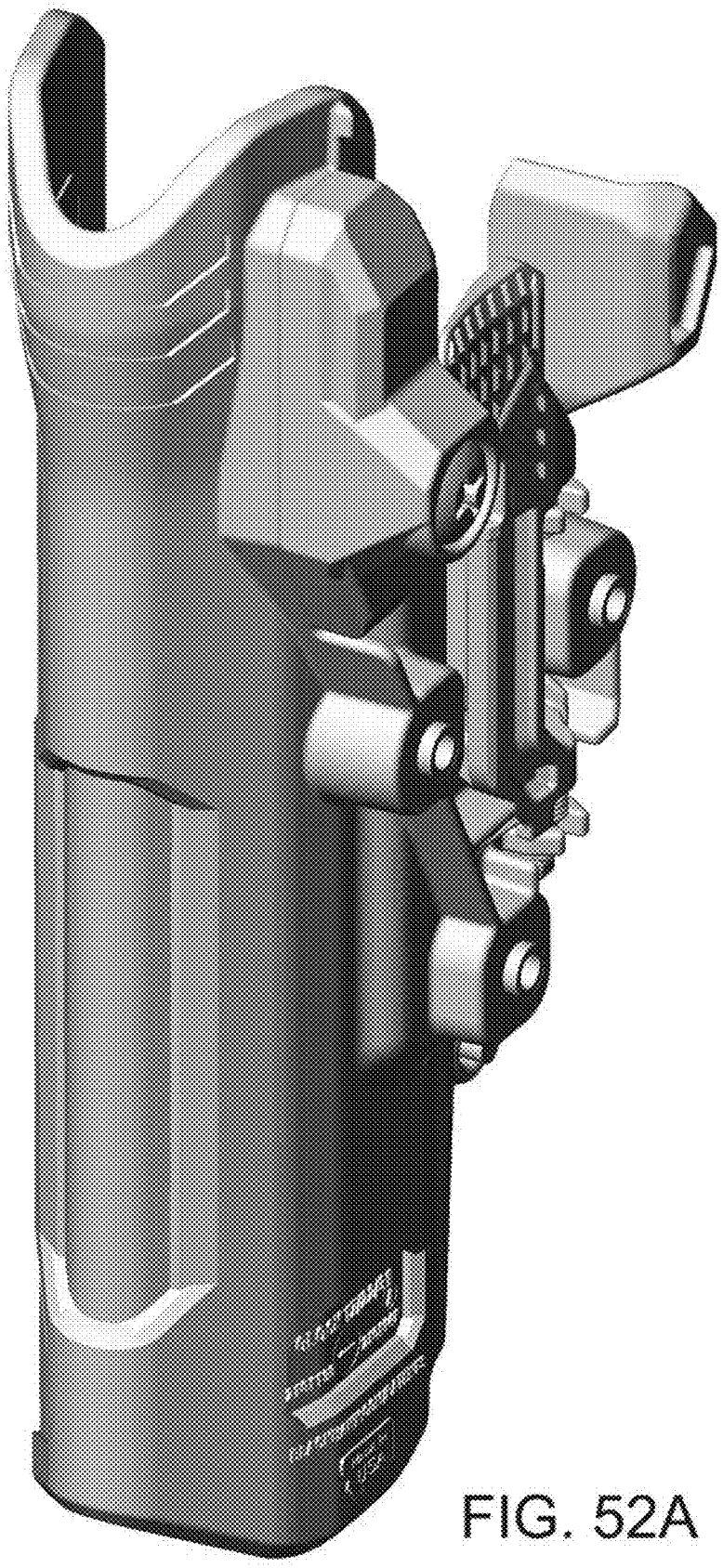
FIGS. 52A and 52B are two perspective views showing a holster having a handgun retention mechanism including a pivotable lever.
Figure 52B:
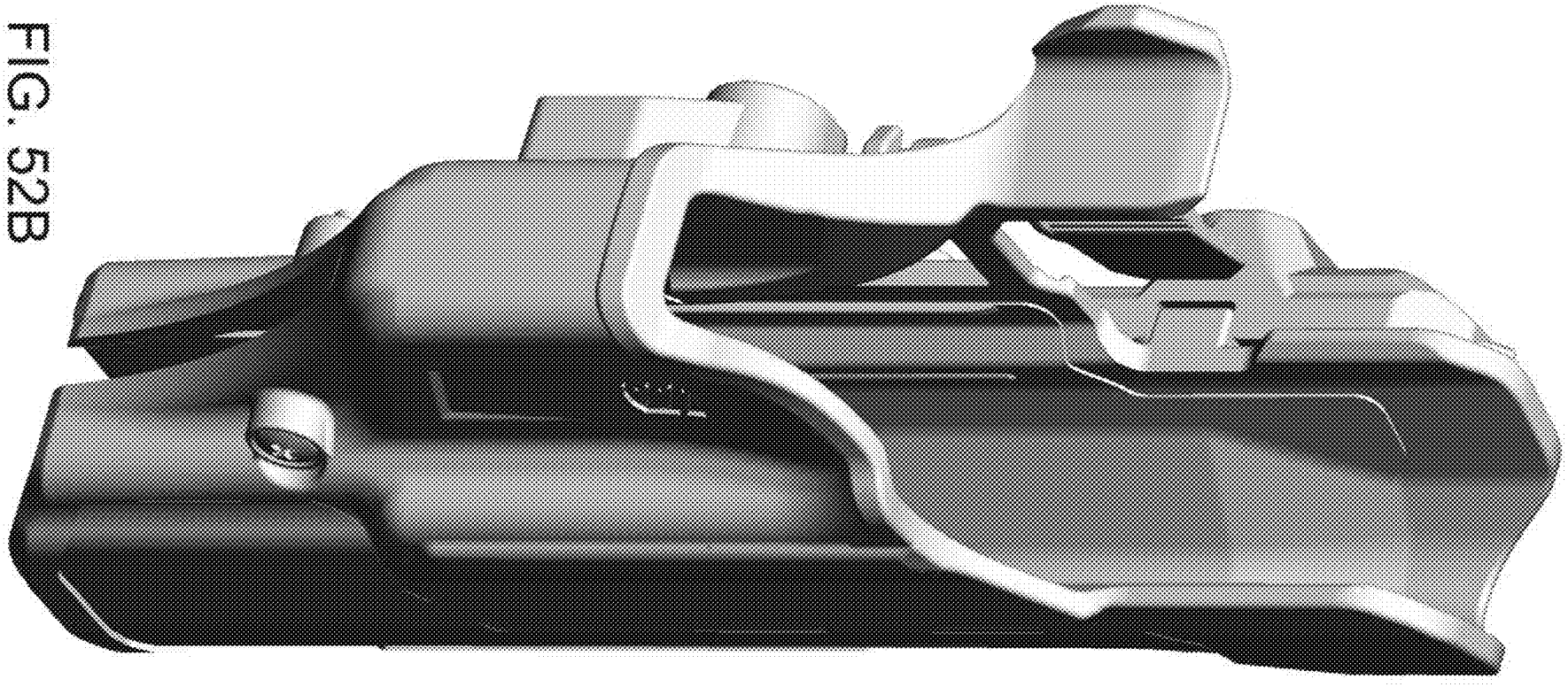
Figure 53A:
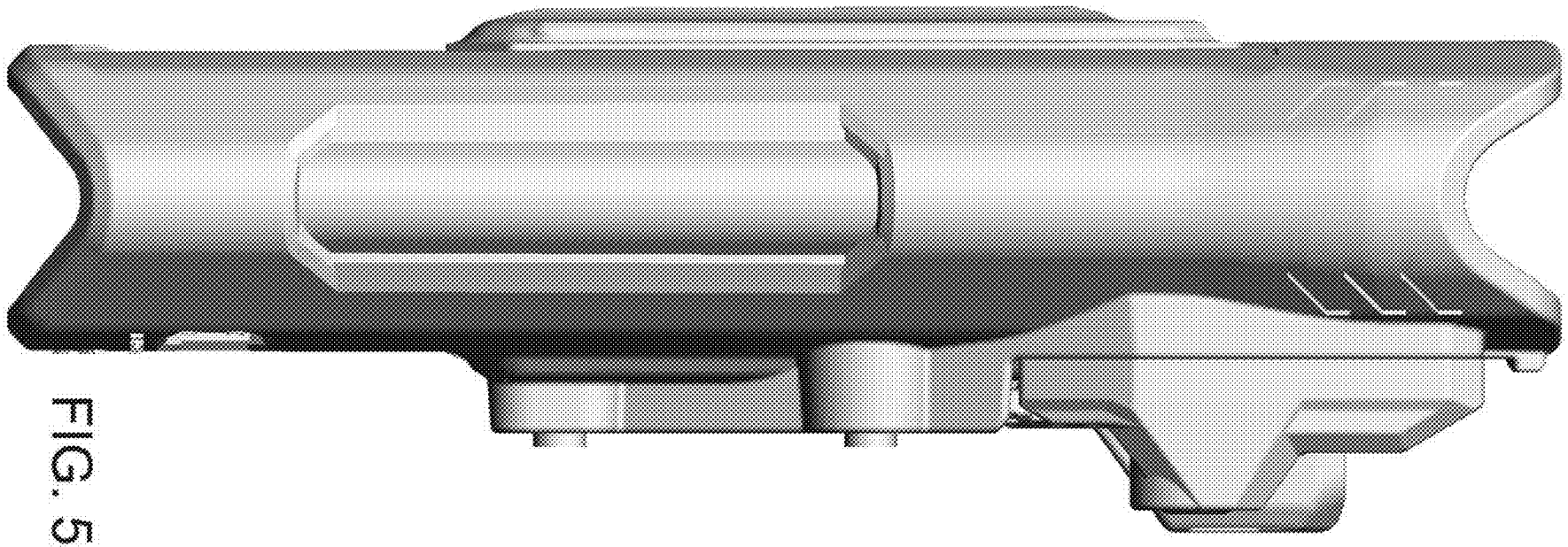
FIG. 53A is a front view of the holster shown in FIGS. 52A and 52B.
Figure 53B:
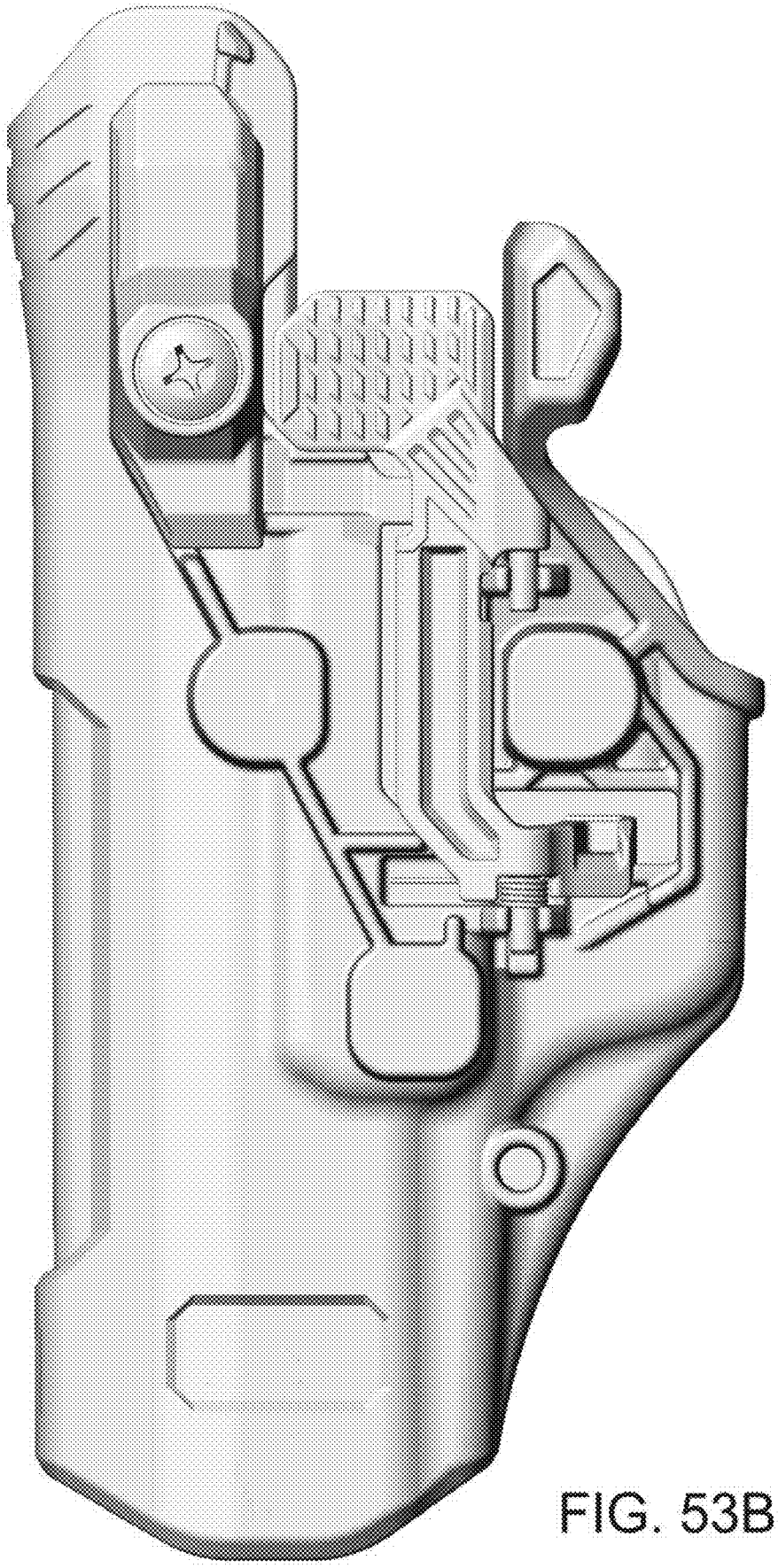
FIG. 53B is a right side view of the holster shown in FIGS. 52A and 52B.
Figure 53C:
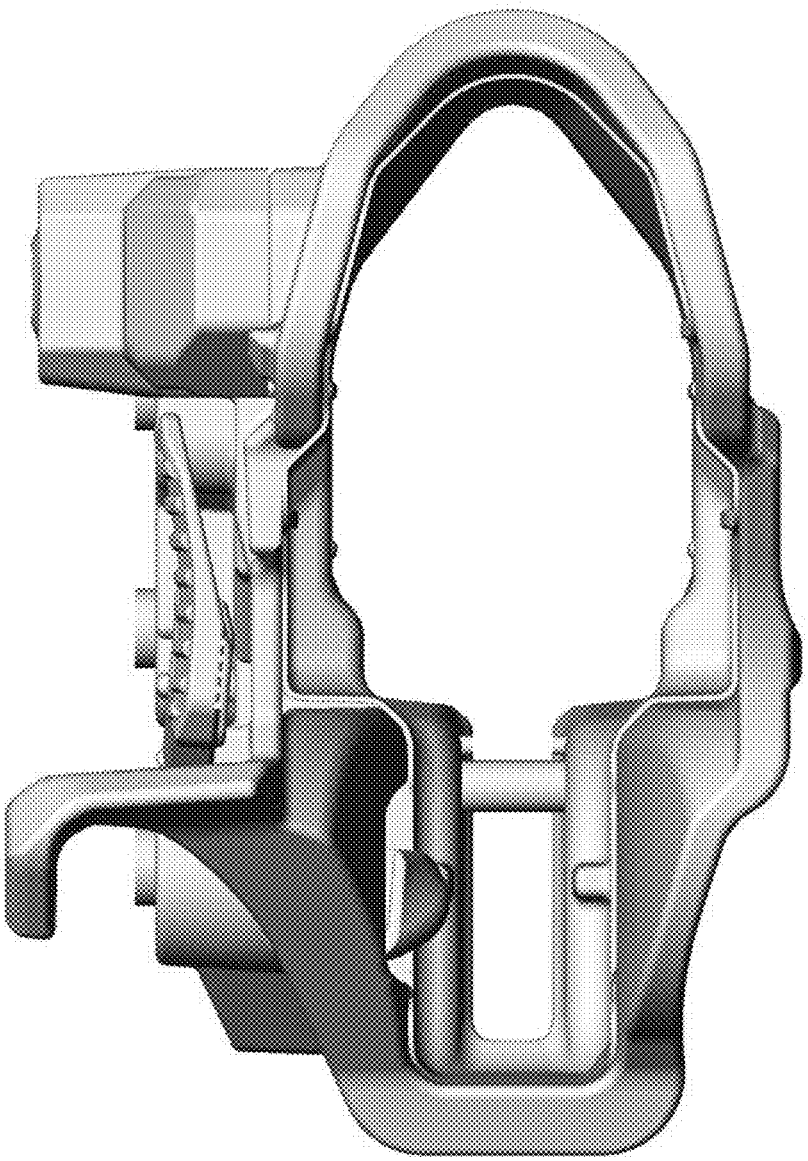
FIG. 53C is a top view of the holster shown in FIGS. 52A and 52B.
Figure 53D:
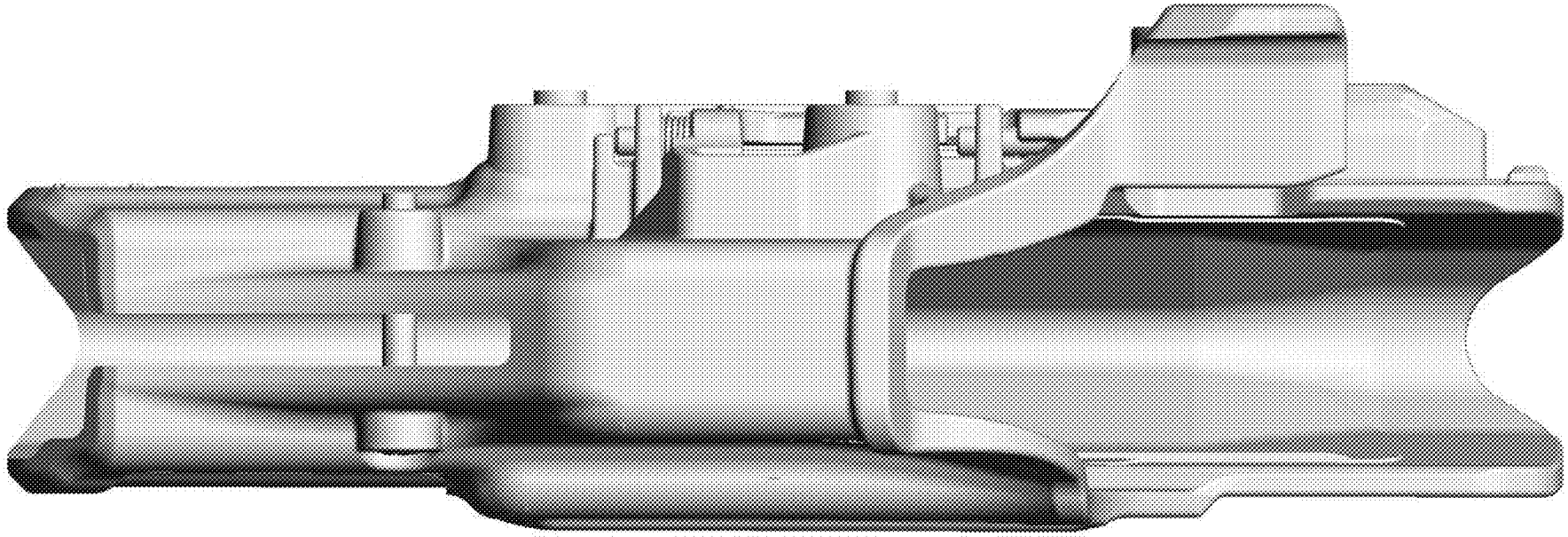
FIG. 53D is a rear view of the holster shown in FIGS. 52A and 52B.
Figure 53E:
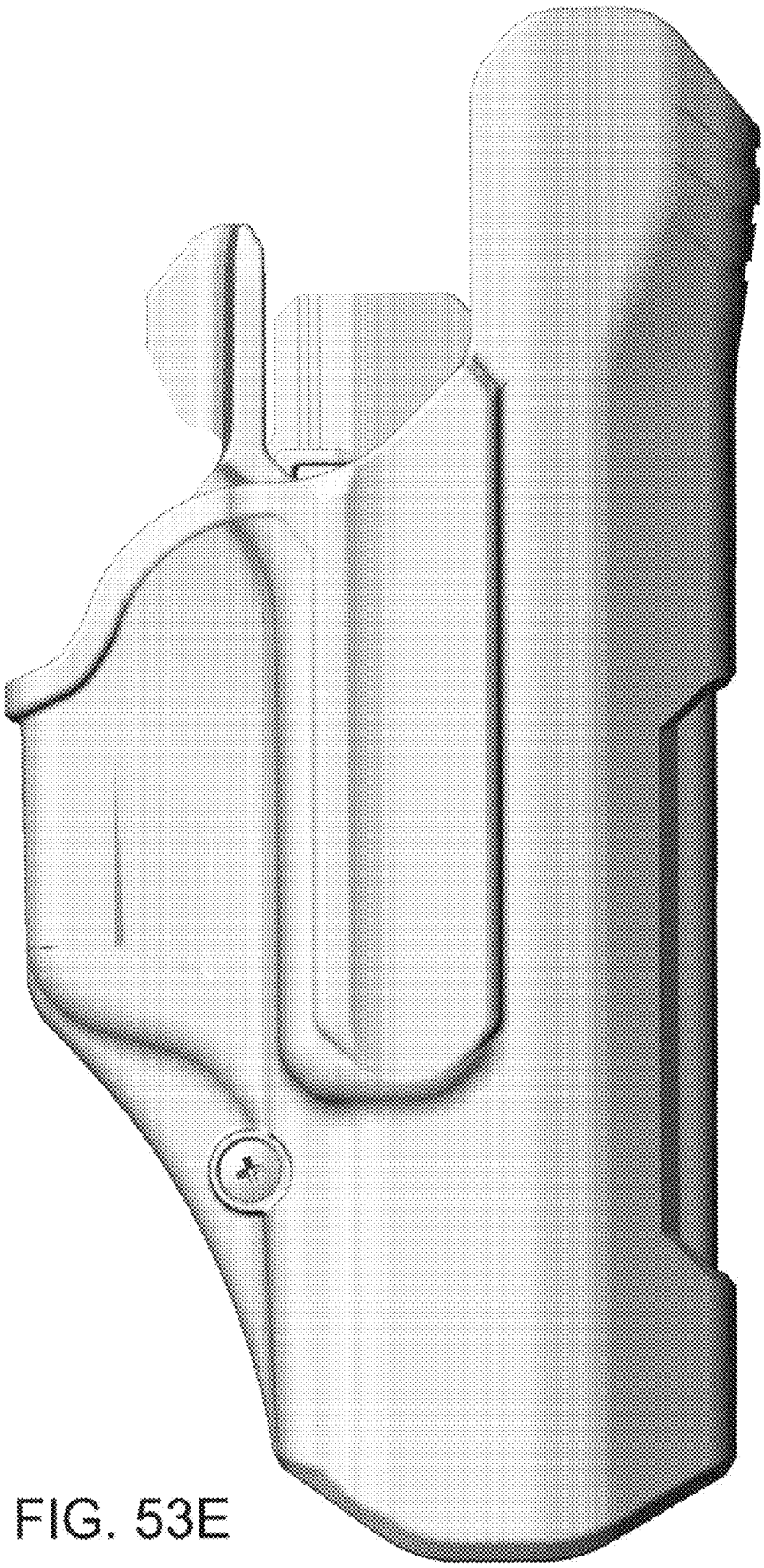
FIG. 53E is a left side view of the holster shown in FIGS. 52A and 52B.
Figure 53F:
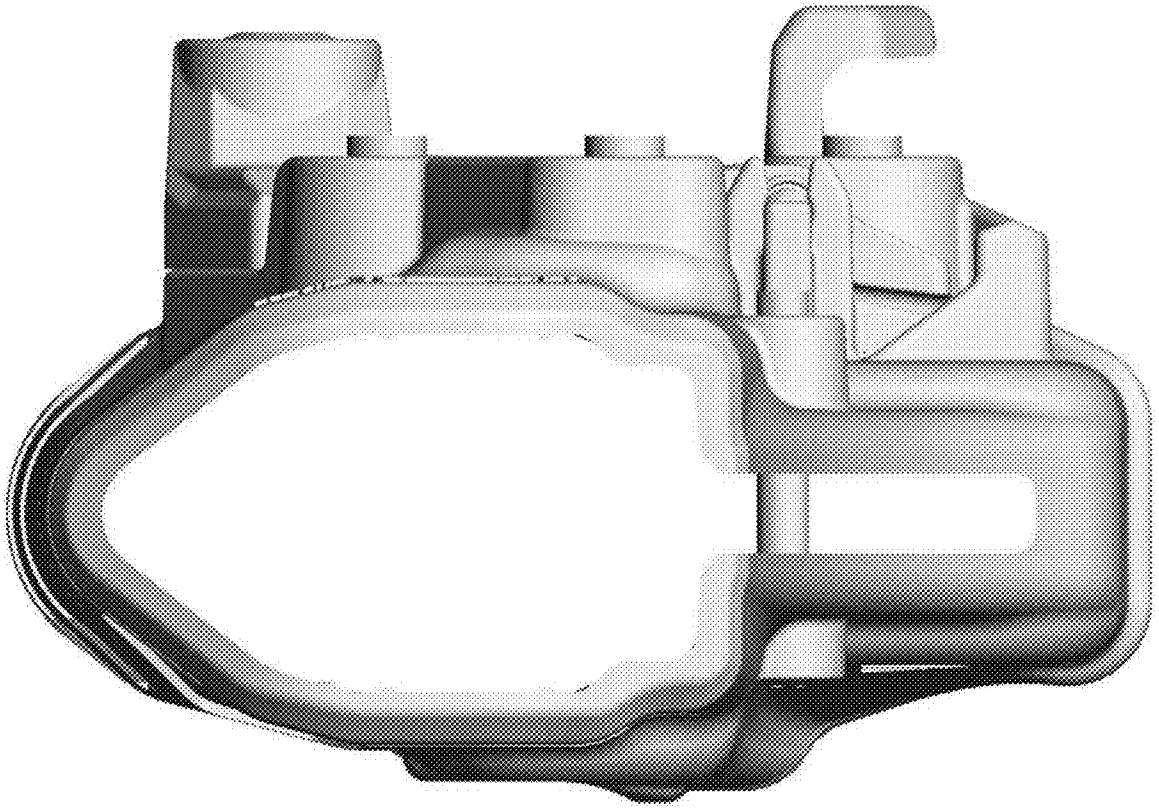
FIG. 53F is a bottom view of the holster shown in FIGS. 52A and 52B.

Referring to FIGS. 33A and 33B, a feature and benefit of embodiments is a retention mechanism having a lever 104' that can be pivoted with little tension in the muscles and tendons of the forearm and thumb while the forearm is extending in a downward direction and the thumb is contacting a thumb receiving tab 180. In embodiments, the retaining mechanism comprises a thumb receiving tab 180 that pivots about a first axis and a lever 104' that pivots about a second axis that is parallel to the first axis. In embodiments, the lever 104' pivots about an axis that is parallel to a handgun insertion and withdrawal axis 110H of the holster 100. In embodiments, the thumb receiving tab 180 pivots about an axis that is parallel to a handgun insertion and withdrawal axis of the holster 100. FIGS. 33A and 33B are two perspective views showing a holster including a U-shaped shroud. In the embodiment of FIG. 33A, the U-shaped shroud is in a handgun retaining position. In the embodiment of FIG. 33B, the U-shaped shroud is in a release position.

Referring to FIGS. 1-47, in embodiments, an exteriorly worn holster 100 for receiving a handgun 80 has a holster body 102 having a plurality of unitary holster wall portions defining a handgun receiving cavity 108 and a rearward opening 88. In embodiments, the handgun has a handgun body 84, a handgrip 86, a slide 98, and a trigger guard 90. In embodiments, the holster body 102 has a handgun receiving and withdrawal axis 110H. In embodiments, the plurality of holster wall portions comprise a user proximal wall portion 113 and a user distal wall portion 115, the proximal wall portion 113 having thumb button recess 218 with a thumb button recess edge portion 220 defining the thumb button recess 218. In embodiments, the thumb button recess 218 extends forwardly from the rearward opening 88.

In embodiments, a first user actuatable handgun retention mechanism 106 of the holster 100 is located at the proximal wall portion 113 for selectively preventing the handgun 80, when in the cavity 108, from being withdrawn from the cavity 108. In embodiments, the first handgun retention mechanism 106 comprises a first lever 104 pivotally mounted on the proximal wall portion 113 of the holster body 102 with a first axis of rotation. In embodiments, the first lever 104 has an actuation tab 107 rearwardly positioned on the lever 104 and positioned within the thumb button recess 218. In embodiments, the actuation tab 107 has an upper margin 222, a rearward margin 224, and a lower margin 226. In embodiments, the lever 104 further has a trigger guard blocking portion 128 forwardly positioned on the lever 104, the lever 104 being configured and positioned such that depression of the actuation tab 107 rotates the lever 104 about its respective axis of rotation to move the trigger guard blocking portion 128 from a trigger guard blocking position to a non-blocking position.

In embodiments, an upper portion 242 of the thumb button recess edge portion 220 extends rearwardly of the actuation tab 107 along the upper margin 222 of the actuation tab 107 and a lower portion 246 of the thumb button recess edge portion 220 extends rearwardly of the actuation tab 107 at the lower margin 226 of the actuation tab 107.

In embodiments, the holster 100 has only a single user actuatable handgun retention mechanism 106 and the actuation tab is configured as an actuation tab 107. In embodiments, the holster 100 comprises a pair of thumb guides 230 positioned above and below the actuation tab 107, the thumb guides 230 projecting laterally outward from the holster body proximal wall portion 113 beyond an undepressed position of the actuation tab 107. In embodiments, the thumb guides 230 each extend laterally outward from an outward surface of the proximal wall portion 113 a distance of at least 0.35 inches.

In embodiments, the holster 100 has a second handgun retention mechanism 174 including a pivoting shroud 176 positioned rearwardly of the slide 98 of the handgun 80 holstered in the holster 100. In embodiments, the second handgun retention mechanism 174 comprises a second lever 104', the second lever 104' having an actuation tab configured as a thumb button 180, the actuation tab of the first lever position behind the thumb button 180 whereby depression of the thumb button 180 also depresses the actuation tab of the first lever.

In embodiments, the holster 100 further comprises a pair of thumb guides 230 positioned above and below the thumb button 180, the thumb guides 230 projecting laterally outward from the holster body 102 proximal wall portion 113 beyond an undepressed position of the thumb button 180.

In embodiments, one of the thumb guides 230 is positioned above the thumb button 180 and comprises a housing for the second handgun retention mechanism 174.

In embodiments, a belt engaging member 160 is attached to the holster body 102 with a plurality of threaded fasteners 162 extending into the holster body 102.

In embodiments, one of said threaded fasteners 162 is positioned above the first lever 104, one of the plurality of threaded fasteners 162 is positioned below the first lever 104, and one of the plurality of threaded fasteners 162 is positioned forward of the first lever 104, wherein the first lever 104 is captured between the holster body 102 and the belt engaging member 160.

In embodiments, a column portion 236 of the belt engaging member 160 extends rearwardly, wherein when the handgun 80 is holstered. In embodiments, the thumb button 180 is positioned between the handgun body 84 and the belt engaging member 160, wherein the belt engaging member 160 has a pair of ribs 232 having their elongate dimension extending forwardly and rearwardly and positioned to confront the thumb guides 230 whereby access to the thumb button 180 is restricted on four sides of the thumb button 180 and an access path 252 for the thumb is provided rearwardly of the thumb button 180. Ribs 232 and bottom rib 254 define a cavity 256 or recess with three sides in the column portion 236 of belt engaging member 160. By providing a cavity 256 in belt engaging member 160, an access path 252 is provided, while allowing the holster 100 to be positioned closer to the body of the user than if cavity 256 were not present and the fourth wall of the cavity 256 was instead provided by a surface coplanar with the rest of the column portion 236 of belt engaging member 160. The ribs 232 may provide structural strengthening of the lower plate portion 258 as well as providing access inhibiting structure to prevent access by others from front of the holster 100 or the back side of the holster 100, as the holster 100 is worn. The recess or cavity 256 opening upwardly providing access to the holster wearer as well as guide structure to easily and non-visually guide the user's thumb to the proper location both to actuate a thumb release button 180 and for the master grip.

In embodiments, the belt engaging member 160 comprises a jacket slot belt loop 228. In embodiments, the jacket slot belt loop 228 has a column portion 236 including a lower plate portion 258 having a holster attachment region 260, a mid level portion 302, and an upper portion 264 with a pair of clamping belt loop portions 234. The lower plate portion 258 having apertures 266 for receiving threaded fasteners 162 for attachment of the holster body 102. The mid level portion 302 may have a distal side 268 that cooperates with the holster body 102 to capture components of a retention mechanism 106 between the holster body 102 and the mid level portion 302 and thereabove a pair of upright ribs 232 protruding outwardly from the distal side 268 of mid level portion 302 defining recess or cavity 256 therebetween that extends upwardly to the upper portion 264 and is open upwardly.

In embodiments, the belt engaging member 160 comprises a jacket slot belt loop 228 having a pair of clamping belt loop portions 234 extending from the column portion 236, each of the clamping belt loop portions 234 being adjustable with respect to the column portion 236 by a respective threaded fastener 262.

The upper portion 264 having a central column 272. A pair of belt loop portions 234 are displaced distally inward of the central column 272 and displaced laterally from the central column 272. The belt loop portions 234 connect to the central column 272 at upper connecting portions 274. In certain embodiments, the central column 272, the upper connection portions 274 and the belt portions 234 all unitary with each other. Each belt loop portion 234 having a lower end 276 not unitarily joined to the central column 272 but having a closable spacing therefrom. The central column 272 may have protruding portions configured as bosses 280 to cooperate with the lower ends 276 of the belt loop portions 234. Threaded fasteners 262 may be utilized to adjust the spacing between each belt loop portions 234 and the central column 272 effecting a clamping action onto a belt, such as a duty belt, whereby the jacket slot belt loop 228 is secured to a user's belt. Optional elastomeric bushings (not shown) may be utilized between the lower ends 276 of the belt loop portions 234 and bosses 280 of the central column 272 wherein the bushings comprise a bore in a central axis of bosses 280 for receiving the threaded fasteners 262. A feature and advantage of such embodiments is that the level of clamping of the jacket slot belt loop 228 and holster 100 are readily adjustable. Moreover, the lateral offset of the belt loop portions 234 from the central column 272 provides stability for the mounting system and holster 100 as the length of the engagement of the jacket slot belt loop 228 with the holster 100 is extended.

In certain embodiments, threaded fasteners 262 can be unscrewed from lower ends 276 of the belt loop portions 234 such that there is a gap 284 between lower ends 276 of the belt loop portions 234 and bosses 280. This gap 284 allows the jacket slot belt loop 228 to receive a belt of the user without the user needing to weave the belt through belt slots 286 formed by the openings in between belt loop portions 234 and central column 272. This allows user to receive a belt in the belt slots 286 without removing other accessories already attached to the belt. Alternatively, a user can weave a belt through belt slots 286 without fully unscrewing threaded fasteners 262. Once a belt is received in the belt slots 286, the threaded fasteners 262 can be re-engaged with the lower ends 276 of clamping belt loop portions 234. The belt can be more tightly secured by tightening threaded fasteners 262. In certain embodiments, if a belt is of a narrower width than belt slots 286, the action of tightening threaded fasteners 262 may force the belt up in the belt slots 286 so that the belt is biased against the upper margin 288 of upper portion 292 of belt slots 286 (FIGS. 35A and 35D) 23. In this manner, belt slots 286 can accommodate a belt that has a width less than that of belt slots 286. In certain embodiments, the distance between the lower ends 290 of the belt slots 286 near the bosses 280 may be greater than the distance between the upper portion 292 of the belt slots 286 near upper margin 288.

In some embodiments, the outside face 294 of the clamping belt loop portions 234 may have protruding features 296, such as ribs or studs, in order to receive a belt more securely (FIG. 35B). On other embodiments, the back side 298 of column portion 236 of belt engaging member 160 may also have protruding features 300 such as ribs or studs, in order to receive belt more securely.

In embodiments, the thumb guides 230 each extend laterally outward from an outward surface of the proximal wall portion 113 a distance of at least 0.35 inches. In embodiments, the thumb guides 230 each extend laterally outward from an outward surface of the proximal wall portion 113 a distance of at least 0.35 inches and the ribs 232 extend outwardly from a surface of the column portion 236 a distance of at least 0.15 inches.

In embodiments, the first lever 104 is seated in a lever receiving region 238 on the proximal wall portion 113 of the holster body and the proximal wall portion 113 has three threaded bosses 240 dispersed around the lever receiving region 238 for receiving a belt engaging member 160. In embodiments, the proximal wall portion 113 further has a plurality of lever region containment wall portions 244 extending from the outer surface of the proximal wall portion 113 and each of the plurality of lever containment wall portions 244 connect to at least one of the three threaded bosses 240. In embodiments, the three threaded bosses 240 are positioned for receiving a belt engaging member 160 utilizing a plurality of threaded fasteners 162.

In embodiments, the first lever 104 is seated in a lever receiving region 238 on the proximal wall portion 113 and the proximal wall portion 113 has three threaded bosses 240 dispersed around the lever receiving region 238 for receiving a belt engaging member 160 and, when the belt engaging member 160 is attached, the first lever 104 is captured within the lever receiving region 238. In embodiments, the first lever 104 may be removed from an engagement with the proximal wall portion 113 when the belt engaging member is not attached to the proximal wall portion 113. In embodiments, the first lever 104 may be removed without tools when the belt engaging member is not attached. In embodiments, the first lever 104 may be removed by simply prying the first lever 104 outward when the belt engaging member 160 is not attached.

In embodiments, the holster body 102 has an upper wall portion having a pair of inclined wall portions defining a joint, a lower wall portion with a slit 250 extending from a forward opening to proximate a trigger guard receiving portion of the holster body defining a pair of forward clamping wall portions 248. In embodiments, a threaded fastener 142 is positioned so as to extend between the pair of forward clamping wall portions 248 for adjusting the forward clamping wall portions 248 about a forward portion of the handgun 80.

Referring to FIGS. 1-47, in embodiments, a holster 100 is provided for receiving a handgun 80 having a handgun body 84, a slide 98, and a trigger guard 90. In embodiments, the holster 100 comprises a holster body 102 having a plurality of holster wall portions defining a rearward opening cavity 108 extending along a handgun receiving and withdrawal axis 110H for receiving and holding the handgun 80. In embodiments, the plurality of holster wall portions comprise a user proximal wall portion 113 and a user distal wall portion 115. In embodiments, the holster includes a first handgun retention mechanism 106' and a second handgun retention mechanism 174, disposed at the proximal wall portion 113, each handgun retention mechanism selectively preventing the handgun 80, when in the cavity 108, from being withdrawn from the cavity 108. In embodiments, the first and second handgun retention mechanisms have a respective first lever 104' having a first axis of rotation and a second lever 180 with an axis of rotation, each lever having a respective actuation tab portion on one end of the lever where depression of the actuation tab rotates the lever about its respective axis of rotation, one of the two actuation tabs configured as a thumb receiving button with an outer thumb receiving surface, the other of the two actuation tabs positioned behind the thumb receiving button such that depression of the thumb receiving button effects a depression of the other of the two actuation tab portions, whereby depression of the thumb receiving button actuates both the first handgun retention mechanism 106' and the second handgun retention mechanism 174. In embodiments, the first lever 104' of the first handgun retention mechanism 106' is pivotally supported by the holster body 102. In embodiments, the first lever 104' comprises an elongate central portion 124 and a blocking portion 128 at an end opposite the respective actuation tab, the blocking portion 128 movable in and out of a handgun blocking position. In embodiments, the second handgun retention mechanism 174 comprising a U-shaped member 176 that is pivotally supported by the holster body 102 so that the U-shaped member 176 selectively pivots between a handgun retaining position in which the U-shaped member extends across a portion of a rearward opening of the cavity 108 and a release position in which the U-shaped member 176 is displaced from the portion of the rearward opening so that a withdrawal path of the handgun 80 is unobstructed by U-shaped member 176.

Leg Strap Adapter

The present disclosure also provides embodiments of a leg strap adapter that, in certain embodiments, can be rotatably connected to a belt engaging member, including those of the present disclosure. Thus, in any of the foregoing embodiments, the belt engaging member can be rotatably connected to a leg strap adapter as described herein by way of at least one hole in the leg strap adapter. In certain embodiments, the leg strap adapter can also be height adjustable by incorporating multiple holes for rotatably connecting the leg strap adapter to the belt engaging member by any one of the holes. In other embodiments, such holes are located along a central, vertical axis of the leg strap adapter.

In embodiments, the leg strap adapter can include a leg strap adapter plate having a central, vertical axis and a horizontal axis, the adapter plate further including at least one hole. In certain embodiments the leg strap adapter includes two or more holes along the vertical axis of the leg strap adapter plate and at least one slot disposed along the horizontal axis of the leg strap adapter plate, where the horizontal axis is orthogonal to the central, vertical axis, the leg strap adapter configured for rotatable attachment to a belt engaging member or holster. In other embodiments, the leg strap adapter has two or more slots. The holes can be configured to receive a screw or other fastener that permits rotation about the screw or fastener as described herein. In some embodiments, the slots are positioned proximate to a first end of the leg strap adapter plate while the holes are positioned proximate to a second end of the leg strap adapter plate, the first end and second end being spaced apart along the vertical axis of the leg strap adapter plate. In some embodiments, the leg strap adapter plate includes two holes along the vertical axis of the leg strap adapter plate. In some embodiments, the leg strap adapter plate includes three, four, or five holes along the vertical axis of the leg strap adapter plate, or otherwise arranged in a pattern on the second end of the leg strap adapter plate. By way of example, but not limitation, the holes can be arranged in a line, a triangle, a square, a diamond or any other configuration. In some embodiments, the leg strap adapter plate is planar or substantially planar. In some embodiments, the leg strap adapter further includes a belt or strap passing through the slots. In some embodiments, the leg strap adapter further includes a belt or strap operatively connected to the leg strap adapter plate without including or using slots. In some embodiments, the belt or strap can be adjustable to accommodate a limb, such as a leg, of the user. In some embodiments, the leg strap adapter can further include a raised portion positioned between the two or more slots, the raised portion extending in a plane substantially parallel to a plane of the leg strap adapter. In some embodiments, the raised portion can include ridges on a user proximal face of the raised portion. For example, the raised portion can have ridges on the surface that contacts the belt or strap. In some embodiments, the ridges can extend in lines connecting the two or more slots. For example, the ridges can extend in lines substantially parallel to the horizontal axis of the leg strap adapter. In some embodiments, the leg strap adapter plate can further include side ridges positioned between the slots proximate to the sides of the leg strap adapter distal from the central, vertical axis and those sides on a user distal face of the leg strap adapter. In some embodiments, the side ridges can extend in lines substantially parallel to the horizontal axis of the leg strap adapter.

In any of the foregoing embodiments, the leg strap adapter can be rotatably attached to the belt engaging member by a threaded member or any other fastener that permits rotatable connection via any one of the holes in the leg strap adapter. The threaded member or other fastener can pass through any one of the holes in the leg strap adapter and a corresponding aperture in the belt engaging member. Thus, where the leg strap adapter includes two or more holes, at different points along the central, vertical axis, the leg strap adapter can be height adjustable depending on through which one hole the threaded member or other fastener passes. By such height adjustment, how high on a user's leg the leg strap adapter rides can be adjusted. The threaded member or other fastener can be fixed to the belt engaging member, which itself can further engage another element such as a holster as described herein. Similarly, where the holes are in any other configuration, the leg strap adapter can be horizontally or vertically adjustable relative to the belt engaging member. Thus, as there is only one attachment point, the rotatable connection between the leg strap adapter and the belt engaging member can allow rotation of the leg strap adapter plate in a plane parallel or substantially parallel to a plane of the belt engaging member. Thus, when worn by a user, the leg strap adapter plate can rotate in a plane along the side of the user's leg to provide flexibility as the user moves. In certain embodiments, the leg strap adapter rotates about the threaded member or other any other fastener as the user's leg moves forward and backward in a plane parallel or substantially parallel to a plane of the belt engaging member. In some embodiments, the belt engaging member includes a jacket slot belt loop as described in the present disclosure. Thus, the leg strap adapter can be attached to the jacket slot belt loop such that it is attached to belt engaging member via the jacket slot belt loop.

In any of the foregoing embodiments, the leg strap adapter rotatably attached to the belt engaging member can be further connected to any holster described in the present disclosure. In any of the foregoing embodiments, the leg strap adapter plate can be of unitary construction. In some embodiments, the leg strap adapter plate can have a substantially trapezoidal or rhombohedral shape where the holes are positioned toward a narrower end of the leg strap adapter plate to better accommodate rotation of the leg strap adapter around the screw or fastener that affixes the leg strap adapter to the belt engaging member.

Figure 54A:
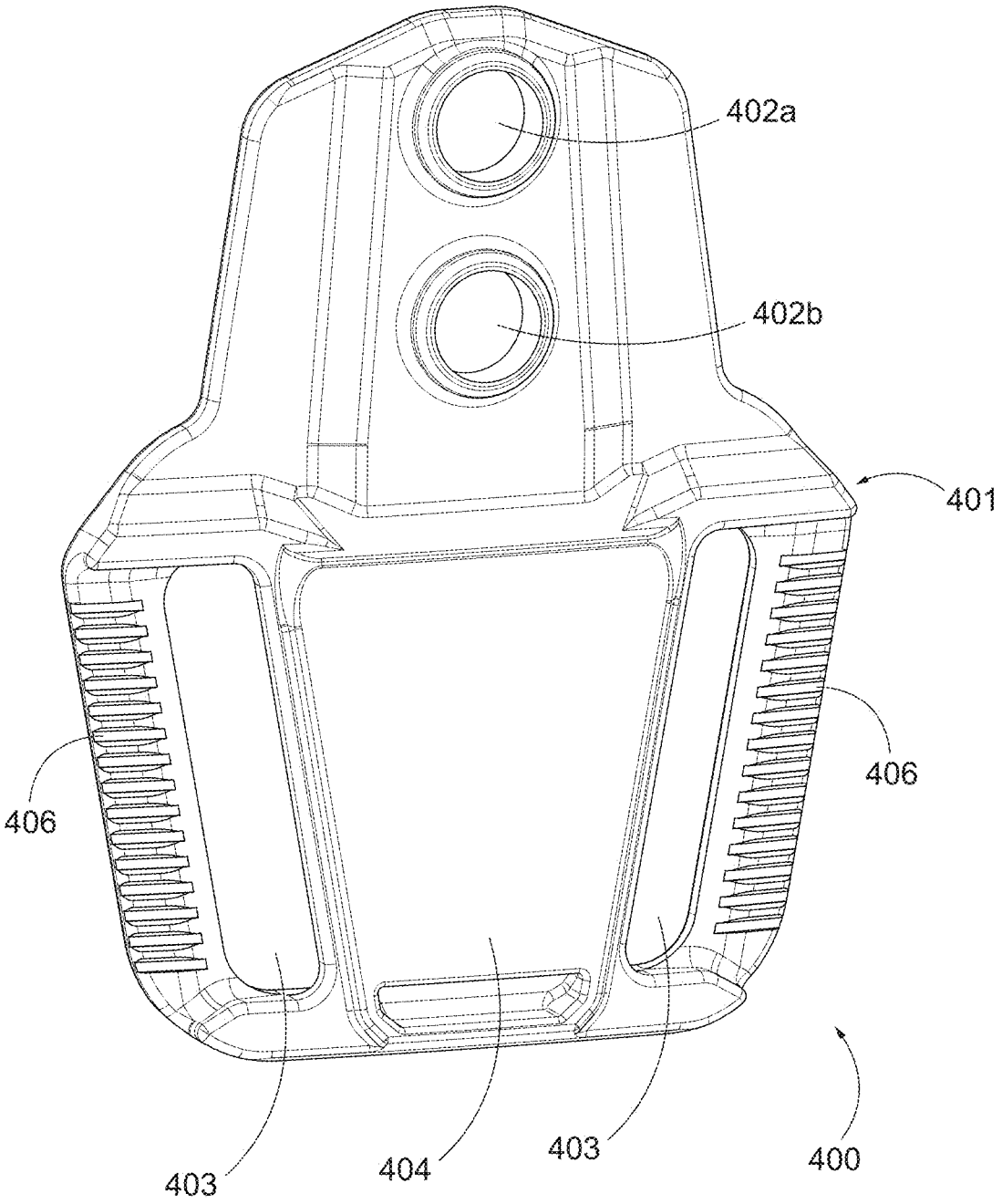
FIG. 54A is a rear view of an exemplary embodiment of a leg strap adapter described herein.
Figure 54B:
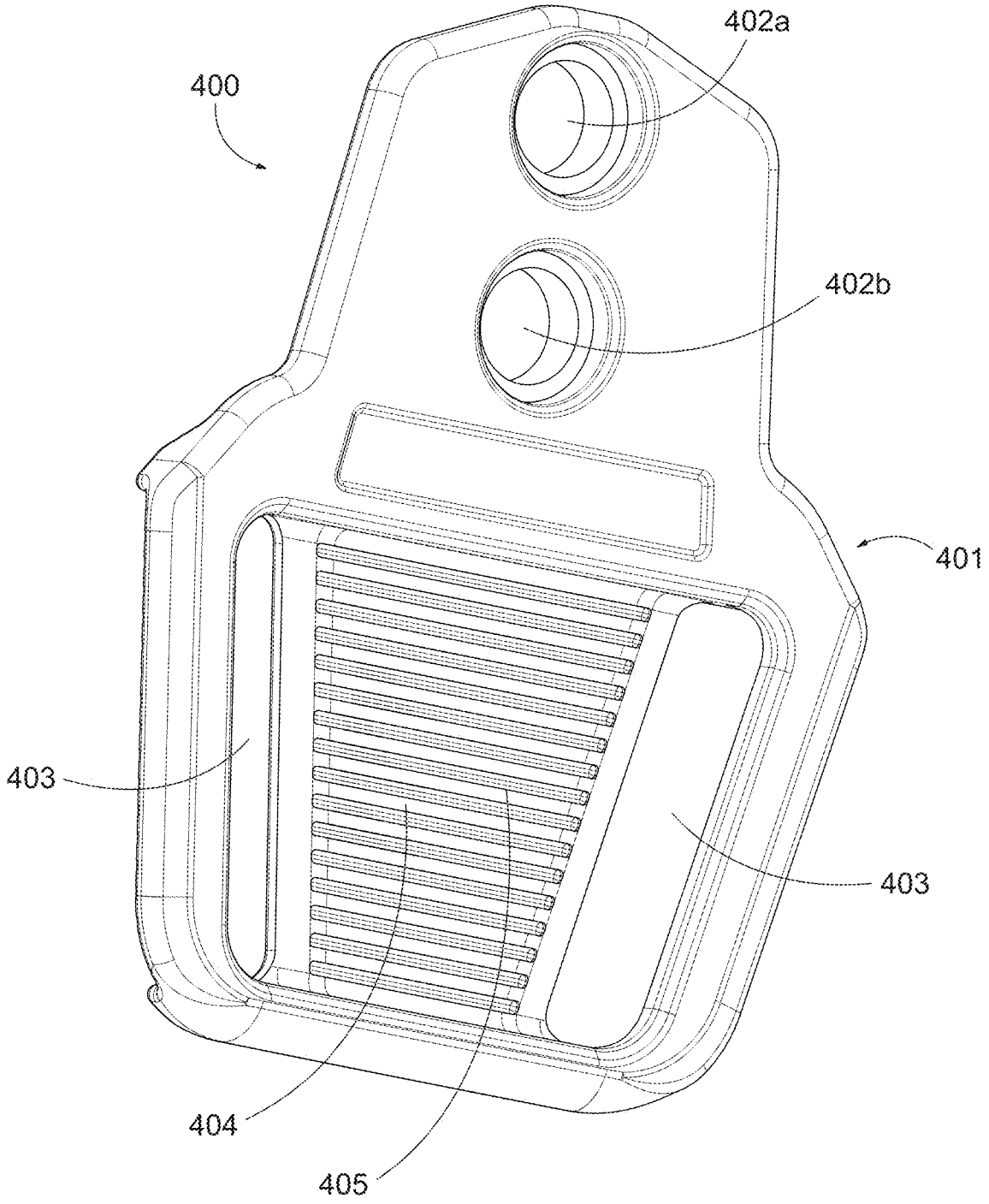
FIG. 54B is a front view of the exemplary embodiment of a leg strap adapter shown in FIG. 54A.

Referring to FIGS. 54A-54B, an exemplary embodiment of a leg strap adapter in accordance with the present disclosure is depicted. As shown in FIGS. 54A-54B, the leg strap adapter 400 includes a leg strap adapter plate 401, two holes (402*a* and 402*b*) disposed along a vertical axis of the leg strap adapter plate, and two slots 403 disposed along a horizontal axis of the leg strap adapter plate 401 configured to receive a strap or belt (not shown), the leg strap adapter plate further including side ridges 406 between the slots and the sides of the leg strap adapter plate distal from the vertical axis. As further shown in FIGS. 54A-54B, the slots 403 can be formed by two apertures formed in the leg strap adapter plate 401 and extending toward the first and second ends of the leg strap adapter and spaced apart along a horizontal axis of the leg strap adapter plate 401 with a raised portion 404 that extends along a plane parallel to a plane of the leg strap adapter 400 bridging the space between the slots 403 which includes ridges 405 on a user proximal face of the raised portion 404. Thus, there is an offset distance between a plane of the raised portion 404 and a plane of the leg strap adapter plate 401.

Figure 55A:
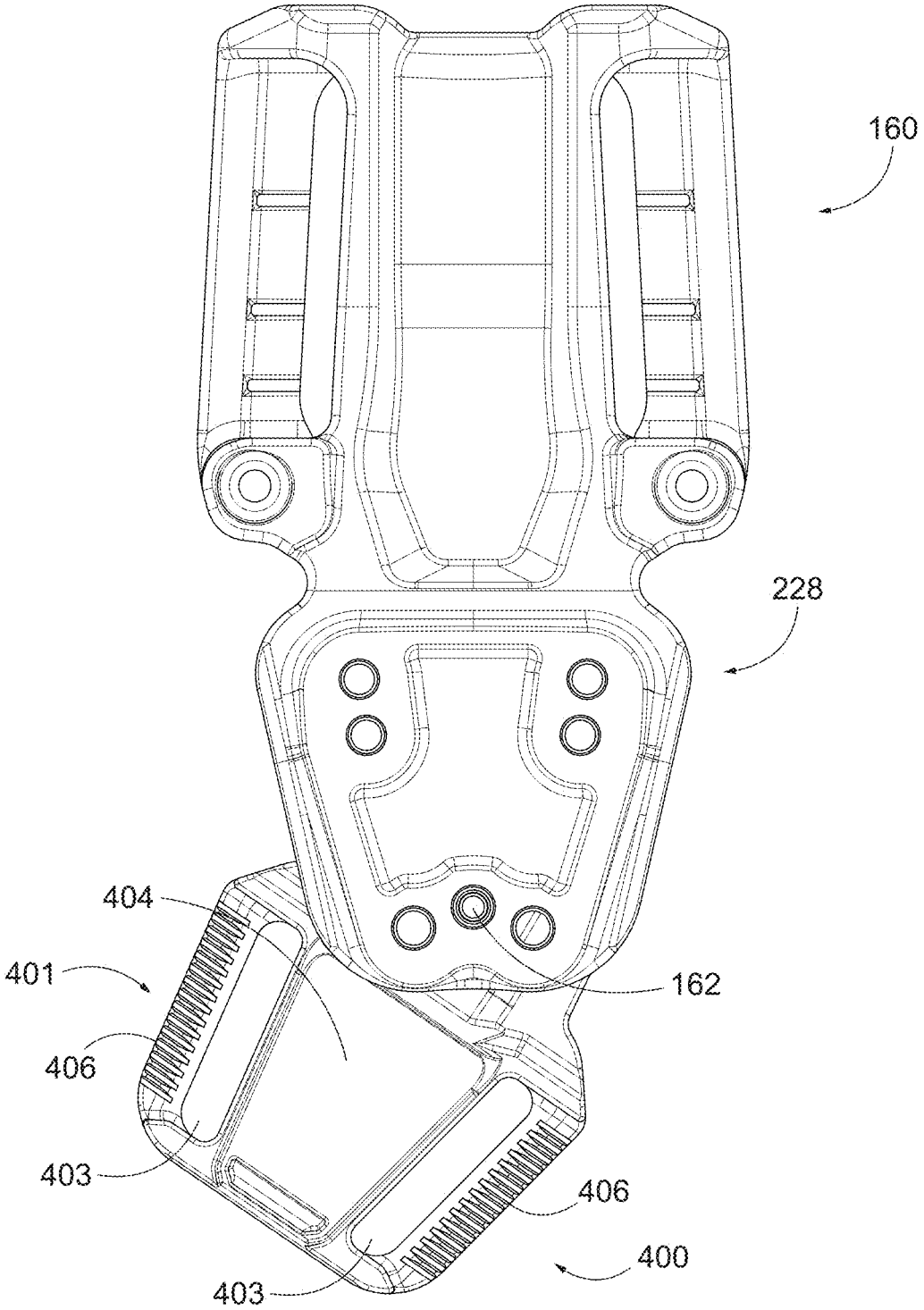
FIG. 55A is a front view of an exemplary embodiment of a leg strap adapter connected to a belt engaging member as described herein.
Figure 55B:
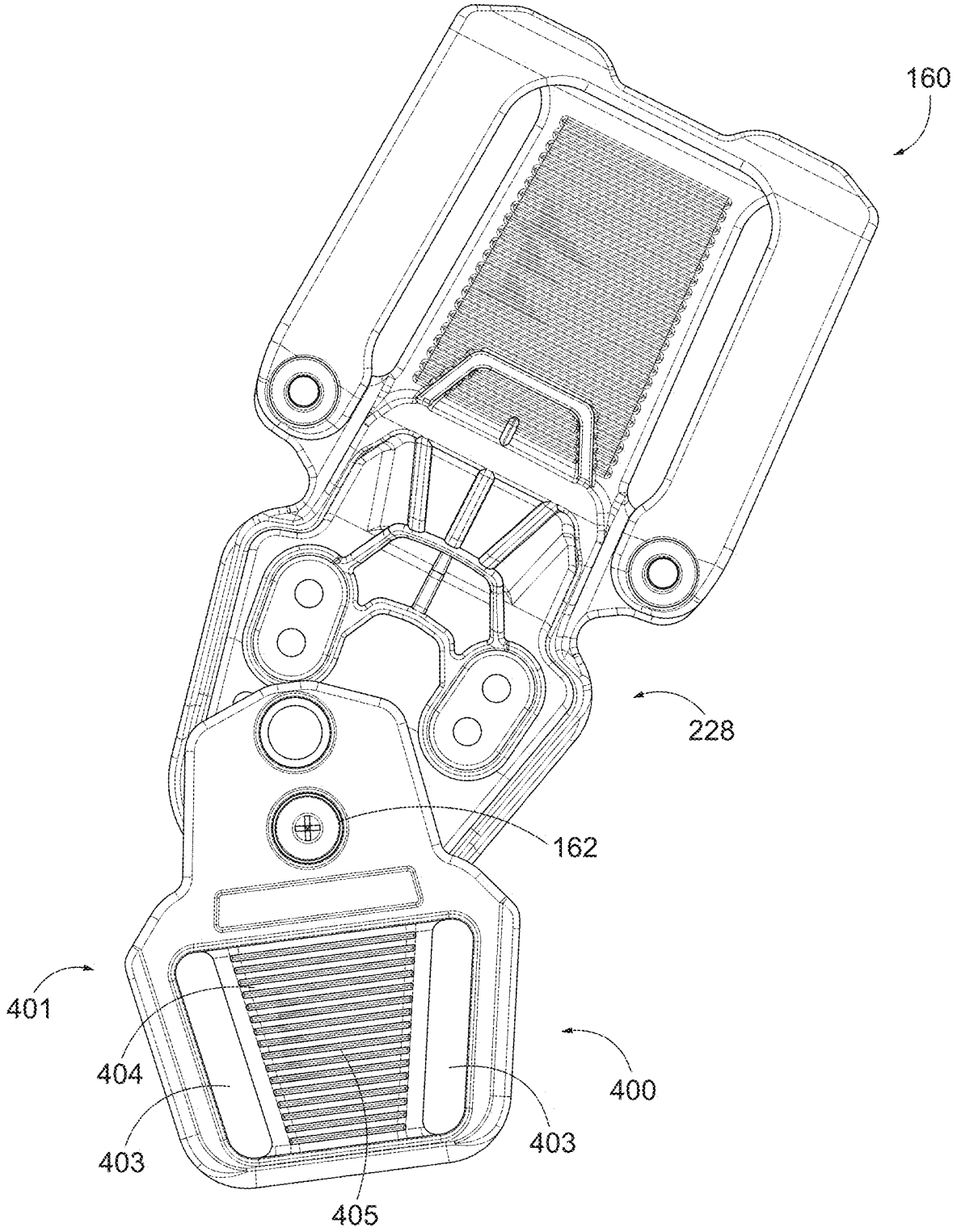
FIG. 55B is a rear view of the exemplary embodiment of the leg strap adapter connected to the belt engaging member as shown in FIG. 55A.
Figure 55C:
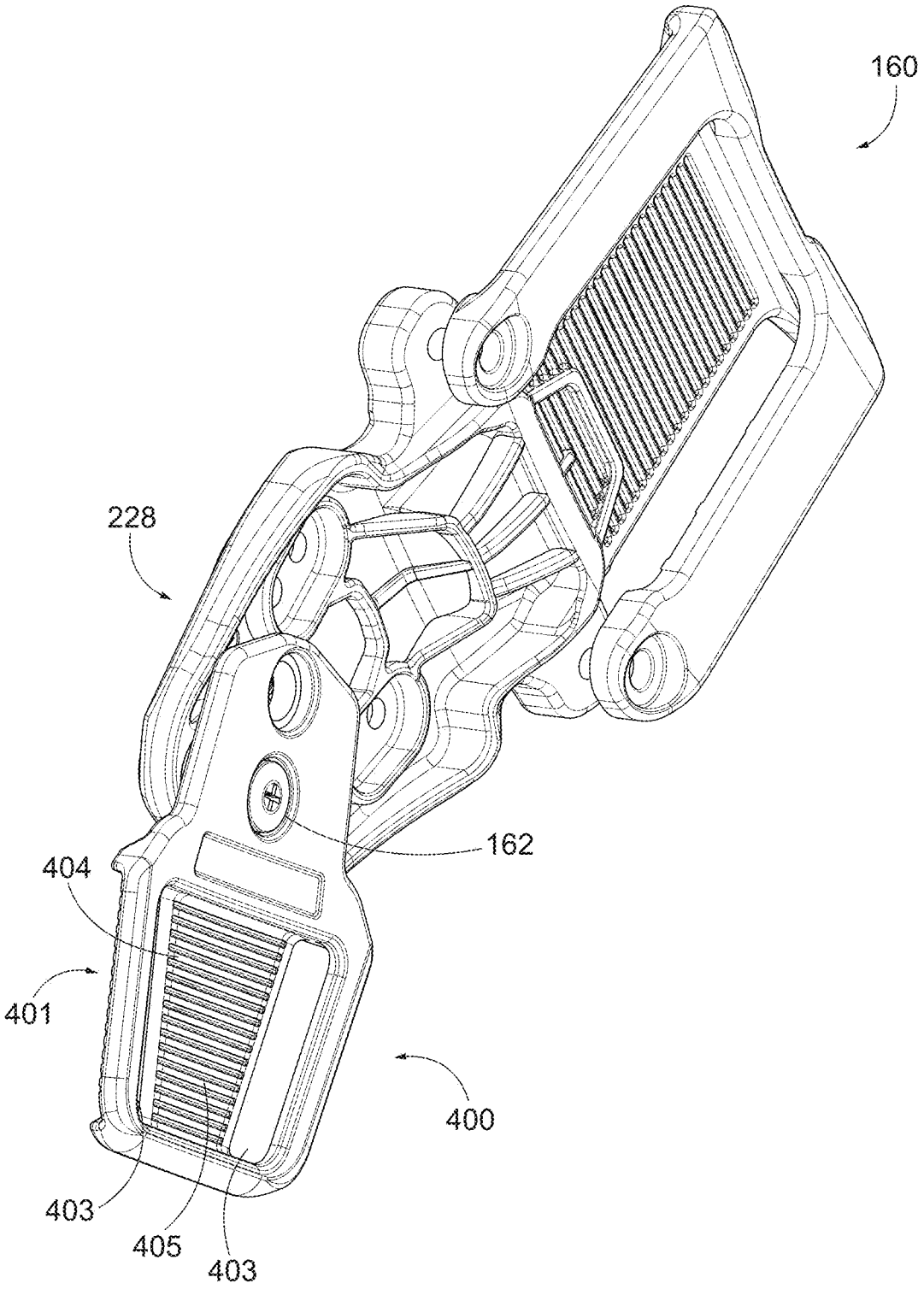
FIG. 55C is a rear, perspective view of the exemplary embodiment of the leg strap adapter connected to the belt engaging member as shown in FIGS. 55A-55B.

Referring to FIGS. 55A-55C, an exemplary embodiment of a leg strap adapter 400 rotatably connected to a belt engaging member 160 that includes a jacket slot belt loop 228 in accordance with the present disclosure is depicted. As shown in FIGS. 55A-55C, the leg strap adapter 400 includes a leg strap adapter plate 401, two holes (402*a* and 402*b*) disposed along a vertical axis of the leg strap adapter plate 401, and two slots 403 disposed along a horizontal axis of the leg strap adapter plate 401 configured to receive a strap or belt (not shown) the leg strap adapter plate further including side ridges 406 between the slots and the sides of the leg strap adapter plate distal from the vertical axis. As further shown in FIGS. 55A-55C, the slots 403 can be formed by two apertures formed in the leg strap adapter plate 401 and toward the first and second ends of the leg strap adapter and spaced apart along a horizontal axis of the leg strap adapter plate 401 with a raised portion 404 that extends along a plane parallel to a plane of the leg strap adapter bridging the space between the slots 403 which includes ridges 405 on a user proximal face of the raised portion 404. FIGS. 55A-55C further depict that the leg strap adapter 400 is rotatably attached to the belt engaging member 160 by a threaded fastener 162 that passes through one of the holes (402*a* or 402*b*) in the leg strap adapter plate 401 and through the belt engaging member 160. This configuration allows the leg strap adapter plate 401 to rotate around the threaded fastener 162 in a plane substantially parallel to a plane of the belt engaging member 160. It should be understood that the threaded fastener 162 can be one that is already used with the belt engaging member 160 or is used solely to affix the leg strap adapter plate 401 to the belt engaging member 160.

Red Dot Sight Dust Cover

The present disclosure also provides a red dot sight (RDS) dust cover that can be integrated with any holster, including those of the present disclosure, that is further configured to accommodate a handgun with a RDS or any holster capable of accommodating a handgun with a RDS. Holsters of the present disclosure can be modified to accommodate a handgun with a RDS by extending a portion of an upward wall of the holster body to form a pocket for receiving the RDS. The RDS dust cover can be used with either level-2 or level-3 configuration.

In any of the foregoing embodiments, the holster can further be configured to receive a handgun with a red dot sight (RDS) and further include a dust cover configured to cover at least a portion of the RDS, the dust cover being pivotally connected to a portion of the holster body, such as the upward wall portion of the holster body. Thus, the dust cover can be pivoted from a first position, where it does not cover the RDS, and a second position, where it covers at least a portion of the RDS. In some embodiments, the holster body further includes a two-position detent positioned to engage two followers on the dust cover, where the two-position detent includes a first, open position detent and a second, closed position detent on each of a first side of the two-position detent and a second, opposite side of the two-position detent, the first, open position detents biasing the dust cover in the first position and the second, closed position detents biasing the dust cover in the second position. In some embodiments, the first, open position detent and the second, closed position detent on each side of the two-position detent are separated by a ridge having a peak such that the respective follower encounters resistance in moving from the first, open position detent to the second, closed position detent and vice versa, thus biasing the dust cover in the open or closed position depending on the relative position of the followers, i.e. in the first, open position detents or the second, closed position detents. In embodiments, the followers can be made of a flexible material such that they can deflect when passing over the ridge without breaking, but are of sufficient rigidity that they can engage the first, open position detent or second, closed position detent to bias the dust cover in the first, open position or the second, closed position, respectively. The ridge can include a peak and thus have a sloped shape on each side of the ridge in the direction of each of the first, open position detent and the second, closed position detent, respectively, such that the ridge provides resistance while the sloped portions aid in deflecting the follower away from or toward the detents. The followers can be disposed at an end of the dust cover proximal to the upward portion of the holster body, one positioned on each of the first and second sides of the two-position detent, extending toward the two-position detent and configured to engage the first detents in the first position or the second detents in the second position. In some embodiments, the two-position detent can be positioned on a central rib of the upward portion of the holster body. In such instances, the followers on the dust cover can positioned with one on each side of a central, vertical axis of the dust cover, the prongs disposed pointing toward the central, vertical axis, and positioned to engage the two-position detent. In operation, the dust cover can be displaced from the second position to the first position by the draw of the gun from the holster which displaces the followers from the second, closed detents to the first, open detents which biases the dust cover in the open position. Once the gun is returned to the holster, the dust cover can be moved manually by the user from the first position to the second position, moving the followers from the first detents to the second detents of the two-position detent, thereby biasing the dust cover in the second position and covering at least a portion of the RDS.

In some embodiments, the dust cover is configured to cover all portions of the RDS not covered by the holster body. In some embodiments, the dust cover is hingeably connected to the upward portion of the holster body. By way of example, but not limitation, the dust cover can further include two pegs, one that extends from a user proximal side of the dust cover toward the and through an aperture in the user proximal wall portion of the holster body and one that extends from a user distal side of the dust cover that is opposite of the user proximal side away from the user proximal wall and through an aperture in the user distal wall portion of the holster body, the pegs and apertures configured to permit hingeable operation of the dust cover. By way of further example, but not limitation, rather than the apertures being in the user proximal wall portion and the user distal wall portion, respectively, the apertures can be in a side of the upward portion of the holster body proximate to the user proximate wall portion of the holster body and in a side of the upward portion of the holster body proximate to the user distal wall portion. Thus, it should be understood that the pivotable nature of the dust cover can be effected by various designs that permit pivoting of the dust cover from the first position to the second position. Thus, the pivoting of the dust cover can be around an axis orthogonal to an axis between upward and downward portions of the holster body. For example, the pivoting can be from a downward direction to an upward direction, and vice versa. In this way, the dust cover can be tilted toward the gun when it is holstered to cover at least a portion of the RDS or away from the gun so that it can be drawn. It should be understood that the foregoing embodiments described with respect to the dust cover can be for a holster that includes a level-2 or level-3 configuration as described herein or to any other holster that can accommodate a RDS-equipped gun.

In some embodiments, where the holster is in a level-3 configuration, the dust cover can further include a foot portion that extends in the direction of the user proximal wall portion or the user distal wall portion from a user proximal side of the dust cover or a user distal side of the dust cover, respectively. The foot portion can be position near an end distal from the followers. For example, the foot portion can be positioned at the "top" of the dust cover. The shroud of the holster further includes a channel configured and positioned to catch the foot portion of the dust cover such that, if the dust cover is in the first position, when the shroud is moved back, the channel engages the foot portion and pulls the dust cover from its first portion to its second position. Thus, the channel can be positioned on a user proximal side of the shroud or a user distal side of the shroud depending on whether the foot portion is on the user proximal side of the dust cover or the user distal side of the dust cover, respectively. In operation, for a holster with a level-3 configuration, when the shroud is in the release position, the dust cover is maintained in its second position. The dust cover can then be moved from its second position to its first position and vice versa as described above, either manually by the user, or pushed from second position to first position by the gun as it is withdrawn from the holster. When the shroud is in the release position and the dust cover is in the first position, the dust cover can be moved to the second position manually by the user. In the alternative, when the shroud is moved from the release position to the handgun retaining position, if the dust cover is in the first position, the channel of the shroud will catch the foot portion and move the dust cover from the first position to the second position. It should be understood that the foot portion can be on either or both the user proximal side of the user distal side of the dust cover and that the channel(s) in the shroud can be positioned to correspond to the position(s) of the foot portion(s).

Figure 56A:
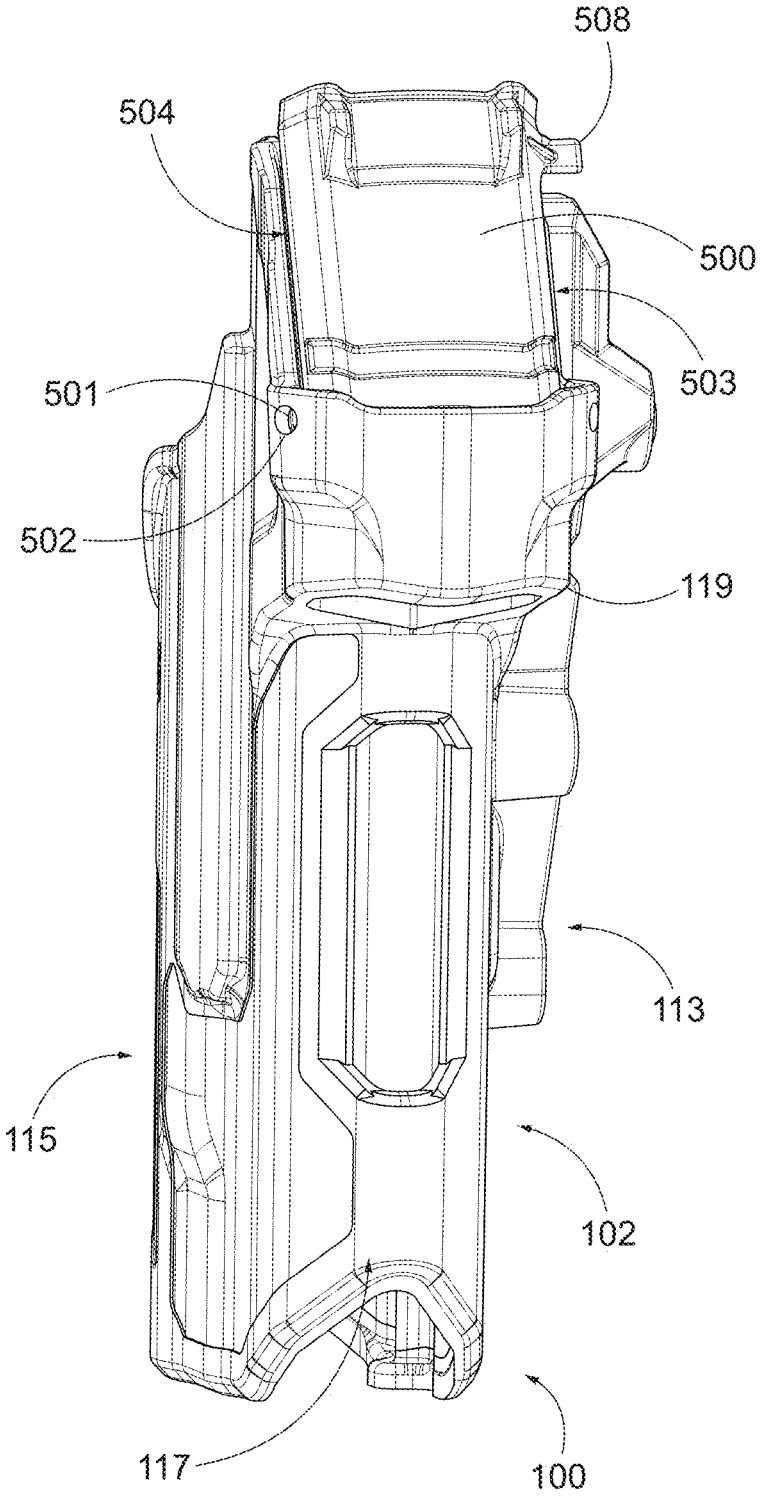
FIG. 56A is a view of an exemplary embodiment of a level-2 holster with a RDS dust cover from an upward end of the holster.
Figure 56B:
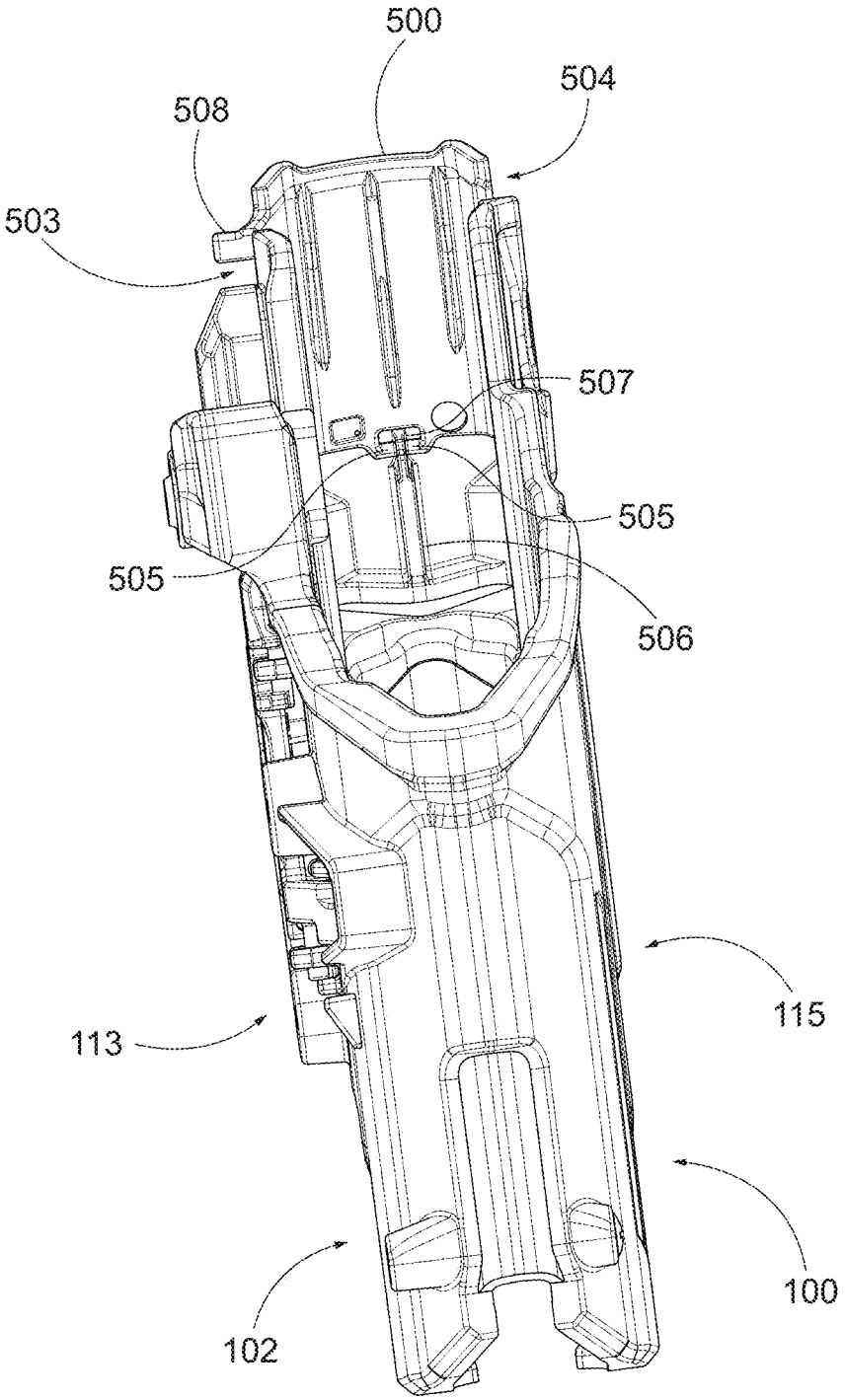
FIG. 56B is a view of the exemplary embodiment of the holster from FIG. 56A from the downward end of the holster.
Figure 56C:
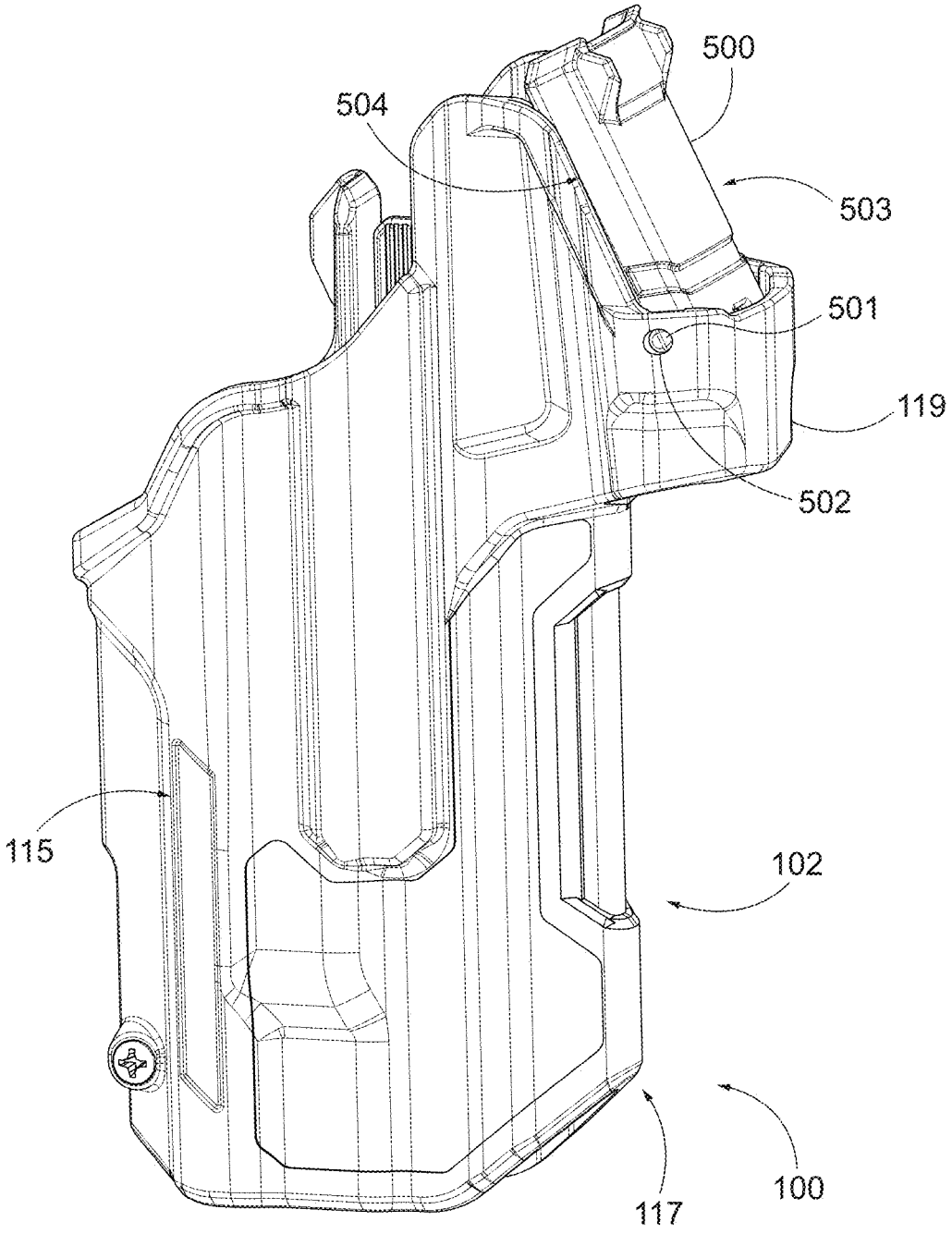
FIG. 56C is a view from the user distal side of the exemplary embodiment of the holster from FIG. 56A.
Figure 56D:
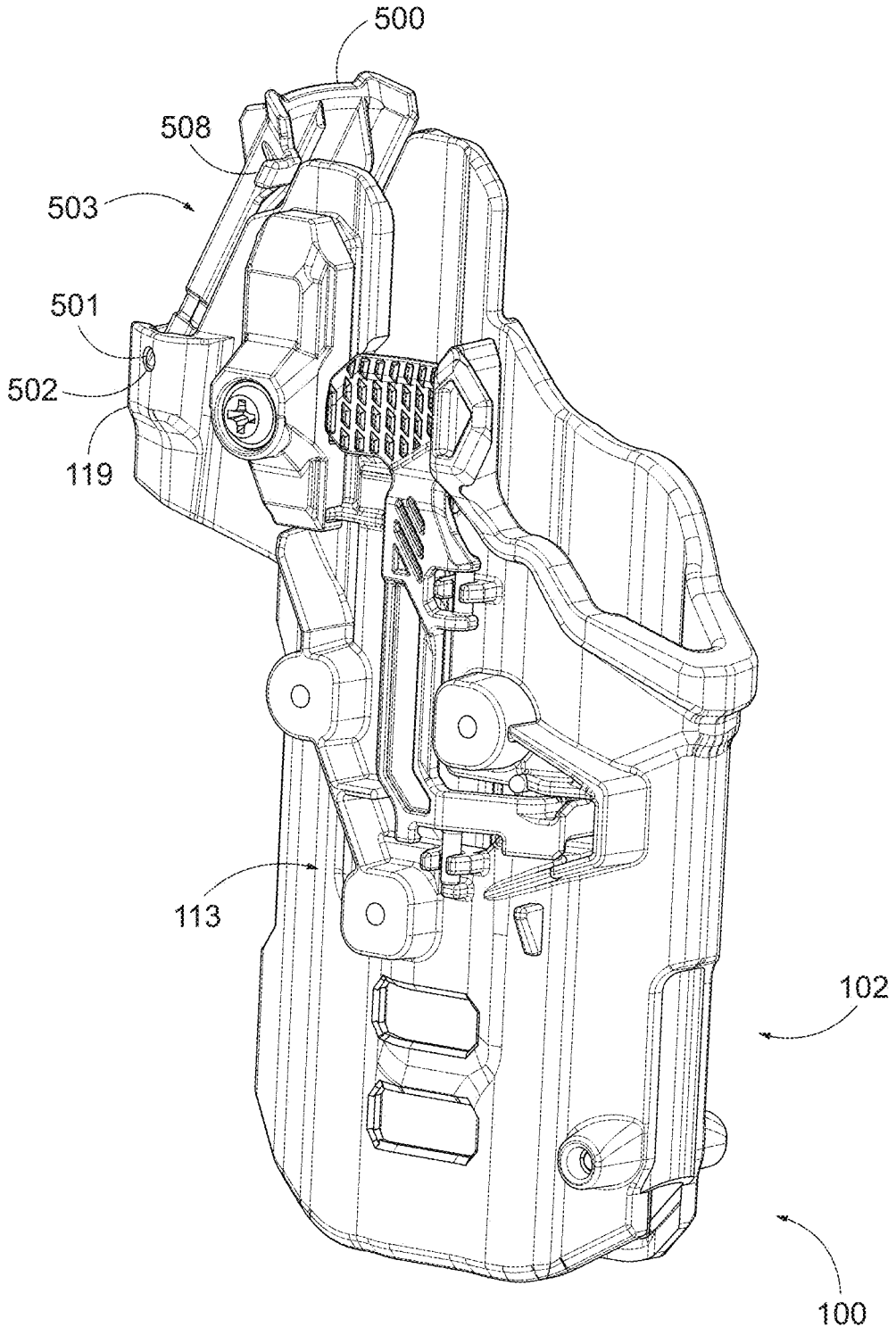
FIG. 56D is a view from the user proximal side of the exemplary embodiment of the holster from FIG. 56A.
Figure 56E:
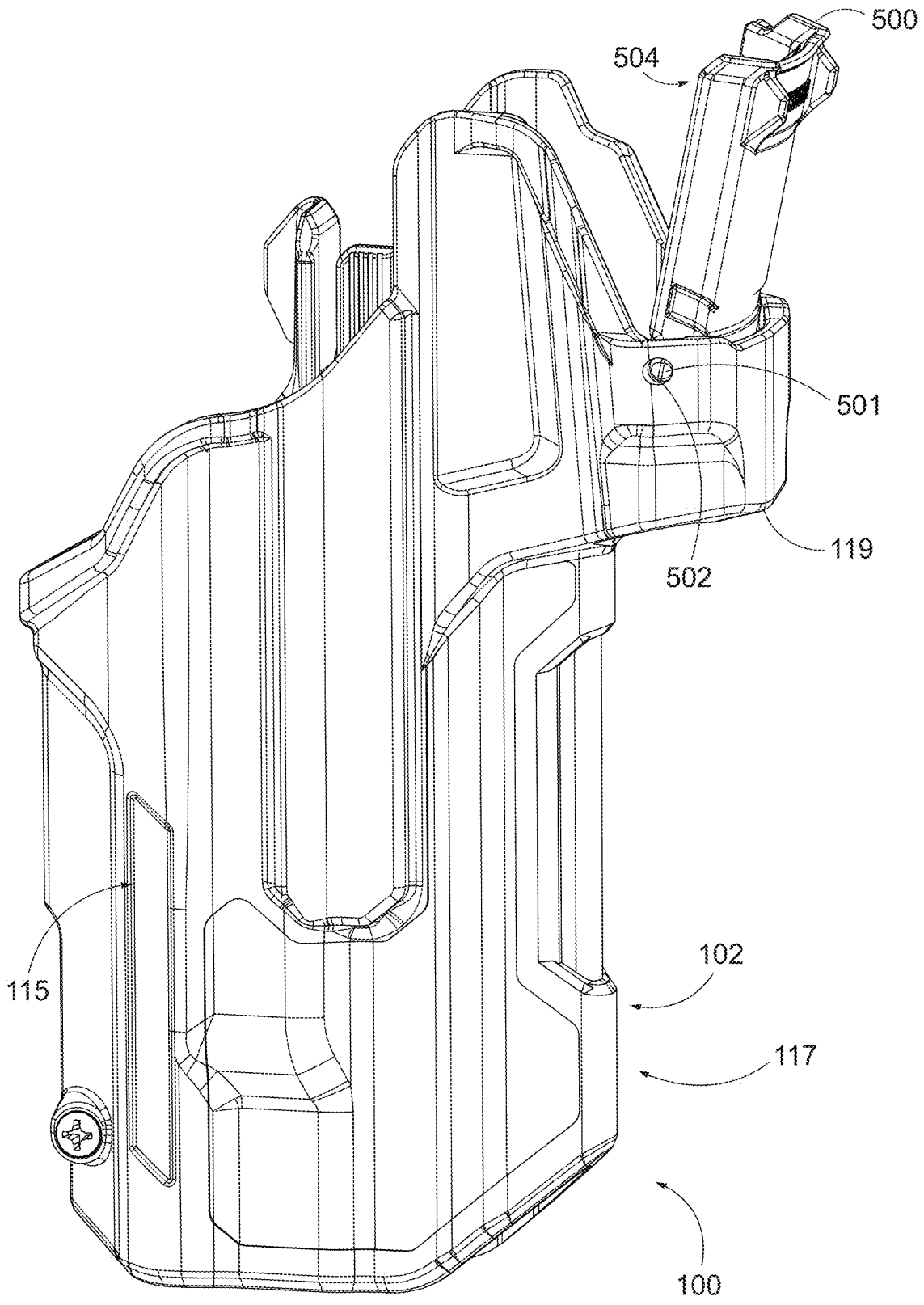
FIG. 56E is a view from the user distal side of the exemplary embodiment of the holster from FIG. 56A with the dust cover in the first, open position.
Figure 56F:
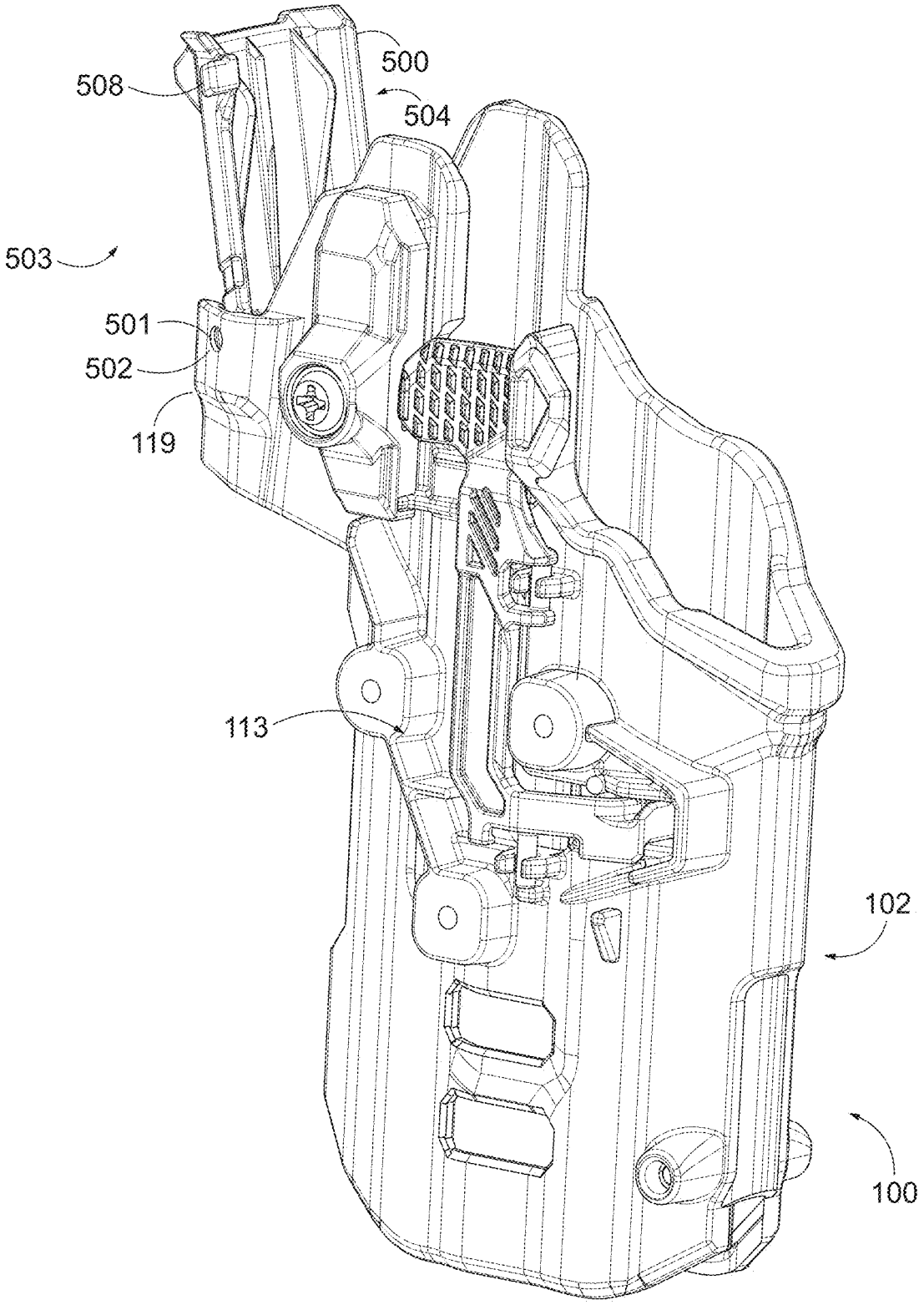
FIG. 56F is a view from the user proximal side of the exemplary embodiment of the holster from FIG. 56A with the dust cover in the second, closed position.
Figure 57:
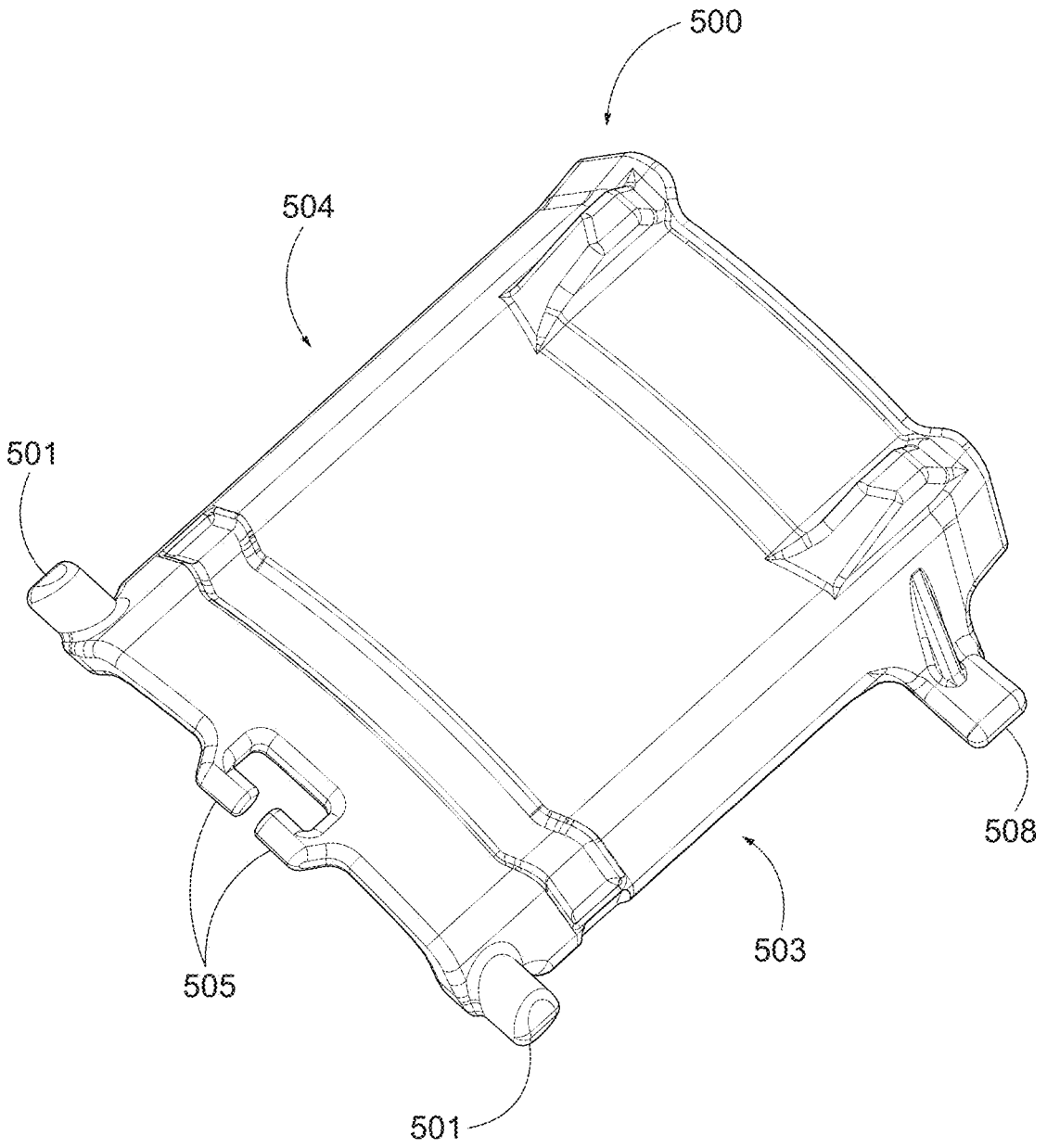
FIG. 57 is a view of the exemplary dust cover of FIG. 56A.

Referring now to FIGS. 56A-58H, exemplary embodiments of the holster configured to accommodate a handgun with a RDS and a dust cover of the present disclosure are provided. FIGS. 56A-56F depict an exemplary level-2 configuration while FIGS. 59A-59H depict an exemplary level-3 configuration and aspects thereof. FIGS. 57 and 58 depict an exemplary dust cover of the present disclosure and a close up view of an exemplary pair of the followers and the two-position detent, respectively.

As shown in FIGS. 56A-56F, an exemplary embodiment of a level-2 holster configuration with a dust cover of the present disclosure is shown. Referring to FIG. 56A, the holster is shown from the upward end and includes the holster 100 having a holster body 102 which includes a user proximal wall portion 113, a user distal wall portion 115 and a upward wall portion 117. The holster is configured to accommodate a handgun having a RDS as evidenced by the projection 119 in the upward wall portion 117. The dust cover 500 is hingeably attached to the upper wall portion 117 in a position to cover at least a portion of the RDS when the handgun is in the holster 100 and the dust cover 500 is in the second, closed position as shown in FIG. 56A. As depicted, the dust cover 500 is hingeably attached to the holster 100 by two protrusions or pegs 501 (only one is shown) that extend through two corresponding apertures 502 (only one is shown) in the upper wall portion 117 on the user proximal and user distal sides (503 and 504, respectively) of the dust cover 500. FIG. 56B depicts the same exemplary embodiment as in FIG. 56A from the downward end of the holster 100. FIG. 56B shows the two followers 505 at the end of the dust cover proximal to the upward portion of the holster body 102. It can be seen that the followers 505 extend on either side toward a central rib 506 of the upward portion of the holster body toward a two-position detent 507. Turning to FIGS. 56C-56D, the exemplary embodiment of FIG. 56A is shown from the user distal side 504 (FIG. 56C) and from the user proximal side 503 (FIG. 56D). Referring to FIGS. 56E and 56F, the holster 100 is shown with the dust cover 500 in the first, open position from the user distal side 504 (FIG. 56E) and the user proximal side 503 (FIG. 56F). When the dust cover 500 is in the first position, the handgun can be inserted or withdrawn without contacting the dust cover 500. As discussed above, when the dust cover 500 is in the second position as in FIGS. 56A-56D, it can be displaced to the open position by the draw of the handgun which moves the followers from the second, closed position detent 510 to the first, open position detent 509 of the two-position detent 507 to bias the dust cover 500 in the open position and permit the continued draw of the handgun.

In FIGS. 56A-56B, 56D and 56F, the dust cover 500 can include a foot portion 508 as shown, however, it should be understood that in embodiments where the holster 100 does not include a level-3 configuration with a shroud, the foot portion can be omitted.

Figure 58A:
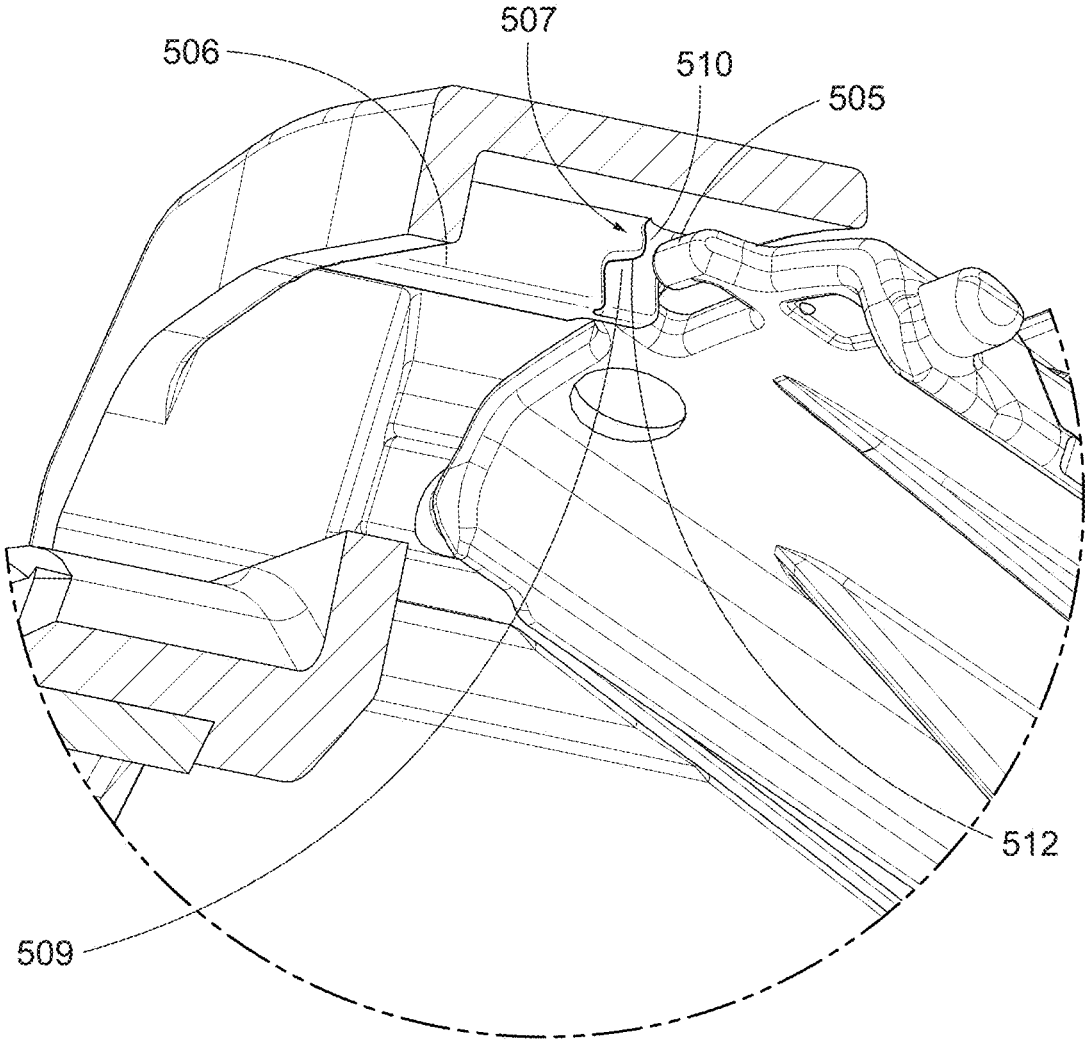
FIG. 58A is a close up view of an exemplary configuration of the followers and two-position detent.
Figure 58B:
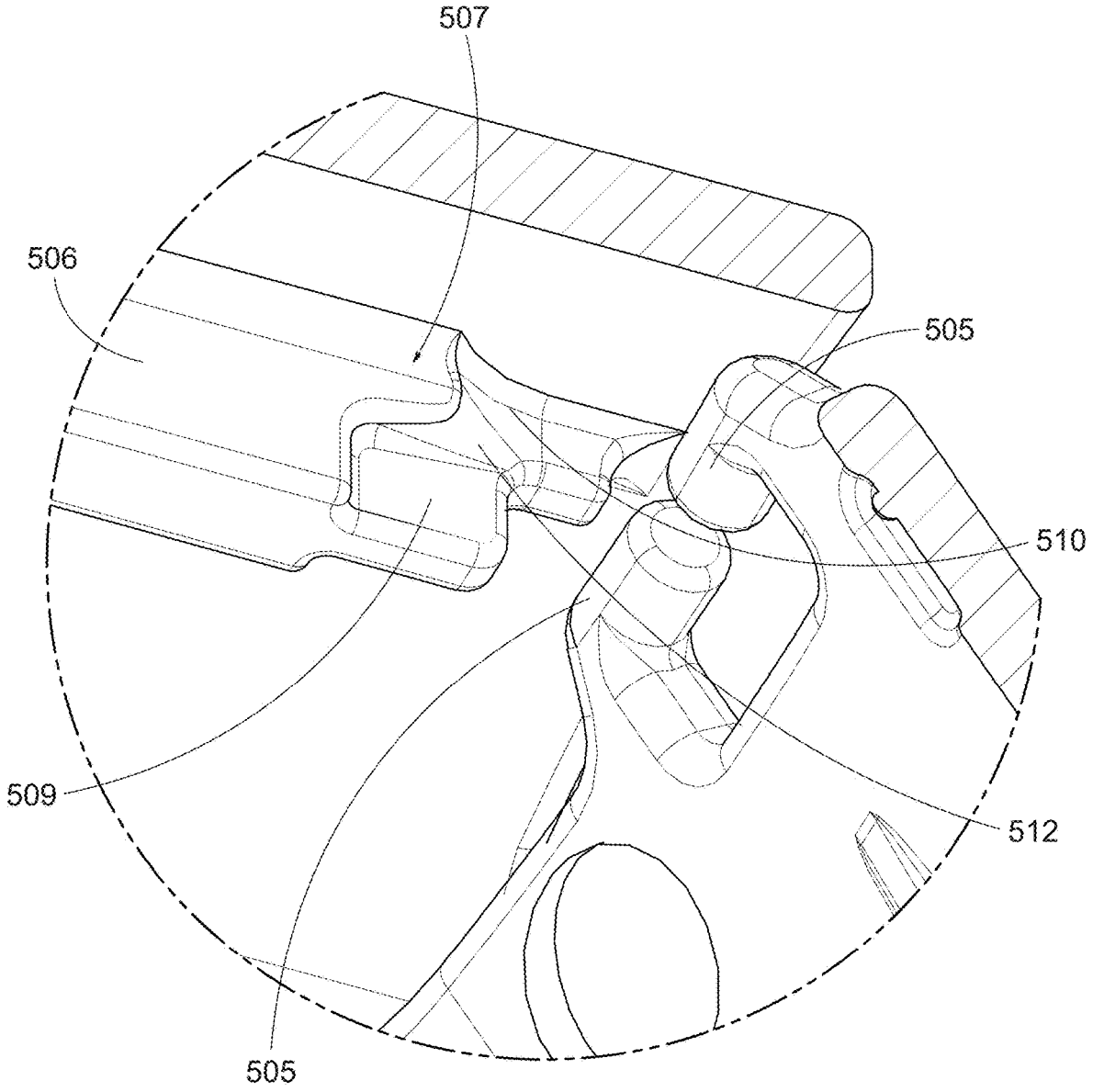
FIG. 58B is a close up view of the exemplary configuration of the followers and two-position detent of FIG. 58A.

As shown in FIG. 57, an exemplary embodiment of the dust cover 500 of the present disclosure can have a user distal side 504 and a user proximal side 503, two followers 505 at an end proximal to the upward portion of the holster, and a foot portion 508 at an end distal from the followers 505 that extends in the direction of the user proximal wall portion a user proximal side of the dust cover. As noted above, it should be understood that the foot portion is not required if the dust cover is not being used in a level-3 configuration and, even in a level-3 configuration, may not require the foot portion if the shroud is not configured with a channel to catch the dust cover. As shown in FIG. 58A, the two followers 505 can be positioned on either side of a two-position detent 507 which includes a first, open position detent 509 and a second, closed position detent 510 on each of a first side of the two-position detent 507 and a second, opposite side of the two-position detent 507 where the first, open position detent 509 and the second, closed position detent 510 are separated by a ridge 512, the first, open position detent 509 biasing the dust cover 500 in the first position and the second, closed position detents 510 biasing the dust cover 500 in the second position. As depicted the two-position detent 507 can be located on a central rib 506 of an upward portion of the holster 100. FIG. 58B shows an extreme close-up of the two-position detent and the followers of the dust cover of FIG. 58A, with the dust cover displaced from the two-position detent, which shows that the ridge includes a peak and sloped sides, sloping toward each of the first, open position detent 509 and the second, closed position detent 510.

Figure 59A:
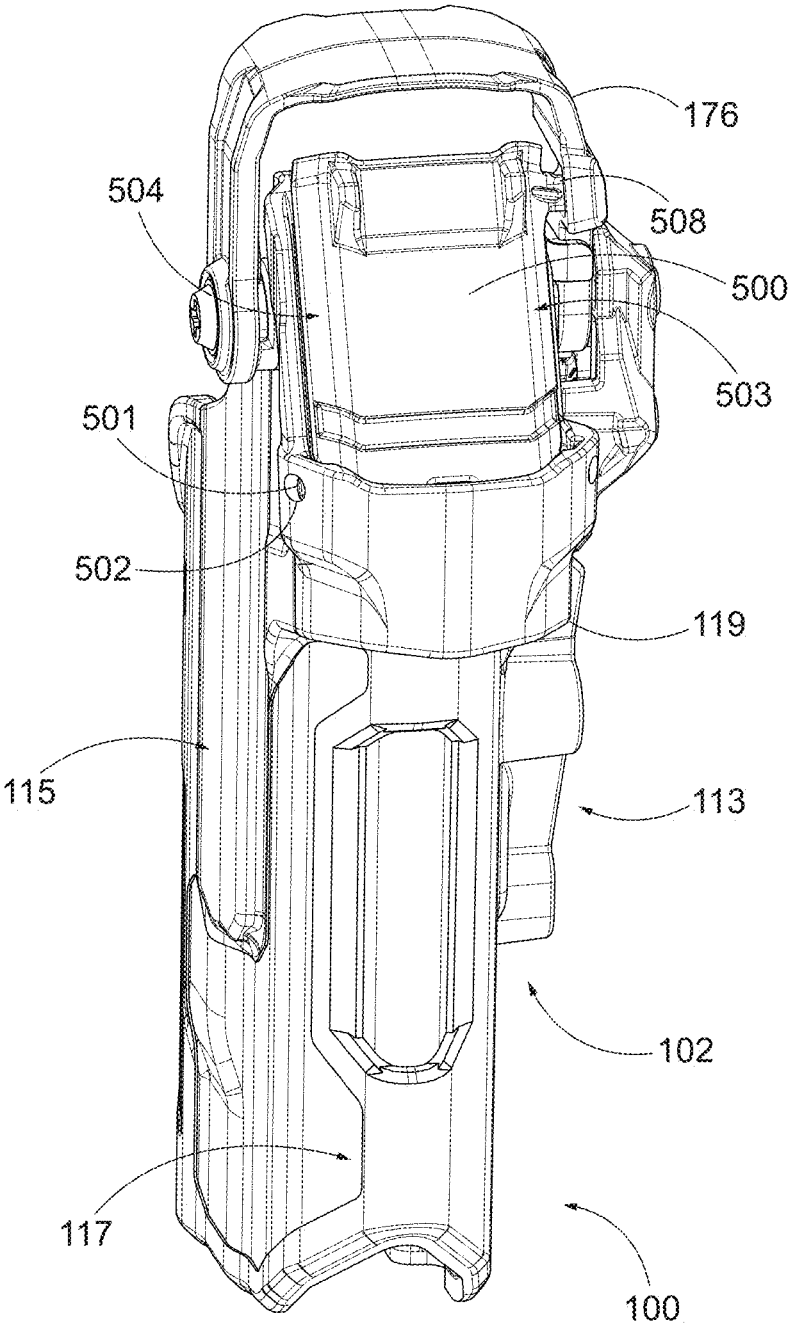
FIG. 59A is a view of an exemplary embodiment of a level-3 holster with a RDS dust cover from an upward end of the holster
Figure 59B:
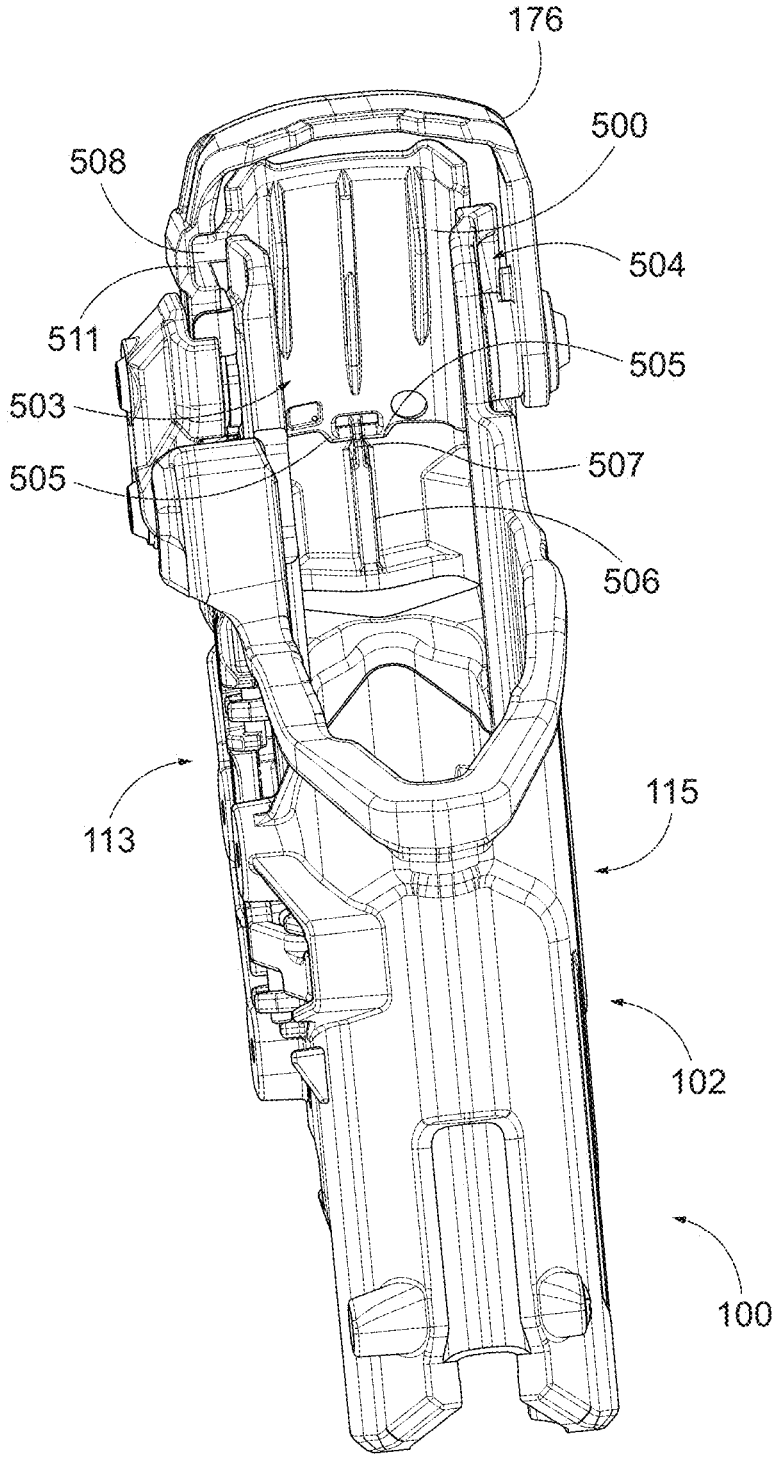
FIG. 59B is a view of the exemplary embodiment of the holster from FIG. 59A from the downward end of the holster.
Figure 59C:
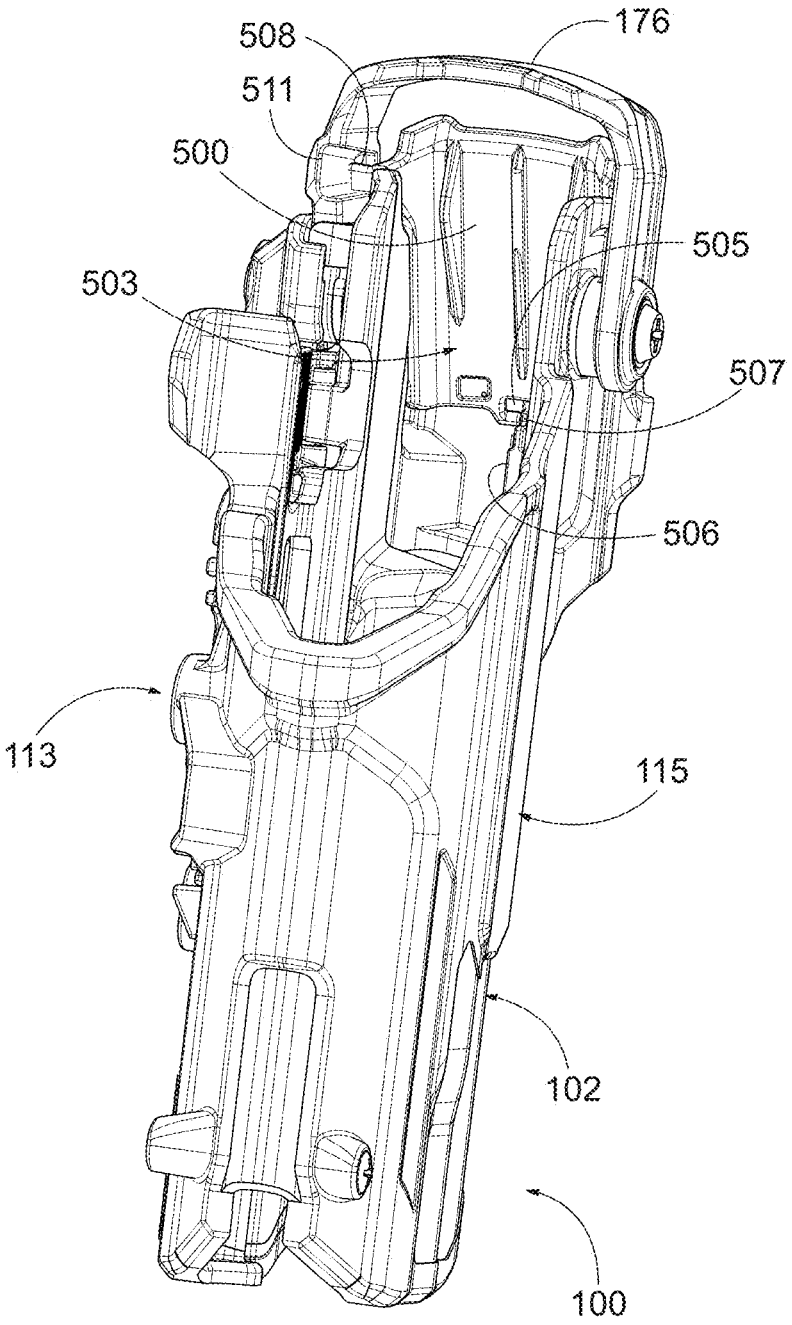
FIG. 59C is a perspective view of the exemplary embodiment of the holster from FIG. 59A from the downward end of the holster.
Figure 59D:
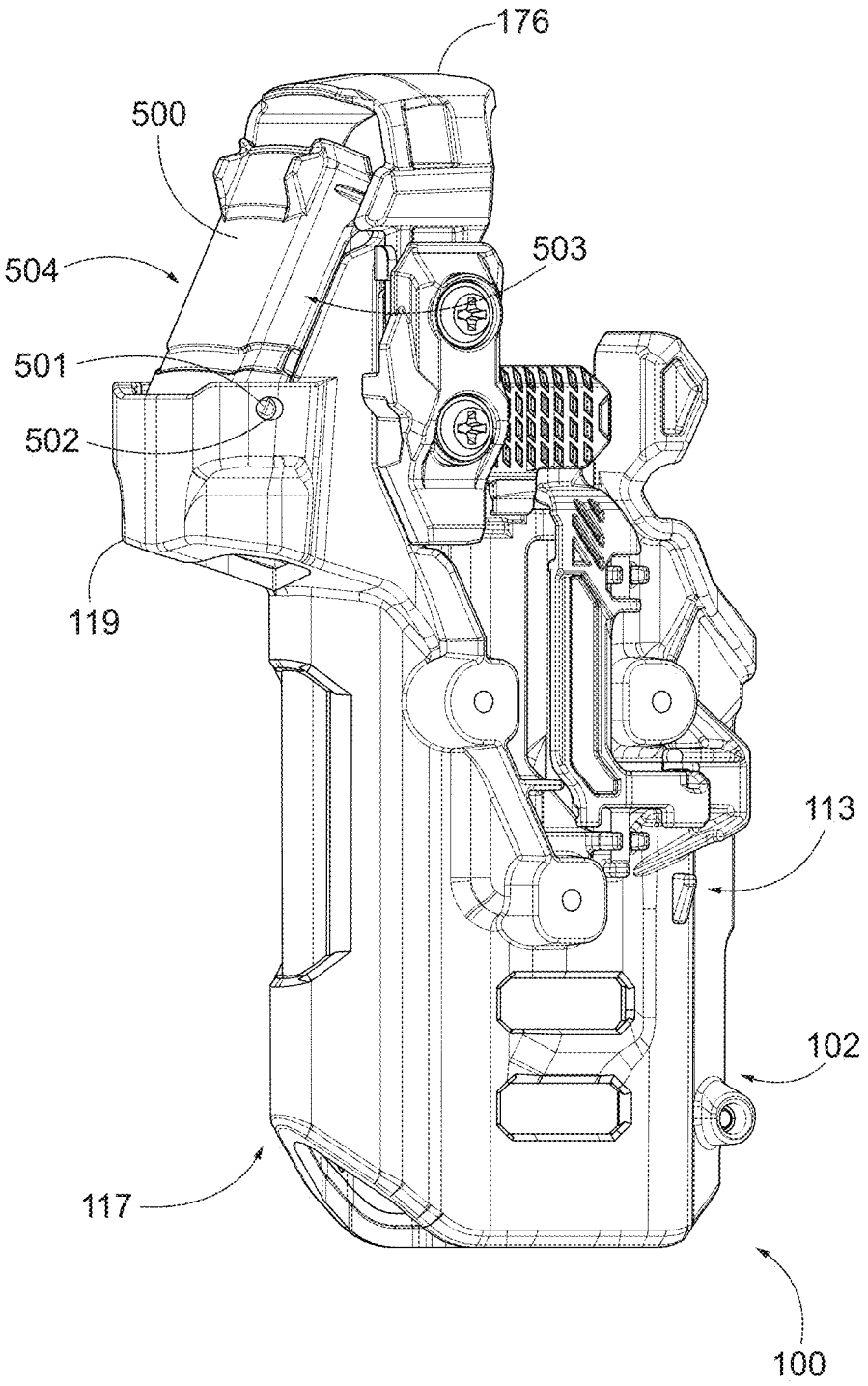
FIG. 59D is a view from the user proximal side of the exemplary embodiment of the holster from FIG. 59A.
Figure 59E:
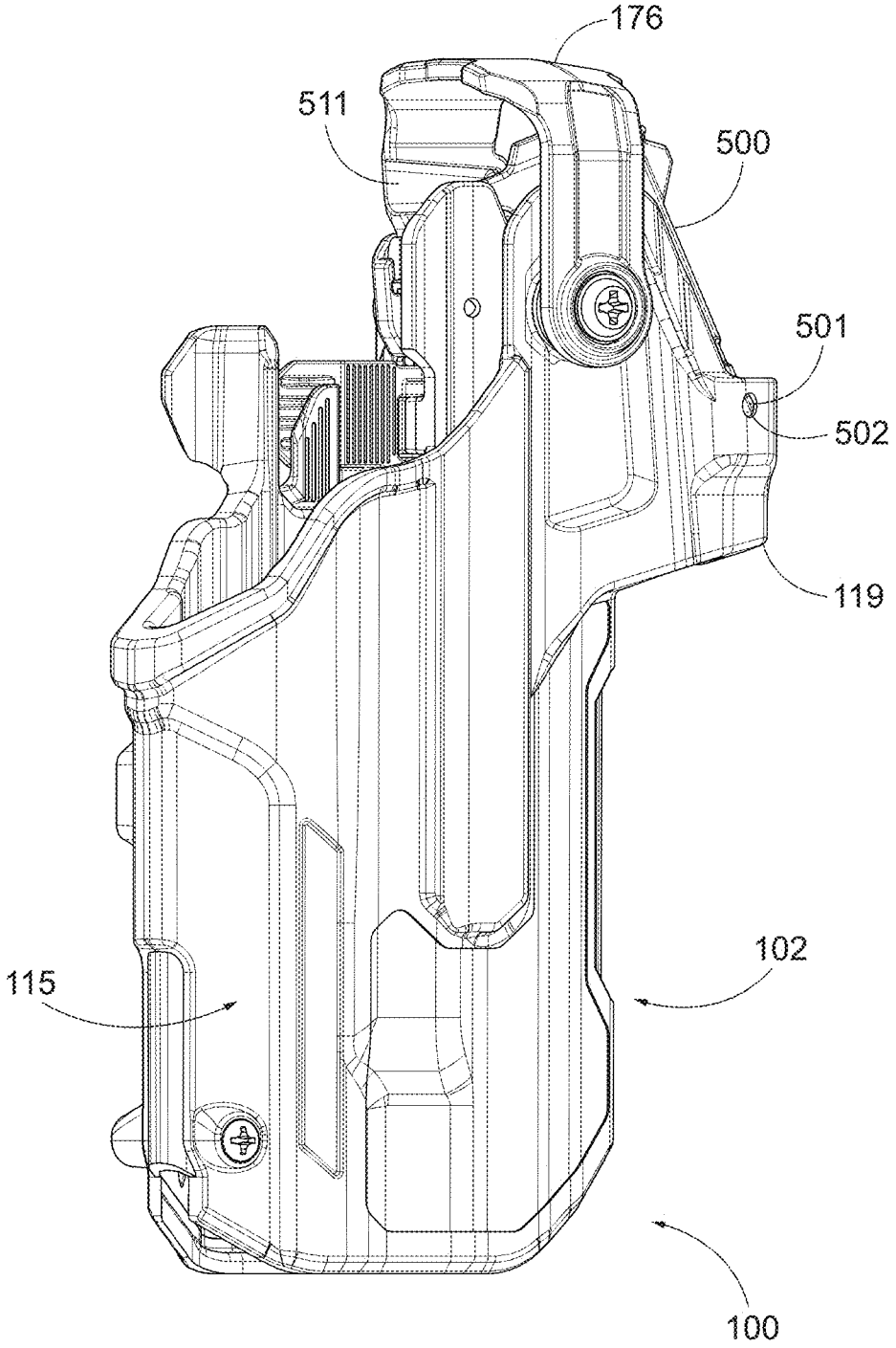
FIG. 59E is a view from the user distal side of the exemplary embodiment of the holster from FIG. 59A.
Figure 59F:
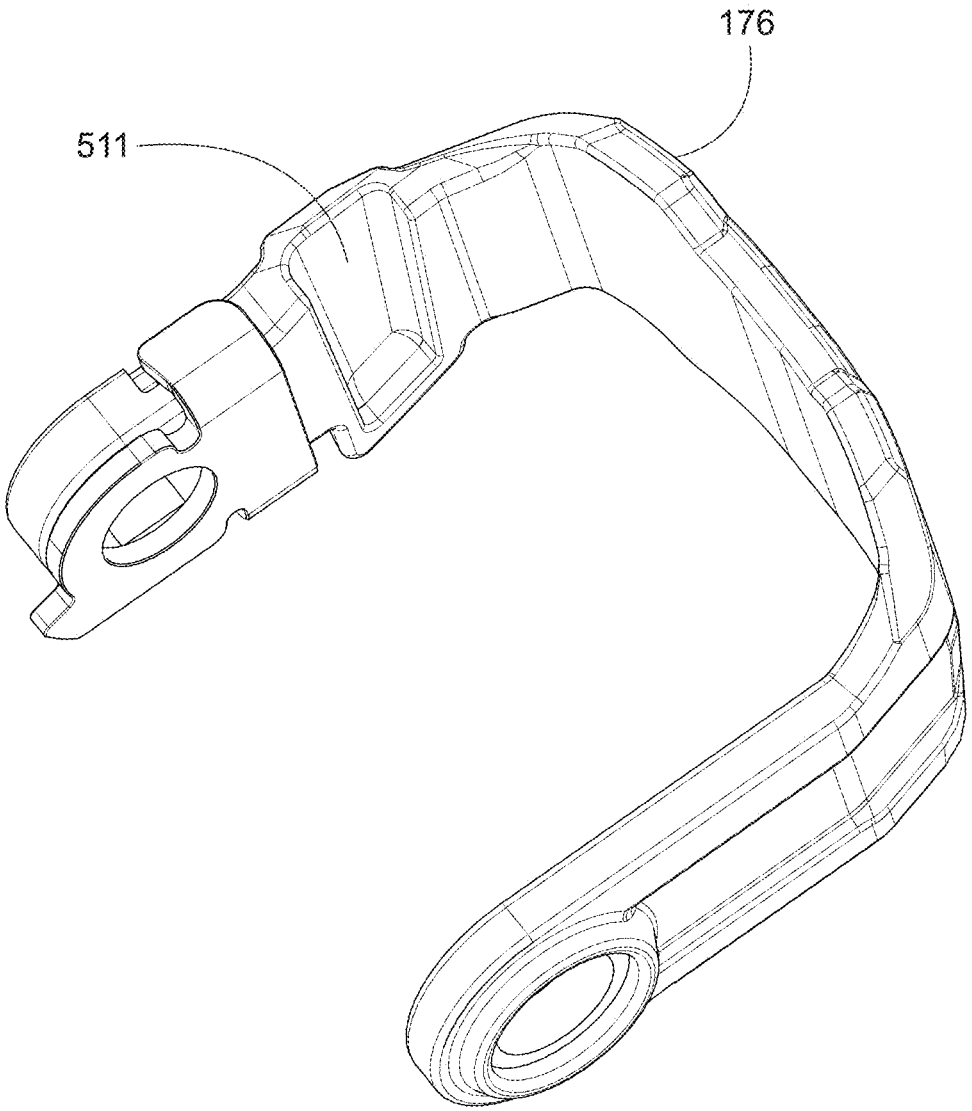
FIG. 59F is a view of the shroud from the exemplary embodiment of FIG. 59A.
Figure 59G:
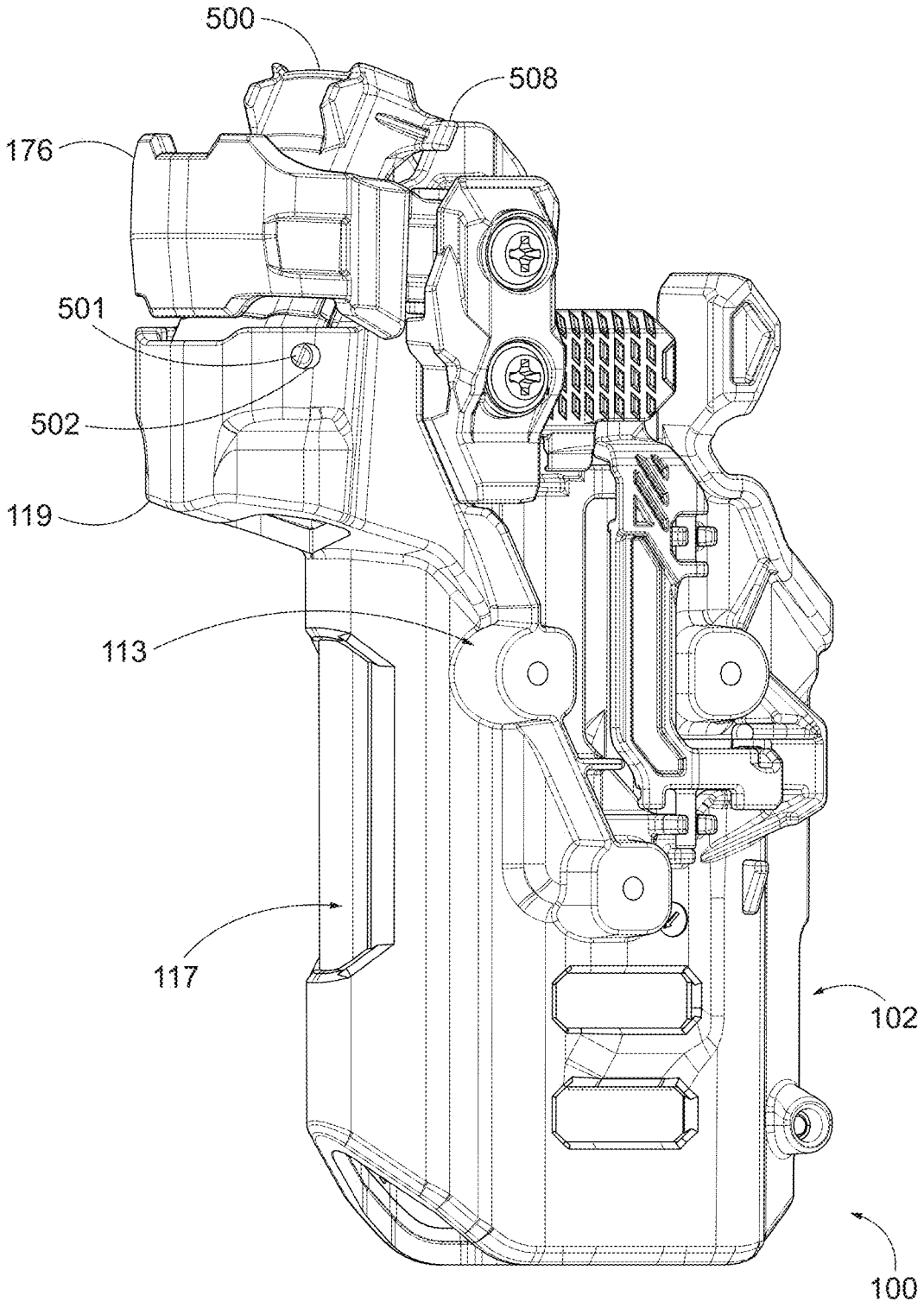
FIG. 59G is a view from the user proximal side of the exemplary embodiment of the holster from FIG. 59A with the shroud in the release position and the dust cover in the second, closed position
Figure 59H:
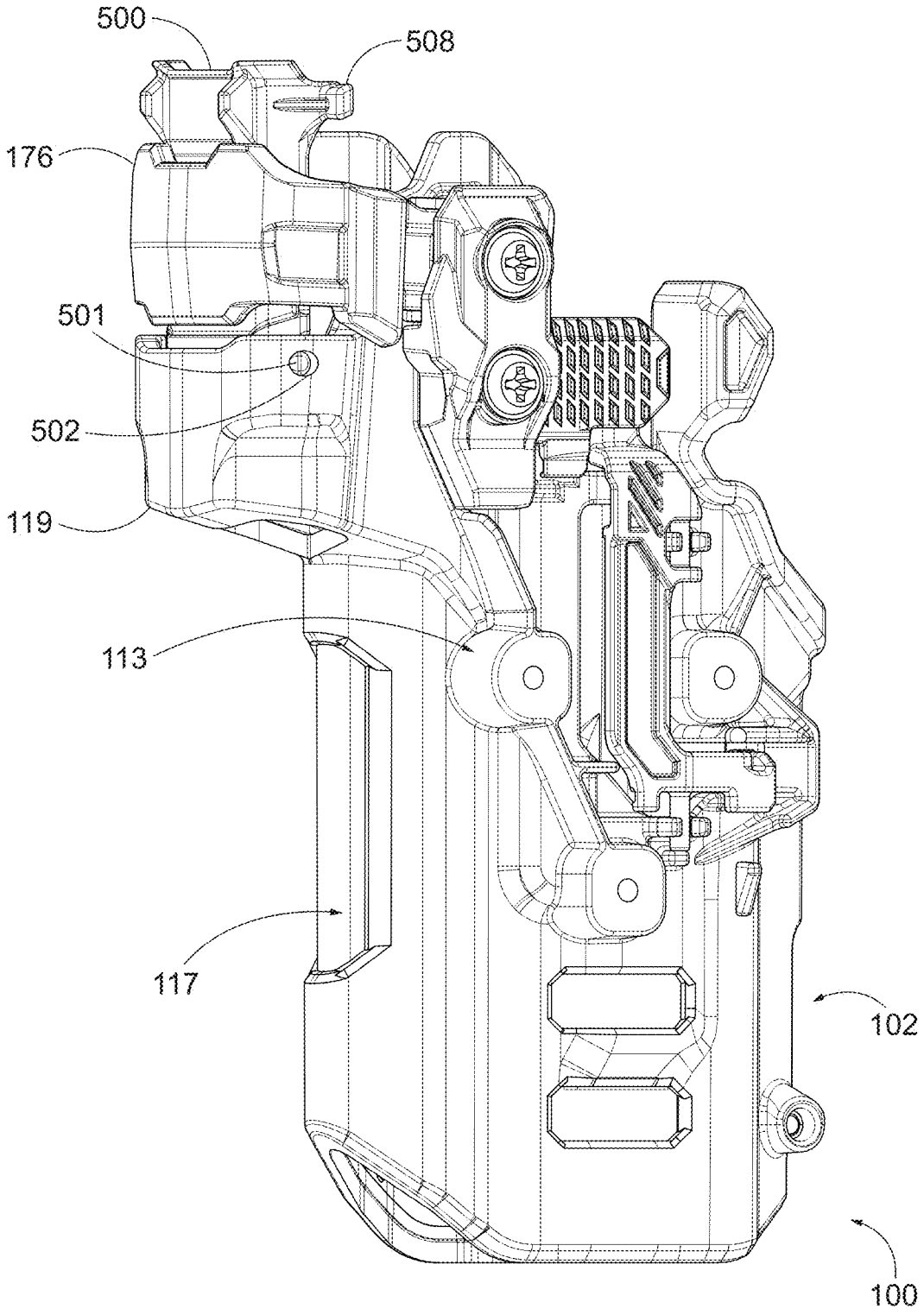
FIG. 59H is a view from the user proximal side of the exemplary embodiment of the holster from FIG. 59A with the shroud in the release position and the dust cover in the first, open position.

As shown in FIGS. 59A-59H, an exemplary embodiments of a level-3 holster configuration with a dust cover 500 of the present disclosure is shown. Referring to FIGS. 59A-59H, a holster 100 with a level-3 configuration is shown which includes a U-shaped shroud 176 and the dust cover 500, where the U-shaped shroud 176 is capable of engaging the foot portion 508 of the dust cover 500 to bias it in the second position to cover the RDS. As shown in FIGS. 59B-59C, the dust cover can include two followers 505 at an end of the dust cover proximal to the upward portion of the holster body which can be positioned on each side of a two-position detent 507 that is disposed on a central rib 506 of an upward portion of the holster 100 and which can bias the dust cover 500 in the second, closed position as shown in FIGS. 59A-59E and 59G or in the first, open position as shown in FIG. 59H. The U-shaped shroud 176 also includes a channel 511 which can engage the foot portion 508 of the dust cover 500 such that it can bias the dust cover 500 in the second, closed position and, if the dust cover 500 is in the first, open position, catch the foot portion 508 to displace the dust cover to the second, closed position. FIGS. 59D-59E depict the holster 100 of FIGS. 59A-59C from the user proximal side and the user distal side, respectively. As noted above, FIGS. 59G-59H depict the holster 100 of FIGS. 59A-59E with the dust cover 500 in the closed position and the shroud 176 is in the release position (FIG. 59G) or the dust cover 500 is in the first, open position and the shroud 176 is in the release position (FIG. 59H). It should be understood that in embodiments with a level-3 configuration holster, the dust cover is not required to include the foot portion unless that shroud with the channel as described is to be used to engage the foot portion. For example, the dust cover can be manually operable by the user independent of the shroud, as in the level-2 configuration.

FIG. 59F depicts an exemplary U-shaped shroud 176 that includes the channel 511 for engaging the foot portion 508 of the dust cover 500.

It should be understood that in any of the foregoing embodiment, the foot portion and channel can be disposed on either a user proximal side or a user distal side of the dust cover.

It should also be understood that the dust cover and its configuration can be applied to any holster, preferably a holster of the present disclosure.

Quick Detach System

The present disclosure also provides a quick detach system which allows for secure attachment of the holster with the ability to quickly detach the holster, in certain embodiments using a snap lock mechanism. The quick detach system can be used with any belt engaging member or other engaging member, including those of the present disclosure. Thus, in any of the foregoing embodiments, the belt engaging member can further include the quick detach system. In this manner, the quick detach system can be used with any engaging member or can be the engaging member itself. By way of example, but not limitation, the quick detach system could be attached to a jacket slot belt loop as described herein or to an article of clothing such as a vest. Thus, a user could quickly attach or detach the holster from the jacket slot belt loop to the vest to change the position of the holster for access to the handgun.

In certain embodiments, the quick detach system can include an attachment plate, having a user proximal face and a user distal face, that includes at least three keyhole apertures extending from the user proximal face to the user distal face that are each configured to receive and secure an attachment member, where each of the at least three keyhole apertures includes an upper portion that is circular or substantially circular and a lower portion that extends toward a bottom edge of the attachment plate, where each attachment member comprises a shaft portion with a first cross-sectional diameter or width and a head portion with a second cross-sectional diameter or width that is larger than the first cross-sectional diameter but is also the same as or smaller than a diameter of the upper portion of the keyhole apertures, where a width of the lower portions of the keyhole apertures is smaller than the first cross-sectional diameter or width but the same or larger than the second cross-sectional diameter or width. In certain embodiments, the attachment plate further includes a snap lock mechanism disposed around one of the keyhole apertures, the snap lock mechanism including two arms pivotably connected to the attachment plate and extending orthogonal to the user proximal face of the attachment plate and a distance outward from the attachment plate, the arms being configured to pivot about an axis orthogonal to a plane of the user proximal face, the two arms being operatively connected by a spring that biases the two arms in a first position where at least a portion of each arm obstructs the head portion of the attachment member sufficiently to prevent movement of the attachment member from the lower portion of the keyhole aperture to the upper portion of the keyhole aperture, where the arms are configured to deflect to a second position where the arms do not obstruct the head portion of the attachment member to allow movement of the attachment member from the lower portion to the upper portion of the keyhole aperture. Thus, in operation, a holster with three attachment members in the same configuration as the keyhole apertures can be pushed against the attachment plate in a manner that allows the head portion of each attachment member to pass through the upper portion of each respective keyhole aperture. The holster, and the attachment members with it, can then be pushed downward which allows the shaft portions of the attachment members in keyhole apertures without a snap lock mechanism to pass into the lower portions of the respective keyhole apertures. With respect to the keyhole aperture with the snap lock mechanism, the downward motion of the shaft portion of the respective attachment member causes the head portion to contact the portion of each pivoting arm that obstructs the lower portion of the keyhole aperture, deflecting the arms to allow the shaft portion of the attachment member to traverse into the lower portion of the keyhole aperture. Upon passing beyond the portions of the arms that were obstructing the lower portion of the keyhole aperture, the shaft portion and head portion of the attachment member are positioned below the snap lock mechanism which allows the spring to bias the pivoting arms back into a position whereby they obstruct the attachment member, by the head portion, from traversing from the lower portion of the keyhole aperture to the upper portion of the keyhole aperture. Thus, in some embodiments, a cavity between the pivoting arms proximal to a bottom edge of the attachment plate can be sized to accommodate the head portion of the attachment member. In order to release the snap lock mechanism, the portions of the pivoting arms that extend outward from the attachment plate can be moved by the user to pivot the portions of the arms that obstruct the attachment member from moving from the lower portion of the keyhole aperture to the upper portion, allowing the user to pull the holster upward so that the attachment members can be aligned with the upper portion of each keyhole aperture, permitting removal of the holster. Alternatively, for attachment of the holster, the portions of the pivoting arms extending outward from the attachment plate and be moved by the user to deflect the pivoting arms and allow for movement of the attachment member, and holster, downward into the locked position where the snap lock mechanism can retain the shaft portion of the attachment member in the lower portion of the keyhole aperture.

In some embodiments, the snap lock mechanism is disposed on the user proximal face of the attachment plate. In some embodiments, the attachment plate includes only three keyhole apertures. In some embodiments, the three keyhole apertures are configured in a triangular configuration with the third keyhole aperture being positioned proximal to a bottom edge of the attachment plate, the third keyhole aperture having the snap lock mechanism disposed around it. It should be understood that the attachment members can be any article that has the requisite head and shaft portions, but can be, by way of example, but not limitation, screws, studs, bosses or the like. For example, the bosses described herein can be attachment members for the quick detach system.

In some embodiments, the quick detach system further includes a base plate which has a user proximal face and a user distal face and which is attached to the attachment plate with its user distal face facing the user proximal face of the attachment plate. In some embodiments, the base plate and attachment plate further include holes whereby screws or other fasteners can be used to join the base plate and the attachment plate. Because there must be sufficient space on the user proximal face of the attachment plate for the head portion of the attachment members to move, in some embodiments, the base plate and attachment plate have a distance between them sufficient to accommodate the head portions of the attachment members or sufficient spaces within the base plate to accommodate the head portions of the attachment members.

In some embodiments, the quick detach system can be attached to a belt engaging member. By way of example, but not limitation, the quick detach system can be attached to a jacket slot belt loop. For example, the user distal face of the base plate can be attached to the belt engaging member. As noted above, in some embodiments, there is a distance between the attachment plate and either the base plate, if present, or the belt engaging member sufficient to allows the head portions of the attachment members to move from the upper portions to the lower portions of each keyhole aperture. It should be understood, that the base plate can be configured for attachment to another device such as a belt engaging member, for example, a jacket slot belt loop and, in this manner, act as an adapter for the attachment plate. A further advantage of the base plate is it can protect the internal snap lock mechanism of the attachment plate.

In some embodiments, the attachment plate can include a notch along a top edge of the attachment plate, where the notch is positioned and configured so as not to occlude the thumb button recess of an attached holster of the present disclosure. In some embodiments, the base plate can include a notch along a top edge of the base plate, where the notch is positioned and configured so as not to occlude the thumb button recess of an attached holster of the present disclosure. In some embodiments, both the attachment plate and the base plate include a notch at the top edge of each, where the notch is positioned and configured so as not to occlude the thumb button recess of an attached holster of the present disclosure. In certain embodiments, the notch may cooperate with the cavity 256 as described herein, form a portion of the bottom portion of such cavity 256.

In some embodiments, the attachment plate can include one, two, three, four, five or more keyhole apertures arranged in a pattern on the attachment plate, where the attachment members on a holster can be configured in the same pattern for attachment to the quick detach system. By way of example, but not limitation, the keyhole apertures can be configured in a triangular pattern, square or diamond pattern or any other suitable pattern for engaging the attachment members of a holster.

It should be understood that the spring described in the snap lock mechanism can be any biasing mechanism capable of biasing the pivotable arms such that, in a first position, they can obstruct the head portion of an attachment member to prevent its movement to the upper portion unless the pivotable arms are deflected to a second position, for example, by the user pivoting the pivotable arms such that they no longer block the path of the head portion of the attachment member from the lower portion of the keyhole aperture to the upper portion of the keyhole aperture, and not limited to a spring in all embodiments. It should be further understood that any snap lock mechanism that can operated by one or more arms can be used. By way of example, but not limitation, a snap lock mechanism can include a single arm that extends outwardly and beyond the attachment plate in a plane orthogonal to the plane of the attachment plate, where the single arm is biased in the first position by a biasing mechanism to be in a position whereby the pivotable arm is positioned and configured to obstruct the head portion of the attachment member from moving from the lower portion of the keyhole aperture to the upper portion of the keyhole aperture but can be displaced by movement of the head portion of the attachment member from the upper portion of the keyhole aperture to the lower portion of the keyhole aperture. The arm can be deflected to a second position, where the arm does not obstruct the movement of the head portion of the attachment member from the lower portion of the keyhole aperture to the upper portion of the keyhole aperture, thus releasing the attachment member from the snap lock mechanism. Thus, in some embodiments, the quick detach system can include one, two, three, four, five or more snap lock mechanisms which can be positioned on any of the keyhole apertures. For example, the snap lock mechanism need not be limited to the keyhole aperture proximate to the bottom edge of the attachment plate. By way of example, but not limitation, in the configuration with two keyhole apertures proximal to the top edge of the attachment plate and one proximal to the bottom edge of the attachment plate or any that includes two or more keyhole apertures proximal to the top edge of the attachment plate, each of two keyhole aperture proximal to the top edge of the attachment plate can include a snap lock mechanism such as a snap lock mechanism having a single arm. In such an embodiment, there are still two arms extending beyond the attachment plate which can be operated by the user to release the holster from the quick detach system be deflecting the pivotable arms to allow the attachment members to move from the lower portions of the two keyhole apertures proximal to the top edge of the quick detach system to the upper portions of the two keyhole apertures, thus releasing the holster from the quick detach system. Thus, in some embodiments, the attachment plate can include two or more snap lock mechanisms and two or more pivotable arms associated with said two or more snap lock mechanisms. In operation, the user can deflect the arms to release the snap lock mechanism to release the holster from the quick detach system. In some embodiments, the snap lock mechanism can operate on any of the keyhole apertures, for example not solely one along the bottom edge. In some embodiments the snap lock mechanism can be positioned on any keyhole apertures. In embodiments with multiple snap lock mechanisms, these can operate on any of the corresponding number of keyhole apertures in the attachment plate.

Figure 60A:
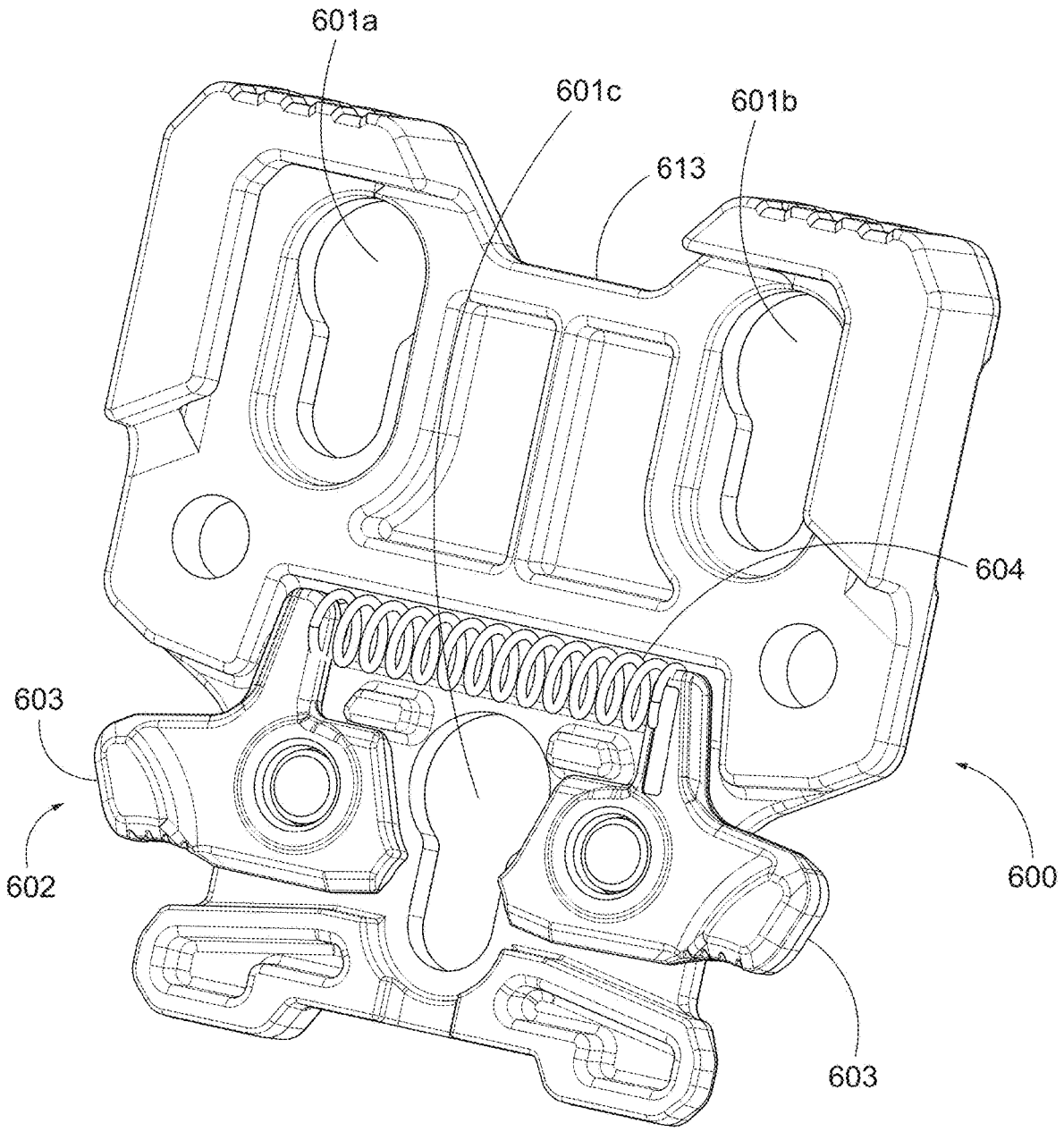
FIG. 60A is a view of an exemplary embodiment of the attachment plate of the quick detach system from the user proximal face.
Figure 60B:
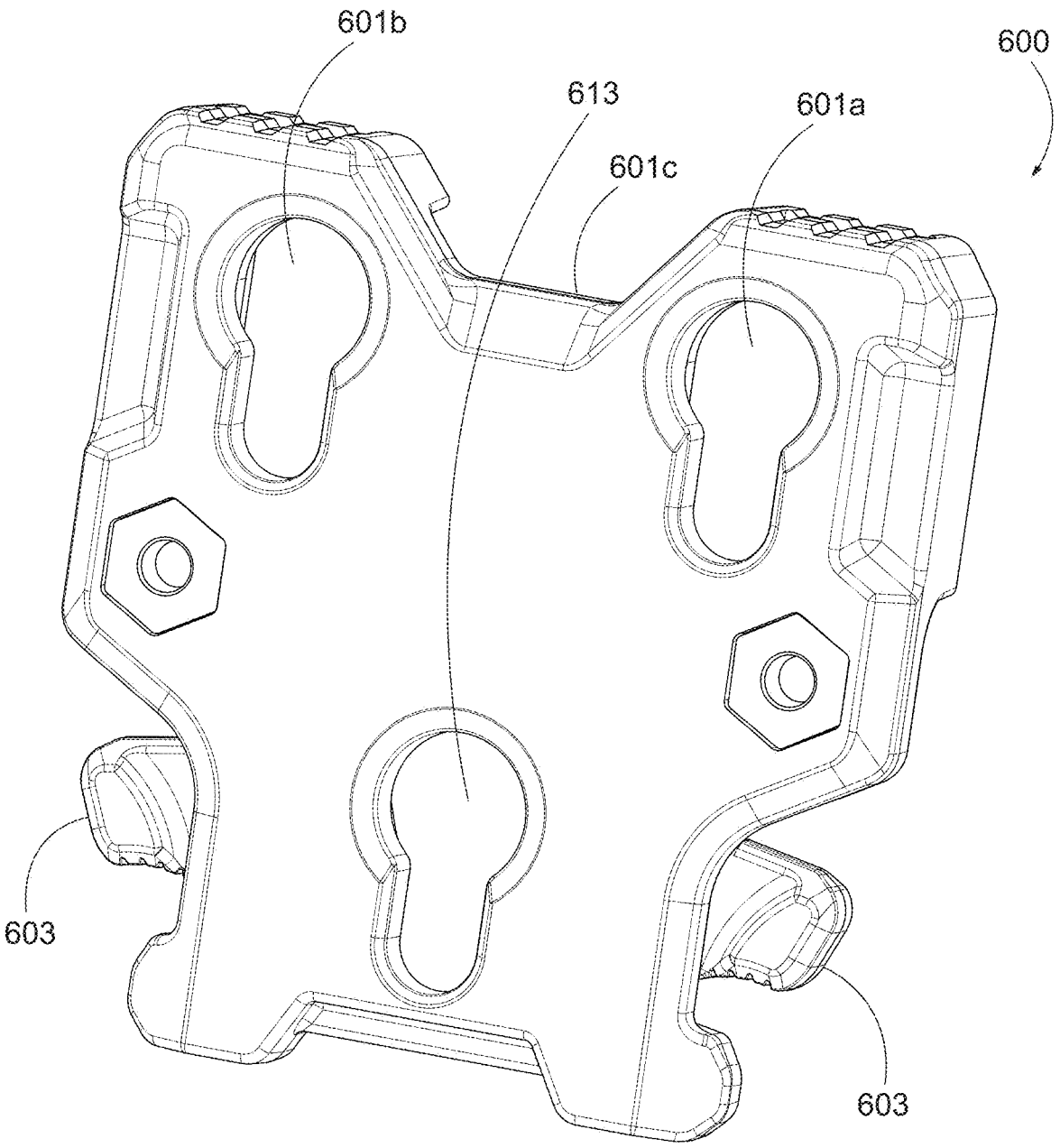
FIG. 60B is a view of the exemplary embodiment of FIG. 60A of the attachment plate of the quick detach system from the user distal face.
Figure 60C:
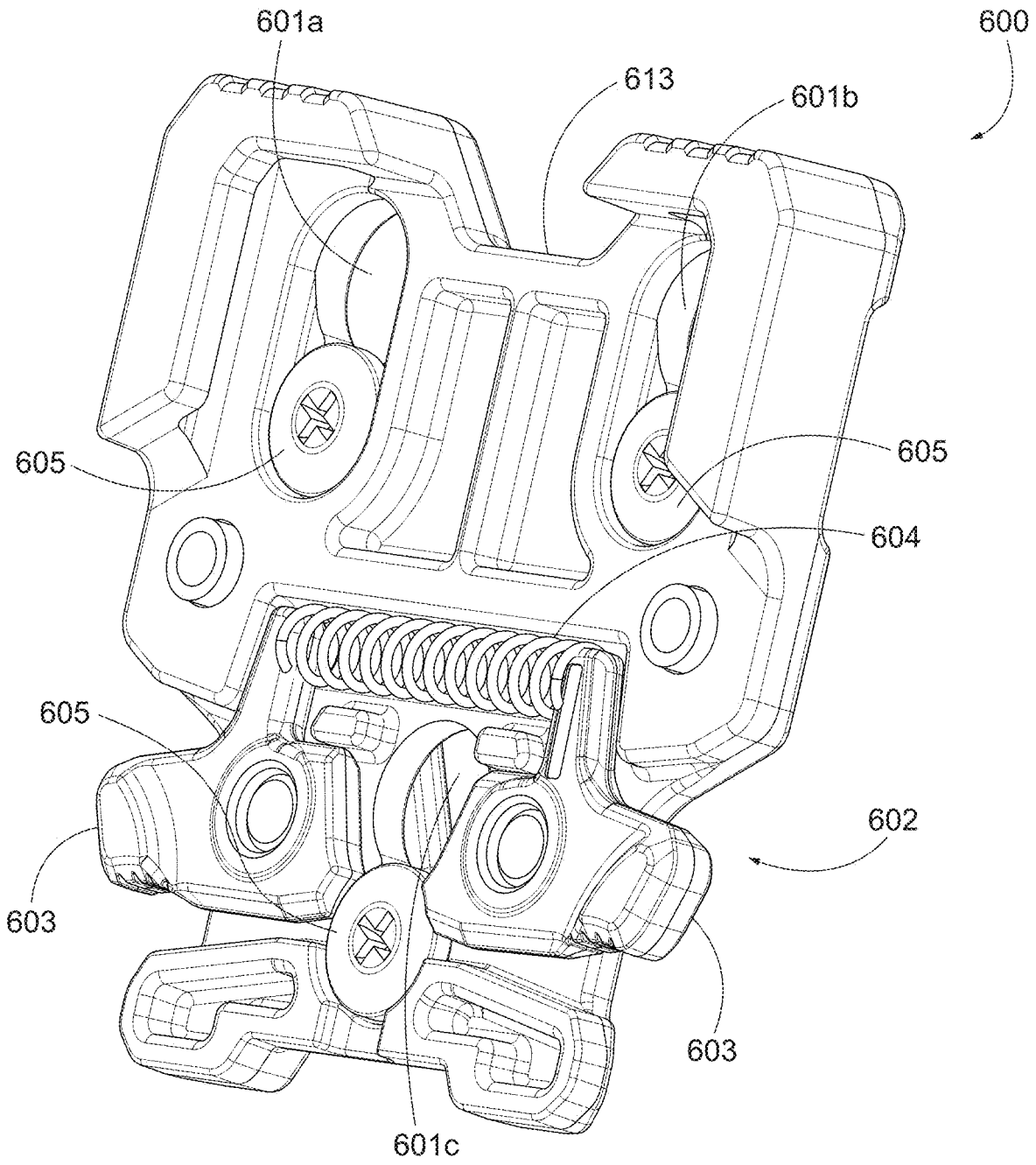
FIG. 60C is a view of the exemplary embodiment of FIG. 60A of the attachment plate of the quick detach system from the user proximal face with the attachment members inserted and locked by the snap lock mechanism.
Figure 60D:
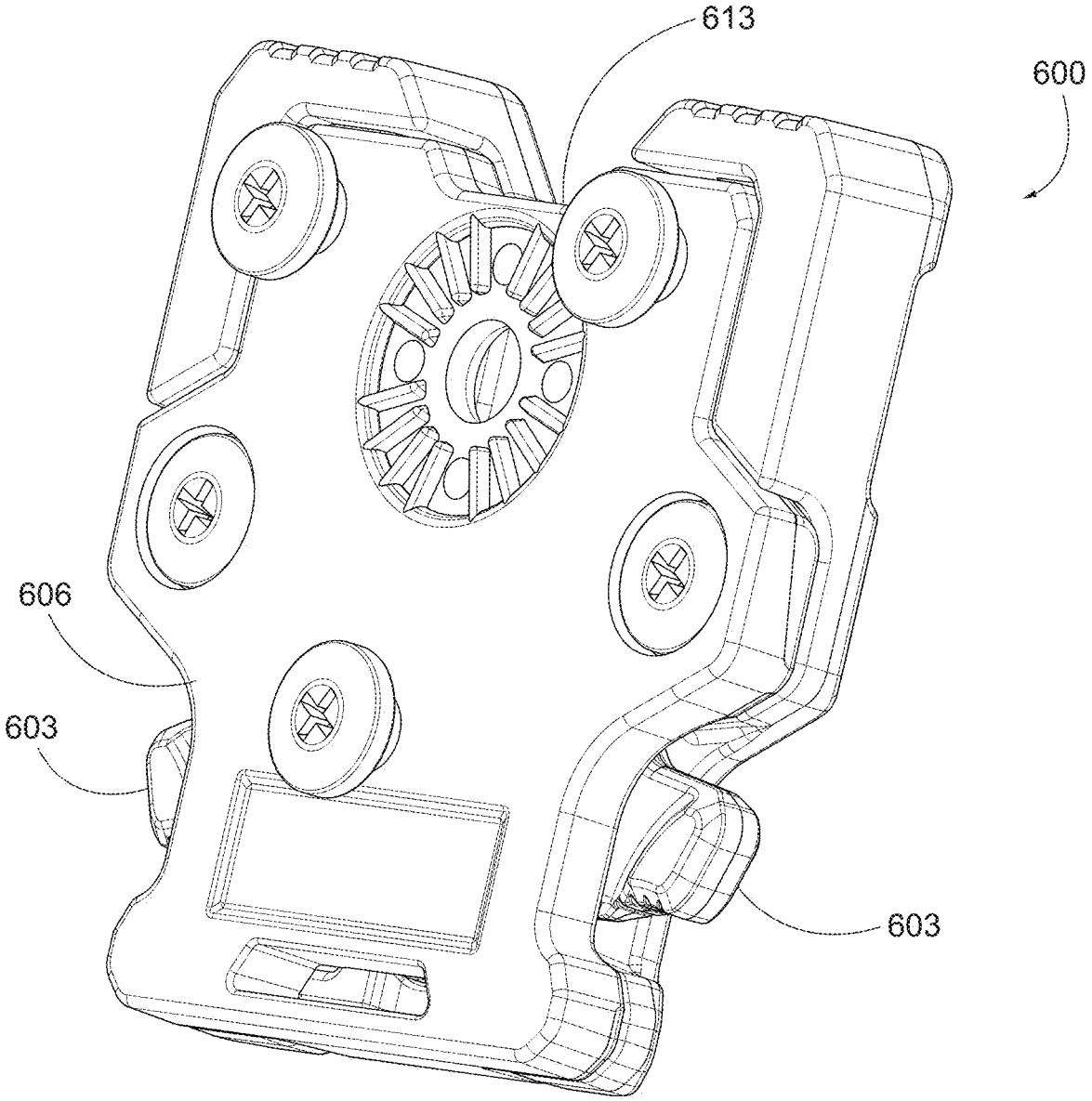
FIG. 60D is a view of the exemplary embodiment of FIG. 60A of the attachment plate from the user proximal face with a base plate attached.
Figure 60E:
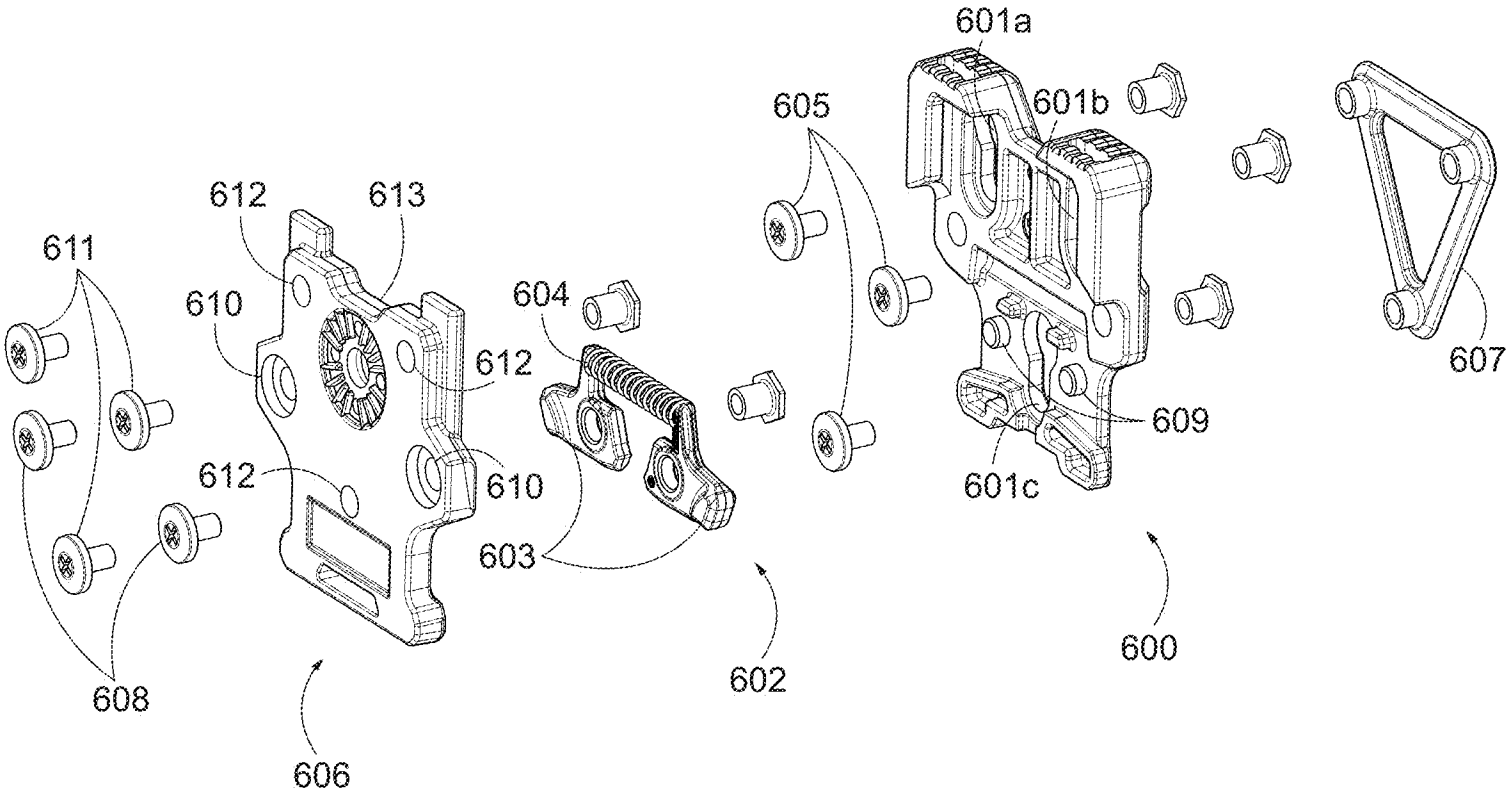
FIG. 60E is an exploded view of an exemplary quick detach system of the present disclosure.
Figure 60F:
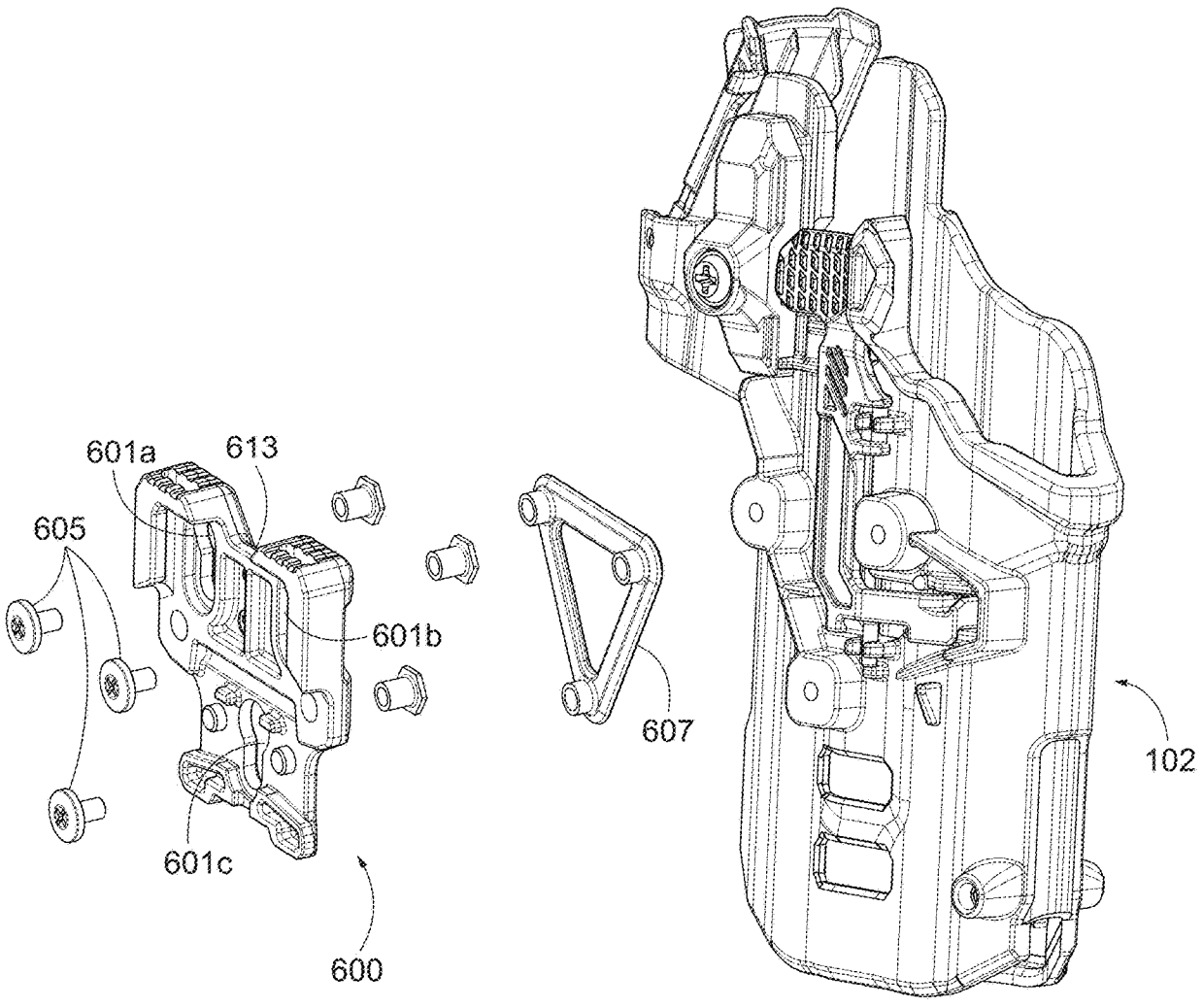
FIG. 60F is an exploded view of an exemplary quick detach system of the present disclosure with a holster body having the attachment members for attachment to the quick detach system.

Referring to FIGS. 60A-60F, exemplary embodiments of the quick detach system are shown. As shown in FIG. 60A, which shows a view of the attachment plate from the user proximal face of the attachment plate, the attachment plate 600 can include three keyhole apertures (601*a*, 601*b*, 601*c*) in a triangular configuration with two keyhole apertures (601*a*, 601*b*) near a top edge of the attachment plate 600 and one keyhole aperture 601*c* near a bottom edge of the attachment plate 600, where the third keyhole aperture 601*c* which is near a bottom edge of the attachment plate 600 has a snap lock mechanism 602 disposed around it that includes two pivotable arms 603, which can pivot about an axis orthogonal to a plane through the user proximal face of the attachment plate 600, and which are connected by a spring 604 that biases the two pivotable arms 603 in a first position, although the pivotable arms 603 are shown in an open position and displaced from the lower portion of the keyhole aperture 601*c*, where they obstruct the head portion or shaft portion of an attachment member 605 from passing from the upper portion of the third keyhole aperture 601*c* to the lower portion of the keyhole aperture 601*c* but can be deflected by downward pressure of the head portion of the corresponding attachment member 605 such that the pivotable arms 603 are deflected from obstructing the head portion, allowing the shaft portion of the attachment member 605 to pass from the upper portion of the third keyhole aperture 601*c* to the lower portion of the third keyhole aperture, whereupon after the head portion of the attachment member 605 is moved downward, the spring 604 biases the pivotable arms 603 back into position to obstruct movement of the attachment member 605 upward unless the pivotable arms 603 are deflected by movement of the pivotable arms 603 by the user. In addition, the attachment plate includes a notch 613 along the top edge of the attachment plate. In certain embodiments, the upper portions of the keyhole aperture (601*a*, 601*b*, 601*c*) are substantially circular in shape and have diameters larger than the head portions of attachment members 605, and the lower portion of the keyhole apertures (601*a*, 601*b*, 601*c*) are substantially slot-like in shape and have a width less than the head portions of attachment members 605. FIG. 60B shows this same exemplary embodiment from the user distal face of the attachment plate 600. Like FIG. 60A, FIG. 60C depicts the same exemplary embodiment from the user proximal face of the attachment plate, however, the attachment members 605, in this case screws, are shown disposed in the lower portion of each keyhole aperture (601*a*, 601*b*, 601*c*) such that the snap lock mechanism 602 via the pivoting arms 603 obstructs the corresponding attachment member 605 in the third keyhole aperture 601*c* from moving upward unless the pivoting arms 603 are displaced by moving them to remove the obstruction. By way of example, but not limitation, the attachment members 605 can be threaded screws or fasteners inserted into the bosses 111 referenced in foregoing embodiments or through a plate and into the bosses 111. FIG. 60D depicts the same exemplary embodiment as FIG. 60C with a base plate 606 attached to the attachment plate 600 on its user proximal face which includes a notch 613 in the top edge of the base plate 606. The base plate 606 can be used to attach the quick detach system including both the base plate 606 and attachment plate 600 to another device such as a belt engaging member, for example, a jacket slot belt loop. The base plate 606 can protect the internal snap lock mechanism and can also provide an adapter for mounting the quick detach system depending on the configuration of the belt engaging member, such as a jacket slot belt loop. As shown in FIG. 60E, a mounting bracket 607 can include the attachment members 605 which pass through the keyhole apertures (601*a*, 601*b* and 601*c*) in the attachment plate 600 where the snap lock mechanism 602 is disposed around the third keyhole aperture 601*c* and includes two pivotable arms 603 operatively connected by a spring 604 to bias them in a first position to obstruct the head portion of the corresponding attachment member from the upper portion of the third keyhole aperture 601*c* to the lower portion and vice versa. The base plate 606 which includes a notch 613 along its top edge can be attached via fasteners 608 to the attachment plate 600 where the base plate 606 and attachment plate 600 include corresponding holes (610 and 609, respectively) for the fasteners to pass through. The base plate 606 can also include external fasteners 611 such as screws which can be inserted into mounting apertures 612 for attachment of the quick detach system via the base plate 606 to other devices such as a belt engaging member such as a jacket slot belt loop. FIG. 60F depicts a similar exemplary embodiment which includes a holster 100 with a holster body 102 and three attachment members 605 in a triangular configuration matching the attachment plate 600 which includes the three keyhole apertures (601*a*, 601*b* and 601*c*). The snap lock mechanism and base plate are not depicted but should be understood as being able to be included as depicted in FIG. 60E.

Figure 61:
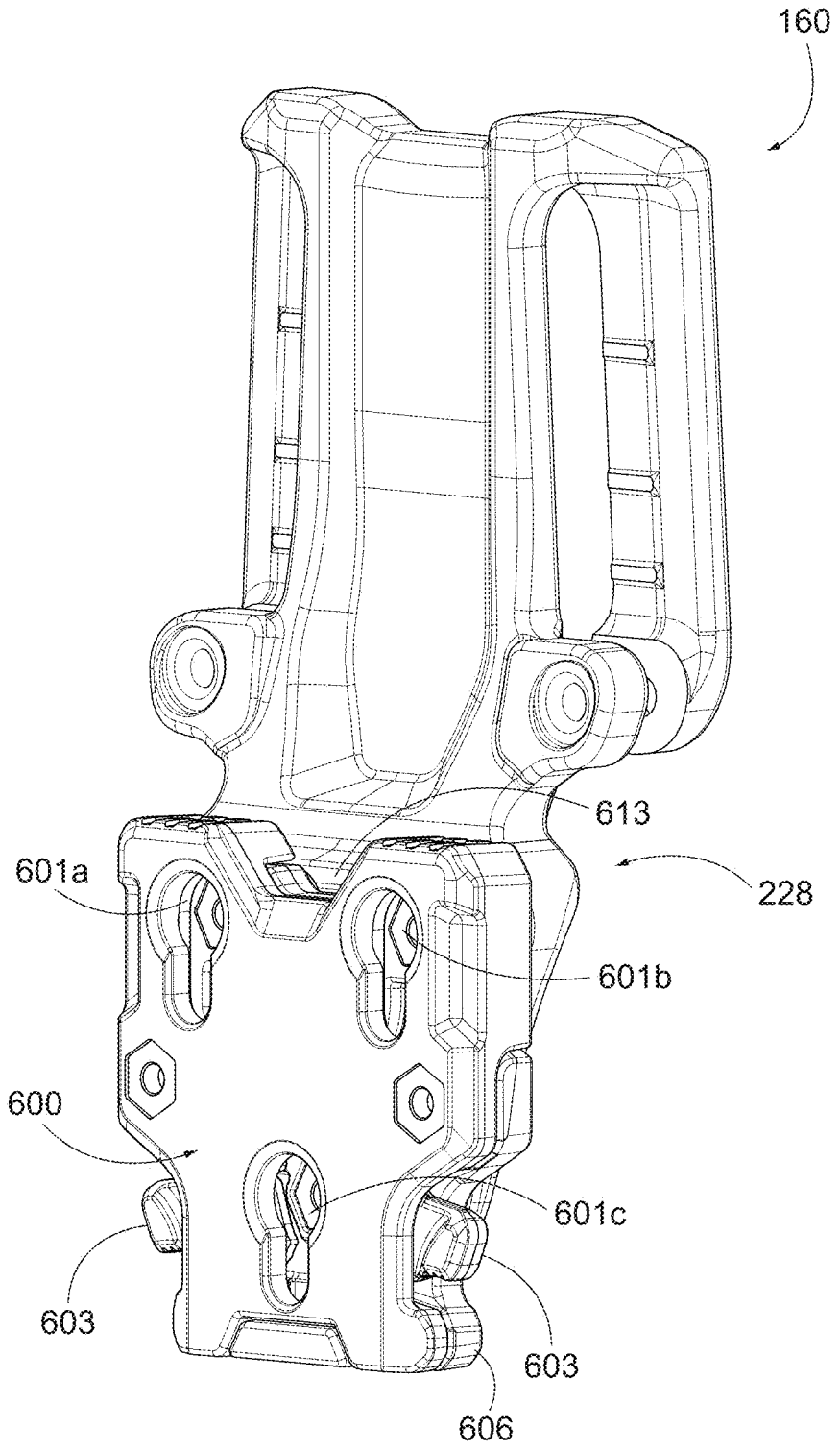
FIG. 61 depicts an exemplary embodiment where the an exemplary quick detach system of the present disclosure is attached to a jacket slot belt loop of the present disclosure.

Referring to FIG. 61, an exemplary quick detach system attached to a jacket slot belt loop 228 of the present disclosure is shown where the belt engaging member 160 includes the jacket slot belt loop 228 which is attached to the attachment plate 600 of the quick detach system by the base plate 606 which provides a sufficient offset for attachment members (not shown) to be inserted into the three keyhole apertures (601*a*, 601*b* and 601*c*) where two pivotable arms 603 are arranged as a snap lock mechanism on the keyhole aperture 601*c* closest to the bottom edge of the attachment plate, where the attachment plate 600 and base plate 606 each include a notch 613 along the top edge of each respective plate that is configured to not occlude the thumb button of a holster of the present disclosure attached by the quick detach system to the jacket slot belt loop, and cooperate with cavity 256 as previously described herein.

It should be understood that in any of the foregoing embodiments of a leg strap adapter, RDS dust cover and quick detach system, these accessories can be combined with holsters, belt engaging members and handguns, including those of the present disclosure. For example, in any of the embodiments including a holster, a gun in the holster can be further included. By way of further example, but not limitation, in some embodiments a system can include the leg strap adapter, holster with RDS dust cover and the quick detach system.

It should also be understood that the holster can include the second retention mechanism without requiring the first retention mechanism. For example, a holster can have the pivotable shroud operable by the second retention mechanism but without a first retention mechanism, e.g. no trigger guard.

The following United States patents and applications are hereby incorporated by reference herein: U.S. Pat. Nos. 5,048,735, 5,100,036, 5,129,562, 5,275,317, 5,284,281, 5,372,288, 5,395,021, 5,419,474, 5,449,103, 5,509,591, 5,573,157, 5,810,221, 5,810,221, 5,918,784, 5,918,784, 6,112,962, 6,189,751, 6,230,946, 6,267,279, 6,276,581, 6,533,149, 6,547,111, 6,547,111, 6,634,527, 6,641,009, 6,641,009, 6,752,300, 6,752,300, 6,769,582, 6,799,392, 6,854,626, 7,200,965, 7,434,712, 7,461,765, 7,461,765, 7,530,456, 7,530,456, 7,556,181, 7,556,181, 7,841,497, 7,841,497, 7,922,050, 7,922,050, 8,141,758, 8,141,758, 8,177,108, 8,235,263, 8,474,670, 8,517,235, 8,602,276, 8,602,276, 8,631,981, 8,631,981, 8,646,665, 8,720,753, 8,720,753, 8,720,754, 8,720,755, 8,851,344, 8,985,412, 9,022,262, 9,022,262, 9,057,579, 9,057,580, 9,134,093, 9,134,093, 9,175,925, 9,175,925, 9,228,802, 9,267,760, 9,347,741, 9,383,165, 9,410,767, 9,500,426, 9,777,986, 9,835,400, 10,619,974, U.S. Ser. No. 16/747,986 filed Jan. 21, 2020 and U.S. Ser. No. 16/748,151 filed Jan. 21, 2020. Components illustrated in such patents may be utilized with embodiments herein. Incorporation by reference is discussed, for example, in MPEP section 2163.07(B).

The patents and other references mentioned above in all sections of this application are herein incorporated by reference in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

Holster Embodiments

In embodiments there is a holster for receiving a handgun having a handgun body, a handgrip, a slide, and a trigger guard, the holster comprising:

a holster body having a plurality of unitary holster wall portions defining a handgun receiving cavity and a rearward opening, the holster body having a handgun receiving and withdrawal axis, the plurality of holster wall portions comprising a user proximal wall portion and a user distal wall portion, the proximal wall portion having thumb button recess with a thumb button edge portion defining the thumb button recess, the thumb button recess extending forwardly from the rearward opening;

a first user actuatable handgun retention mechanism at the proximal wall portion for selectively preventing the handgun, when in the cavity, from being withdrawn from the cavity; the first handgun retention mechanism comprising a first lever pivotally mounted on the proximal wall portion of the holster body with a first axis of rotation, the first lever having an actuation tab rearwardly positioned on the lever and positioned within the recess, the actuation tab having an upper margin, a rearward margin, and a lower margin, the lever further having a trigger guard blocking portion forwardly positioned on the lever, the lever configured and positioned such that depression of the actuation tab rotates the lever about its respective axis of rotation to move the trigger guard blocking portion from a trigger guard blocking position to a non-blocking position, wherein an upper portion of the thumb button recess edge portion extends rearwardly of the actuation tab along the upper margin of the actuation tab and a lower portion of the thumb button recess edge portion extends rearwardly of the actuation tab at the lower margin of the actuation tab.

In embodiments, the holster has only a single user actuatable handgun retention mechanism and the actuation tab is configured as a thumb button.

In embodiments, the holster further comprises a pair of thumb guides positioned above and below the thumb button, the thumb guides projecting laterally outward from the holster body proximal wall portion beyond an undepressed position of the thumb button.

In embodiments, the thumb guides each extend laterally outward from an outward surface of the proximal wall portion a distance of at least 0.35 inches.

In embodiments, the holster has a second handgun retention mechanism including a pivoting shroud positioned rearwardly of the slide of the handgun holstered in the holster, the second handgun retention mechanism comprising a second lever, the second lever having an actuation tab configured as a thumb button, the actuation tab of the first lever position behind the thumb button whereby depression of the thumb button also depresses the actuation tab of the first lever.

In embodiments, the holster further comprises a pair of thumb guides positioned above and below the thumb button, the thumb guides projecting laterally outward from the holster body proximal wall portion beyond an undepressed position of the thumb button.

In embodiments, the thumb guide is positioned above the thumb button comprises a housing for the second handgun retention mechanism.

In embodiments, the holster is in combination with a belt engaging member, wherein the belt engaging member is attached with a plurality of threaded fasteners extending into the holster body, one of said threaded fasteners positioned above the first lever, one of the plurality of threaded fasteners positioned below the first lever, and one of the plurality of threaded fasteners positioned forward of the first lever, wherein the first lever is captured between the holster body and the belt engaging member.

In embodiments, the holster is in combination with a belt engaging member, wherein the belt engaging member is attached with a plurality of threaded fasteners extending into the holster body, and wherein a column portion of the belt engaging member extends rearwardly, wherein when the handgun is holstered the thumb button is positioned inbetween the handgun body and the belt engaging member, wherein the belt engaging member has a pair of ribs having their elongate dimension extending forwardly and rearwardly and positioned to confront the thumb guides whereby access to the thumb button is restricted on four sides of the thumb button and an access path for the thumb is provided rearwardly of the thumb button.

In embodiments, the belt engaging member is a jacket slot belt loop having a pair of clamping belt loop portions extending from the column portion, each of the clamping belt loop portions adjustable with respect to the column portion by a respective threaded fastener.

In embodiments, the thumb guides each extend laterally outward from an outward surface of the proximal wall portion a distance of at least 0.35 inches.

In embodiments, the thumb guides each extend laterally outward from an outward surface of the proximal wall portion a distance of at least 0.35 inches and the ribs extend outwardly from a surface of the column portion a distance of at least 0.15 inches.

In embodiments, the first lever is seated in a lever receiving region on the proximal wall portion and has two unitary pivot portions that cooperate with two pivot portions unitary with the proximal wall portion, whereby the pivoting connection is made without metal pins.

In embodiments, the first lever is seated in a lever receiving region on the proximal wall portion and wherein the proximal wall portion has three threaded bosses for receiving a holster engagement member dispersed around the lever receiving region, the proximal wall portion further having a plurality of lever region containment wall portions extending from the outer surface of the proximal wall portion and each of the plurality of lever containment wall portions connecting to at least one of the three threaded bosses, the three bosses positioned for receiving a belt engaging member utilizing a plurality of threaded fasteners.

In embodiments, the first lever is seated in a lever receiving region on the proximal wall portion and wherein the proximal wall portion has three threaded bosses for receiving a holster engagement member dispersed around the lever receiving region for receiving a belt engaging member, and wherein when the belt engaging member is attached the first lever is captured within the receiving region, and wherein when the belt engaging member is not attached, the first lever may be removed from an engagement with the proximal wall portion.

In embodiments, the belt engaging member is not attached, the first lever may be removed without tools.

In embodiments, the belt engaging member is not attached, the first lever may be removed by simply prying the first lever outwardly from its seated position.

In embodiments, the belt engaging member is attached, the first lever is captured within a first lever containment region, the thumb button extending out of the containment region.

In embodiments, the holster body has an upper wall portion having a pair of inclined wall portions defining a joint, a lower wall portion with a slit extending from a forward opening to proximate a trigger guard receiving portion of the holster body defining a pair of forward clamping wall portions, a threaded fastener extending between the pair of forward clamping portions for adjusting the forward clamping portions about a forward portion of the handgun.

In embodiments, the forward clamping body portions of the holster body are configured to engage the handgun at four corners of the handgun, two upper corners defined by the handgun slide and two lower corners defined by the body.

In embodiments, the holster body comprises an inner layer and an outer layer formed of different polymers with one of the inner layer and outer layer being overmolded onto the other of the inner layer and outer layer, the inner layer formed of a polymer that is softer than the outer layer.

In embodiments, the holster body comprises an inner layer and an outer layer formed of different polymers with one of the inner layer and outer layer being overmolded onto the other of the inner layer and outer layer, the inner layer formed of a polymer that is softer than the outer layer.

In embodiments, a holster for receiving a handgun having a handgun body, a slide, and a trigger guard comprises:

a holster body having a plurality of holster wall portions defining a rearward opening cavity extending along a handgun receiving and withdrawal axis for receiving and holding the handgun, the plurality of holster wall portions comprising a user proximal wall portion and a user distal wall portion;

a first handgun retention mechanism and a second handgun retention mechanism, disposed at the proximal wall portion, each handgun retention mechanism selectively preventing the handgun when in the cavity from being withdrawn from the cavity; the first and second handgun retention mechanisms having a respective first lever having a first axis of rotation and a second lever with an axis of rotation, each lever having a respective actuation tab on one end of the lever where depression of the actuation tab rotates the lever about its respective axis of rotation, one of the two actuation tabs configured as a thumb receiving button with an outer thumb receiving surface, the other of the two actuation tabs positioned behind the thumb receiving button such that depression of the thumb receiving button effects a depression of the other of the two actuation tabs, whereby depression of the thumb receiving button actuates both the first handgun retention mechanism and the second handgun retention mechanism;

wherein the first lever of the first handgun retention mechanism being pivotally supported by the holster body, the first lever comprising an elongate central portion and a blocking portion at an end opposite the respective actuation tab, the blocking portion movable in and out of a handgun blocking position;

the second handgun retention mechanism comprising a shroud that is pivotally supported by the holster body so that the shroud selectively pivots between a handgun retaining position in which the shroud extends across a portion of a rearward opening of the cavity and a release position in which the shroud is displaced from the portion of the rearward opening so that a withdrawal path of the handgun is unobstructed by shroud.

In embodiments, the activation portion of the first lever comprising a first arm extending away from the elongate central portion in a first direction, the elongate central portion and the first arm cooperating to form a first L-shape, the blocking portion of the first lever comprising a second arm extending away from the elongate central portion in a second direction opposite the first direction, the elongate central portion and the second arm cooperating to form a second L-shape, the first lever axis of rotation extends forwardly and rearwardly, the lever pivoting between a handgun trigger guard capture position and a handgun trigger guard release position.

In embodiments, the first arm of the first lever has a first length, the second arm of the lever has a second length, the elongate central portion of the first lever has a third length and a ratio of the third length to the first length is greater than 1.5 and a ratio of the third length to the second length is greater than 1.5.

In embodiments, the first axis of rotation of the first lever is offset from the central portion of the first lever and wherein the first lever connects to the holster body at only two pivots and neither pivot utilizes a separate metal pivot pin.

In embodiments, the thumb receiving button is part of the second lever, and wherein the thumb receiving button is not depressed, the actuation tab of the first lever is spaced therefrom such that the thumb receiving button moves a range of rotary distance when depressed before the thumb receiving button engages with the actuation tab of the second lever.

In embodiments, the first lever further comprises a first rearward pivot portion integrally formed with the elongate central portion and the holster body comprises a second rearward pivot portion integrally formed with one of the holster wall portions, the first rearward pivot portion mating with the second rearward pivot portion and defining a second pivot joint without a separate pin, the first pivot joint and the second pivot joint having a common axis, the common axis extending forwardly and rearwardly with respect to the holster.

In embodiments, the first lever pivotally attaches to the proximal wall portion by way of a pair of C-shaped portions and a pair of cooperating pin portions, each C-shaped portion and each pin portion unitary with one of the holster body and the first lever.

In embodiments, the first lever is seated in a lever receiving region on the proximal wall portion and has two unitary pivot portions that cooperate with two pivot portions unitary with the proximal wall portion, whereby the pivoting connection is made without metal pins.

In embodiments, the first lever is seated in a lever receiving region on the proximal wall portion and wherein the proximal wall portion has three threaded bosses for receiving a holster engagement member dispersed around the lever receiving region, the proximal wall portion further having a plurality of lever region containment wall portions extending from the outer surface of the proximal wall portion and each of the plurality of lever containment wall portions connecting to at least one of the three threaded bosses, the three bosses positioned for receiving a belt engaging member utilizing a plurality of threaded fasteners.

In embodiments, the first lever is seated in a lever receiving region on the proximal wall portion and wherein the proximal wall portion has three threaded bosses for receiving a holster engagement member dispersed around the lever receiving region for receiving a belt engaging member, and wherein when the belt engaging member is attached the first lever is captured within the receiving region, and wherein when the belt engaging member is not attached, the first lever may be removed from an engagement with the proximal wall portion.

In embodiments, the belt engaging member is not attached, the first lever may be removed without tools.

In embodiments, the belt engaging member is not attached, the first lever may be removed by simply prying the first lever outwardly from its seated position.

In embodiments, the belt engaging member is attached, the first lever is captured within a first lever containment region, the thumb button extending out of the containment region.

In embodiments, the proximal wall portion has a thumb button recess edge portion defining has a thumb button recess, the thumb button and the actuation tab of the first lever positioned in the thumb button recess.

In embodiments, the thumb button edge portion defines a closed loop and extends entirely around the thumb button recess.

In embodiments, the thumb button recess extends forwardly from the rearward opening.

In embodiments, the thumb button has an upper margin, a lower margin and a rearward margin, and wherein the thumb button recess edge portion has an upper edge portion that extends along an entire length of the upper margin and has a lower edge portion that extends along the entire length of the lower margin.

In embodiments, the holster is in combination with a belt engaging member, wherein the belt engaging member is attached with a plurality of threaded fasteners extending into the holster body, one of said threaded fasteners positioned above the first lever, one of the plurality of threaded fasteners positioned below the first lever, and one of the plurality of threaded fasteners positioned forward of the first lever, wherein the first lever is captured between the holster body and the belt engaging member.

In embodiments, the holster is in combination with a belt engaging member, wherein the belt engaging member is attached with a plurality of threaded fasteners extending into the holster body, and wherein a column portion of the belt engaging member extends rearwardly, wherein when the handgun is holstered the thumb button is positioned inbetween the handgun body and the belt engaging member, wherein the belt engaging member has a pair of ribs having their elongate dimension extending forwardly and rearwardly and positioned to confront the thumb guides whereby access to the thumb button is restricted on four sides of the thumb button and an access path for the thumb is provided rearwardly of the thumb button.

In embodiments, the belt engaging member is a jacket slot belt loop having a pair of clamping belt loop portions extending from the column portion, each of the clamping belt loop portions adjustable with respect to the column portion by a respective threaded fastener.

In embodiments, the thumb guides each extend laterally outward from an outward surface of the proximal wall portion a distance of at least 0.35 inches.

In embodiments, the thumb guides each extend laterally outward from an outward surface of the proximal wall portion a distance of at least 0.35 inches and the ribs extend outwardly from a surface of the column portion a distance of at least 0.15 inches.

In embodiments, the holster body has an upper wall portion having a pair of inclined wall portions defining a joint, a lower wall portion with a slit extending from a forward opening to proximate a trigger guard receiving portion of the holster body defining a pair of forward clamping wall portions, a threaded fastener extending between the pair of forward clamping portions for adjusting the forward clamping portions about a forward portion of the handgun.

In embodiments, the forward clamping body portions of the holster body are configured to engage the handgun at four corners of the handgun, two upper corners defined by the handgun slide and two lower corners defined by the body.

In embodiments, the holster body comprises an inner layer and an outer layer formed of different polymers with one of the inner layer and outer layer being overmolded onto the other of the inner layer and outer layer, the inner layer formed of a polymer that is softer than the outer layer.

In embodiments, the holster body comprises an inner layer and an outer layer formed of different polymers with one of the inner layer and outer layer being overmolded onto the other of the inner layer and outer layer, the inner layer formed of a polymer that is softer than the outer layer.

In embodiments, the proximal wall portion of the holster body has an actuation tab opening proximate the two actuation tabs whereby there is a gap with no wall portion between the actuation tabs and a handgun holstered in the holster.

In embodiments, a holster for receiving a handgun having a handgun body, a slide, and a trigger guard comprises:

a holster body having a plurality of holster wall portions defining a rearward opening cavity extending along a handgun receiving and withdrawal axis for receiving and holding the handgun, the plurality of holster wall portions comprising a user proximal wall portion and a user distal wall portion;

a first handgun retention mechanism and a second handgun retention mechanism, disposed at the proximal wall portion, each handgun retention mechanism selectively preventing the handgun when in the cavity from being withdrawn from the cavity; the first and second handgun retention mechanisms having a respective first lever having a first axis of rotation and a second lever with an axis of rotation, each lever having a respective actuation tab on one end of the lever where depression of the actuation tab rotates the lever about its respective axis of rotation, one of the two actuation tabs configured as a thumb receiving button with an outer thumb receiving surface, the other of the two actuation tabs positioned behind the thumb receiving button such that depression of the thumb receiving button effects a depression of the other of the two actuation tabs, whereby depression of the thumb receiving button actuates both the first handgun retention mechanism and the second handgun retention mechanism;

wherein the first lever of the first handgun retention mechanism being pivotally supported by the holster body, the first lever comprising an elongate central portion and a blocking portion at an end opposite the respective actuation tab, the blocking portion movable in and out of a handgun blocking position;

the second handgun retention mechanism comprising a U-shaped member that is pivotally supported by the holster body so that the U-shaped member selectively pivots between a handgun retaining position in which the U-shaped member extends across a portion of a rearward opening of the cavity and a release position in which the U-shaped member is displaced from the portion of the rearward opening so that a withdrawal path of the handgun is unobstructed by U-shaped member.

In embodiments, the lever is disposed between the belt engaging member and the holster body.

In embodiments, the lever is captured between the belt engaging member and the holster body.

In embodiments, the lever can be freely separated from the holster body after the belt engaging member is removed from the holster body.

In embodiments, the belt engaging member comprises a first and second belt loop portions defining a first and second passageways, for receiving a belt.

In embodiments, the belt engaging member comprises a second belt loop portion defining a second passageway, second belt loop portion being dimensioned and configured to encircle a belt while the belt is extending through the second passageway.

In embodiments, the U-shaped member is part of a hood assembly, a bracket of the hood assembly includes a lug portion and the thumb receiving tab includes a protrusion portion that engages the lug portion of the hood assembly while the U-shaped member is in the handgun retaining position.

In embodiments, a hood spring biases the U-shaped member to pivot toward the release position.

In embodiments, a hood spring biases the lug portion of the hood assembly against the protrusion portion of the thumb receiving tab while the U-shaped member is in the handgun retaining position.

In embodiments, rotation of the thumb receiving tab through a first range of rotary motion causes the protrusion portion of the thumb receiving tab to disengage the lug portion of the hood assembly.

In embodiments, rotation of the thumb receiving tab through a second range of rotary motion causes the thumb receiving tab to engage the tab receiving portion of the lever causing at least a portion of the trigger guard retaining portion of the lever to be withdrawn from the trigger guard receiving portion of the holster body.

In embodiments, a holster for receiving a handgun having a handgun body, a handgrip, a slide, and a trigger guard comprises:

a holster body having a plurality of unitary holster wall portions defining a handgun receiving cavity, a rearward opening to the cavity and a forward opening to the cavity, the holster body having a handgun receiving and withdrawal axis, the plurality of holster wall portions comprising a user proximal wall portion, a user distal wall portion, a upper wall portion, and a lower wall portion, the upper wall portion having a pair of inclined wall portions extending from a forward margin of the holster body to a rearward margin of the holster body, the inclined wall portions configured as a peak and defining a joint between the proximal wall portion and the distal wall portion, the proximal wall portion having a handgun retention mechanism thereon including a thumb button for releasing a holstered handgun;

the holster body having an inner layer and an outer layer, the layers formed of different polymers with one of the inner layer and outer layer being overmolded onto the other of the inner layer and outer layer, the inner layer formed of a polymer that is softer than the outer layer;

the lower wall portion of the holster body having a rearward slit extending from the forward opening to proximate a trigger guard receiving portion of the holster body defining a pair of split holster forward clamping body portions, one clamping body portion associated with the proximal wall portion and the other clamping body portion associated with the distal wall portion, a threaded fastener extending through the pair of forward clamping body portions whereby rotation of the threaded fastener pulls together or expands the forward clamping body portions about the joint.

In embodiments, the forward clamping body portions of the holster body are configured to engage the handgun at four corners of the handgun, two upper corners defined by the handgun slide and two lower corners defined by the body.

In embodiments, the holster has only a single user actuatable handgun retention mechanism and the actuation tab is configured as a thumb button.

In embodiments, the holster further comprises a pair of thumb guides positioned above and below the thumb button, the thumb guides projecting laterally outward from the holster body proximal wall portion beyond a undepressed position of the thumb button.

In embodiments, the thumb guides each extend laterally outward from an outward surface of the proximal wall portion a distance of at least 0.35 inches. wherein the first lever of the first handgun retention mechanism being pivotally supported by the holster body, the first lever comprising an elongate central portion and a blocking portion at an end opposite the respective actuation tab, the blocking portion movable in and out of a handgun blocking position;

In embodiments, the holster has a second handgun retention mechanism including a pivoting shroud positioned rearwardly of the slide of the handgun holstered in the holster, the second handgun retention mechanism comprising a second lever, the second lever having an actuation tab configured as a thumb button, the actuation tab of the first lever position behind the thumb button whereby depression of the thumb button also depresses the actuation tab of the first lever.

In embodiments, the holster further comprises a pair of thumb guides positioned above and below the thumb button, the thumb guides projecting laterally outward from the holster body proximal wall portion beyond a undepressed position of the thumb button.

In embodiments, the thumb guide positioned above the thumb button comprises a housing for the second handgun retention mechanism.

In embodiments, the holster is in combination with a belt engaging member, wherein the belt engaging member is attached with a plurality of threaded fasteners extending into the holster body, one of said threaded fasteners positioned above the first lever, one of the plurality of threaded fasteners positioned below the first lever, and one of the plurality of threaded fasteners positioned forward of the first lever, wherein the first lever is captured between the holster body and the belt engaging member.

In embodiments, the holster is in combination with a belt engaging member, wherein the belt engaging member is attached with a plurality of threaded fasteners extending into the holster body, and wherein a column portion of the belt engaging member extends rearwardly, wherein when the handgun is holstered the thumb button is positioned inbetween the handgun body and the belt engaging member, wherein the belt engaging member has a pair of ribs having their elongate dimension extending forwardly and rearwardly and positioned to confront the thumb guides whereby access to the thumb button is restricted on four sides of the thumb button and an access path for the thumb is provided rearwardly of the thumb button.

In embodiments, the belt engaging member is a jacket slot belt loop having a pair of clamping belt loop portions extending from the column portion, each of the clamping belt loop portions adjustable with respect to the column portion by a respective threaded fastener.

In embodiments, a holster for receiving a handgun having a handgun body, a handgrip, a slide, and a trigger guard, the holster comprises:

a holster body having a plurality of unitary holster wall portions defining a handgun receiving cavity, a rearward opening to the cavity and a forward opening to the cavity, the holster body having a handgun receiving and withdrawal axis, the proximal wall portion having a handgun retention mechanism thereon including a thumb button for releasing a holstered handgun;

wherein the holster body comprises an inner layer and an outer layer formed of different polymers with one of the inner layer and outer layer being overmolded onto the other of the inner layer and outer layer, the inner layer formed of a polymer that is softer than the outer layer.

In embodiments, the upper wall portion has a pair of inclined wall portions extending from a forward margin of the holster body to a rearward margin of the holster body, the inclined wall portions configured as a peak and defining a joint between the proximal wall portion and the distal wall portion, the proximal wall portion having a handgun retention mechanism thereon including a thumb button for releasing a holstered handgun the lower wall portion of the holster body having a rearward slit extending from the forward opening to proximate a trigger guard receiving portion of the holster body defining a pair of split holster forward clamping body portions, one clamping body portion associated with the proximal wall portion and the other clamping body portion associated with the distal wall portion, a threaded fastener extending through the pair of forward clamping body portions whereby rotation of the threaded fastener pulls together or expands the forward clamping body portions about the joint.

Jacket Slot Belt Loop Embodiments

In embodiments of the jacket slot belt loop, the jacket slot belt loop comprises:

a column portion comprising: a lower plate portion comprising a holster attachment region; a mid level portion; and an upper portion; the upper portion comprising a pair of clamping belt loop portions extending from the upper portion, each of the clamping belt loop portions adjustable with respect to the column portion by a respective threaded fastener, and the mid level portion and the upper portion of the column portion further comprising a recess defined by a lower rib and two side ribs.

In embodiments of the jacket slot belt loop, the recess is configured to accommodate a thumb while drawing a pistol from a holster attached to the holster attachment region.

In embodiments of the jacket slot belt loop, the holster attachment region further comprises apertures for receiving at least one threaded fastener for attachment to a holster body.

In embodiments of the jacket slot belt loop, the recess is configured to cooperate with a holster body to capture components of a retention mechanism of the holster body between the holster body and the recess.

In embodiments of the jacket slot belt loop, the clamping belt loop portions is displaced distally inward of the column and displaced laterally from the column portion.

In embodiments of the jacket slot belt loop, the upper portion further comprises an upper connection portion connecting the clamping belt loop portions to the upper portion; the upper portion, upper connection portion, and clamping belt loop portions being unitary with each other.

In embodiments of the jacket slot belt loop, the clamping belt loop portions further comprises a lower end not unitarily joined to the column, but having a closable space therefrom, the closable space closable by the threaded fastener.

In embodiments of the jacket slot belt loop, the mid level portion further comprises protruding portions configured to cooperate with the lower ends of the clamping belt loop portions.

In embodiments of the jacket slot belt loop, the protruding portions comprises bosses.

In embodiments of the jacket slot belt loop, the clamping belt loop portions further comprises an outside face, the outside face comprising protruding features.

In embodiments of the jacket slot belt loop, the protruding features is selected from a group consisting of ribs and studs.

In embodiments of the jacket slot belt loop, the upper portion comprises a back side, the back side comprising protruding features.

In embodiments of the jacket slot belt loop, the protruding features is selected from a group consisting of ribs and studs.

In embodiments of a holster system for receiving a handgun, the holster system comprises:

a holster comprising: a holster body having a plurality of unitary holster wall portions defining a handgun receiving cavity, the plurality of holster wall portions including a proximal wall portion having a thumb actuator recess; a handgun retention mechanism at the proximal wall portion for selectively preventing the handgun, when in the cavity, from being withdrawn from the cavity; the handgun retention mechanism comprising a thumb actuator disposed within the thumb actuator recess; a jacket slot belt loop comprising: a column portion comprising: a lower plate portion comprising a holster attachment region configured to attach to the holster; a mid level portion; and an upper portion; the upper portion comprising a pair of clamping belt loop portions extending from the upper portion, each of the clamping belt loop portions adjustable with respect to the column portion by a respective threaded fastener, and the mid level portion and the upper portion of the column portion further comprising a recess defined by a lower rib and two side ribs, wherein the recess is disposed opposite the thumb actuator recess and is configured to accommodate a thumb while actuating the thumb actuator and drawing the pistol from the holster.

What is claimed is:

1. A leg strap adapter for attachment to a belt engaging member, comprising:

a leg strap adapter assembly having a central, vertical axis and a horizontal axis;

one or more holes disposed along the central, vertical axis of the leg strap adapter assembly; and two slots disposed along the horizontal axis of the leg strap adapter assembly and configured to receive one of a strap and a belt passing through the two slots, wherein the leg strap adapter assembly is configured to be rotatably coupled to a belt engaging member through the one or more holes disposed along the central, vertical axis of the leg strap adapter assembly, the leg strap adapter assembly not configured to directly mount to a holster.

2. The leg strap adapter of claim 1, further comprising a strap or belt passing through the two slots disposed along the horizontal axis of the leg strap adapter assembly.

3. The leg strap adapter of claim 2, further comprising horizontally extending side ridges on a user proximal side of the leg strap adapter and disposed between each of the two slots and respective sides of the leg strap adapter assembly distal from the vertical axis.

4. The leg strap adapter of claim 3, further comprising a raised portion on a user distal side of the leg strap adapter, wherein the raised portion is disposed between the two slots and extends along a plane parallel to a plane of the leg strap adapter assembly bridging the two slots.

5. The leg strap adapter of claim 4, further comprising horizontally extending ridges on a user proximal face of the raised portion.

6. The leg strap adapter of claim 5, further comprising an offset distance between the plane of the raised portion and the plane of the leg strap adapter assembly bridging the slots.

7. The leg strap adapter of claim 2, further comprising a belt engaging member rotatably connected to the leg strap adapter assembly by a screw or fastener passing through only one of the one or more holes disposed along the central, vertical axis of the leg strap adapter assembly.

8. The leg strap adapter of claim 7, further comprising a holster operatively connected to the belt engaging member.

9. The leg strap adapter of claim 7, wherein the leg strap adapter assembly is substantially planar.

10. The leg strap adapter of claim 7, wherein the belt engaging member is a jacket slot belt loop comprising a pair of clamping belt loop portions extending from a column portion, each of the clamping belt loop portions adjustable with respect to the column portion by a respective threaded fastener.

11. The leg strap adapter of claim 7, wherein the one or more holes disposed along, the central, vertical axis of the leg strap adapter assembly comprises two or more holes.

12. The leg strap adapter of claim 1, further comprising:
the belt engaging member, and
a waist belt received in the belt engaging member.

13. An adapter assembly, comprising:
a leg strap adapter assembly comprising a central, vertical axis and a horizontal axis;
one or more holes disposed along the central, vertical axis of the leg strap adapter assembly; and
a horizontal retention element disposed along the horizontal axis of the leg strap adapter assembly and configured to receive at least one of a strap and a belt,
a belt engaging member;
a waist belt received in the belt engaging member;
wherein the leg strap adapter assembly is configured to be rotatably coupled to the belt engaging member through the one or more holes disposed along the central, vertical axis of the leg strap adapter assembly, the leg strap adapter assembly not configured to directly mount to a holster.

14. An adapter assembly, comprising:
a leg strap adapter assembly comprising:
a central, vertical aXis and a horizontal axis;
one or more holes disposed along the central, vertical aXis of the leg strap adapter assembly; and
a horizontal retention element disposed along the horizontal aXis of the leg strap adapter assembly and configured to receive at least one of a strap and a belt,
at least one of a belt engaging member and a holster;
wherein the leg strap adapter assembly is configured to be rotatably coupled to the at least one of a belt engaging member and a holster through the one or more holes disposed along the central, vertical aXis of the leg strap adapter assembly, the leg strap adapter assembly is configured to attach to a distal end of the at least one of the holster and the belt engaging member.

* * * * *